US011590565B2

(12) United States Patent
Felberbaum et al.

(10) Patent No.: US 11,590,565 B2
(45) Date of Patent: Feb. 28, 2023

(54) METAL CASTING AND ROLLING LINE

(71) Applicant: NOVELIS INC., Atlanta, GA (US)

(72) Inventors: Milan Felberbaum, Lausanne (CH); Sazol Kumar Das, Acworth, GA (US); Aurele Mariaux, Sierre (CH); Duane E. Bendzinski, Woodstock, GA (US); Cyrille Bezencon, Chermignon d'en-Bas (CH); Simon William Barker, Woodstock, GA (US); Corrado Bassi, Salgesch (CH); Rajeev G. Kamat, Marietta, GA (US); Tudor Piroteala, Acworth, GA (US); Rajasekhar Talla, Woodstock, GA (US); Robert Bruce Wagstaff, Greenacres, WA (US)

(73) Assignee: Novelis Inc., Atlanta, GA (US)

( * ) Notice: Subject to any disclaimer, the term of this patent is extended or adjusted under 35 U.S.C. 154(b) by 0 days.

(21) Appl. No.: 17/085,466

(22) Filed: Oct. 30, 2020

(65) Prior Publication Data

US 2021/0046540 A1 Feb. 18, 2021

Related U.S. Application Data

(63) Continuation of application No. 15/717,361, filed on Sep. 27, 2017, now Pat. No. 10,913,107.

(Continued)

(51) Int. Cl.

*B22D 11/00* (2006.01)
*B22D 11/12* (2006.01)

(Continued)

(52) U.S. Cl.

CPC ..... *B22D 11/003* (2013.01); *B21B 1/26* (2013.01); *B21B 1/463* (2013.01); *B21B 13/22* (2013.01);

(Continued)

(58) Field of Classification Search

CPC ..... B22D 11/1206; B22D 11/0654; B22D 11/1246; B22D 11/124; B21B 1/463; B21B 1/26; B21B 1/46

(Continued)

(56) References Cited

U.S. PATENT DOCUMENTS 3,612,151 A 10/1971 Harrington et al.
3,933,193 A 1/1976 Baker et al.

(Continued)

FOREIGN PATENT DOCUMENTS

CA 2900625 8/2014
CN 1207965 A 2/1999

(Continued)

OTHER PUBLICATIONS

Hiroshi, Translation of JPS60152348 (Year: 1985).*

(Continued)

*Primary Examiner* — Adam J Eiseman
*Assistant Examiner* — Bobby Yeonjin Kim
(74) *Attorney, Agent, or Firm* — Kilpatrick Townsend & Stockton LLP

(57) ABSTRACT

A continuous casting and rolling line for casting, rolling, and otherwise preparing metal strip can produce distributable metal strip without requiring cold rolling or the use of a solution heat treatment line. A metal strip can be continuously cast from a continuous casting device and coiled into a metal coil, optionally after being subjected to post-casting quenching. This intermediate coil can be stored until ready for hot rolling. The as-cast metal strip can undergo reheating prior to hot rolling, either during coil storage or immediately prior to hot rolling. The heated metal strip can be cooled to a rolling temperature and hot rolled through one or more roll stands. The rolled metal strip can optionally be reheated and quenched prior to coiling for delivery. This final coiled metal (Continued)

strip can be of the desired gauge and have the desired physical characteristics for distribution to a manufacturing facility.

9 Claims, 68 Drawing Sheets

Related U.S. Application Data

(60) Provisional application No. 62/529,028, filed on Jul. 6, 2017, provisional application No. 62/505,944, filed on May 14, 2017, provisional application No. 62/413,764, filed on Oct. 27, 2016, provisional application No. 62/413,591, filed on Oct. 27, 2016, provisional application No. 62/413,740, filed on Oct. 27, 2016.

(51) Int. Cl.

| | |
|---|---|
| ***C22F 1/04*** | (2006.01) |
| ***B21B 1/26*** | (2006.01) |
| ***B21B 1/46*** | (2006.01) |
| ***B22D 11/06*** | (2006.01) |
| ***B22D 11/126*** | (2006.01) |
| ***B21B 13/22*** | (2006.01) |
| ***B21B 15/00*** | (2006.01) |
| ***C22F 1/00*** | (2006.01) |
| ***C22F 1/047*** | (2006.01) |
| *B21B 1/22* | (2006.01) |
| *B21B 3/00* | (2006.01) |

(52) U.S. Cl.
CPC ..... *B21B 15/00* (2013.01); *B22D 11/0605* (2013.01); *B22D 11/0631* (2013.01); *B22D 11/126* (2013.01); *B22D 11/1206* (2013.01); *C22F 1/002* (2013.01); *C22F 1/04* (2013.01); *C22F 1/047* (2013.01); *B21B 2001/225* (2013.01); *B21B 2003/001* (2013.01); *B21B 2015/0057* (2013.01)

(58) Field of Classification Search
USPC ..... 266/113
See application file for complete search history.

(56) References Cited

U.S. PATENT DOCUMENTS

| | | | | | |
|---|---|---|---|---|---|
| 4,028,141 | A | | 6/1977 | Chia et al. | |
| 4,174,232 | A | | 11/1979 | Lenz et al. | |
| 4,194,553 | A | | 3/1980 | Kimura et al. | |
| 4,238,248 | A | | 12/1980 | Bolliger et al. | |
| 4,614,552 | A | | 9/1986 | Fortin et al. | |
| 4,698,897 | A | * | 10/1987 | Frommann | B21B 1/463 164/476 |
| 4,753,685 | A | | 6/1988 | Usui et al. | |
| 4,808,247 | A | | 2/1989 | Komatsubara et al. | |
| 4,823,860 | A | | 4/1989 | Lauener | |
| 4,869,310 | A | | 9/1989 | Yanagi et al. | |
| 4,976,024 | A | * | 12/1990 | Kimura | B21B 1/466 29/527.6 |
| 5,046,347 | A | | 9/1991 | Crosato et al. | |
| 5,244,516 | A | | 9/1993 | Kawaguchi | |
| 5,461,770 | A | | 10/1995 | Kimura et al. | |
| 5,548,882 | A | * | 8/1996 | Windhaus | C21D 9/68 164/417 |
| 5,560,789 | A | | 10/1996 | Sainfort et al. | |
| 5,720,335 | A | * | 2/1998 | Osada | B22D 11/0697 164/475 |
| 5,779,824 | A | | 7/1998 | Sawada et al. | |
| 6,289,972 | B1 | * | 9/2001 | Benedetti | B21B 1/466 164/476 |
| 6,471,796 | B1 | | 10/2002 | Kagohara et al. | |
| 6,579,387 | B1 | | 6/2003 | Selepack et al. | |
| 6,755,236 | B1 | | 6/2004 | Sivilotti et al. | |
| 6,789,602 | B2 | | 9/2004 | Li et al. | |
| 7,182,825 | B2 | | 2/2007 | Unal et al. | |
| 7,380,583 | B2 | | 6/2008 | Gallerneault et al. | |
| 7,448,432 | B2 | | 11/2008 | Barker et al. | |
| 10,493,508 | B2 | | 12/2019 | Bassi et al. | |
| 10,533,243 | B2 | | 1/2020 | Newman et al. | |
| 10,550,455 | B2 | | 2/2020 | Hosch et al. | |
| 2003/0150587 | A1 | * | 8/2003 | Li | C22F 1/04 164/452 |
| 2003/0173003 | A1 | | 9/2003 | Selepack et al. | |
| 2004/0011438 | A1 | | 1/2004 | Lorentzen et al. | |
| 2004/0089382 | A1 | | 5/2004 | Senkov et al. | |
| 2004/0094245 | A1 | | 5/2004 | Li et al. | |
| 2004/0129353 | A1 | | 7/2004 | Verma et al. | |
| 2005/0028894 | A1 | | 2/2005 | Hoffmann et al. | |
| 2005/0086784 | A1 | | 4/2005 | Li et al. | |
| 2005/0211350 | A1 | | 9/2005 | Unal et al. | |
| 2007/0209739 | A1 | | 9/2007 | Zhao | |
| 2008/0035301 | A1 | * | 2/2008 | Arvedi | B22D 11/124 164/460 |
| 2009/0178778 | A1 | | 7/2009 | Seidel et al. | |
| 2010/0212856 | A1 | * | 8/2010 | Rosenthal | B21B 1/46 164/493 |
| 2011/0111081 | A1 | | 5/2011 | Chen et al. | |
| 2012/0024434 | A1 | * | 2/2012 | Franz | B21B 1/463 148/648 |
| 2013/0334091 | A1 | | 12/2013 | Sawtell et al. | |
| 2014/0250963 | A1 | | 9/2014 | Nelson et al. | |
| 2015/0071816 | A1 | | 3/2015 | Unal et al. | |
| 2015/0218679 | A1 | | 8/2015 | Aruga et al. | |
| 2015/0252461 | A1 | | 9/2015 | Kokubo et al. | |
| 2015/0328670 | A1 | * | 11/2015 | Aiken | B05B 12/122 72/12.2 |
| 2017/0175240 | A1 | | 6/2017 | Wen et al. | |
| 2017/0198376 | A1 | * | 7/2017 | Newman | C22C 21/02 |
| 2018/0087138 | A1 | | 3/2018 | Gaensbauer et al. | |
| 2018/0112296 | A1 | | 4/2018 | Bryant et al. | |
| 2018/0112298 | A1 | | 4/2018 | Weykamp | |
| 2018/0117650 | A1 | | 5/2018 | Felberbaum et al. | |
| 2018/0117669 | A1 | | 5/2018 | Felberbaum et al. | |
| 2018/0119261 | A1 | * | 5/2018 | Das | C22C 21/14 |
| 2018/0119262 | A1 | | 5/2018 | Felberbaum et al. | |
| 2018/0297092 | A1 | * | 10/2018 | Chung | B21B 45/0218 |
| 2019/0022720 | A1 | | 1/2019 | Shafiei et al. | |
| 2019/0022721 | A1 | | 1/2019 | Shafiei et al. | |
| 2019/0022724 | A1 | | 1/2019 | Shafiei et al. | |
| 2019/0054519 | A1 | * | 2/2019 | Barker | B22D 11/0685 |

FOREIGN PATENT DOCUMENTS

| | | | | | |
|---|---|---|---|---|---|
| CN | 1505692 | A | | 6/2004 | |
| CN | 1662670 | A | | 8/2005 | |
| CN | 1942595 | | | 4/2007 | |
| CN | 101896631 | A | | 11/2010 | |
| CN | 102413955 | A | | 4/2012 | |
| CN | 103119185 | | | 5/2013 | |
| CN | 103131904 | A | | 6/2013 | |
| CN | 103510029 | A | | 1/2014 | |
| CN | 103764305 | A | | 4/2014 | |
| CN | 104109784 | A | | 10/2014 | |
| CN | 104284745 | A | | 1/2015 | |
| CN | 104411846 | A | | 3/2015 | |
| CN | 104583433 | A | | 4/2015 | |
| CN | 104762575 | A | | 7/2015 | |
| CN | 105397045 | A | | 3/2016 | |
| CN | 105734369 | A | | 7/2016 | |
| CN | 105814222 | A | | 7/2016 | |
| EP | 2813592 | | | 12/2014 | |
| GB | 1387992 | A | | 3/1975 | |
| GB | 2027743 | | | 2/1980 | |
| JP | S60152348 | | * | 8/1985 | B22D 11/1246 |
| JP | S621839 | A | | 1/1987 | |
| JP | S6283453 | A | | 4/1987 | |
| JP | H06322493 | A | | 11/1994 | |
| JP | H0790459 | A | | 4/1995 | |

(56) References Cited

FOREIGN PATENT DOCUMENTS

| | | | | |
|---|---|---|---|---|
| JP | H07252573 | | 10/1995 | |
| JP | H10502973 | | 3/1998 | |
| JP | 10130768 | | 5/1998 | |
| JP | 2000017412 | | 1/2000 | |
| JP | 2000210760 | A | 8/2000 | |
| JP | 2000212673 | | 8/2000 | |
| JP | 2001518140 | A | 10/2001 | |
| JP | 2006299420 | A | 11/2006 | |
| JP | 2007031819 | | 2/2007 | |
| JP | 2007262484 | A | 10/2007 | |
| JP | 2008076297 | A | 4/2008 | |
| JP | 2008190022 | | 8/2008 | |
| JP | 2014047384 | A | 3/2014 | |
| JP | 2014219222 | A | 11/2014 | |
| JP | 2016160515 | A | 9/2016 | |
| JP | 2016160516 | A | 9/2016 | |
| KR | 940010443 | | 5/1994 | |
| KR | 940010443 | B1 | 10/1994 | |
| KR | 20080014744 | A | 2/2008 | |
| KR | 20150023006 | A | 3/2015 | |
| RU | 2292967 | C2 | 2/2007 | |
| RU | 2299256 | C1 | 5/2007 | |
| RU | 2305022 | C1 | 8/2007 | |
| RU | 2313594 | C1 | 12/2007 | |
| RU | 2008139893 | A | 4/2010 | |
| RU | 102550 | U1 | 3/2011 | |
| RU | 2415193 | | 3/2011 | |
| SU | 1306484 | A3 | 4/1987 | |
| WO | 9711205 | | 3/1997 | |
| WO | 9811205 | | 3/1998 | |
| WO | WO-0037190 | A1 * | 6/2000 | ..... B21B 1/28 |
| WO | 0144532 | | 6/2001 | |
| WO | 2008003504 | A2 | 1/2008 | |
| WO | 2008016169 | | 2/2008 | |
| WO | 2009130175 | A1 | 10/2009 | |
| WO | 2013133960 | | 9/2013 | |
| WO | 2016090026 | | 6/2016 | |

OTHER PUBLICATIONS

International Patent Application No. PCT/US2017/053723, Invitation to Pay Additional Fees and Partial Search Report dated Dec. 6, 2017, 15 pages.

International Patent Application No. PCT/US2017/053723, International Search Report and Written Opinion dated Feb. 7, 2018, 22 pages.

Lohne et al., "Quench sensitivity in AlMgSi alloys containing manganese or chromium", Scandinavian Journal of Metallurgy, 1983, pp. 34-36, vol. 12, The Jernkontoret Corporate Nordic Research Organisation.

Prince, "The effects of dispersoids upon the micromechanisms of crack propagation in Al Mg Si alloys", Acta Mett., 1979, pp. 1401-1408, vol. 27, Pergamon Press Ltd., Great Britain.

Song et al, "The role of tin in the hot-ductility deterioration of a low-carbon steel," Metallurgical and Materials Transactions A, 2003, pp. 1611-1616, vol. 34.8, Springer.

Zhao et al., "Effect of Mn contents on the bake hardenability and bendability of Al-0.6mass%Mg-0.8mass%Si alloy sheets", Journal of Japan Institute of Light Metals, 2005, pp. 227-232, vol. 55, No. 5, Japan Institute of Light Metals.

Australian Patent Application No. 2017350512, Examination Report No. 1 dated Aug. 30, 2019, 3 pages.

Russian Patent Application No. 2019115595, Office Action dated Jan. 21, 2020, 13 pages.

European Patent Application No. 17781312.8, Office Action dated Mar. 12, 2020, 7 pages.

European Patent Application No. 17781312.8, Office Action dated Jul. 27, 2020, 6 pages.

Japanese Patent Application No. 2019-522748, Office Action dated Mar. 31, 2020, 11 pages.

Canadian Patent Application No. 3,041,998, Office Action dated May 22, 2020, 5 pages.

Chinese Patent Application No. 201780066754.9, Office Action dated Aug. 18, 2020, 18 pages.

Korean Patent Application No. 10-2019-7015112, Office Action dated Aug. 12, 2020, 22 pages.

U.S. Appl. No. 15/717,361, Restriction Requirement dated Jan. 13, 2020, 5 pages.

U.S. Appl. No. 15/717,361, Non-Final Office Action dated Mar. 19, 2020, 10 pages.

U.S. Appl. No. 15/717,361, Non-Final Office Action dated Jun. 18, 2020, 10 pages.

U.S. Appl. No. 15/717,361, Non-Final Office Action dated Aug. 20, 2020, 6 pages.

U.S. Appl. No. 15/717,361, Notice of Allowance dated Oct. 7, 2020, 5 pages.

Canadian Application No. 3,041,998 , Office Action, dated Nov. 15, 2021, 3 pages.

Japanese Application No. 2020-136203 , Office Action, dated Oct. 5, 2021, 16 pages.

Korean Application No. 10-2021-7005513 , Office Action, dated Oct. 21, 2021, 14 pages.

Li et al., "Aluminum Alloy Material and Heat Treatment Process", Metallurgical Industry Press, Apr. 30, 2012, pp. 349-353.

Wang et al., "Introduction to Constructive Material Science", Shanghai Science and Technology Press, Feb. 28, 1987, p. 97.

Japanese Patent Application No. 2020-136203 , Office Action dated May 25, 2021, 19 pages.

Brazilian Application No. 112019008427-4 , Office Action, dated Jul. 27, 2021, 5 pages.

European Application No. 21170636.1 , Extended European Search Report, dated Jul. 7, 2021, 8 pages.

Indonesian Application No. PID201904259 , Notice of Decision to Grant, dated May 19, 2021, 4 pages.

Chinese Application No. 201780066754.9, Office Action, dated Jul. 15, 2021, 16 pages.

Indian Application No. 201917016630 , "First Examination Report", dated Jul. 20, 2021, 7 pages.

Tong et al., "5000 Questions on New Technology of Energy Saving and Emission Reduction in Steelworks", China Science and Technology Press, Jul. 31, 2009, pp. 1-4.

Canadian Patent Application No. 3,041,998 , Office Action dated Jan. 7, 2021, 3 pages.

Chinese Patent Application No. 201780066754.9 , Office Action dated Apr. 12, 2021, 16 pages.

Korean Patent Application No. 10-2019-7015112 , Office Action dated Feb. 2, 2021, 7 pages.

Korean Patent Application No. 10-2021-7005513 , Office Action dated Apr. 15, 2021, 13 pages.

Indonesian Patent Application No. PID201904259 , Substantive Examination Report dated Nov. 26, 2020, 4 pages.

Russian Patent Application No. 2019115595 , Office Action dated May 12, 2020, 8 pages.

Application No. CA3,041,474 , Office Action, dated Jan. 17, 2022, 4 pages.

Application No. CN201780066634.9 , Office Action, dated Dec. 27, 2021, 7 pages.

Application No. CN201780066754.9 , Office Action, dated Nov. 3, 2021, 9 pages.

Application No. EP17790884.5 , Notice of Decision to Grant, dated Nov. 25, 2021, 2 pages.

Application No. EP17790885.2 , Office Action, dated Dec. 7, 2021, 4 pages.

Application No. JP2019-520573 , Office Action, dated Dec. 14, 2021, 15 pages.

Application No. KR10-2021-7005513 , Office Action, dated Jan. 20, 2022, 6 pages.

U.S. Appl. No. 15/716,654 , Non-Final Office Action, dated Mar. 30, 2022, 8 pages.

U.S. Appl. No. 15/716,657 , Non-Final Office Action, dated Mar. 31, 2022, 9 pages.

Application No. BR112019007283-7 , Notice of Allowance, dated May 3, 2022.

(56) References Cited

OTHER PUBLICATIONS

Application No. BR112019007379-5 , Office Action, dated May 3, 2022, 4 pages.
Application No. BR112019007596-8 , Office Action, dated Jan. 25, 2022, 4 pages.
Application No. BR112019008427-4 , Office Action, dated May 3, 2022, 4 pages.
Application No. CA3,041,562 , Notice of Allowance, dated Feb. 14, 2022, 1 page.
Application No. CA3,041,580 , Office Action, dated Mar. 9, 2022, 4 pages.
Application No. CN201780066612.2 , Notice of Decision to Grant, dated May 6, 2022, 6 pages.
Application No. CN201780066634.9 , Office Action, dated May 30, 2022, 8 pages.
IN202118047657 , "First Examination Report", dated Mar. 22, 2022, 5 pages.
Application No. JP2019-520567 , Notice of Decision to Grant, dated Apr. 26, 2022, 2 pages.
Application No. JP2019-520573 , Notice of Decision to Grant, dated May 17, 2022, 2 pages.
Application No. JP2021-134099 , Office Action, dated Jun. 14, 2022, 8 pages.
Application No. MX/A/2019/004835 , Office Action, dated Apr. 19, 2022, 4 pages.
U.S. Appl. No. 15/716,581 , "Non-Final Office Action", dated Jul. 27, 2022, 13 pages.
U.S. Appl. No. 15/716,654 , "Final Office Action", dated Aug. 17, 2022, 9 pages.
U.S. Appl. No. 15/716,657 , "Final Office Action", dated Aug. 18, 2022, 9 pages.
BR112019007379-5 , "Notice of Allowance", dated Sep. 6, 2022.
BR112019008427-4 , "Notice of Allowance", dated Oct. 4, 2022.
CA3,041,474 , "Notice of Allowance", dated Sep. 28, 2022, 1 page.
CA3.041,580 , "Office Action", dated Oct. 21, 2022, 4 pages.
CN201780066634.9 , "Notice of Decision to Grant", dated Aug. 24, 2022, 5 pages.
Davis , "Aluminum and Aluminum Alloys", ASM International, 1993, pp. 300-303.
EP17790885.2 , "Office Action", dated Jun. 15, 2022, 5 pages.
EP21170636.1 , "Office Action", dated Jul. 18, 2022, 5 pages.
KR10-2021-7023150 , "Office Action", dated Aug. 30, 2022, 8 pages.
KR10-2022-7013242 , "Office Action", dated Jun. 29, 2022, 14 pages.
MX/A/2019/004835 , "Notice of Allowance", dated Sep. 2, 2022, 2 pages.

* cited by examiner

1501

DECOUPLED CONTINUOUS CASTING
6014(T4)

1500

DC 6014(T4)

6XXX SERIES WITHOUT POST-CAST QUENCH
AND WITH 1 HOUR REHEAT AT 550° C

6XXX SERIES WITH POST-CAST QUENCH TO 100° C
IN <10 SECONDS AND 1 HOUR REHEAT AT 550° C.

6XXX SERIES WITHOUT POST-CAST QUENCH
AND WITH 8 HOUR REHEAT AT 550° C

6XXX SERIES WITH POST-CAST QUENCH TO 100° C
IN <10 SECONDS AND 8 HOUR REHEAT AT 550° C.

METAL CASTING AND ROLLING LINE

CROSS REFERENCE TO RELATED APPLICATIONS

This application is a continuation of U.S. patent application Ser. No. 15/717,361 entitled "METAL CASTING AND ROLLING LINE" and filed on Sep. 27, 2017, which claims the benefit of U.S. Provisional Patent Application No. 62/413,591 entitled "DECOUPLED CONTINUOUS CASTING AND ROLLING LINE" and filed on Oct. 27, 2016; U.S. Provisional Patent Application No. 62/505,944 entitled "DECOUPLED CONTINUOUS CASTING AND ROLLING LINE" and filed on May 14, 2017; U.S. Provisional Patent Application No. 62/413,764 entitled "HIGH STRENGTH 7XXX (SERIES ALUMINUM ALLOY AND METHODS OF MAKING THE SAME" and filed on Oct. 27, 2016; U.S. Provisional Patent Application No. 62/413,740 entitled "HIGH STRENGTH 6XXX (SERIES ALUMINUM ALLOY AND METHODS OF MAKING THE SAME" and filed on Oct. 27, 2016; and U.S. Provisional Patent Application No. 62/529,028 entitled "SYSTEMS AND METHODS FOR MAKING ALUMINUM ALLOY PLATES" and filed on Jul. 6, 2017, the disclosures of each of which are hereby incorporated by reference in their entireties.

TECHNICAL FIELD

The present disclosure relates to producing metal stock, such as coils of metal strip, and more specifically to the continuous casting and rolling of metals such as aluminum.

BACKGROUND

Direct chill (DC) and continuous casting are two methods of casting solid metal from liquid metal. In DC casting, liquid metal is poured into a mold having a retractable false bottom capable of withdrawing at the rate of solidification of the liquid metal in the mold, often resulting in a large and relatively thick ingot (e.g., 1500 mm×500 mm×5 m). The ingot can be processed, homogenized, hot rolled, cold rolled, annealed and/or heat treated, and otherwise finished before being coiled into a metal strip product distributable to a consumer of the metal strip product (e.g., an automotive manufacturing facility).

Continuous casting involves continuously injecting molten metal into a casting cavity defined between a pair of moving opposed casting surfaces and withdrawing a cast metal form (e.g., a metal strip) from the exit of the casting cavity. Continuous casting has been desirable in instances where the entire product can be prepared in a single, fully-coupled processing line. Such a fully-coupled processing line involves matching, or "coupling," the speed of the continuous casting equipment to the speed of the downstream processing equipment.

BRIEF DESCRIPTION OF THE DRAWINGS

The specification makes reference to the following appended figures, in which use of like reference numerals in different figures is intended to illustrate like or analogous components.

DETAILED DESCRIPTION

Figure 1:
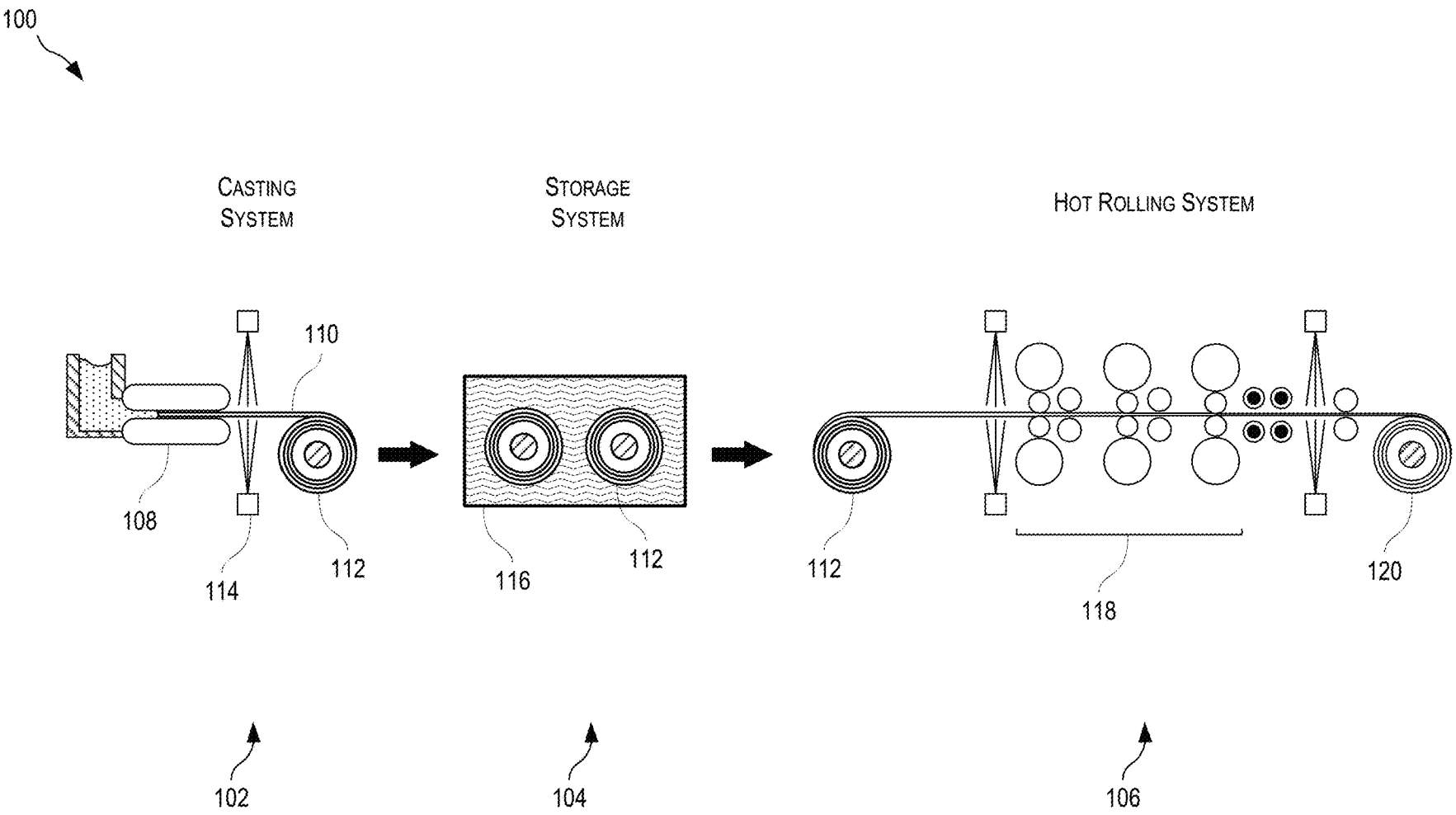
FIG. 1 is a schematic diagram depicting a decoupled metal casting and rolling system according to certain aspects of the present disclosure.

Certain aspects and features of the present disclosure relate to decoupled and partially-decoupled continuous casting and rolling lines for casting, rolling, and otherwise preparing metal articles (e.g., metal strip) suitable for providing a distributable coil of metal strip. In some examples, the metal articles are prepared without requiring cold rolling or the use of a continuous annealing solution heat treatment (CASH) line. A metal strip can be continuously cast from a continuous casting device, such as a belt caster, and then coiled into a metal coil, optionally after being subjected to post-casting quenching. This coiled, as-cast metal strip can be stored until ready for hot rolling. The as-cast metal strip can undergo reheating prior to hot rolling, either during coil storage or immediately prior to hot rolling. The heated metal strip can be cooled to a rolling temperature and hot rolled through one or more roll stands. The rolled metal strip can optionally be reheated and quenched prior to coiling for delivery. This final coiled metal strip can be of the desired gauge and have the desired physical characteristics for distribution to a manufacturing facility.

Certain aspects and features of the present disclosure relate to casting an aluminum alloy with a high solidification rate and thereafter subjecting the cast metal article to hot or warm rolling to reduce the thickness of the metal article by at least approximately 30% or at or approximately 30%-80%, 40%-70%, 50%-70%, or 60% to produce a hot band. In some cases, the metal article can be passed through an inline furnace before being hot or warm rolled, which furnace can keep the metal article at a peak metal temperature of approximately 400° C.-580° C. for approximately 10-300 seconds, 60-180 seconds, or 120 seconds. The hot band product can be at final gauge, at final gauge and temper, or can be ready for further processing, such as cold rolling and solution heat treatment. In some cases, an inline furnace can be especially helpful in 5xxx series alloys to facilitate taking a higher reduction of thickness during the hot or warm rolling. As used herein, the term reduction of thickness can be a form of reduction of section that is performed using rolling. Other types of reduction of section can include reduction of diameter for extruded metal articles. Hot or warm rolling can be a type of hot or warm working, respectively. Other types of hot or warm working can include hot or warm extruding, respectively.

In some cases, desirable shapes and sizes of intermetallic particles can be achieved through continuous casting (e.g., with a high solidification rate), optional heating in an inline furnace, and inline hot or warm rolling at reductions in thickness of at or approximately 50%-70%. These desirable shapes and sizes of intermetallic particles can promote further processing, such as cold rolling, as well as customer use, such as bending and forming.

As used herein, temperatures can refer to peak metal temperatures, as appropriate. As well, references to durations at particular temperatures can refer to a duration of time starting from when the metal article has reached the desired peak metal temperature (e.g., excluding ramp-up times), although that need not always be the case.

Aspects and features of the present disclosure can be used with any suitable metal, however may be especially useful when casting and rolling aluminum alloys. Specifically, desirable results can be achieved when casting alloys such as 2xxx series, 3xxx series, 4xxx series, 5xxx series, 6xxx series, 7xxx series, or 8xxx series aluminum alloys. For example, certain aspects and features of the present disclosure allow for 5xxx and 6xxx series alloys to be cast without the need for continuous annealing solution heat treatment. In another example, certain aspects and features of the present disclosure allow for more efficient and more reliable casting of 7xxx series alloys as compared to current casting methodologies. In this description, reference is made to alloys identified by aluminum industry designations, such as "series" or "AA6xxx" or "6xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

In some cases, certain aspects and features of the present disclosure may be suitable for use with aluminum, aluminum alloys, titanium, titanium-based materials, steel, steel-based materials, magnesium, magnesium-based materials, copper, copper-based materials, composites, sheets used in composite, or any other suitable metal, non-metal, or combination of materials. In certain examples where the material being cast includes metal, the metal may be ferrous metal or non-ferrous metal.

Traditionally, the metal strip created by a continuous casting device is fed directly into a hot rolling mill to be reduced to a desired thickness. The apparent benefit of continuous casting traditionally relies on being able to feed the as-cast metal strip directly into a process line, unlike DC casting. Because the continuously cast product is fed directly into the rolling mill, the casting speed and the rolling speed must be carefully matched to avoid inducing undesirable tensions in the metal strip that could lead to unusable product, damage to equipment, or dangerous conditions.

Surprisingly, beneficial results can be achieved by intentionally decoupling the casting process from the hot rolling process in a continuous casting and rolling system. By decoupling the continuous casting process from the hot rolling process, the casting speed and the rolling speed no longer need to be closely matched. Rather, the casting speed can be selected to produce desired characteristics in the metal strip, and the rolling speed can be selected based on the requirements and limitations of the rolling equipment. In a decoupled continuous casting and rolling system, the continuous casting device can cast a metal strip that is immediately or shortly thereafter coiled into an intermediate, or transfer, coil. The intermediate coil can be stored or immediately brought to the rolling equipment. At the rolling equipment, the intermediate coil can be uncoiled, allowing the metal strip to pass through the rolling equipment to be hot rolled and otherwise processed. The end result of the hot rolling process is a metal strip that can have the characteristics desired for a particular customer. The metal strip can be coiled and distributed, such as to an automotive plant capable of forming automotive parts from the metal strip. In some cases, the metal strip can be heated at various points after being initially cast in the continuous casting process (e.g., by the continuous caster), however the metal strip will remain below a solidus temperature of the metal strip.

As used herein, the term decoupled refers to removing the speed link between the casting device and the rolling stand (s). As described above, a coupled system (sometimes referred to herein as an in-line system) would include a continuous casting device feeding directly into rolling stands such that the output speed of the casting device must be matched to the input speed of the rolling stands. In an uncoupled system, the casting speed can be set irrespective of the input speed of the rolling stands and the speed of the rolling stands can be set irrespective of the output speed of the casting device. Various examples described herein decouple the casting device from the rolling stand(s) by having the casting device output a metal coil at a first speed, then having that coil be later fed into the rolling stand(s) for rolling at a second speed. In some cases where the casting speed is desired to be faster than a desired rolling speed can accommodate, it may be possible to provide limited decoupling of the output speed of a casting device and the input speed of the rolling stand(s), even when the casting device feeds cast metal strip directly to the rolling stand(s), through the use of an accumulator positioned between the casting device and the rolling stand(s).

The casting device can be any suitable continuous casting device. However, surprisingly desirable results have been achieved using a belt casting device, such as the belt casting device described in U.S. Pat. No. 6,755,236 entitled "BELT-COOLING AND GUIDING MEANS FOR CONTINUOUS BELT CASTING OF METAL STRIP," the disclosure of which is hereby incorporated by reference in its entirety. In some cases, especially desirable results can be achieved by using a belt casting device having belts made from a metal having a high thermal conductivity, such as copper. The belt casting device can include belts made from a metal having a thermal conductivity of at least 250, 300, 325, 350, 375, or 400 watts per meter per Kelvin at casting temperatures, although metals having other values of thermal conductivity may be used. The casting device can cast a metal strip at any suitable thickness, however desirable results have been achieved at thicknesses of approximately 7 mm to 50 mm.

Certain aspects of the present disclosure can improve the formation and distribution of dispersoids within the aluminum matrix. Dispersoids are collections of other solid phases that are located within the primary phase of a solidified aluminum alloy. Various factors during casting, handling, heating, and rolling can significantly affect the dispersoid size and distribution in a metal strip. Dispersoids are known to help bending performance and other characteristics of aluminum alloys, and are often desirable in sizes between about 10 nm to about 500 nm and in a relatively even distribution throughout the metal strip. In some cases, desired dispersoids can be in sizes of about 10 nm to 100 nm or 10 nm to 500 nm. In DC casting, long homogenization cycles (e.g., 15 hours or more) are required to produce a desirable distribution of dispersoids. In standard continuous casting, dispersoids are often not present at all or present in small quantities which are unable to provide any beneficial effect.

Certain aspects of the present disclosure relate to a metal strip and systems and methods for forming a metal strip having desirable dispersoids (e.g., a desirable distribution of dispersoids of a desirable size). In some cases, the casting device can be configured to provide fast solidification (e.g., quickly solidifying at rates of at or more than about 10 times faster than standard DC casting solidification, such as at least at or about 1° C./s, at least at or about 10° C./s, or at least at or about 100° C./s) and fast cooling (e.g., quickly cooling at rates of at least at or about 1° C./s, at least at or about 10° C./s, or at least at or about 100° C./s) of the metal strip, which can facilitate improved microstructure in the final metal strip. In some cases, the solidification rate can be at or above 100 times the solidification rate of traditional DC casting. Fast solidification can result in a unique microstructure, including a unique distribution of dispersoid-forming elements very evenly distributed throughout the solidified aluminum matrix. Fast cooling this metal strip, such as immediately quenching the metal strip as it exits the casting device, or shortly thereafter, can facilitate locking the dispersoid-forming elements in solid solution. The resultant metal strip can be then supersaturated with dispersoid-forming elements. The supersaturated metal strip can then be coiled into an intermediate coil for further processing in the decoupled casting and rolling system. In some cases, the desired dispersoid-forming elements include Manganese, Chromium, Vanadium, and/or Zirconium. This metal strip that is supersaturated with dispersoid-forming elements can, when reheated, very quickly induce the precipitation of evenly distributed and desirably-sized dispersoids.

In some cases, fast solidification and fast cooling can be performed singularly by a casting device. The casting device can be of sufficient length and have sufficient heat removal characteristics to produce a metal strip supersaturated in dispersoid-forming elements. In some cases, the casting device can be of sufficient length and have sufficient heat removal characteristics to reduce the temperature of the cast metal strip to at or below 250° C., 240° C., 230° C., 220° C., 210° C., or 200° C., although other values may be used. Generally, such a casting device would have to either occupy significant space or operate at slow casting speeds. In some cases, where a smaller and faster casting device is desired, the metal strip can be quenched immediately after exiting the casting device or soon thereafter. One or more nozzles can be positioned downstream of the casting device to reduce the temperature of the metal strip to at or below 250° C., 240° C., 230° C., 220° C., 210° C., 200° C., 175° C., 150° C., 125° C., or 100° C., although other values may be used. The quench can occur sufficiently fast or quickly to lock the dispersoid-forming elements in a supersaturated metal strip.

Traditionally, fast solidification and fast cooling have been avoided because the resulting metal strip has undesirable characteristics. However, it has been surprisingly discovered that a metal strip supersaturated in dispersoid-forming elements can be an efficient precursor for a metal strip having desired dispersoid arrangements. The unique, dispersoid-forming-element-supersaturated metal strip can be reheated, such as during storage or immediately before hot rolling, to convert the supersaturated matrix of dispersoid-forming elements into a strip containing dispersoids of a desired distribution (e.g., evenly distributed) and of desired sizes (e.g., between approximately 10 nm and approximately 500 nm or between approximately 10 nm and approximately 100 nm). Because the metal strip is supersaturated in dispersoids-forming elements, the driving force for precipitation of desirably-sized dispersoids is higher than for a non-supersaturated matrix. In other words, certain fast solidification and/or cooling aspects as disclosed herein can be used to prepare or prime a metal strip, which metal strip can later be briefly reheated to bring out the desired dispersoid arrangement. For example, it has been found that certain aspects of the present disclosure are able to produce metal strips supersaturated in dispersoid-forming elements capable of being reheated to precipitate desirably-sized dispersoids at reheating times that are 10-100 times shorter than existing technology (e.g., DC casting). Further, the speed at which this reheating can take place enables reheating to be performed in a hot rolling line, such as at the beginning of the hot rolling line. However, in some cases, one or more coils of metal strips supersaturated in dispersoid-forming elements can be reheated prior to being uncoiled on a hot rolling line. Because desirably-sized dispersoids can be elicited much more quickly, significant time and energy can be saved in producing desirable metal strips. Further, improved dispersoid distribution can enable desirable performance to be achieved with the use of lower amounts of alloying elements. In other words, certain aspects and features of the present disclosure enable alloying elements to be leveraged more efficiently than traditional DC or continuous casting.

Further, manipulation of one or more of the solidification rate, cooling (e.g., quenching) rate, and reheating time can be used to specifically tailor dispersoid size and distribution on demand. A controller can be coupled to systems to control solidification rate, cooling rate, and reheating time. When a metal strip is desired to have a certain characteristic attributable to a particular dispersoid arrangement (e.g., size and/or distribution), the controller can manipulate the various rates/times to produce the desired metal strip. In this fashion, metal strips with desired dispersoid arrangements can be created on demand. Because control of dispersoid arrangements can provide for more or less efficiency in how alloying elements are leveraged, on demand control of dispersoid arrangements can enable a controller to compensate for deviations in alloying elements of a particular mixture of liquid metal. For example, when producing deliverable metal strips having certain desired characteristics, a controller may compensate for slight deviations in the concentrations of alloying elements between casts by adjusting the solidification rate, cooling rate, and/or reheating time of the system to produce dispersoid arrangements that provide for more or less efficient usage of the alloying elements (e.g., more efficient usage may be desirable when a negative deviation of alloying elements is determined). Such compensation can be performed automatically or can be automatically recommended to a user.

Intermediate coils can be stored prior to being hot rolled, thus allowing a casting device to output at a speed faster than the hot rolling stand(s) can accommodate, with excess metal strip being coiled and stored until the hot rolling stand(s) are available. When stored, the intermediate coils can optionally be reheated. For example, with various types of aluminum alloys, intermediate strips can be reheated to a temperature at or around 500° C. or higher, or at or around 530° C. and higher. The reheating temperature will remain below the solidus temperature for the metal strip.

In some cases, intermediate coils are maintained at a temperature approximately at or above 100° C., at or above 200° C., at or above 300° C., or at or above 400° C., or at or above 500° C., although other values may be used. In some cases, intermediate coils can be stored in a fashion that minimizes uneven radial forces, which may hinder uncoiling during a hot rolling process. In some cases, intermediate coils can be stored vertically, with the lateral axis of the coil extending in a vertical direction. In some cases, intermediate coils can be stored horizontally, with the lateral axis of the coil extending in a horizontal direction. In some cases, intermediate coils can be suspended from a central spindle, thus minimizing the amount of weight compressing the loops of the coil against one another, specifically the portion of the coil located below the spindle. In some cases, the intermediate coils can be periodically or continuously rotated about a horizontal axis (e.g., the lateral axis of the coil when stored horizontally).

During a hot rolling process, an intermediate coil can be uncoiled, optionally surface treated, optionally reheated, rolled to a desired thickness, optionally reheated post-rolling and quenched, and coiled for distribution. The hot rolling process can include one or more hot rolling stands, each including work rolls for applying force to reduce the thickness of the metal strip. In some cases, the total amount of reduction of thickness during hot rolling can be at or less than approximately 70%, 65%, 60%, 55%, 50%, 45%, 40%, 35%, 30%, 25%, 20% or 15%, although other values may be used. The hot rolling can be performed at a relatively high speed, such as an entry speed (e.g., speed of the metal strip as it enters the first hot roll stand) of around 50 to around 60 meters per minute (m/min), although other entry speeds can be used. The exit speed (e.g., speed of the metal strip as it exits the last hot roll stand) can be much faster due to the percentage of reduction of thickness imparted by the hot roll stand(s), such as around 300 to around 800 m/min, although other exits speeds may occur. For desirable results, hot rolling can be performed at a hot rolling temperature. The hot rolling temperature can be at or around 350° C., such as between 340° C. and 360° C., 330° C. and 370° C., 330° C. and 380° C., 300° C. and 400° C., or 250° C. to 400° C., although other ranges may be used. In some cases, the desired hot rolling temperature for a metal strip can be its alloy recrystallization temperature. In some cases, the temperature of the metal strip can move from a starting hot rolling temperature (e.g., the temperature of the metal strip as it enters the first hot rolling stand), optionally through one or more interstrand hot rolling temperatures (e.g., the temperature(s) of the metal strip between any two adjacent hot rolling stands), to an exiting hot rolling temperature (e.g., the temperature of the metal strip as it exits the last hot rolling stand). Any of these temperatures can be in the ranges described above for a hot rolling temperature, although other ranges may be used. The starting hot rolling temperature, optional interstand temperature(s), and the exiting hot rolling temperature can be approximately the same (e.g., see FIG. 7) or can be different (e.g., see FIG. 8).

In some cases, the metal strip can enter the hot rolling process at a high temperature or can be reheated, as disclosed above, shortly after being uncoiled into the hot rolling system. The temperature of the metal strip at this point can be in excess of 500° C., 510° C., 520° C., or 530° C., yet below melting, although other ranges can be used. Prior to entering the hot rolling stand(s), the metal strip can be cooled to the hot rolling temperature described above. After passing through the hot rolling stands, the metal strip can be optionally heated to a post-rolling temperature. For heat-treatable alloys, such as 6xxx series and 7xxx series aluminum alloys, the post-rolling temperature can be at or around a solutionizing temperature, whereas for non-heat treatable alloys, such as 5xxx series aluminum alloys, the post-rolling temperature can be a recrystallizing temperature. In some cases, such as for non-heat treatable alloys, the post-rolling heating may not be used, especially if the metal strip exits the hot rolling process at a temperature at or above the recrystallizing temperature (e.g., at or above around 350° C.). For heat-treatable alloys, the post-rolling temperature or solutionizing temperature can differ depending on the alloy, but may be at or above approximately 450° C., 460° C., 470° C., 480° C., 490° C., 500° C., 510° C., 520° C., and 530° C. In some cases, a solutionizing temperature can be at or approximately 20° C.-40° C., or more preferably 30° C., below a solidus temperature of the alloy in question. Immediately after reheating the metal strip to the post-rolling temperature, or shortly thereafter, the metal strip can be quenched. The metal strip can be quenched down to a coiling temperature, which can be at or below 150° C., 140° C., 130° C., 120° C., 110° C., or 100° C., although other values may be used. The metal strip may then be coiled for delivery. At this point, the coiled metal strip may have the desired physical characteristics for distribution, such as a desired gauge and a desired temper.

After hot rolling and quenching, the metal strip can have a desired gauge and temper, such as a T4 temper. Reference is made in this application to alloy temper or condition. For an understanding of the alloy temper descriptions most commonly used, see "American National Standards (ANSI) H35 on Alloy and Temper Designation Systems." An F condition or temper refers to an aluminum alloy as fabricated. An O condition or temper refers to an aluminum alloy after annealing. A W condition or temper refers to an aluminum alloy after solution heat treatment, although it may be an unstable temper at ambient temperatures. A T condition or temper refers to an aluminum alloy after certain heat treatment that produces a stable temper. A T3 condition or temper refers to an aluminum alloy after solution heat treatment (i.e., solutionizing), cold working and natural aging. A T4 condition or temper refers to an aluminum alloy after solution heat treatment (i.e., solutionization) followed by natural aging. A T6 condition or temper refers to an aluminum alloy after solution heat treatment followed by artificial aging. A T8 condition or temper refers to an aluminum alloy after cold working, followed by solution heat treatment, followed by artificial aging.

In some cases, a metal strip (e.g., an aluminum metal strip) can undergo dynamic recrystallization during hot rolling by starting hot rolling at a high temperature (e.g., a hot rolling entry temperature that is above a recrystallization temperature, such as at or above approximately 550° C.) and allowing the metal strip to cool during the hot rolling process to a hot rolling exit temperature. In some cases, dynamic recrystallization during hot or warm rolling can occur by applying sufficient force to induce sufficient strain on the metal article during rolling at a particular temperature to recrystallize the metal article.

Dynamic recrystallization can enable the metal strip to be quenched immediately after hot rolling, without needing to reheat the metal strip (e.g., to above a recrystallization temperature) to achieve recrystallization. Additionally, by rapidly quenching immediately after hot rolling, undesirable precipitates can be avoided. At certain temperatures, precipitates, such as $Mg_2Si$ phase, can begin forming over time. A zone of high precipitation can be defined based on temperature and time spent at that temperature, in which precipitates are expected to form quickly such as from 1% to 90% completion of precipitation. Therefore, to minimize precipitate formation, it can be desirable to minimize the time spent in that zone of high precipitation. Through dynamic recrystallization followed by rapid quenching, the amount of time a metal strip spends at a temperature within the zone of high precipitation can be minimized. In some cases, desirable metallurgical properties can be achieved by hot rolling and quenching a metal strip, wherein the metal strip monotonically decreases in temperature from just before entering the first hot rolling stand to just after exiting the quenching zone (e.g., monotonically decreasing in temperature throughout the hot rolling and quenching processes).

In some cases, a metal strip can enter hot rolling after little or no initial quenching. The metal strip can be allowed to drop in temperature during hot rolling from a hot rolling entry temperature that is above a recrystallization temperature (e.g., a preheat temperature, such as at or above 550° C.) to a hot rolling exit temperature that is below the hot rolling entry temperature. The temperature decline from the hot rolling entry temperature to the hot rolling exit temperature can be a monotonic decline. To effect the temperature decrease during hot rolling, each stand of the hot rolling mill can extract heat from the metal strip. For example, a hot rolling stand can be cooled sufficiently such that passing the metal strip through the hot rolling stand can cause heat to be extracted from the metal strip through the work rolls of the hot rolling stand. In some cases, heat can be extracted from the metal strip between hot rolling stands through the use of lubricants or other cooling materials (e.g., fluids such as air or water), instead of or in addition to removal of heat through the hot rolling stands themselves. In some cases, the last and penultimate hot rolling stands can roll the metal strip at progressively lower temperatures. In some cases, the last and penultimate hot rolling stands can roll the metal strip at the same or approximately the same temperature.

Instead of relying on post-rolling (e.g., after hot rolling) recrystallization during a heat treatment process, which can require a temperature increase prior to quenching and which can result in a prolonged duration within a zone of high precipitation, a metal strip can undergo dynamic recrystallization during the hot rolling process, as described herein. Dynamic recrystallization can involve rolling the metal strip at a sufficiently high strain rate and at sufficiently high temperature. Dynamic recrystallization can occur in the final rolling stand of the hot rolling mill. Dynamic recrystallization is dependent upon the strain rate and temperature of the metal strip being processed. The Zener-Hollomon parameter (Z) can be defined by the equation $Z=\dot{\varepsilon}\exp Q/RT$, where $\dot{\varepsilon}$ is the strain rate, Q is the activation energy, R is the gas constant, and T is the temperature. Recrystallization occurs when the Zener-Hollomon parameter falls within a desired range. To remain within this range while minimizing temperature (e.g., hot rolling exit temperature), a metal strip must undergo higher strain rates than would be necessary at higher temperatures. Therefore, it can be desirable to maximize the amount of reduction (e.g., percentage thickness reduction) of the final hot rolling stand or at least select an amount of reduction suitable to achieve a hot rolling exit temperature suitable for rapid quenching to minimize time spent within the zone of high precipitation. To achieve the desired total reduction of thickness, the amount of reduction of thickness added to the final hot rolling stand can be offset by decreasing the amount of reduction of thickness provided by one or more of the preceding hot rolling stands.

Additionally, to minimize time spent within the zone of high precipitation, it can be desirable to run the hot rolling mill at high speeds. For example, in a hot rolling mill using three stands to reduce the metal strip from a gauge of 16 mm to 2 mm, a strip speed of approximately 50 m/min at the entry of the hot rolling mill can result in a strip speed of approximately 400 m/min at the exit of the hot rolling mill. Thus, to achieve a suitably minimal duration within the zone of high precipitation, a quenching process may need to reduce the temperature of the metal strip by approximately 400° C. (e.g., to 100° C.) while the metal strip proceeds at speeds around approximately 400 m/min. In some metals, such as steel, such rapid quenching can be impossible, can be impracticable, or can require large, expensive, and inefficient equipment. In aluminum, it can be possible to provide such quenching as described herein, especially if the recrystallization temperature is minimized through shifting a portion of the reduction of thickness from earlier hot rolling stands to the final hot rolling stand. Further, when a hot rolling process is decoupled from a casting process, the hot rolling process can be permitted to proceed at high speeds, such as those described herein. High speeds during the hot rolling process can help minimize the time spent in the zone of high precipitation. Additionally, high hot rolling speeds can facilitate achieving a suitably high rate of strain necessary to achieve a low recrystallization temperature, as described herein.

Additionally, dynamic recrystallization and rapid quenching to minimize precipitate formation can be facilitated through use of relatively thin metal strips. By casting the metal strip at a relatively thin gauge, such as described herein, the hot rolling process can proceed at high speeds and can be followed by a rapid quenching process, which can reduce the time spent in the zone of high precipitation. The thin gauge can also facilitate high hot rolling speeds. The techniques described herein for dynamic recrystallization and rapid quenching can facilitate preparation of a metal strip or other metallurgical product that carries a T4 temper and has smaller-than-expected amounts of precipitates. For example, a metal strip prepared according to certain aspects of the present disclosure can have a T4 temper and have a volume fraction of Mg2Si at or less than approximately 4.0%, 3.9%, 3.8%, 3.7%, 3.6%, 3.5%, 3.4%, 3.3%, 3.2%, 3.1%, 3.0%, 2.9%, 2.8%, 2.7%, 2.6%, 2.5%, 2.4%, 2.3%, 2.2%, 2.1%, 2.0%, 1.9%, 1.8%, 1.7%, 1.6%, 1.5%, 1.4%, 1.3%, 1.2%, 1.1%, 1.0%, 0.9%, 0.8%, 0.7%, 0.6%, 0.5%, 0.4%, 0.3%, 0.2%, or 0.1%. In some cases, a metal strip prepared according to certain aspects of the present disclosure can have a T4 temper and have a volume fraction of Mg2Si at or less than approximately 10%, 9.9%, 9.8%, 9.7%, 9.6%, 9.5%, 9.4%, 9.3%, 9.2%, 9.1%, 9%, 8.9%, 8.8%, 8.7%, 8.6%, 8.5%, 8.4%, 8.3%, 8.2%, 8.1%, 8%, 7.9%, 7.8%, 7.7%, 7.6%, 7.5%, 7.4%, 7.3%, 7.2%, 7.1%, 7%, 6.9%, 6.8%, 6.7%, 6.6%, 6.5%, 6.4%, 6.3%, 6.2%, 6.1%, 6%, 5.9%, 5.8%, 5.7%, 5.6%, 5.5%, 5.4%, 5.3%, 5.2%, 5.1%, 5%, 4.9%, 4.8%, 4.7%, 4.6%, 4.5%, 4.4%, 4.3%, 4.2%, or 4.1%. As used herein, reference to a volume fraction of Mg2Si can refer to a volume fraction of Mg2Si relative to the total amount of Mg2Si that could be formed in the particular alloy being cast. The percentage of volume fraction of Mg2Si can also be referred to as a percentage of completion of the precipitation reaction to form the Mg2Si.

Certain aspects and features of the present disclosure relate to techniques for tuning the size, shape, and size distribution of iron-bearing (Fe-bearing) intermetallics. Tailoring the characteristics of Fe-bearing intermetallics can be important to achieving optimal product performance, especially for 6xxx series alloys, and especially for the demanding specifications necessary for aluminum automobile parts. Whereas conventional DC casting may require long periods (e.g., several hours) of high-temperature (e.g., >530° C.) homogenization to transform beta phase Fe (β-Fe) into alpha phase Fe (α-Fe) intermetallics, certain aspects of the present disclosure are suitable for producing metal product with desirable Fe-bearing intermetallics. As described herein, certain aspects of the present disclosure relate to producing an intermediate gauge product from a continuous caster. The intermediate gauge product can be finished into a T4 temper product via i) cold rolling to final gauge and solution heat treatment; ii) warm rolling to final gauge and solution heat treatment; iii) hot rolling to final gauge, reheating with a magnetic heater, and performing an in-line quench; iv) hot rolling to final gauge and solution heat treatment; or v) hot rolling to final gauge with dynamic recrystallization to produce T4 temper.

In some cases, the metal strip cast from the continuous caster can be rolled (e.g., hot rolled) prior to coiling. The rolling prior to coiling can be at a large reduction of thickness, such as at least 30% or more typically between 50% and 75%. Especially useful results have been found when the continuously cast metal strip is rolled with a single hot rolling stand prior to coiling, although additional stands can be used in some cases. In some cases, this high-reduction (e.g., greater than 30%, 35%, 40%, 45%, 50%, 55%, 60%, 65%, 70%, or 75% reduction in thickness) hot rolling after continuous casting can help break up Fe-bearing particles in the metal strip, among other benefits. In cases where the metal strip is reduced in thickness through rolling after continuous casting and before coiling, any hot rolling processes that occur after uncoiling may require one fewer hot rolling stands and/or one fewer passes since the metal strip has already been reduced in thickness between casting and coiling.

In some cases, the metal strip can be flash homogenized. Flash homogenization can include heating the metal strip to a temperature above 500° C. (e.g., 500-570° C., 520-560° C., or at or approximately 560° C.) for a relatively short period of time (e.g., approximately 1 minute to 10 minutes, such as 30 second, 45 seconds, 1 minutes, 1:30 minutes, 2 minutes, 3 minutes, 4 minutes, 5 minutes, 6 minutes, 7 minutes, 8 minutes, 9 minutes, or 10 minutes, or any range in between). This heating can occur between the continuous caster and the initial coiling, and more specifically between the continuous caster and the hot rolling stand prior to coiling, or between that hot rolling stand and coiling. This flash homogenization can help reduce the aspect ratio of the Fe-bearing intermetallics (e.g., a or 13 type) and can also reduce the size of these intermetallics. In some cases, flash homogenization (e.g., at 570° C. for about 2 minutes) can successfully achieve beneficial spheroidization and/or refinement of Fe-constituent particles that would otherwise require extensive homogenization at higher temperatures.

In some cases, the combination of flash homogenization and high-reduction hot rolling after continuous casting, as described herein, can be especially useful for refining (e.g., breaking up) Fe-bearing particles.

In one example, a casting system can include a continuous caster, a furnace (e.g., a tunnel furnace), a hot roll stand, and a coiler. In some cases, one or more quenches can occur before and/or after the hot roll stand. The hot roll stand can provide a reduction in thickness of the metal strip of at least 30% or between 50-70%. A quench before the hot rolling stand may be optional, however it may beneficially break up Fe-bearing particles and improve precipitation characteristics. In some cases, after the hot rolling, quenching, and coiling, the metal strip can be hot-rolled after a slow/fast heat up and soaking at a relatively high temperature (e.g., >500° C.). In some cases, after the hot rolling, quenching, and coiling, the metal strip can be warm rolled after slow/fast heat up to a relatively lower temperature (e.g., <350° C.). In some cases, after the hot rolling, quenching, and coiling, the metal strip can be cold rolled without any further heat treatment. As described herein, these various techniques can result in various properties with respect to Fe-bearing particles, such as various Fe constituent size distributions.

In some cases, the metal strip can be reheated at various points in the hot rolling system through the use of heating devices such as magnetic heaters, such as induction heaters or rotating magnet heaters. Non-limiting examples of suitable rotating magnet heaters include those disclosed in U.S. Provisional Application No. 62/400,426 filed on Sep. 27, 2016 and entitled "ROTATING MAGNET HEAT INDUCTION," the disclosure of which is hereby incorporated in its entirety.

Generally, the rolling stand(s) of the hot rolling system are cooled, such as through a coolant system including nozzles that spray coolant onto the rolls of the rolling stand(s) and/or the metal strip itself. This coolant system may extract sufficient heat such that the mechanical action of reducing the thickness of the metal strip by passing the metal strip through the hot rolling stand(s) does not increase the temperature of the metal strip. However, in some cases, the metal strip can be intentionally reheated by reducing the amount of cooling applied by the coolant system, thus allowing the mechanical action of reducing the thickness of the metal strip by passing the metal strip through the hot rolling stand(s) to impart a positive temperature change in the metal strip.

As used herein, various cooling and/or quenching devices are described with reference to coolant supplied by one or more nozzles. Other mechanisms to provide fast cooling to a metal strip can be used, whether fluid-based or not and whether nozzle-based or not. In some cases, the metal strip can be cooled or quenched using a deluge of coolant, such as provided directly from a hose, a conduit, a tank, or other such structure for conveying the coolant to the metal strip.

Aspects and features of the present disclosure are described herein with respect to producing metal strips, however aspects of the present disclosure may also be used to produce metal products of any suitable size or form, such as foils, sheets, slabs, plates, shates, or other metal products.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may not be drawn to scale.

FIG. 1 is a schematic diagram depicting a decoupled metal casting and rolling system 100 according to certain aspects of the present disclosure. The decoupled metal casting and rolling system 100 can include a casting system 102, a storage system 104, and a hot rolling system 106. The decoupled metal casting and rolling system 100 can be considered a single, continuous processing line having decoupled subsystems. The metal strip 110 cast by the casting system 102 can continue in a downstream direction through the storage system 104 and the hot rolling system 106. The decoupled metal casting and rolling system 100 can be considered continuous, as metal strip 110 can be continuously produced by the casting system 102, stored by the storage system 104, and hot rolled by the hot rolling system 106. In some cases, the decoupled metal casting and rolling system 100 can be located within a single building or facility, however in some cases the subsystems of the decoupled metal casting and rolling system 100 may be located separately from one another. In some cases, a single casting system 102 can be associated with one or more storage systems 104 and one or more hot rolling systems 106, thereby allowing the casting system 102 to operate continuously at a rate of speed much higher than a single storage system 104 or hot rolling system 106 would otherwise permit.

The casting system 102 includes a continuous casting device, such as a continuous belt caster 108, that continuously casts a metal strip 110. The casting system 102 can optionally include a fast quenching system 114 positioned immediately downstream of the continuous belt caster 108, or shortly thereafter. The casting system 102 can include a coiling device capable of coiling the metal strip 110 into an intermediate coil 112.

The intermediate coil 112 accumulates a portion of the metal strip 110 exiting the continuous belt caster 108 and, after being cut by a shear or other suitable device, can be transported to another location, allowing a new intermediate coil 112 to form thereafter from additional metal strip 110 exiting the continuous belt caster 108, thus allowing the continuous belt caster 108 to operate continuously or semi-continuously.

The intermediate coil 112 can be provided directly to the hot rolling system 106, or can be stored and/or processed in the storage system 104. The storage system 104 can include various storage mechanisms, such as vertical or horizontal storage mechanisms and periodic or continuously rotating storage mechanisms. In some cases, intermediate coils 112 can undergo preheating in a preheater 116 (e.g., a furnace) when being stored in the storage system 104. Preheating can occur for some or all of the duration of time when the intermediate coil 112 is in the storage system 104. After being stored in the storage system 104, the metal strip 110 can be provided to the hot rolling system 106.

The hot rolling system 106 can reduce the thickness of the metal strip 110 from an as-cast gauge to a desired gauge for distribution. In some cases, the desired gauge for distribution can be at or approximately 0.7 mm to 4.5 mm, or at or approximately 1.5 mm to 3.5 mm. The hot rolling system 106 can include a set of hot rolling stands 118 for reducing the thickness of the metal strip 110. In some cases, the set of hot rolling stands 118 can include a single hot rolling stand, however any number of hot rolling stands can be used, such as two, three, or more. In some cases, the use of a larger number of hot rolling stands (e.g., three, four, or more) can result in better surface quality for a given total reduction of thickness (e.g., reduction of thickness from before the first hot rolling stand to after the last hot rolling stand) because each rolling stand therefore needs to reduce the thickness of the metal by a smaller amount, and thus fewer surface defects are generally imparted on the metal strip. The hot rolling system 106 can further perform other processing of the metal strip, such as surface finishing (e.g., texturing), preheating, and heat treating. Metal strip 110 exiting the hot rolling system 106 can be provided directly to further processing equipment (e.g., a blanking machine or a bending machine) or can be coiled into a distributable coil 120 (e.g., a finished coil). As used herein, the term distributable can describe a metal product, such as a coiled metal strip, that has the desired characteristics of a consumer of the metal strip. For example, a distributable coil 120 can include coiled metal strip having physical and/or chemical characteristics that meet an original equipment manufacturer's specifications. The distributable coil 120 can be a W temper or a T temper. The distributable coil 120 can be stored, sold, and shipped as appropriate.

The decoupled metal casting and rolling system 100 depicted in FIG. 1 allows the speed of the casting system 102 to be decoupled from the speed of the hot rolling system 106. As depicted, the decoupled metal casting and rolling system 100 uses a storage system 104 for storing intermediate coils 112, wherein the metal strip 110 exiting the continuous belt caster 108 is coiled into discrete units and stored until the hot rolling system 106 is available to process them. Instead of storing intermediate coils 112, in some cases, the storage system 104 uses an inline accumulator that accepts metal strip 110 from the casting system 102 at a first speed and accumulates it between a set of moving rollers to allow the continuous metal strip 110 to be fed into a hot rolling system 106 at a second speed different from the first speed. The inline accumulator can be sized to accommodate a difference in the first speed and the second speed for a predetermined time period based on the desired casting duration of the casting system 102. In systems where the casting system 102 is desired to operate continuously, a coil-based storage system 104 can be desirable.

Figure 2:
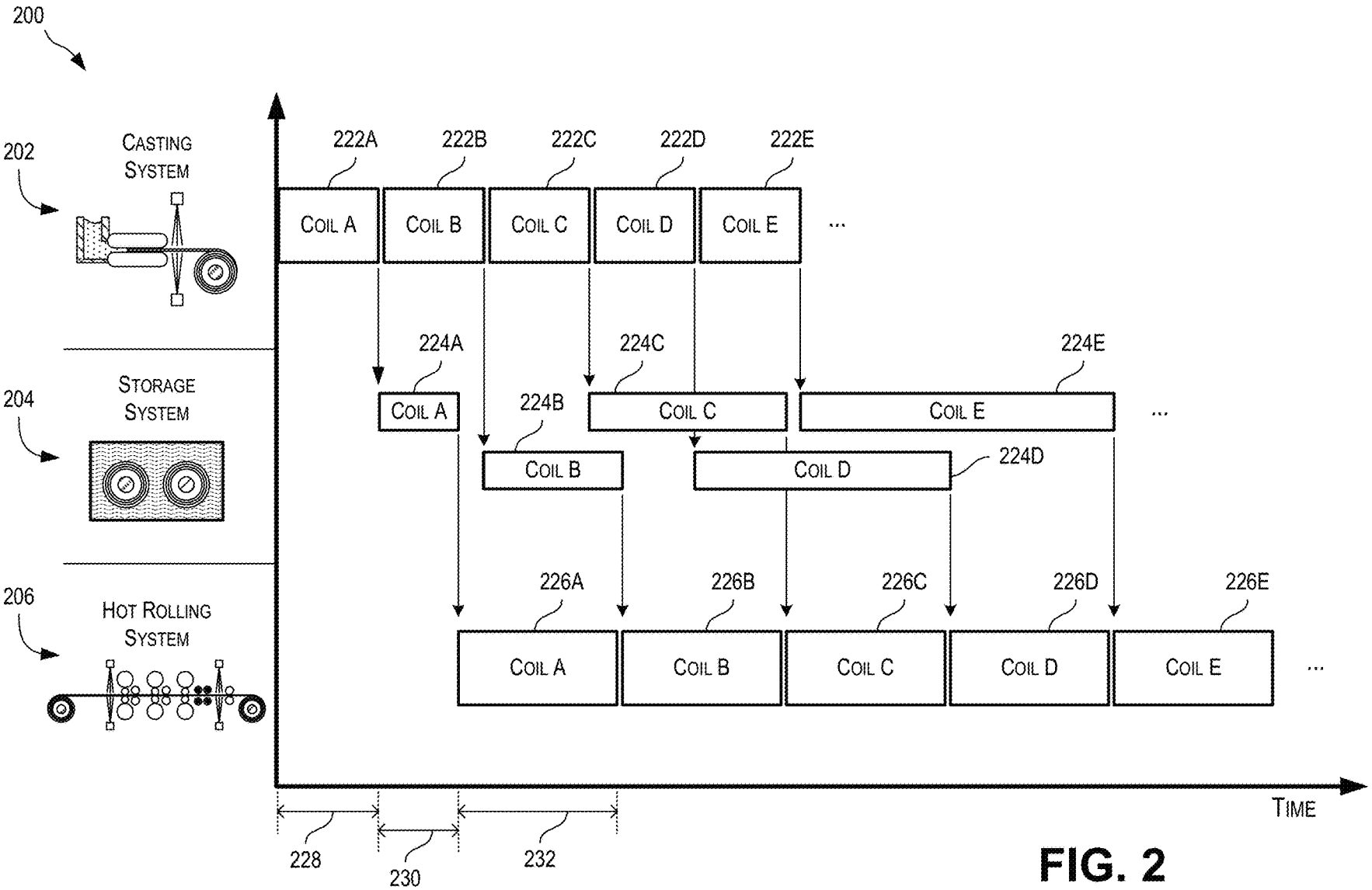
FIG. 2 is a timing chart for the production of various coils using a decoupled metal casting and rolling system according to certain aspects of the present disclosure.

FIG. 2 is a timing chart 200 for the production of various coils using a decoupled metal casting and rolling system according to certain aspects of the present disclosure. The timing chart 200 depicts the location and processes being performed for each of the various coils as a function of time as the coils pass from the casting system 202, through the storage system 204, and through the hot rolling system 206. The casting system 202, storage system 204, and hot rolling system 206 can be the casting system 102, storage system 104, and hot rolling system 106 of the decoupled metal casting and rolling system 100 of FIG. 1.

As described above, the casting system 202 can cast intermediate coils. Blocks 222A, 222B, 222C, 222D, and 222E represent the casting times of intermediate coils A, B, C, D, and E, respectively. The casting system 202 can cast each intermediate coil at a particular casting speed. Therefore, coil casting time 228 can represent the time necessary for the casting system 202 to cast and coil a single intermediate coil. In some cases, the casting system 202 undergoes a reset time during which the casting system 202 is reset to cast and coil a subsequent intermediate coil. In other cases, the casting system 202 can immediately begin casting and coiling the subsequent intermediate coil. As depicted in FIG. 2, the casting system 202 can repeatedly output intermediate coils continuously.

Intermediate coils can be passed to the storage system 204 for storage and/or optional processing (e.g., reheating). Blocks 224A, 224B, 224C, 224D, and 224E represent the storage durations of intermediate coils A, B, C, D, and E, respectively. Because the speed of the casting system 202 is decoupled from the speed of the hot rolling system 206, the storage system 204 may be able to store any suitable numbers of intermediate coils for varying amounts of time, depending on the number of hot rolling systems 206 available and the speeds of the casting system 202 and the hot rolling system 206.

In some cases, each intermediate coil can remain in the storage system 204 for a minimum storage time 230, which can be a minimum amount of time necessary to perform any optional processing during storage. In some cases, there is no minimum storage time 230, and the intermediate coil can be delivered to the hot rolling system 206 without storage if the hot rolling system 206 is available to accept the intermediate coil. For example, if there is no minimum storage time 230, then intermediate coil A would be delivered directly to the hot rolling system 206 and there would be no block 224A.

Intermediate coils provided to the hot rolling system 206 can be rolled and otherwise processed into a distributable coil. Blocks 226A, 226B, 226C, 226D, and 226E represent the duration of time spent in the hot rolling system 206 for intermediate coils A, B, C, D, and E, respectively. The hot rolling system 206 can operate at a set speed, resulting in a coil rolling time 232 that represents the duration of time necessary to hot roll and otherwise process an intermediate roll in the hot rolling system 206.

It can be appreciated that while decoupled, the process of casting, storing, and hot rolling the metal strip is continuous as the metal strip continuously passes from one system to the next. The storage system 204 can be especially desirable when the coil casting time 228 is shorter than the coil rolling time 232. The difference between the coil casting time 228 and the coil rolling time 232 can dictate the necessary size of the storage system 204 as a function of overall casting duration (e.g., the overall length of time it is desired for the casting system 202 to continuously cast intermediate coils before shutting down).

Figure 3:
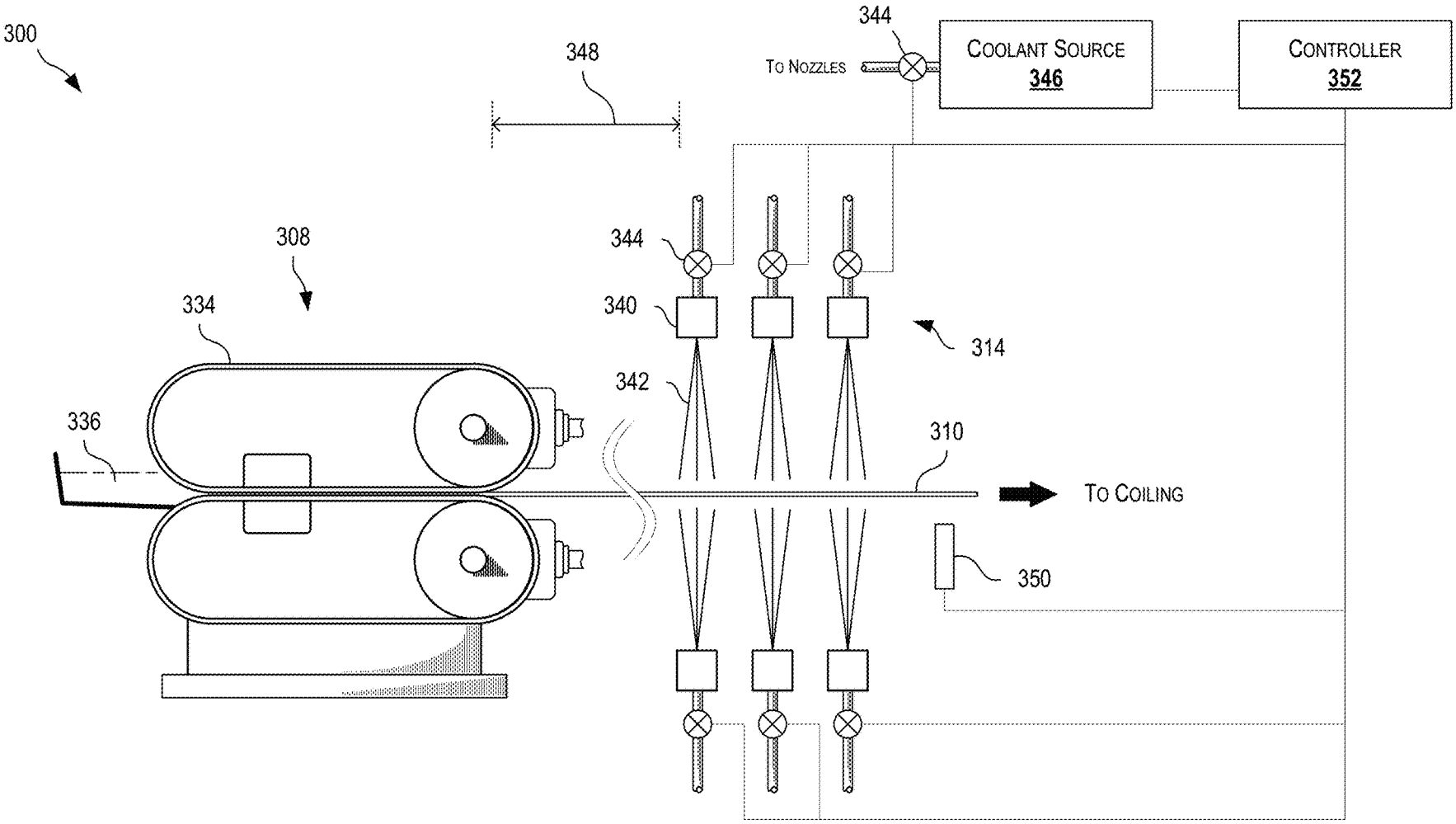
FIG. 3 is a schematic diagram depicting a decoupled continuous casting system according to certain aspects of the present disclosure.

FIG. 3 is a schematic diagram depicting a decoupled continuous casting system 300 according to certain aspects of the present disclosure. The decoupled continuous casting system 300 includes a continuous casting device, such as a continuous belt caster 308. The continuous belt caster 308 includes opposing belts 334 capable of extracting heat from liquid metal 336 at a cooling rate sufficient to solidify the liquid metal 336, which once solid passes out of the continuous belt caster 308 as a metal strip 310. The continuous belt caster 308 can operate at a desired casting speed. The opposing belts 334 can be made of any suitable material, however in some cases the belts 334 are made from copper. Cooling systems within the continuous belt caster 308 can extract sufficient heat from the liquid metal 336 such that the metal strip 310 exiting the continuous belt caster 308 has a temperature between 200° C. to 530° C., although other ranges can be used.

In some cases, fast solidification and fast cooling can be achieved by using a continuous belt caster 308 configured to extract sufficient heat from the metal such that the metal strip 310 exiting the continuous belt caster 308 has a temperature below 200° C. In other cases, fast post-casting cooling can be performed by a quenching system 314 positioned immediately downstream of the continuous belt caster 308 or shortly thereafter. The quenching system 314 can extract sufficient heat from the metal strip 310 such that the metal strip exits the quenching system 314 at a temperature at or below 100° C., despite the temperature at which the metal strip 310 exits the continuous belt caster 308. As one example, the quenching system 314 can be configured to reduce the temperature of the metal strip 310 to at or below 100° C. within approximately ten seconds.

The quenching system 314 can include one or more nozzles 340 for distributing coolant 342 onto the metal strip 310. Coolant 342 can be fed to nozzles 340 from a coolant source 346 coupled to the nozzles 340 by appropriate piping. The quenching system 314 can include one or move valves 344, including valves 344 associated with one or more nozzles 340 and/or valves 344 associated with the coolant source 346, to adjust the amount of coolant 342 being applied to the metal strip 310. In some cases, the coolant source 346 can include a temperature control device for setting a desired temperature of the coolant 342. A controller 352 can be operatively coupled to the valve(s) 344, the coolant source 346, and/or a sensor 350 to control the quenching system 314. The sensor 350 can be any suitable sensor for determining a temperature of the metal strip 310, such as a temperature of the metal strip 310 as it exits the quenching system 314. Based on the detected temperature, the controller 352 can adjust a temperature of the coolant 342 or a flow rate of the coolant 342 to maintain the temperature of the metal strip 310 as it exits the quenching system 314 within desired parameters (e.g., below 100° C.).

The quenching system 314 can be positioned to begin cooling the metal strip 310 a distance 348 downstream of where the metal strip 310 exits the continuous belt caster 308. The distance 348 can be as small as practicable. In some cases, the distance 348 is at or less than 5 meters, 4 meters, 3 meters, 2 meters, 1 meter, 50 cm, 25 cm, 20 cm, 15 cm, 10 cm, 5 cm, 2.5 cm, or 1 cm.

Metal strip 310 exiting the quenching system 314 can have a desirable distribution of dispersoid-forming elements, and thus be in a desirable state for later dispersoid formation (e.g., dispersoid precipitation), as disclosed herein. Metal strip 310 exiting the quenching system 314 can be coiled, by a coiling device, into an intermediate coil.

Figure 4:
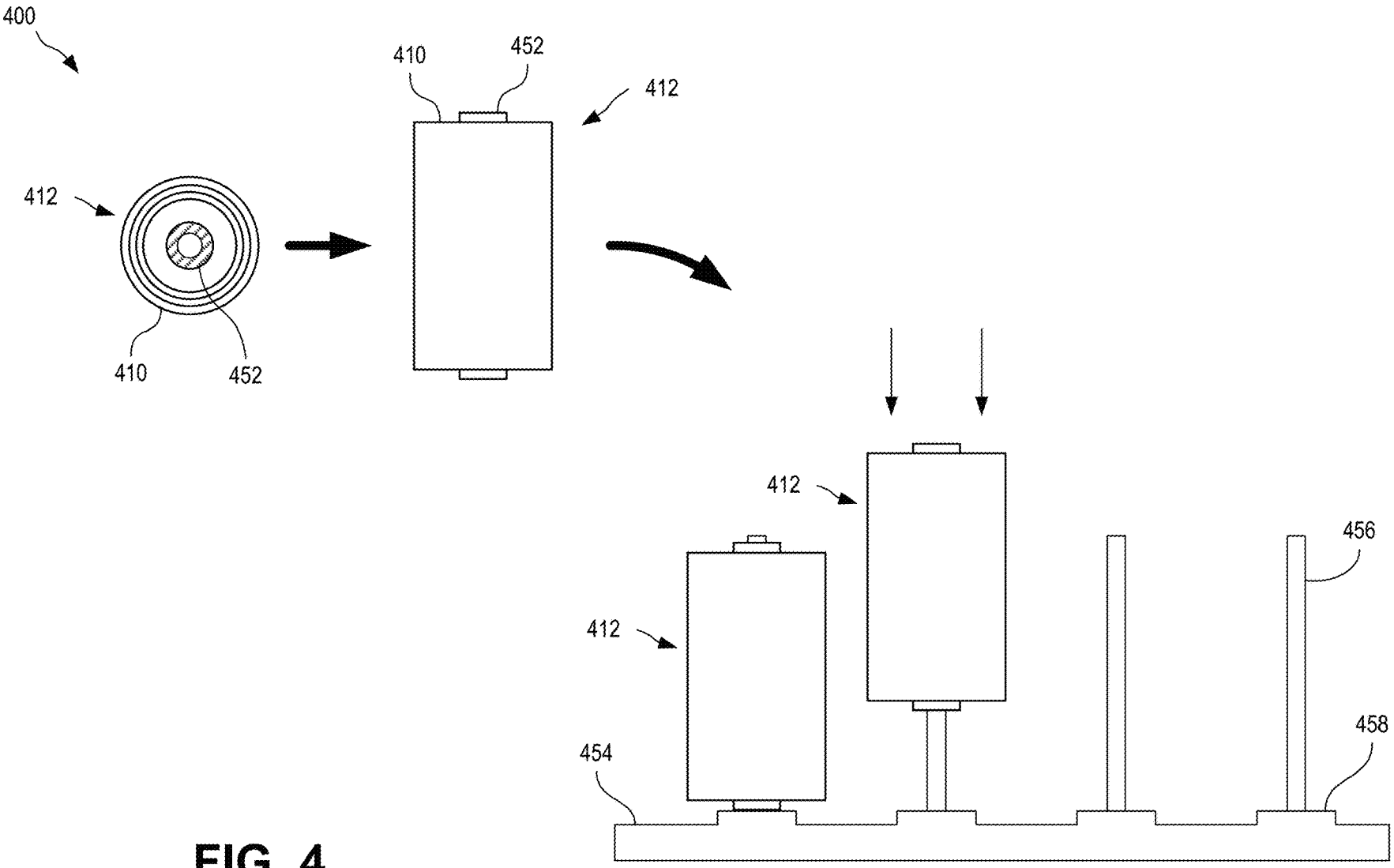
FIG. 4 is a schematic diagram depicting an intermediate coil vertical storage system according to certain aspects of the present disclosure.

FIG. 4 is a schematic diagram depicting an intermediate coil vertical storage system 400 according to certain aspects of the present disclosure. The intermediate coil vertical storage system 400 can be the storage system 104 of FIG. 1. The intermediate coil vertical storage system 400 can be used to store an intermediate coil 412, such as an intermediate coil 412 comprising metal strip 410 wrapped around a spindle 452. The intermediate coil 412 can be lifted into a vertical orientation and then placed on a storage rack 454 having vertical supports 456. The vertical supports 456 can interact with the spindle 452 to securely maintain the intermediate coil 412 in the vertical orientation. In some cases, a vertical support 456 can be an extended protrusion that fits within an aperture of the spindle 452, although other mechanisms can be used. In some cases, the storage rack 454 can include a shoulder 458 for keeping the metal strip 410 of the intermediate coil 412 spaced apart from the storage rack 454. In some cases, an intermediate coil 412 can include a metal strip 410 without a spindle, in which case the vertical support 456 can fit within a central aperture formed by the coiled metal strip 410.

Figure 5:
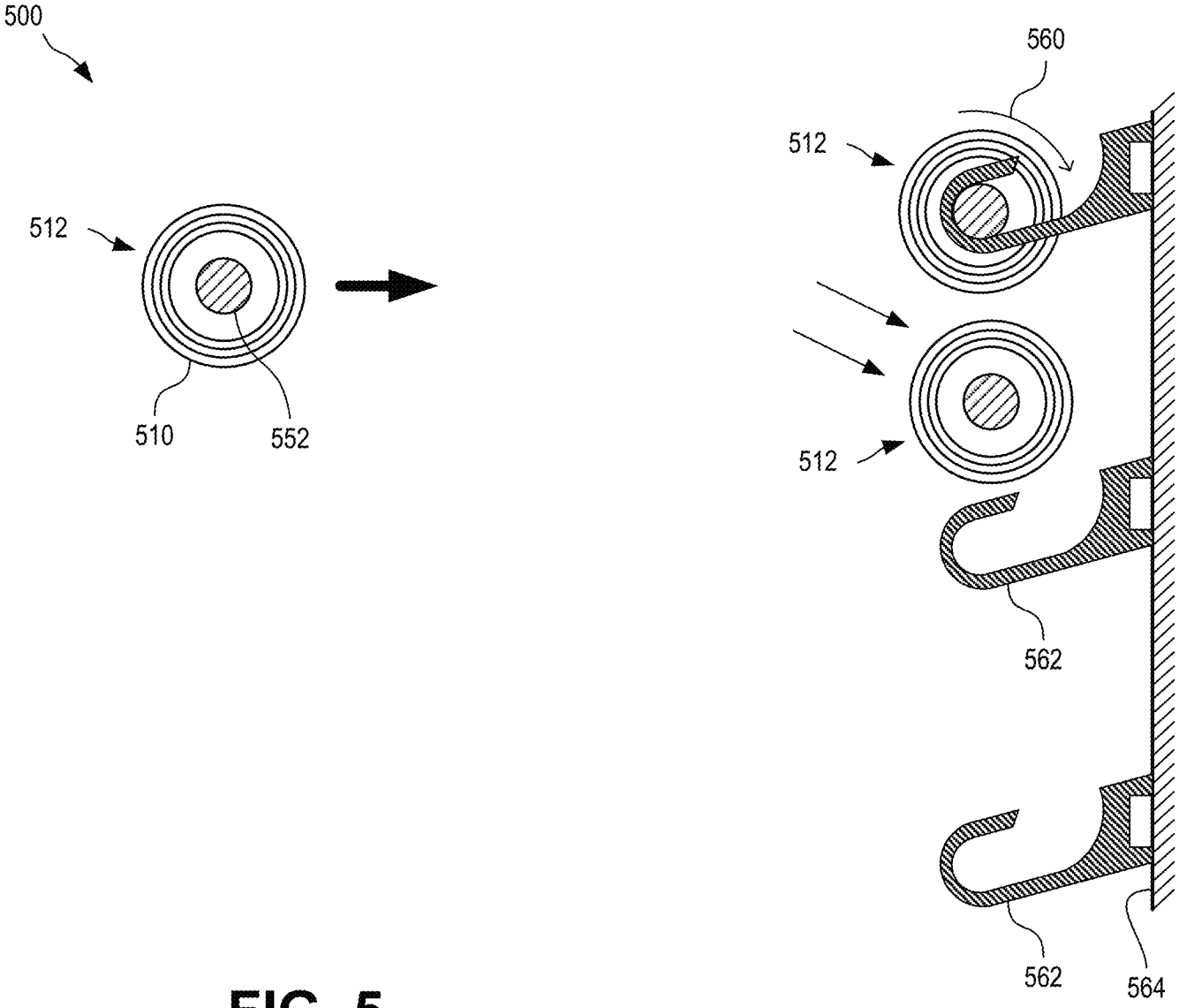
FIG. 5 is a schematic diagram depicting an intermediate coil elevated storage system according to certain aspects of the present disclosure.

FIG. 5 is a schematic diagram depicting an intermediate coil horizontal storage system 500 according to certain aspects of the present disclosure. The intermediate coil horizontal storage system 500 can be the storage system 104 of FIG. 1. The intermediate coil horizontal storage system 500 can be used to store an intermediate coil 512, such as an intermediate coil 512 comprising metal strip 510 wrapped around a spindle 552. The intermediate coil horizontal storage system 500 can include one or more horizontal supports 562 for supporting the spindle 552 of the intermediate coil 512 in a horizontal orientation. In some cases, one or more horizontal supports 562 can be secured to a single structure 564, such as a wall or other suitable structure.

In some cases, the intermediate coil 512 can be rotated in a rotation direction 560 during storage. Rotation can occur periodically (e.g., rotate for 30 seconds once every ten minutes) or continuously. In some cases, the horizontal support 562 can include a motor or other source of motive energy for rotating the intermediate coil 512.

In some cases, the intermediate coil 512 can include a metal strip 510 without a spindle, in which case the horizontal support 562 can include a spindle or other mechanism for supporting the intermediate coil 512 in a horizontal orientation. In some cases, the horizontal support can support such a spindleless intermediate coil from a central aperture formed by the coiled metal strip 510, thus avoiding increased weight being applied to the portions of the metal strip 510 located gravitationally below the aperture. However, in some cases, the horizontal support 562 can include rollers or other such mechanisms for supporting an intermediate coil in a horizontal orientation from below the bottom of the intermediate coil. In some cases, such rollers can facilitate rotation of the intermediate coil.

Figure 6:
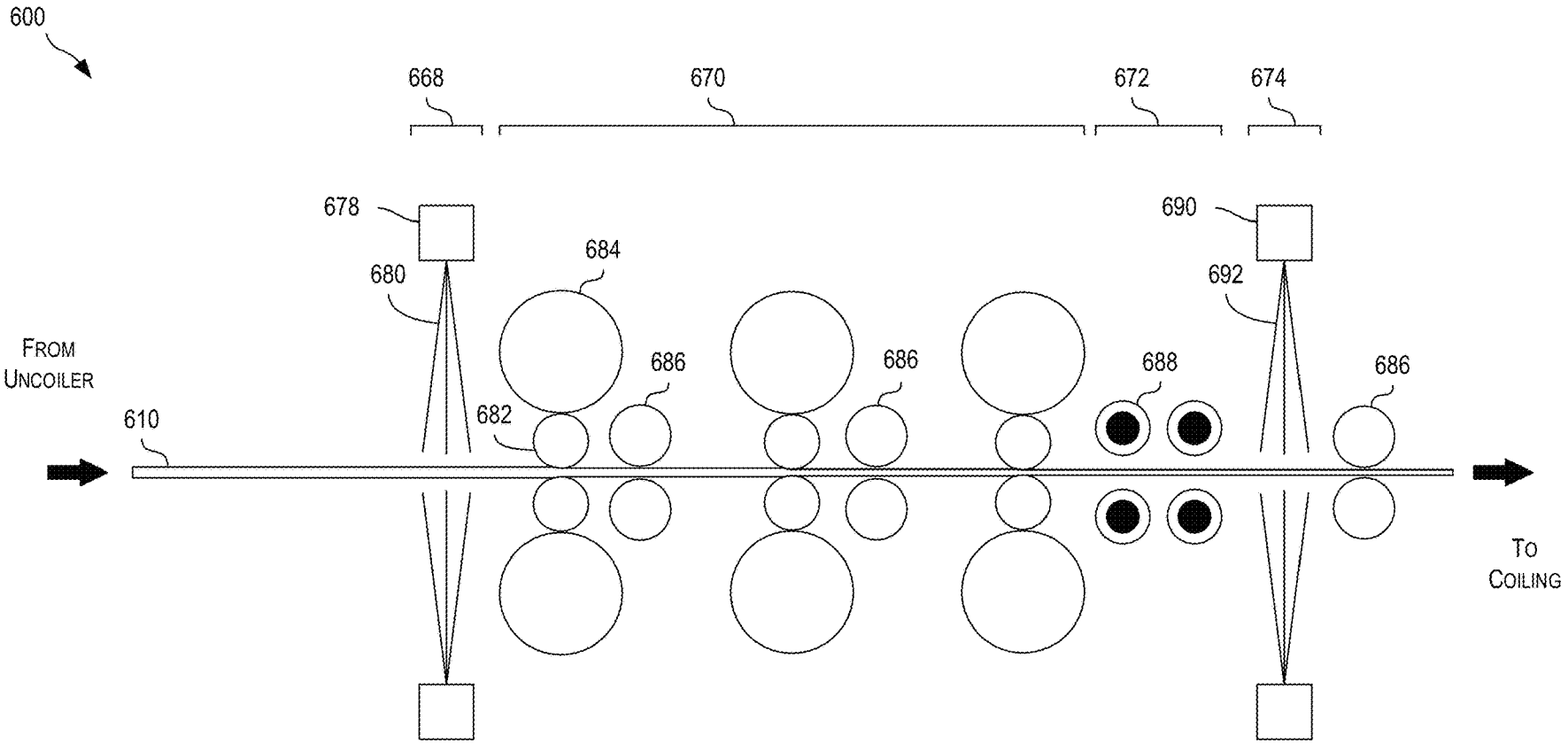
FIG. 6 is a schematic diagram depicting a hot rolling system according to certain aspects of the present disclosure.

FIG. 6 is a schematic diagram depicting a hot rolling system 600 according to certain aspects of the present disclosure. The hot rolling system 600 can be the hot rolling system 106 from FIG. 1. The hot rolling system 600 can accept metal strip 610, such as in the form of an intermediate coil that is uncoiled by an uncoiling device (e.g., uncoiler). The metal strip 610 can pass through various zones of the hot rolling system 600, such as an initial quench zone 668, a hot rolling zone 670, a heat treatment zone 672, and a heat treatment quenching zone 674. The hot rolling systems can include fewer or more zones.

In an initial quench zone 668, the metal strip 610 can be cooled down to a hot rolling temperature suitable for hot rolling in the hot rolling zone 670. The hot rolling temperature can be at or approximately 350° C., although other values can be used. Any suitable heat extraction device can be used in the initial quench zone 668, such as an initial quench nozzle 678 supplying initial quench coolant 680 to the metal strip 610. Various controllers and sensors can be used to ensure the heat extraction device is cooling at the desired amounts. The initial quench zone 668 can be located upstream of the hot rolling zone 670, such as immediately upstream of the hot rolling zone 670.

In a hot rolling zone 670, one or more hot rolling stands can reduce the thickness of the metal strip 610. Hot rolling can include reducing the thickness of the metal strip 610 while the metal strip 610 is at a hot rolling temperature, such as at or approximately 350° C. Each hot rolling stand can include a pair of work rolls 682 in direct contact with the metal strip 610 and a pair of backup rolls 684 for applying rolling force to the metal strip 610 through the work rolls 682. Other types of hot rolling stands can be used, such as duo stands, quarto stands, sexto stands, or other stands having any suitable number of backup rolls, including zero. Various heat extraction devices can be used on the metal strip 610, work rolls 682, and/or backup rolls 684 to counteract the mechanically-induced heat that is generated during hot rolling.

In a heat treatment zone 672, a heating device, such as a set of rotating magnetic heaters 688, can heat the metal strip 610. The metal strip can be heated in the heat treatment zone 672 to a heat treatment temperature, such as at or around 500° C. or higher. The heat treatment zone 672 can rapidly heat the metal strip 610 after it exits the hot rolling zone 670. Various controllers and sensors can be used to ensure the heating device is heating the metal strip 610 to the heat treatment temperature. Rotating magnetic heaters 688 can include electromagnet or permanent-magnet rotors rotating in proximity to the metal strip 610 without contacting the metal strip 610. These rotating magnetic heaters 688 can create changing magnetic fields capable of inducing eddy currents within the metal strip 610, thus heating the metal strip 610.

In some cases, the heating normally performed in the heat treatment zone 672 can be in whole or in part performed during the hot rolling zone 670 by allowing the mechanically-induced heat generated during hot rolling to heat the metal strip 610 towards, up to, or above the heat treatment temperature. Thus, any additional heating device of the heat treatment zone 672 (e.g., rotating magnetic heaters 688) may be used to a lesser degree or excluded from the hot rolling system 600.

In a heat treatment quenching zone 674, the metal strip 610 can be rapidly cooled to a desired output temperature, such as at or approximately 100° C. In some cases, the metal strip may be cooled below a desired coiling temperature (e.g., approximately 100° C.), after which the metal strip can be reheated up to the desired coiling temperature using any suitable reheating equipment, such as rotating magnetic heaters. The heat treatment quenching zone 674 can be located immediately downstream of the heat treatment zone 672, and at a distance sufficient to ensure the metal strip 610 is maintained at or above the heat treatment temperature for no longer than a desired duration, such as at or less than 5 seconds or at or less than 1 second. In some cases, the desired duration is a low as possible, minimizing the distance between the heat treatment zone 672 and the heat treatment quenching zone 674. The heat treatment quenching zone 674 can include one or more heat treatment quench nozzles 690 that supply heat treatment quenching coolant 692 to the metal strip 610. In some cases, the heat treatment quenching coolant 692 is the same coolant as the initial quench coolant 680.

Throughout the hot rolling system 600, various support rolls 686 can be employed to facilitate the passage of the metal strip 610 through the hot rolling system 600.

Figure 7:
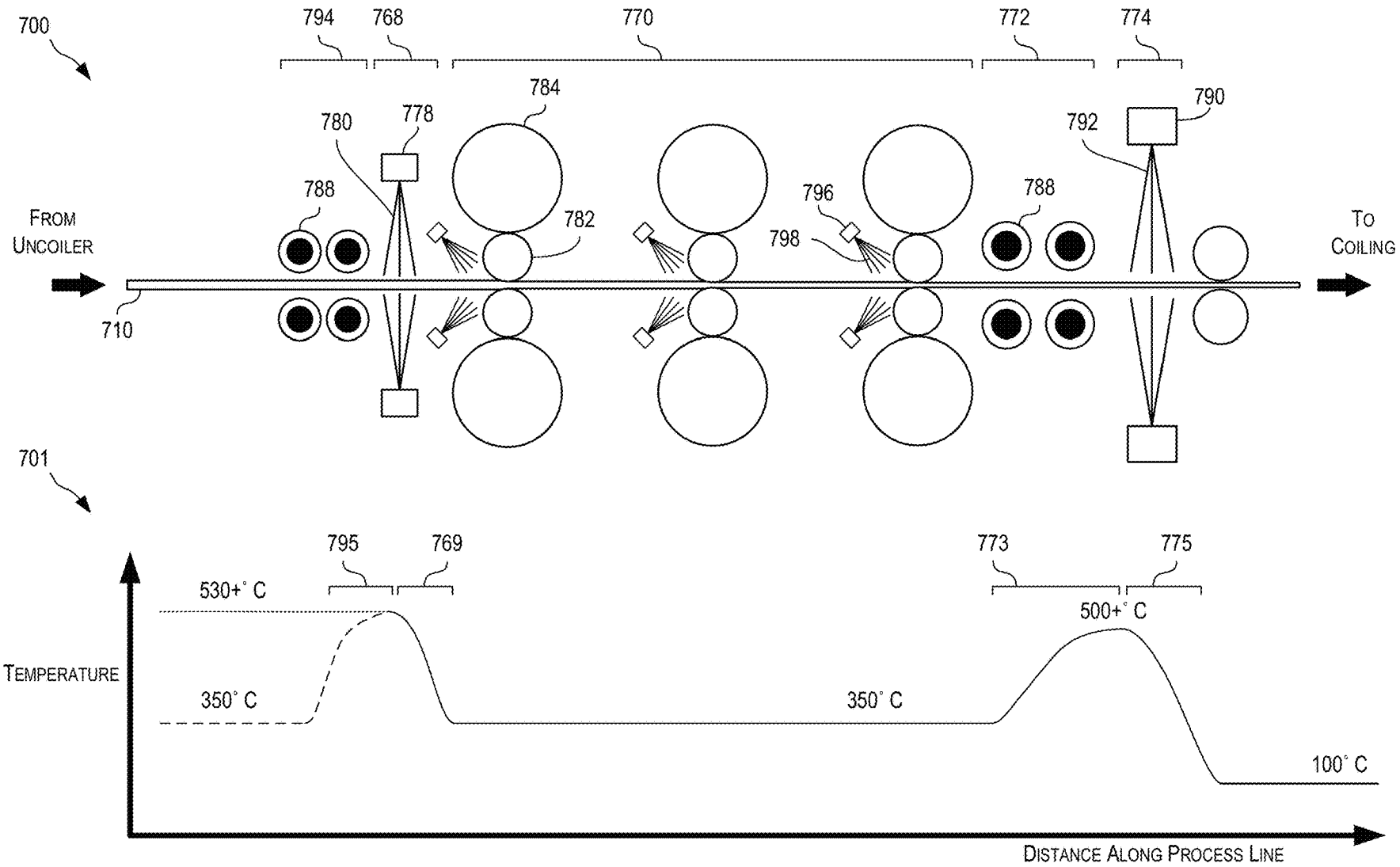
FIG. 7 is a combination schematic diagram and chart depicting a hot rolling system and the associated temperature profile of the metal strip being rolled thereon according to certain aspects of the present disclosure.

FIG. 7 is a combination schematic diagram and chart depicting a hot rolling system 700 and the associated temperature profile 701 of the metal strip 710 being rolled thereon according to certain aspects of the present disclosure. The hot rolling system 700 can be hot rolling system 106 from FIG. 1.

Hot rolling system 700 includes, from upstream uncoiling to downstream coiling, a preheat zone 794, an initial quench zone 768, a hot rolling zone 770, a heat treatment zone 772, and a heat treatment quenching zone 774. The temperature profile 701 shows that the metal strip 710 may enter the hot rolling system 700 at either a standard temperature (e.g., 350° C. as shown in dashed line) or a preheated temperature (e.g., 530+° C. as shown in dotted line). When entering at a preheated temperature, the preheat zone 794 may apply little or no additional heat to the metal strip 710. However, when entering at any temperature below a desired preheat temperature (e.g., at or above 530° C.), one or more heating devices in the preheat zone 794 may apply heat to the metal strip 710 to raise the temperature of the metal strip to or above the desired preheat temperature. Preheating 795 of the metal strip 710 can improve dispersoid arrangement in the metal strip 710, as disclosed herein. In some cases, the preheat zone 794 can include a set of rotating permanent magnets 788, although other heating devices can be used.

Before entering the hot rolling zone 770, the metal strip 710 can undergo initial quenching 769 in the initial quench zone 768. In the initial quench zone 768, initial quench coolant 780 supplied by the one or more initial quench nozzles 778 can reduce a temperature of the metal strip 710 to a hot rolling temperature (e.g., at or around 350° C.) for subsequent hot rolling 770.

During the hot rolling process in the hot rolling zone 770, the metal strip 710 can be reduced in thickness due to force applied from the backup rolls 784 through the work rolls 782. To counteract mechanically-induced heat generated through hot rolling, one or more rolling coolant nozzles 796 can supply rolling coolant 798 to one or more of the metal strip 710, work rolls 782, or backup rolls 784. Thus, as seen in the temperature profile 701, the temperature of the metal strip 710 can be maintained at or around the rolling temperature throughout the hot rolling zone 770.

At the heat treatment zone 772, the metal strip 710 can be heated 773 to a heat treatment temperature (e.g., at or around 500° C. or above). The heat treatment zone 772 can include a set of rotating permanent magnets 788, although other heating devices can be used. At the heat treatment quenching zone 774, the metal strip 710 can be quenched 775 down to a temperature below the hot rolling temperature, such as down to an output temperature (e.g., at or below 100° C.). The heat treatment quenching zone 774 can cool the metal strip 710 by supplying heat treatment quench coolant 792 from one or more heat treatment quench nozzles 790. In some cases, the initial quench coolant 780, rolling coolant 798, and heat treatment quench coolant 792 come from the same coolant source, although that need not be the case.

Figure 8:
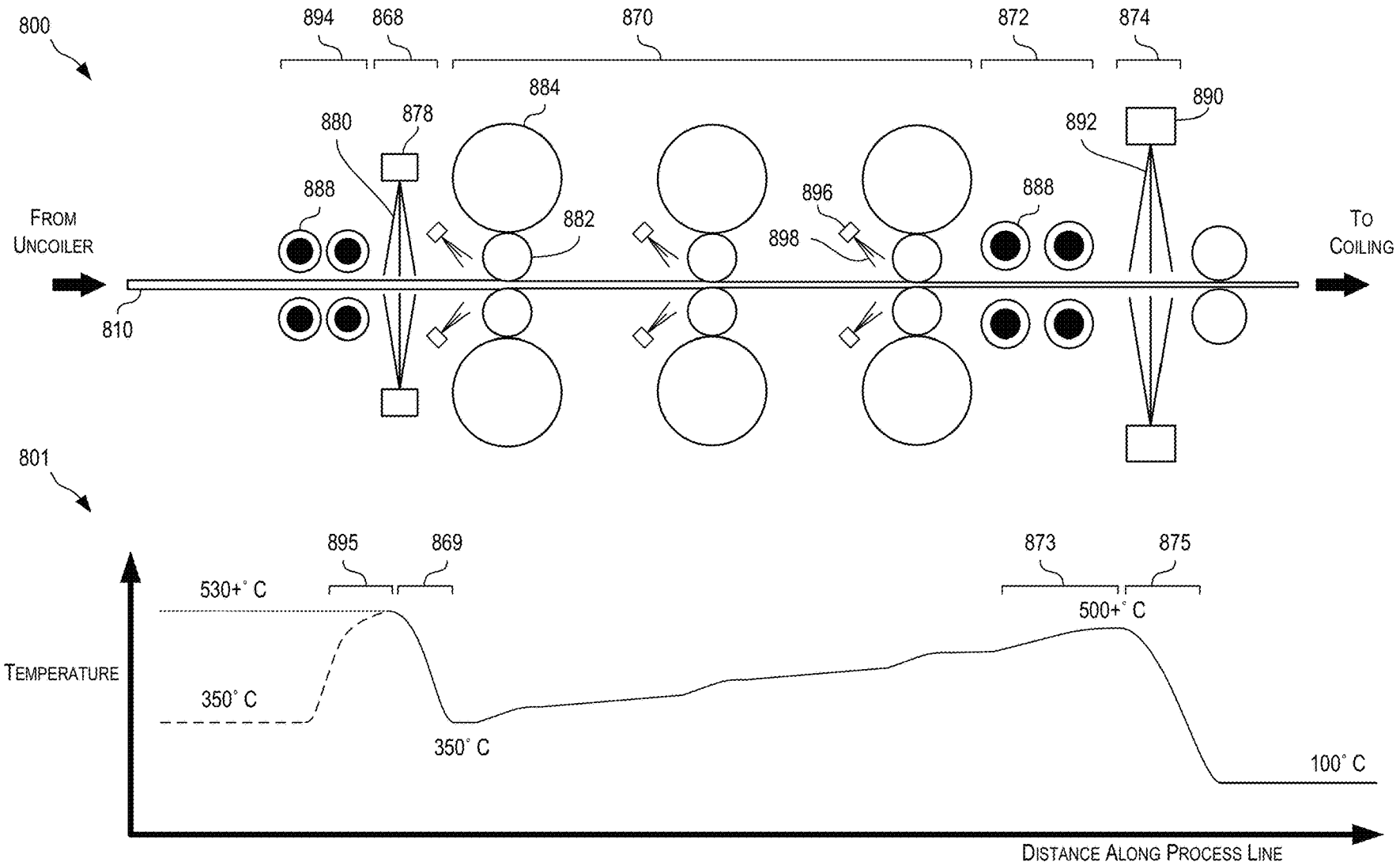
FIG. 8 is a combination schematic diagram and chart depicting a hot rolling system having intentionally undercooled rolling stands and the associated temperature profile of the metal strip being rolled thereon according to certain aspects of the present disclosure.

FIG. 8 is a combination schematic diagram and chart depicting a hot rolling system 800 having intentionally undercooled rolling stands and the associated temperature profile 801 of the metal strip 810 being rolled thereon according to certain aspects of the present disclosure. The hot rolling system 800 can be hot rolling system 106 from FIG. 1.

Hot rolling system 800 includes, from upstream uncoiling to downstream coiling, a preheat zone 894, an initial quench zone 868, a hot rolling zone 870, a heat treatment zone 872, and a heat treatment quenching zone 874. The temperature profile 801 shows that the metal strip 810 may enter the hot rolling system 800 at either a standard temperature (e.g., 350° C. as shown in dashed line) or a preheated temperature (e.g., 530+° C. as shown in dotted line). When entering at a preheated temperature, the preheat zone 894 may apply little or no additional heat to the metal strip 810. However, when entering at any temperature below a desired preheat temperature (e.g., at or above 530° C.), one or more heating devices in the preheat zone 894 may apply heat to the metal strip 810 to raise the temperature of the metal strip to or above the desired preheat temperature. Preheating 895 of the metal strip 810 can improve dispersoid arrangement in the metal strip 810, as disclosed herein. In some cases, the preheat zone 894 can include a set of rotating permanent magnets 888, although other heating devices can be used.

Before entering the hot rolling zone 870, the metal strip 810 can undergo initial quenching 869 in the initial quench zone 868. In the initial quench zone 868, initial quench coolant 880 supplied by the one or more initial quench nozzles 878 can reduce a temperature of the metal strip 810 to a hot rolling temperature (e.g., at or around 350° C.) for subsequent hot rolling 870.

During the hot rolling process in the hot rolling zone 870, the metal strip 810 can be reduced in thickness due to force applied from the backup rolls 884 through the work rolls 882. To counteract mechanically-induced heat generated through hot rolling, one or more rolling coolant nozzles 896 can supply rolling coolant 898 to one or more of the metal strip 810, work rolls 882, or backup rolls 884. However, in contrast to the hot rolling system 700 of FIG. 7, the hot rolling system 800 includes intentionally undercooled rolling stands. The rolling stands are intentionally undercooled by having the rolling coolant nozzles 896 apply less rolling coolant 898 than necessary to fully counteract the mechanically-induced heat. Thus, as seen in the temperature profile 801, the temperature of the metal strip 810 can be increased above the rolling temperature as it passes through the hot rolling zone 870, such as towards, up to, or above a target heat treatment temperature. In some cases, instead of applying less rolling coolant 898, rolling coolant 898 of a different temperature or different mixture can be used to provide less heat extraction.

At the heat treatment zone 872, the metal strip 810 can be heated 873 to a heat treatment temperature (e.g., at or around 500° C. or above). The heat treatment zone 872 can include a set of rotating permanent magnets 888, although other heating devices can be used. When the hot rolling stands are intentionally undercooled, the heat treatment zone 872 can apply little or no additional heat to achieve the desired heat treatment temperature in the metal strip 810.

At the heat treatment quenching zone 874, the metal strip 810 can be quenched 875 down to a temperature below the hot rolling temperature, such as down to an output temperature (e.g., at or below 100° C.). The heat treatment quenching zone 874 can cool the metal strip 810 by supplying heat treatment quench coolant 892 from one or more heat treatment quench nozzles 890. In some cases, the initial quench coolant 880, rolling coolant 898, and heat treatment quench coolant 892 come from the same coolant source, although that need not be the case.

Figure 9:
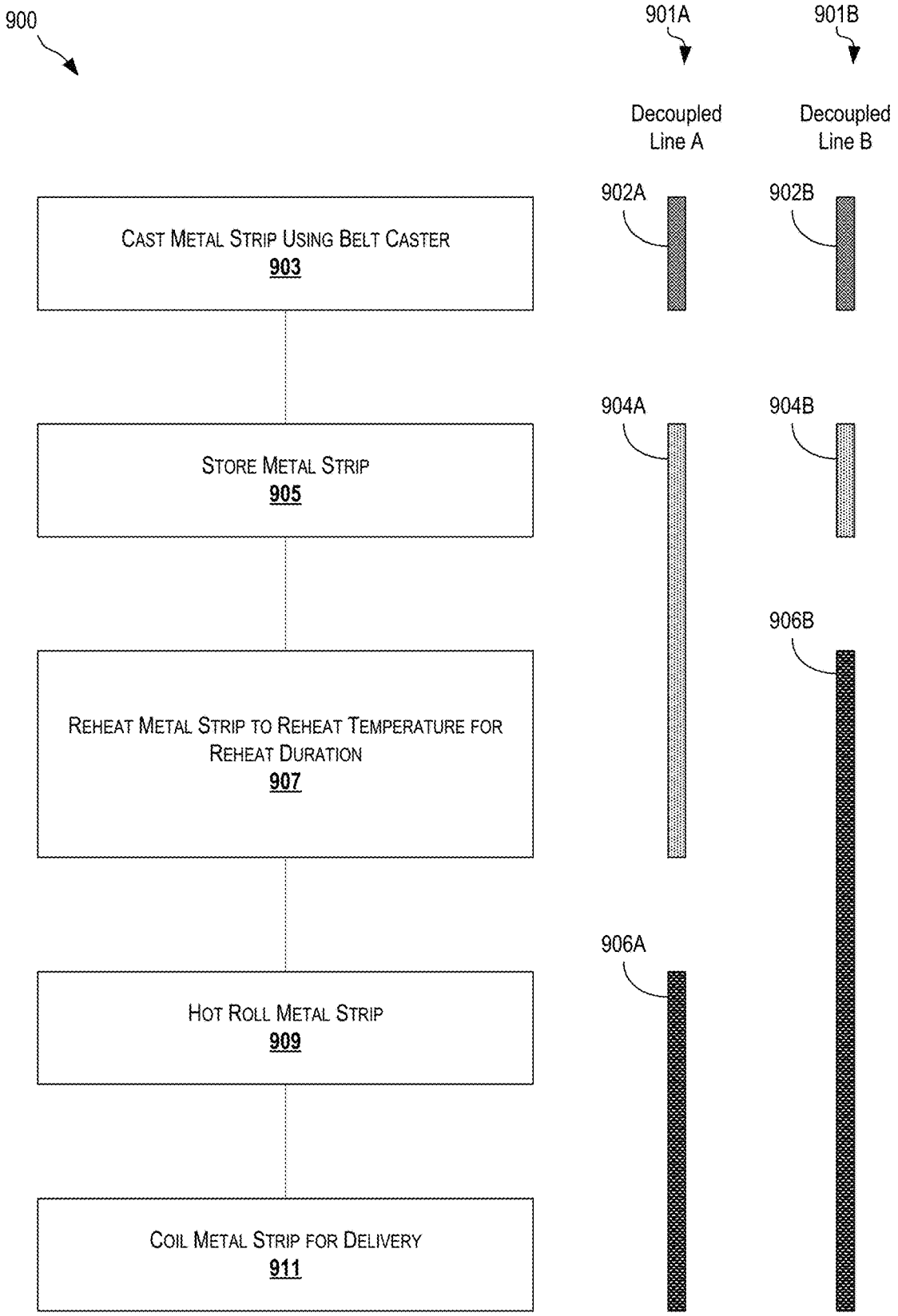
FIG. 9 is a combination flowchart and schematic diagram depicting a process for casting and rolling metal strip in association with a first variant of a decoupled system and a second variant of a decoupled system according to certain aspects of the present disclosure.

FIG. 9 is a combination flowchart and schematic diagram depicting a process 900 for casting and rolling metal strip in association with a first variant 901A of a decoupled system and a second variant 901B of a decoupled system according to certain aspects of the present disclosure. At block 903, the metal strip can be cast using a continuous casting device, such as a continuous belt caster. The metal strip can be cast at a first speed. At block 905, the metal strip can be stored, such as in the form of an intermediate coil. At block 907, the metal strip can be reheated up to or above a reheat temperature (e.g., at or about 550° C. or above). In some cases, the reheat temperature can be at or approximately 400° C.-580° C. The metal strip can be reheated for a reheat duration. In some cases, the reheat duration can be at or less than six hours, at or less than two hours, at or less than one hour, at or less than 5 minutes, or at or less than one minute. In some cases, the reheat duration can be selected to elicit a desired amount of dispersoid precipitation. At block 909, the metal strip can be hot rolled to reduce the thickness of the metal strip to a desired thickness. The metal strip can be hot rolled at a second speed that is different from the first speed. The second speed can be slower than the first speed. At optional block 911, the metal strip can be coiled for delivery.

The right portion of FIG. 9 is a schematic diagram depicting which blocks of process 900 can be performed by certain subsystems of a first variant 901A of a decoupled casting and rolling system and a second variant 901B of a decoupled casting and rolling system.

In the first variant 901A, the casting at block 903 is performed by casting system 902A. The storage of the metal strip at block 905 and the reheating of the metal strip at block 907 are performed by a storage system 904A. The hot rolling of the metal strip at block 909 and the optional coiling of the metal strip at block 911 are performed by a hot rolling system 906A.

In the second variant 901B, the casting at block 903 is performed by casting system 902B. The storage of the metal strip at block 905 is performed by a storage system 904B. The reheating of the metal strip at block 907, the hot rolling of the metal strip at block 909, and the optional coiling of the metal strip at block 911 are performed by a hot rolling system 906B.

Figure 10:
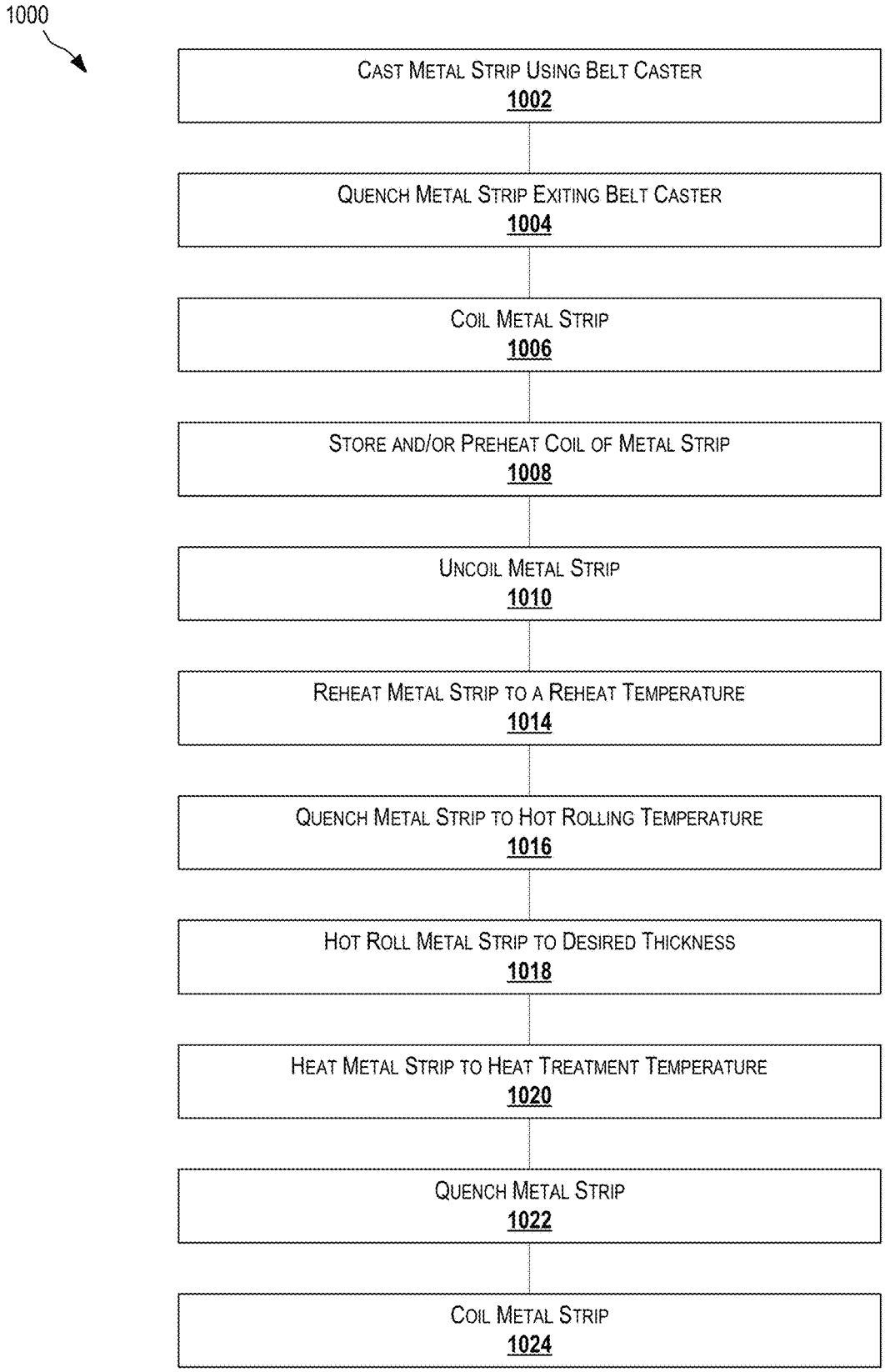
FIG. 10 is a flowchart depicting a process for casting and rolling metal strip according to certain aspects of the present disclosure.

FIG. 10 is a flowchart depicting a process 1000 for casting and rolling metal strip according to certain aspects of the present disclosure. At block 1002, a continuous casting device, such as a continuous belt caster, casts a metal strip. The metal strip can be cast at a first speed. At block 1004, the metal strip can be fast quenched (e.g., fast cooled) as it exits the continuous casting device, such as immediately as it exits the casting device or shortly thereafter. At block 1006, the metal strip can be coiled into an intermediate coil.

At block 1008, the intermediate coil can be stored. Storing the intermediate coil can optionally include storing the intermediate coil in a vertical orientation or a horizontal orientation, and optionally can include suspending the intermediate coil and/or rotating the intermediate coil. At block 1008, the intermediate coil can be optionally preheated to a preheat temperature.

At block 1010, the metal strip can be uncoiled from the intermediate coil, such as by an uncoiling device of a hot rolling system. At optional block 1014, the metal strip can be reheated to a reheat temperature. In cases where the intermediate coil is reheated to the reheat temperature at block 1008, reheating at block 1014 may be avoided.

At block 1016, the metal strip can be quenched to a hot rolling temperature. At block 1018, the metal strip can be hot rolled to a desired thickness. The metal strip can be hot rolled at a second speed that is different from the first speed. The second speed can be slower than the first speed.

At optional block 1020, the metal strip can be heated to a heat treatment temperature. Heating the metal strip to a heat treatment temperature can include fast applying heat to the metal strip immediately after the metal strip exits the hot rolling zone or shortly thereafter. Heating the metal strip to a heat treatment temperature can include fast applying heat to the metal strip for a short duration. At block 1022, the metal strip can be fast quenched. Fast quenching of the metal strip at block 1022 can stop the heat treatment of block 1020 after a desired duration. Fast quenching of the metal strip at block 1022 can bring the temperature of the metal strip down to an output temperature, such as at or around 100° C. or below. At optional block 1024, the metal strip can be coiled into a distributable coil (e.g., a finished coil). At block 1024, the metal strip has the physical and/or chemical characteristics necessary for distribution to a customer (e.g., characteristics matching a desired specification).

Figure 11:
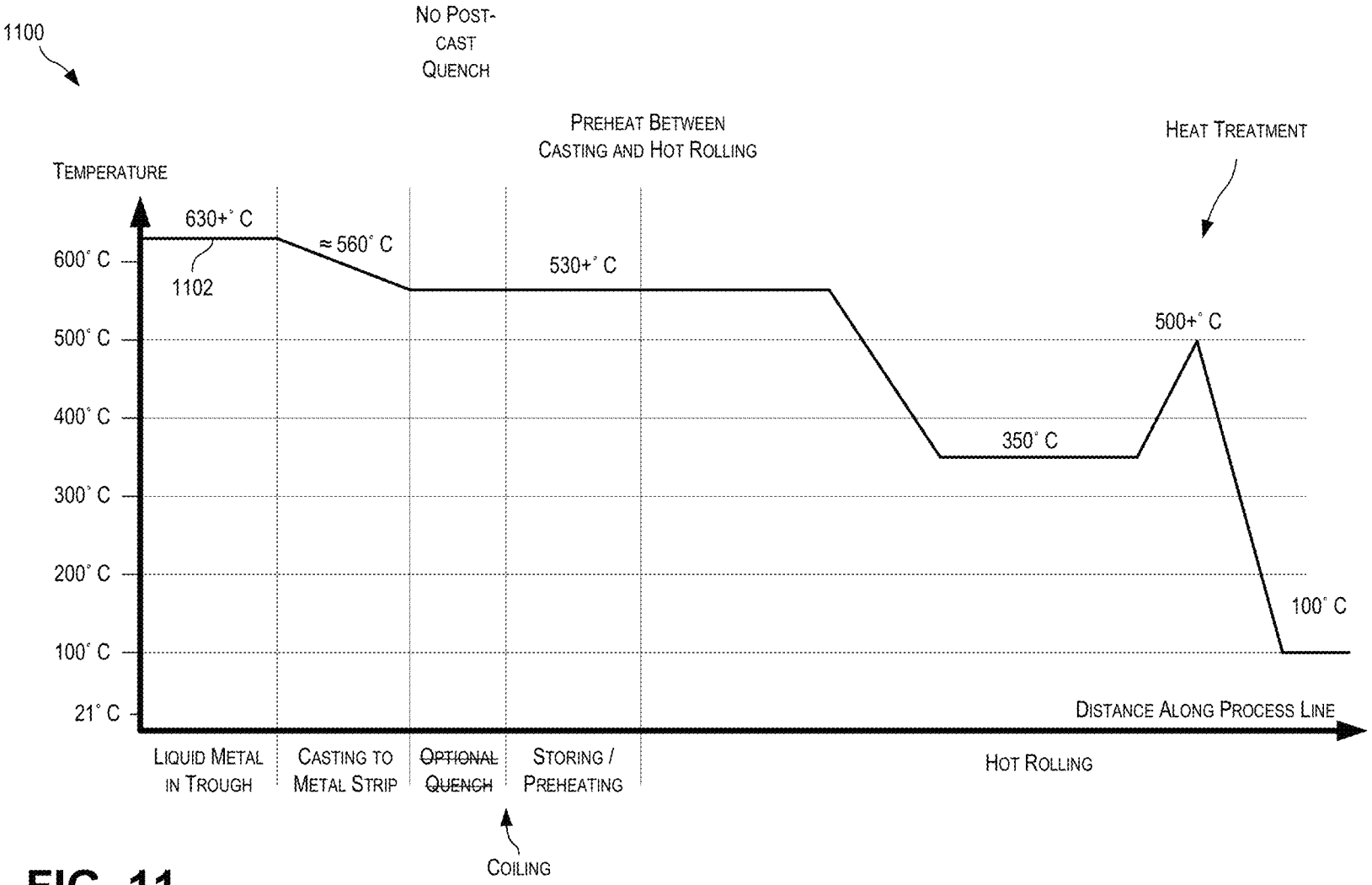
FIG. 11 is a chart depicting a temperature profile of a metal strip being cast without a post-cast quench and stored at high temperature before being rolled, according to certain aspects of the present disclosure.

FIG. 11 is a chart 1100 depicting a temperature profile of a metal strip being cast without a post-cast quench and stored at high temperature before being rolled, according to certain aspects of the present disclosure. The x axis of chart 1100 represents the distance along the decoupled continuous casting and rolling system from an upstream direction towards a downstream direction (e.g., from left to right). They axis of chart 1100 is temperature (° C.). The line 1102 of chart 1100 represents the approximate temperature of the metal as it moves along the decoupled continuous casting and rolling system. The metal strip is depicted as exiting the casting device at approximately 560° C., although in some cases the metal strip may exit the casting device at a temperature between approximately 200° C. and 560° C., including approximately 350° C. and 450° C.

When no post-cast quench is performed, the temperature of the metal strip exiting the casting device may not drop or drop only slightly before coiling. When preheating occurs between casting and hot rolling (e.g., preheating during storage), the metal strip may be maintained at an elevated temperature (e.g., at or around 530° C. or above) and may be supplied to the hot rolling system at or around that temperature. During hot rolling, the metal strip can drop in temperature to a hot rolling temperature (e.g., at or around 350° C.) for at least the duration of time in which the metal strip passes through the rolling stands of the hot rolling system. The metal strip can be fast reheated to a heat treatment temperature (e.g., at or around 500° C. or above) before being quenched down to an output temperature (e.g., at or around 100° C. or below).

Figure 12:
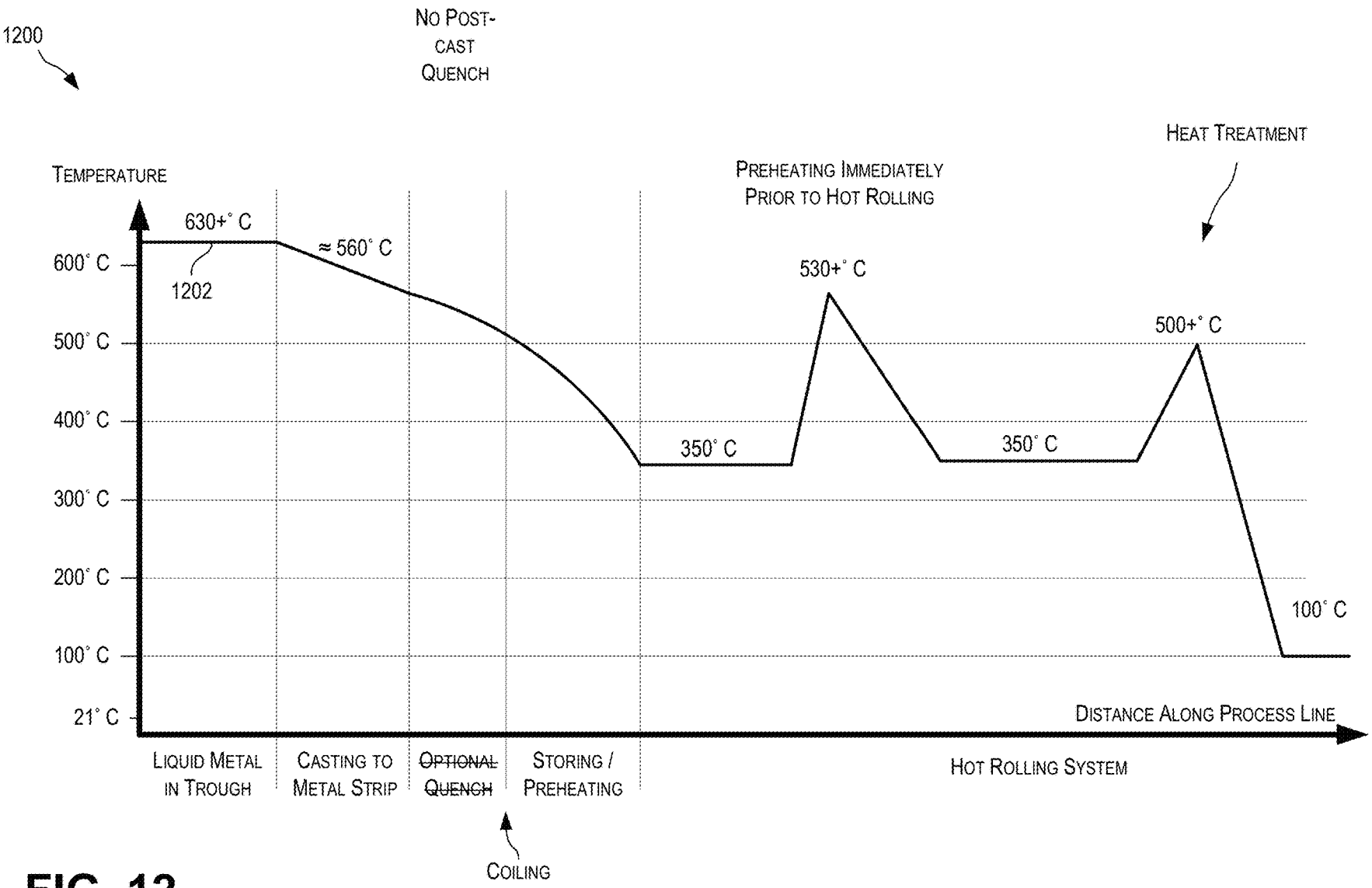
FIG. 12 is a chart depicting a temperature profile of a metal strip being cast without a post-cast quench and with preheating prior to rolling, according to certain aspects of the present disclosure.

FIG. 12 is a chart 1200 depicting a temperature profile of a metal strip being cast without a post-cast quench and with preheating prior to rolling, according to certain aspects of the present disclosure. The x axis of chart 1200 represents the distance along the decoupled continuous casting and rolling system from an upstream direction towards a downstream direction (e.g., from left to right). They axis of chart 1200 is temperature (° C.). The line 1202 of chart 1200 represents the approximate temperature of the metal as it moves along the decoupled continuous casting and rolling system. The metal strip is depicted as exiting the casting device at approximately 560° C., although in some cases the metal strip may exit the casting device at a temperature between approximately 200° C. and 560° C., including approximately 350° C. and 450° C.

When no post-cast quench is performed, the temperature of the metal strip exiting the casting device may not drop or drop only slightly before coiling. When preheating occurs inline in the hot rolling system (e.g., immediately prior to hot rolling), the metal strip may drop in temperature during storage and may enter the hot rolling system at approximately 350° C. The inline preheating performed in the hot rolling system can rapidly increase the temperature of the metal strip to a preheating temperature (e.g., at or around 530° C. or above). Shortly after reheating, the metal strip can be quenched down to a hot rolling temperature (e.g., at or around 350° C.) and maintained there for at least the duration of time in which the metal strip passes through the rolling stands of the hot rolling system. The metal strip can be fast reheated to a heat treatment temperature (e.g., at or around 500° C. or above) before being quenched down to an output temperature (e.g., at or around 100° C. or below).

Figure 13:
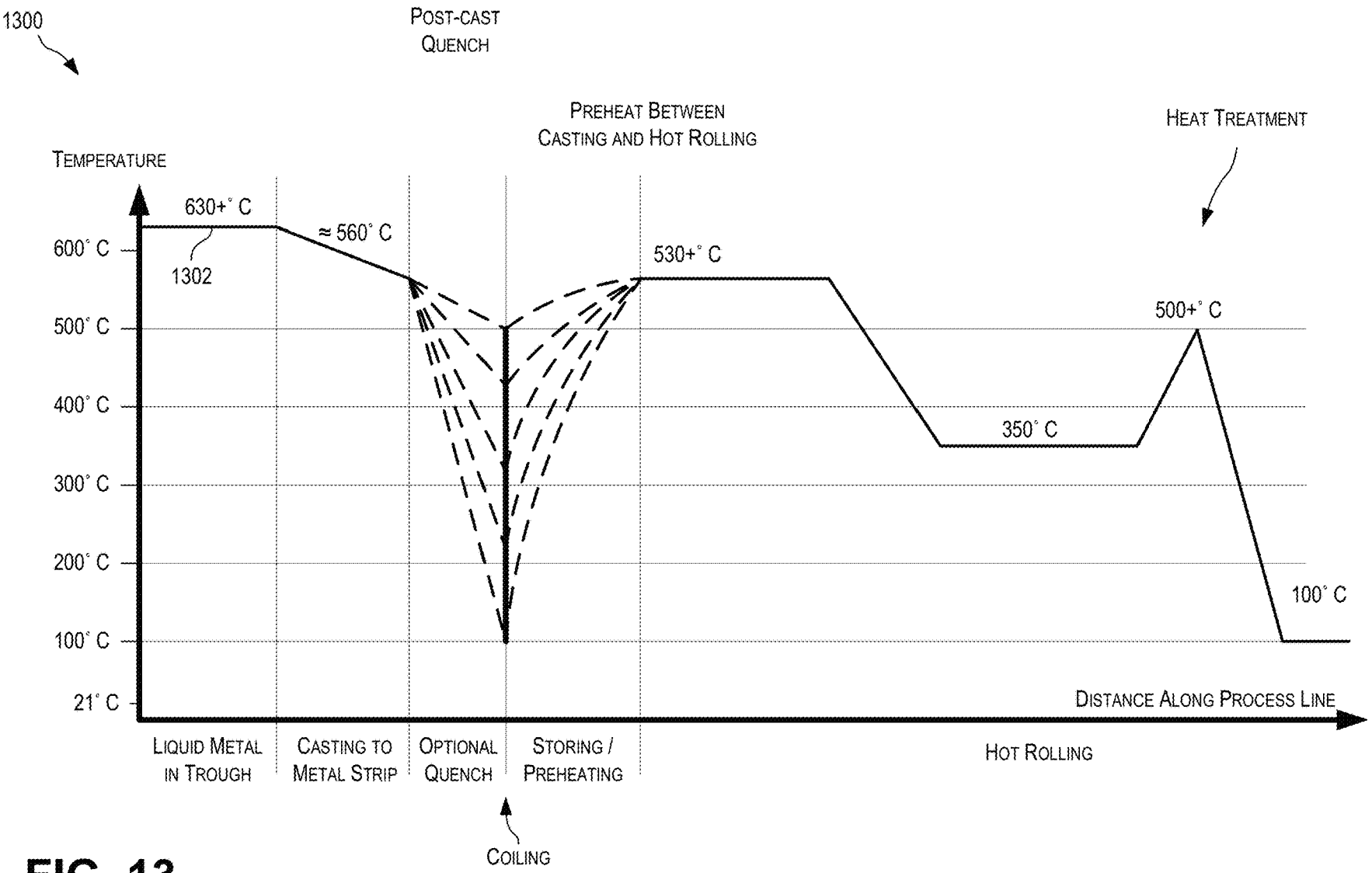
FIG. 13 is a chart depicting a temperature profile of a metal strip being cast with a post-cast quench and storing at high temperature before being rolled, according to certain aspects of the present disclosure.

FIG. 13 is a chart 1300 depicting a temperature profile of a metal strip being cast with a post-cast quench and stored at high temperature before being rolled, according to certain aspects of the present disclosure. The x axis of chart 1300 represents the distance along the decoupled continuous casting and rolling system from an upstream direction towards a downstream direction (e.g., from left to right). They axis of chart 1300 is temperature (° C.). The line 1302 of chart 1300 represents the approximate temperature of the metal as it moves along the decoupled continuous casting and rolling system. The metal strip is depicted as exiting the casting device at approximately 560° C., although in some cases the metal strip may exit the casting device at a temperature between approximately 200° C. and 560° C., including approximately 350° C. and 450° C.

When a post-cast quench is performed, the temperature of the metal strip exiting the casting device can drop fast prior to coiling. This fast quench can lower the temperature of the metal strip at or below approximately 500° C., 400° C., 300° C., 200° C., or 100° C. When preheating occurs between casting and hot rolling (e.g., preheating during storage), the metal strip may be heated to an elevated temperature (e.g., at or around 530° C. or above) and may be supplied to the hot rolling system at or around that temperature. During hot rolling, the metal strip can drop in temperature to a hot rolling temperature (e.g., at or around 350° C.) for at least the duration of time in which the metal strip passes through the rolling stands of the hot rolling system. The metal strip can be rapidly reheated to a heat treatment temperature (e.g., at or around 500° C. or above) before being quenched down to an output temperature (e.g., at or around 100° C. or below).

Figure 14:
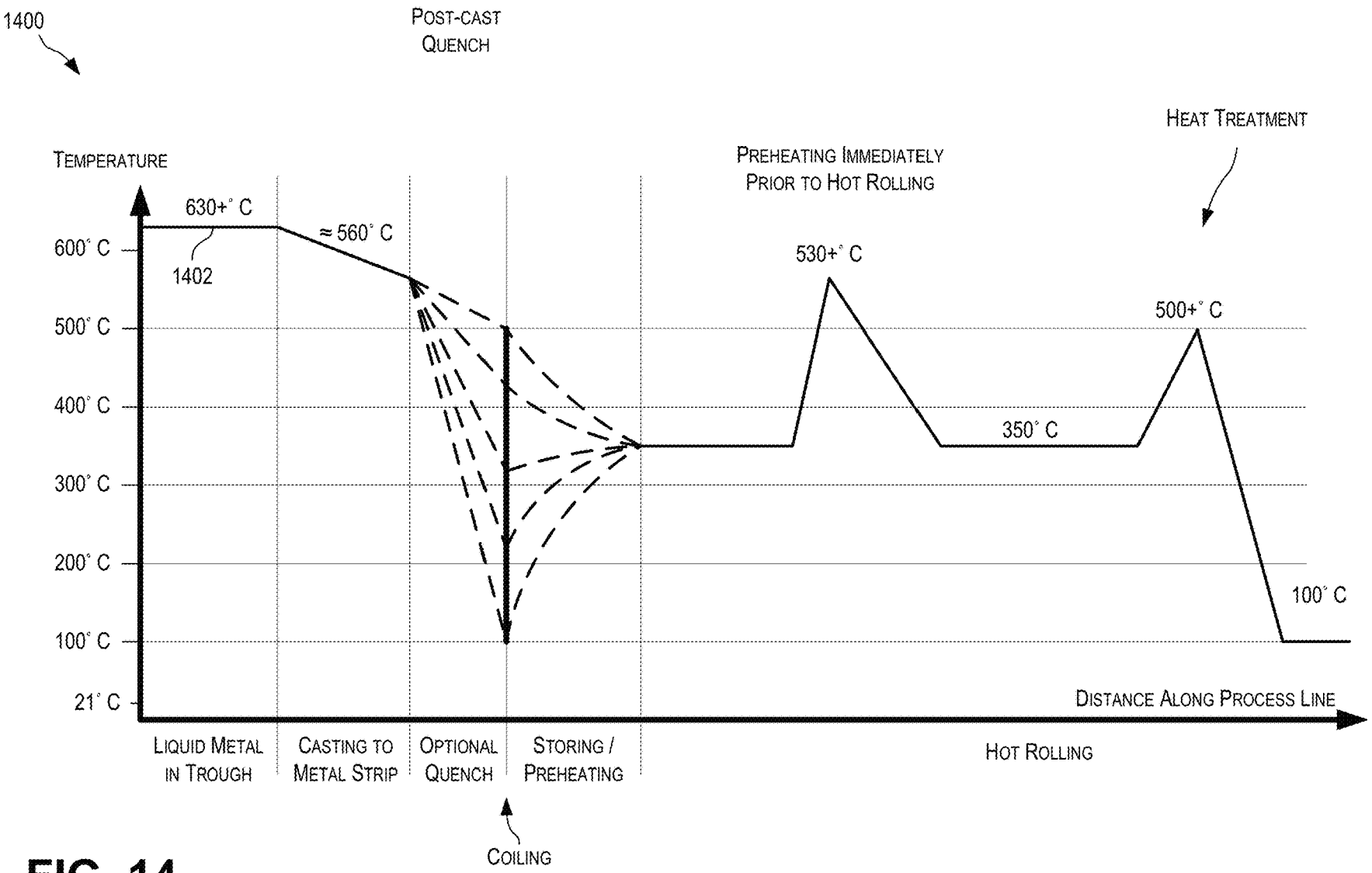
FIG. 14 is a chart depicting a temperature profile of a metal strip being cast with a post-cast quench and with preheating prior to rolling, according to certain aspects of the present disclosure.

FIG. 14 is a chart 1400 depicting a temperature profile of a metal strip being cast with a post-cast quench and preheated prior to rolling, according to certain aspects of the present disclosure. The x axis of chart 1400 represents the distance along the decoupled continuous casting and rolling system from an upstream direction towards a downstream direction (e.g., from left to right). They axis of chart 1400 is temperature (° C.). The line 1402 of chart 1400 represents the approximate temperature of the metal as it moves along the decoupled continuous casting and rolling system. The metal strip is depicted as exiting the casting device at approximately 560° C., although in some cases the metal strip may exit the casting device at a temperature between approximately 200° C. and 560° C., including approximately 350° C. and 450° C.

When a post-cast quench is performed, the temperature of the metal strip exiting the casting device can drop fast prior to coiling. This fast quench can lower the temperature of the metal strip at or below approximately 500° C., 400° C., 300° C., 200° C., or 100° C. Depending upon the temperature of the metal strip during coiling, the metal strip may drop in temperature or be heated during coiling. The metal strip may enter the hot rolling system at approximately 350° C., however in some cases it may enter the hot rolling system at temperatures below that. The inline preheating performed in the hot rolling system can quickly increase the temperature of the metal strip to a preheating temperature (e.g., at or around 530° C. or above). Shortly after reheating, the metal strip can be quenched down to a hot rolling temperature (e.g., at or around 350° C.) and maintained there for at least the duration of time in which the metal strip passes through the rolling stands of the hot rolling system. The metal strip can be fast reheated to a heat treatment temperature (e.g., at or around 500° C. or above) before being quenched down to an output temperature (e.g., at or around 100° C. or below).

Figure 15:
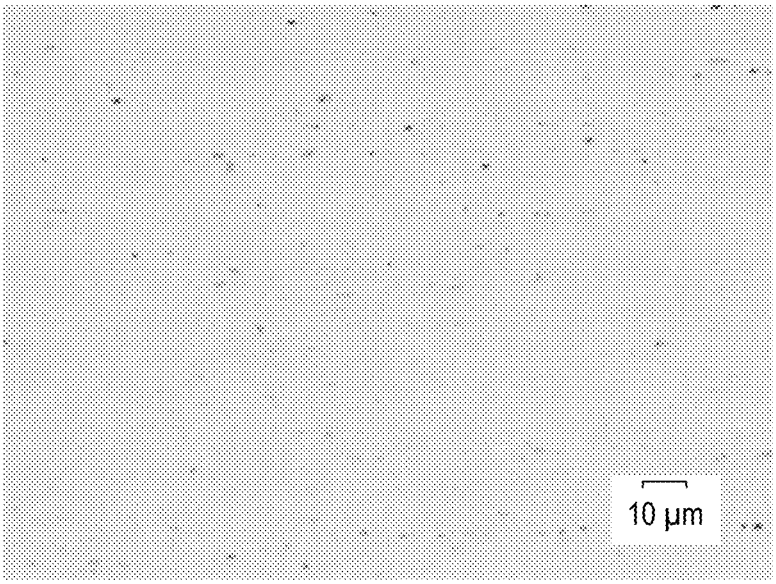
FIG. 15 is a set of magnified images depicting intermetallics in aluminum alloy AA6014 for a standard DC-cast metal strip as compared to a metal strip as cast using a decoupled casting and rolling system according to certain aspects of the present disclosure.
Figure 15:
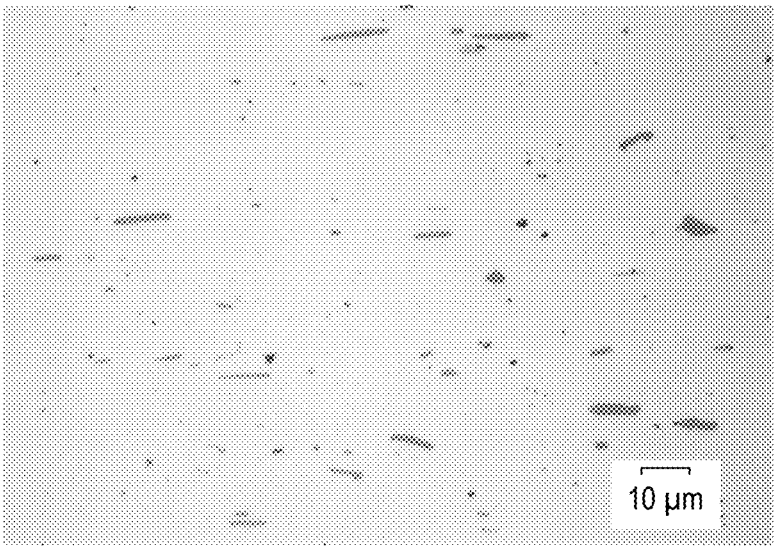

FIG. 15 is a set of magnified images depicting iron-bearing (Fe-bearing) intermetallics in aluminum alloy AA6014 for a standard DC-cast metal strip 1500 as compared to a metal strip 1501 as cast using a decoupled casting and rolling system according to certain aspects of the present disclosure. Metal strip 1500 was prepared according to standard direct chill casting techniques, including long heat treatment times (e.g., on the order of many hours or days). Metal strip 1501 was prepared according to certain aspects of the present disclosure.

When comparing the images of metal strips 1500 and 1501, the DC-cast metal strip 1500 shows many large intermetallics that are tens of microns in size, whereas the intermetallics found in metal strip 1501 are much smaller with even the largest intermetallics measuring below a few microns in length. These different arrangements of intermetallics show that the solidification in the DC-cast metal strip 1500 occurred relatively slowly compared to the solidification in metal strip 1501. In fact, the solidification of metal strip 1501 occurred at rates of about 100 times faster than the rate of solidification of the DC-cast metal strip 1500.

Figure 16:
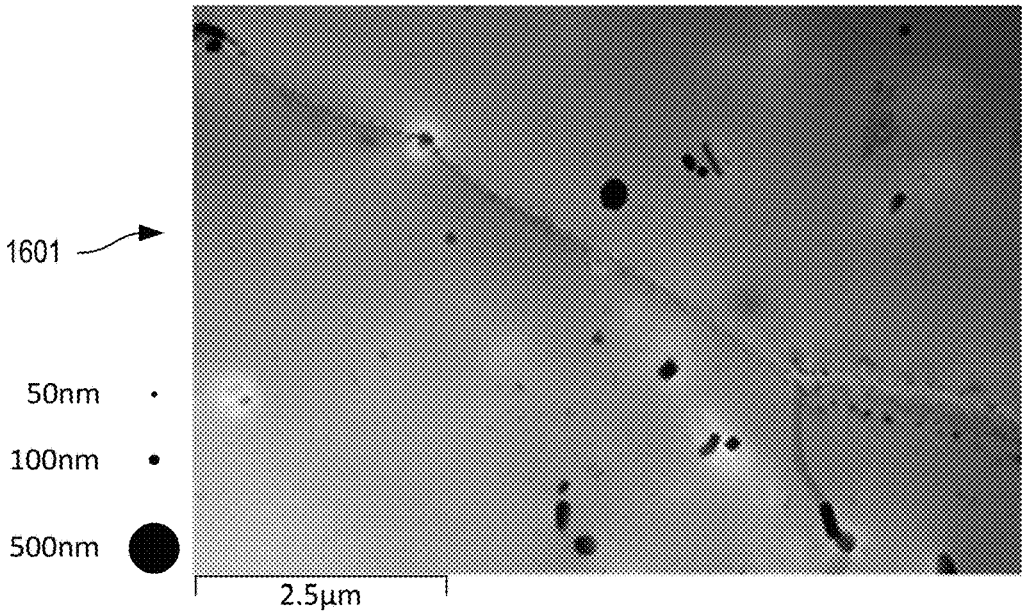
FIG. 16 is a set of scanning transmission electron micrographs depicting dispersoids in 6xxx series aluminum alloy metal strips that have been reheated for one hour at 550° C. comparing a metal strip cast without a post-cast quench and a metal strip cast with a post-cast quench according to certain aspects of the present disclosure.
Figure 16:
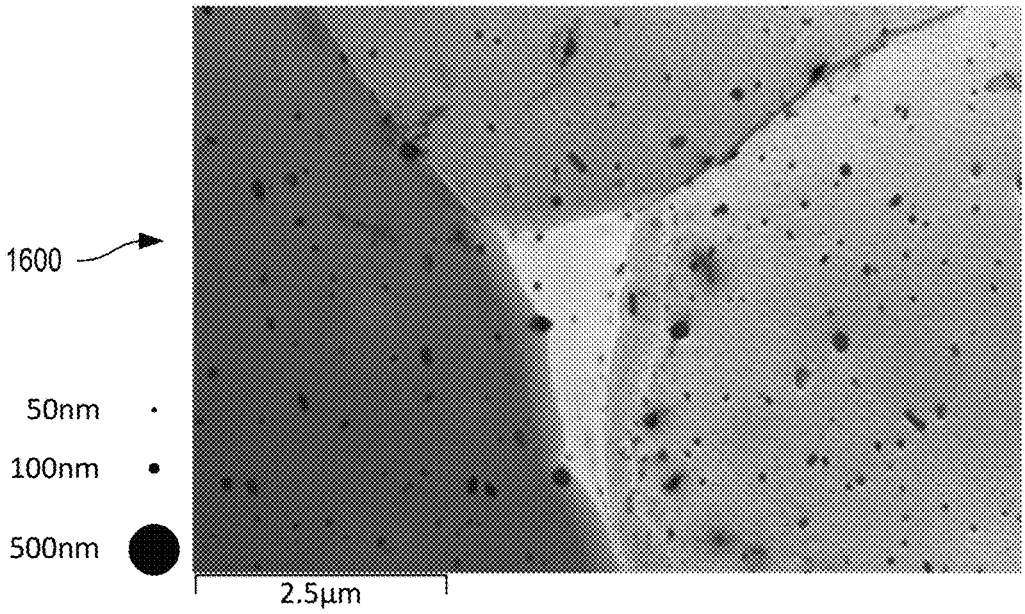

FIG. 16 is a set of scanning transmission electron micrographs depicting dispersoids in 6xxx series aluminum alloy metal strips that have been reheated for one hour at 550° C. comparing a metal strip 1601 cast without a post-cast quench and a metal strip 1600 cast with a post-cast quench according to certain aspects of the present disclosure. Each of the metal strips 1600, 1601 was prepared using a continuous casting system as described herein, such as continuous casting system 102 of FIG. 1, however, the casting system used for metal strip 1600 included a fast quenching system, such as fast quenching system 314 of FIG. 3, whereas the casting system used for metal strip 1601 did not include a fast quenching system.

Metal strip 1601 exited the continuous belt caster at approximately 450° C. and was allowed to air-cool down to approximately 100° C. over the course of three hours. Metal strip 1600 exited the continuous belt caster at approximately 450° C. and was immediately quenched down to 100° C. in approximately 10 seconds or less. Both metal strip 1601 and metal strip 1600 were reheated in a conventional resistance furnace preheated at 550° C. for one hour.

The dispersoid arrangement of metal strip 1601 shows only a few desirably sized dispersoids, with most being too large or too small. By contrast, the dispersoid arrangement of metal strip 1600 shows a well-distributed arrangement of desirably sized dispersoids. Desirably sized dispersoids may have diameters, on average, between 10 nm and 500 nm or between 10 nm and 100 nm. For reference, a 50 nm dot (e.g., midrange desirable dispersoid) and a 100 nm dot (e.g., maximum desirable dispersoid) are depicted to the left of each micrograph at the approximate scale of the micrographs.

Because of the immediate quenching after continuous casting, the precursor metal strip to metal strip 1600 (e.g., before being reheated as indicated) included many small and well-dispersed dispersoid-forming elements held in supersaturation within the aluminum matrix. This matrix supersaturated with dispersoid-forming elements is uniquely advantageous as a precursor metal capable of being reheated to produce the desirable dispersoid arrangement shown in FIG. 16. When the precursor metal strip to metal strip 1600 was reheated, dispersoids began to precipitate from the supersaturated matrix into the desired dispersoid arrangement depicted. By contrast, without the post-cast quench, the dispersoid arrangement of metal strip 1601 is not as well distributed and includes undesirably large dispersoids.

Figure 17:
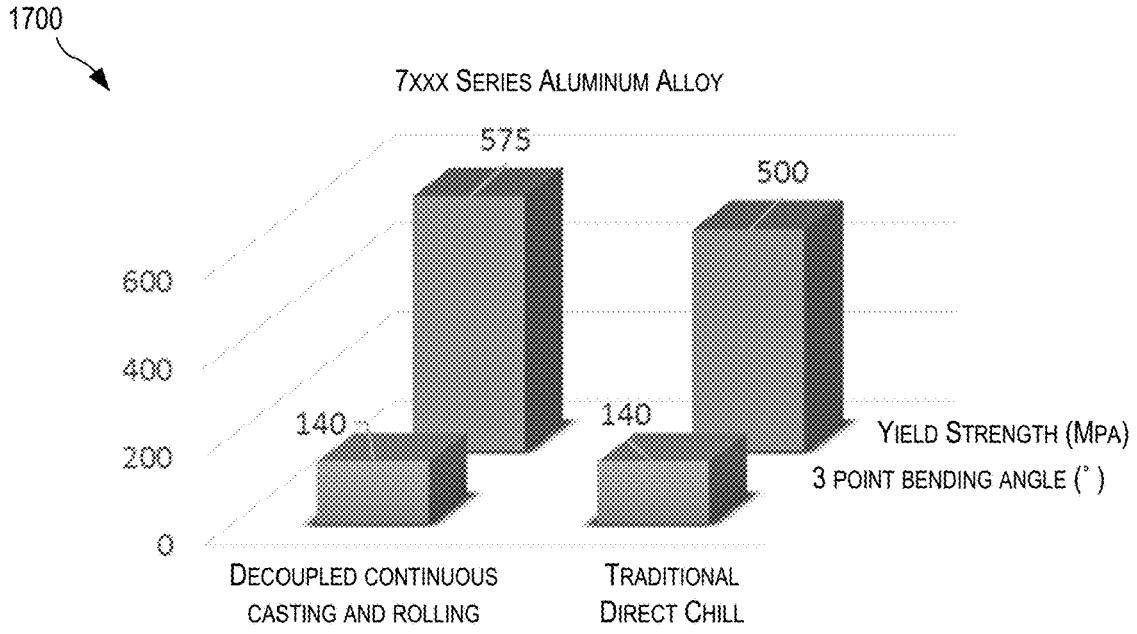
FIG. 17 is a chart comparing yield strength and three point bending test results for 7xxx series metal strips prepared using traditional direct chill techniques and using decoupled continuous casting and rolling according to certain aspects of the present disclosure.

FIG. 17 is a chart 1700 comparing yield strength and three point bending test results for 7xxx series metal strips prepared using traditional direct chill techniques and using decoupled continuous casting and rolling according to certain aspects of the present disclosure. The chart 1700 shows that the same three point bending characteristics can be achieved while simultaneously achieving much improved (e.g., 15% improved) yield strength by using the decoupled continuous casting and rolling system disclosed herein as compared to traditional direct chill casting techniques.

Figure 18:
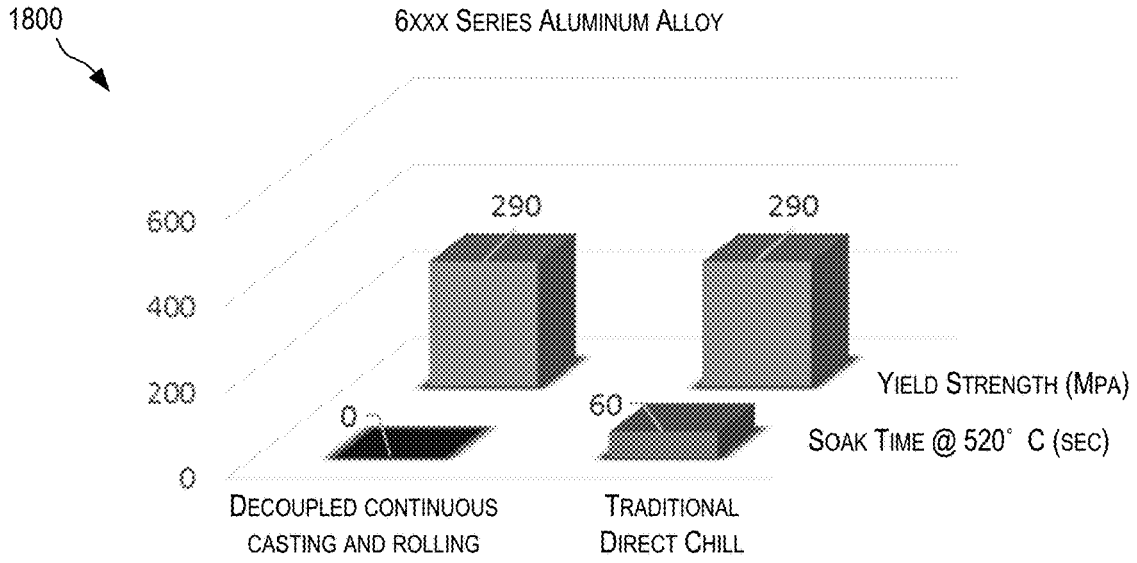
FIG. 18 is a chart comparing yield strength and solution heat treatment soak time results for 6xxx series metal strips prepared using traditional direct chill techniques and using decoupled continuous casting and rolling according to certain aspects of the present disclosure.

FIG. 18 is a chart 1800 comparing yield strength and solution heat treatment soak time results for 6xxx series metal strips prepared using traditional direct chill techniques and using decoupled continuous casting and rolling according to certain aspects of the present disclosure. The chart 1800 shows that desired yield strength characteristics (e.g., at or around 290 MPa) normally require at least 60 seconds of soak time at a solutionizing temperature (e.g., at or around 520° C.) for metal cast using traditional direct chill techniques. However, for metal cast using the decoupled continuous casting and rolling system disclosed herein, the desired yield strength characteristics are able to be achieved with a zero second soak time at the solutionizing temperature.

Traditional DC casting techniques require this 60 second soak time to put various strengthening particles back into solution. However, because of the desirable arrangement of particles in metal cast according to various aspects of the present disclosure, desired strength can be achieved by simply heating the metal strip to a solutionizing temperature without needing to keep the metal at that temperature for more than a few seconds, one second, or even 0.5 seconds.

This huge savings in soak time is especially important when solution heat treatment is desired to be performed inline with a hot rolling mill. Because the metal strip can be moving at speeds around 300 m/min up to 800 m/min or more at the exit of the hot rolling stands, the amount of processing line necessary to provide a 60 second soak to a DC-cast metal strip can be in excess of 300-800 meters. By contrast, the amount of processing line needed to provide the desired soaking time for a metal strip prepared according to various embodiments of the present disclosure can be negligible. This distance can be practically zero or as low as the minimum distance necessary between a heating device (e.g., rotating magnetic heaters) and a quenching device directly downstream thereof.

Figure 19:
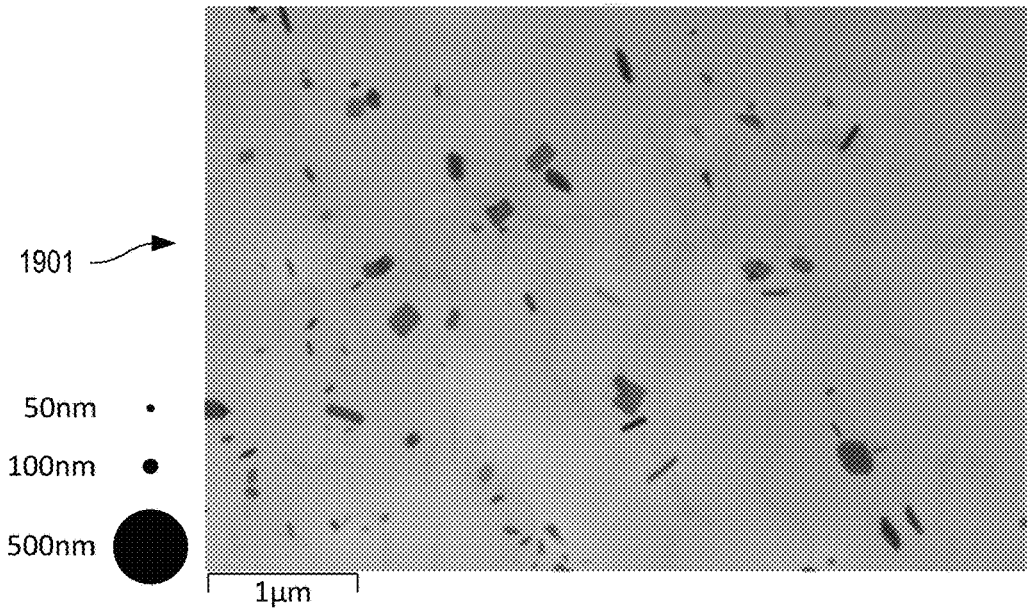
FIG. 19 is a set of scanning transmission electron micrographs depicting dispersoids in AA6111 aluminum alloy metal strips that have been reheated for eight hours at 550° C. comparing a metal strip cast without a post-cast quench and a metal strip cast with a post-cast quench according to certain aspects of the present disclosure.
Figure 19:
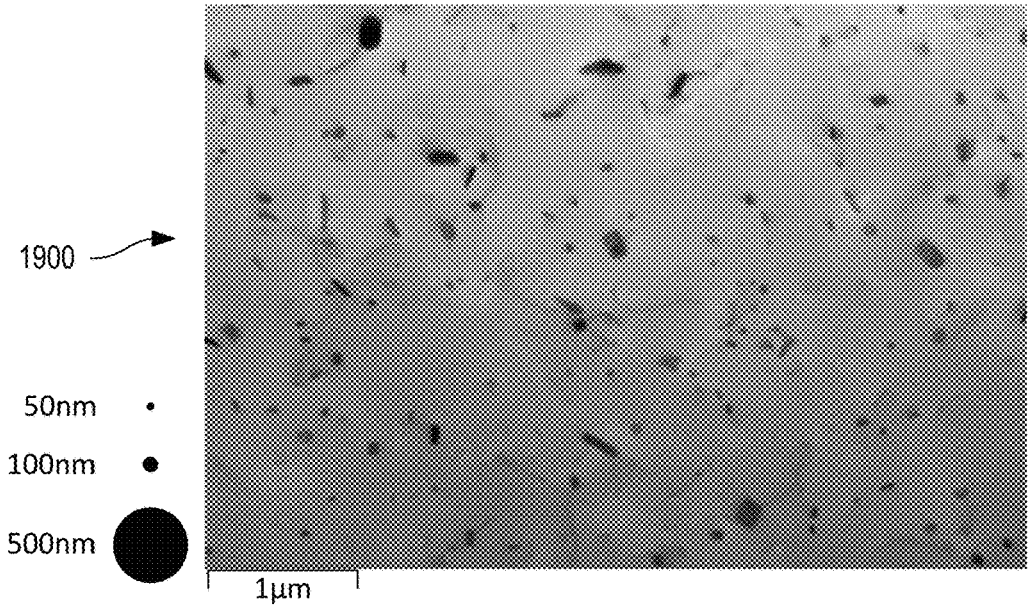

FIG. 19 is a set of scanning transmission electron micrographs depicting dispersoids in AA6111 aluminum alloy metal strips that have been reheated for eight hours at 550° C. comparing a metal strip 1901 cast without a post-cast quench and a metal strip 1900 cast with a post-cast quench according to certain aspects of the present disclosure. Each of the metal strips 1900, 1901 was prepared using a continuous casting system as described herein, such as continuous casting system 102 of FIG. 1, however, the casting system used for metal strip 1900 included a fast quenching system, such as fast quenching system 314 of FIG. 3, whereas the casting system used for metal strip 1901 did not include a fast quenching system.

Metal strip 1901 exited the continuous belt caster at approximately 450° C. and was allowed to air-cool down to approximately 100° C. over the course of three hours. Metal strip 1900 exited the continuous belt caster at approximately 450° C. and was immediately quenched down (e.g., to 100° C. in approximately 10 seconds or less). Both metal strip 1901 and 1900 were slowly reheated at a rate of 50° C./hour up to 540° C. and held at 540° C. for eight hours.

The dispersoid arrangement of metal strip 1901 shows coarse dispersoids and only a few desirably sized dispersoids. By contrast, the dispersoid arrangement of metal strip 1900 shows a well-distributed arrangement of many desirably sized dispersoids. Desirably sized dispersoids may have diameters, on average, between 10 nm and 500 nm or between 10 nm and 100 nm. For reference, a 50 nm dot (e.g., midrange desirable dispersoid), a 100 nm dot, and a 500 nm dot are depicted to the left of each micrograph at the approximate scale of the micrographs.

Because of the immediate quenching after continuous casting, the precursor metal strip to metal strip 1900 (e.g., before being reheated as indicated) included many small and well-dispersed dispersoid-forming elements held in supersaturation within the aluminum matrix. This matrix supersaturated with dispersoid-forming elements is uniquely advantageous as a precursor metal capable of being reheated to produce the desirable dispersoid arrangement shown in FIG. 19. When the precursor metal strip to metal strip 1900 was reheated, dispersoids began to precipitate from the supersaturated matrix into the desired dispersoid arrangement depicted. By contrast, without the post-cast quench, the dispersoid arrangement of metal strip 1901 is not as well distributed and includes fewer and coarser dispersoids.

Figure 20:
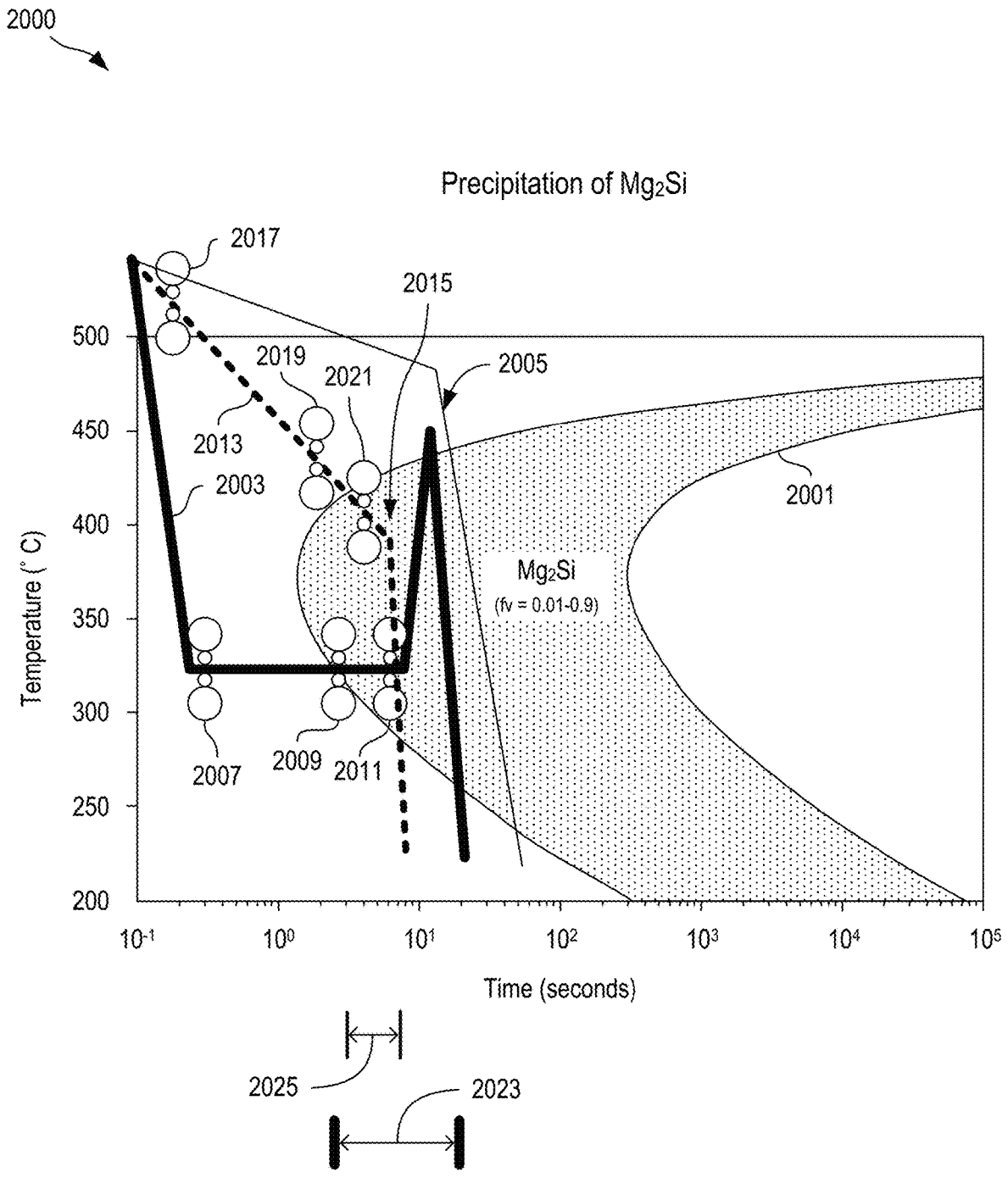
FIG. 20 is a chart depicting the precipitation of $Mg_2Si$ of an aluminum metal strip during hot rolling and quenching according to certain aspects of the present disclosure.

FIG. 20 is a chart 2000 depicting the precipitation of $Mg_2Si$ of an aluminum metal strip during hot rolling and quenching according to certain aspects of the present disclosure. The chart 2000 depicts expected precipitation of $Mg_2Si$ according to the time spent at certain temperatures for an aluminum alloy, such as a 6xxx series aluminum alloy. A zone of high precipitation 2001 is shown. The boundaries of the zone of high precipitation 2001 denotes expected precipitation of $Mg_2Si$ between 1% and 90% (e.g., between a volume fraction of 0.01 and 0.9). Thus, when a line crosses the left edge of the zone of high precipitation 2001, the metal following that line is expected to have approximately 1% precipitation of $Mg_2Si$, which will grow until the line crosses the right edge of the zone of high precipitation 2001, at which point the metal following that line is expected to have at least 90% precipitation of $Mg_2Si$. For example, a metal held at approximately 400° C. will be expected to have approximately 1% or less precipitation of $Mg_2Si$ for up to approximately 1.7 seconds, and if kept at that temperature for 407 seconds, would be expected to have at least 90% precipitation of $Mg_2Si$. Within zone of high precipitation 2001, the precipitation of $Mg_2Si$ occurs rapidly, quickly moving from 1% to 90% precipitation. Therefore, in some cases, it can be desirable to minimize the amount of time the metal strip spends within the zone of high precipitation 2001. In some cases, it can be desirable to exit the zone of high precipitation 2001 after a specific amount of time calculated to achieve a desired volume fraction of precipitation of $Mg_2Si$ or any other precipitate.

Line 2003 depicts the temperature of a metal strip immediately before, during, and after hot rolling, including quenching, in which the metal strip is preheated and cooled prior to hot rolling, rolled at a hot rolling temperature that is below the recrystallization temperature, then heated after hot rolling and finally quenched. Line 2003 can follow the temperature of a metal strip such as metal strip 710 of FIG. 7 as it passes through the initial quench zone 768, the hot rolling zone 770, the heat treatment zone 772, and the heat treatment quenching zone 774.

Line 2003 shows an initial drop in temperature down to a hot rolling temperature. The metal strip remains at the hot rolling temperature throughout the hot rolling process, which can include passing through a first rolling stand 2007, a second rolling stand 2009, and a third rolling stand 2011. It is noted that line 2003 is within the zone of high precipitation 2001 of $Mg_2Si$ when the metal strip passes through the second rolling stand 2009 and the third rolling stand 2011. Line 2003 can show the metal strip being heat treated after hot rolling, then quenched. Point 2005 depicts when quenching begins.

Line 2003 enters the zone of high precipitation 2001 at approximately 2.5 seconds and exits the zone of high precipitation 2001 at approximately 19.2 seconds, thus spending approximately 16.7 seconds within the zone of high precipitation 2001. In some cases, line 2003 briefly exits the zone of high precipitation 2001 near the end of heat treatment as the temperature rises above the left-most edge of the zone of high precipitation 2001 before quickly dropping in temperature as quenching begins.

Line 2013 depicts the temperature of a metal strip immediately before, during, and after hot rolling, including quenching, in which the metal temperature is gradually cooled during hot rolling before being finally quenched. Line 2013 can follow the temperature of a metal strip such as metal strip 2110 of FIG. 21, below, as it passes through the hot rolling zone 2170 and the heat treatment quenching zone 2174.

Line 2013 shows little or no initial quenching prior to hot rolling. Rather, the metal strip is allowed to drop during hot rolling from a hot rolling entry temperature that is above a recrystallization temperature (e.g., a preheat temperature, such as at or above 530° C.) to a hot rolling exit temperature that is below the hot rolling entry temperature. To effect the temperature decrease during hot rolling that is depicted in line 2013, each stand of the hot rolling mill can extract heat from the metal strip. Instead of relying on post-rolling (e.g., after hot rolling) recrystallization during a heat treatment process, the metal strip can undergo dynamic recrystallization during the hot rolling process. Line 2013 can follow a monotonically decreasing path from immediately prior to the first hot rolling stand to immediately following the quenching process.

It can be desirable to control the precipitation of precipitates, such as $Mg_2Si$. In some cases, the amount of precipitation can be minimized or controlled to a preset, desired amount. For example, when desiring to minimize precipitation, the amount of time spent within the zone of high precipitation 2001 can be minimized. To minimize the amount of time spent within the zone of high precipitation 2001, the metal strip can exit the final hot rolling stand at a hot rolling exit temperature and can thereafter be quickly quenched to a temperature below that which substantial precipitation is expected (e.g., to a temperature below the zone of high precipitation 2001 for that particular timeframe). Thus, it can be desirable to minimize the hot rolling exit temperature and/or to maximize the rate of cooling during quenching. As described herein, it can be desirable to maximize the amount of reduction (e.g., percentage thickness reduction) of the final hot rolling stand (e.g., third hot rolling stand 2021) or at least select an amount of reduction suitable to achieve a hot rolling exit temperature suitable for rapid quenching to minimize time spent within the zone of high precipitation 2001. For example, in some cases, the amount of reduction performed at each of a first hot rolling stand 2017, a second hot rolling stand 2019, and a third hot rolling stand 2021 can be 50% reduction (e.g., from 16 mm to 8 mm, then from 8 mm to 4 mm, then from 4 mm to 2 mm). In some cases, the amount of reduction performed at the third hot rolling stand 2021 can be greater than 40%, 45%, 50%, 55%, 60%, 65%, or 70%.

The hot rolling exit temperature can be any suitable temperature. In some cases, it can be desirable to remove substantial amounts of heat during the hot rolling process such that the metal exits the final hot rolling stand at a hot rolling exit temperature at or below approximately 450° C., 445° C., 440° C., 435° C., 430° C., 425° C., 420° C., 415° C., 410° C., 405° C., 400° C., 395° C., 390° C., 385° C., 380° C., 375° C., 370° C., 365° C., 360° C., 355° C., 350° C., 345° C., 340° C., 335° C., 330° C., 325° C., 320° C., 315° C., 310° C., 305° C., or 300° C. In some cases, it can be desirable for the hot rolling exit temperature to be between approximately 375° C. and 405° C., 380° C. and 400° C., 385° C. and 395° C., or approximately 390° C. By entering the first hot rolling stand 2017 at a temperature above the recrystallization temperature and reducing the temperature as the metal strip passes through the second hot rolling stand 2019 and the third hot rolling stand 2021, down to a hot rolling exit temperature, dynamic recrystallization can take place within the metal strip during the hot rolling process. Other numbers of rolling stands can be used.

As depicted in chart 2000, line 2013 enters the zone of high precipitation 2001 at approximately 3.1 seconds and exits the zone of high precipitation 2001 at approximately 7.4 seconds, thus spending approximately 4.3 seconds within the zone of high precipitation 2001. Thus, the duration within the zone of high precipitation 2001 of line 2013 can be approximately 25% of the duration within the zone of high precipitation 2001 of line 2003. This difference in duration can substantially affect the amount of precipitation of $Mg_2Si$ or other precipitates. While chart 2000 depicts precipitation of $Mg_2Si$, similar charts exist for other precipitates and similar principles can apply.

Figure 21:
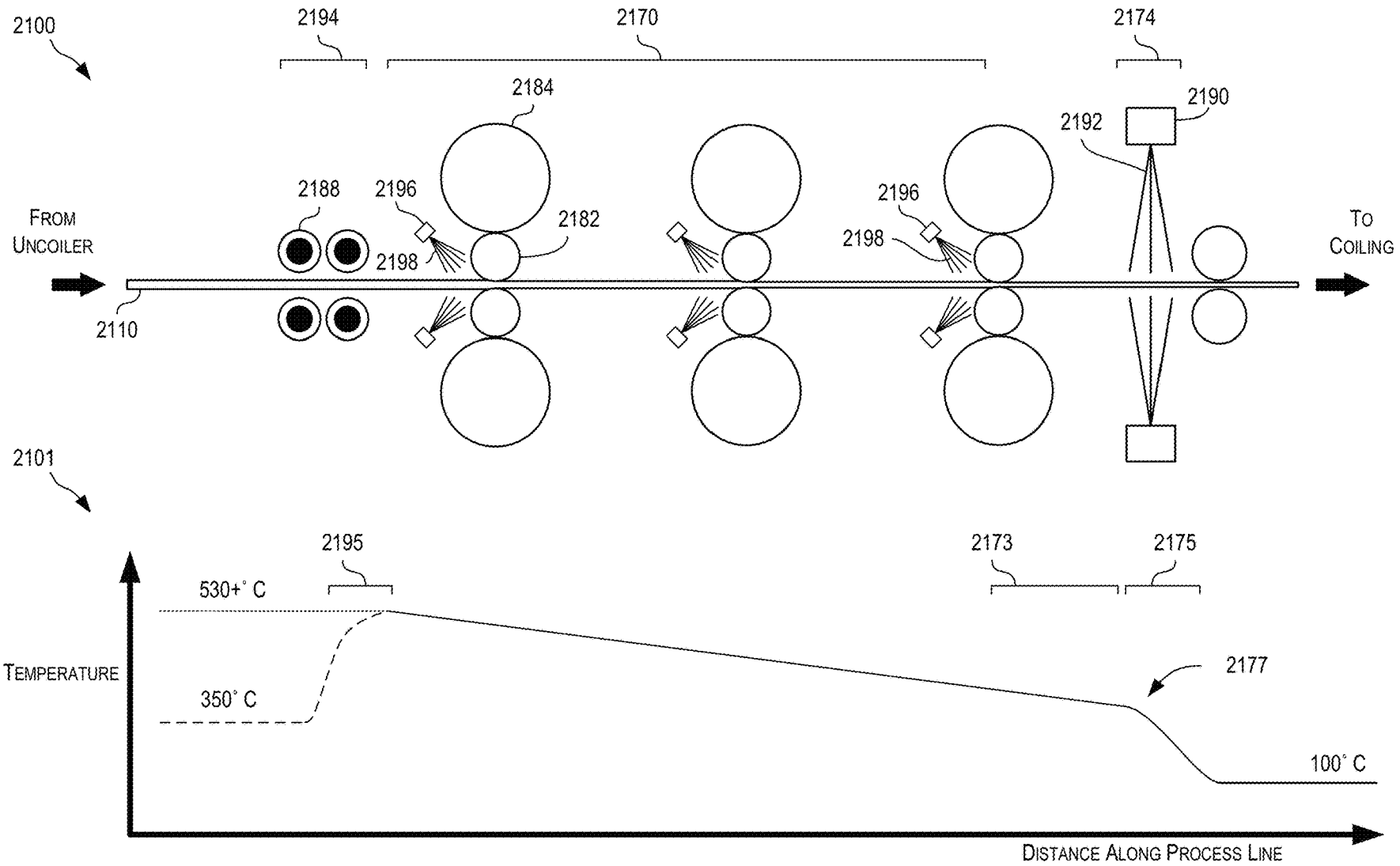
FIG. 21 is a combination schematic diagram and chart depicting a hot rolling system and the associated temperature profile of the metal strip being rolled thereon according to certain aspects of the present disclosure.

FIG. 21 is a combination schematic diagram and chart depicting a hot rolling system 2100 and the associated temperature profile 2101 of the metal strip 2110 being rolled thereon according to certain aspects of the present disclosure. The hot rolling system 2100 can be hot rolling system 106 from FIG. 1 and can be operated based on the principles outline with respect to line 2013 of FIG. 20.

Hot rolling system 2100 includes, from upstream uncoiling to downstream coiling, an optional preheat zone 2194, a hot rolling zone 2170, and a quenching zone 2174. The temperature profile 2101 shows that the metal strip 2110 may enter the hot rolling system 2100 at either a standard temperature (e.g., 350° C. as shown in dashed line) or a preheated temperature (e.g., 530+° C. as shown in dotted line). When entering at a preheated temperature, the preheat zone 2194 may apply little or no additional heat to the metal strip 2110. However, when entering at any temperature below a desired preheat temperature (e.g., at or above 530° C.), one or more heating devices in the preheat zone 2194 may apply heat to the metal strip 2110 to raise the temperature of the metal strip to or above the desired preheat temperature. Preheating 2195 of the metal strip 2110 can improve dispersoid arrangement in the metal strip 2110, as disclosed herein. In some cases, the preheat zone 2194 can include one or more sets of rotating permanent magnets 2188, although other heating devices can be used.

Before entering the hot rolling zone 2170, the metal strip 2110 undergoes little or no initial quenching. Therefore, the metal strip 2110 can have an elevated temperature (e.g., at or greater than approximately 530° C.) when entering the hot rolling zone 2170.

During the hot rolling process in the hot rolling zone 2170, the metal strip 2110 can be reduced in thickness due to force applied from the backup rolls 2184 through the work rolls 2182. To counteract mechanically-induced heat generated through hot rolling and to provide a cooling effect to the metal strip 2110, one or more rolling coolant nozzles 2196 can supply rolling coolant 2198 to one or more of the metal strip 2110, work rolls 2182, or backup rolls 2184. Coolant 2198 can be any suitable coolant, such as lubricating oil, air, water, or a mixture thereof. Thus, as seen in the temperature profile 2101, the temperature of the metal strip 2110 can be monotonically decreased throughout the hot rolling zone 2170 from a hot rolling entry temperature (e.g., at or above approximately 530° C.) to a hot rolling exit temperature that is below the hot rolling entry temperature (e.g., at or approximately 400° C.). In some cases, it can be desirable to minimize the hot rolling exit temperature while ensuring dynamic recrystallization occurs. This minimization can be accomplished by keeping a high rate of strain at the final rolling stand, such as through relatively high speed rolling with relatively high reduction of thickness.

The metal strip 2110 can be quenched immediately after exiting the hot rolling zone 2170 (e.g., without being reheated). At the quenching zone 2174, the metal strip 2110 can be quenched 2175 down to a temperature below the hot rolling exit temperature, such as down to an output temperature (e.g., at or below 100° C.). The heat treatment quenching zone 2174 can cool the metal strip 2110 by supplying quench coolant 2192 from one or more quench nozzles 2190. In some cases, the rolling coolant 2198 and the quench coolant 2192 come from the same coolant source, although that need not be the case.

Figure 22:
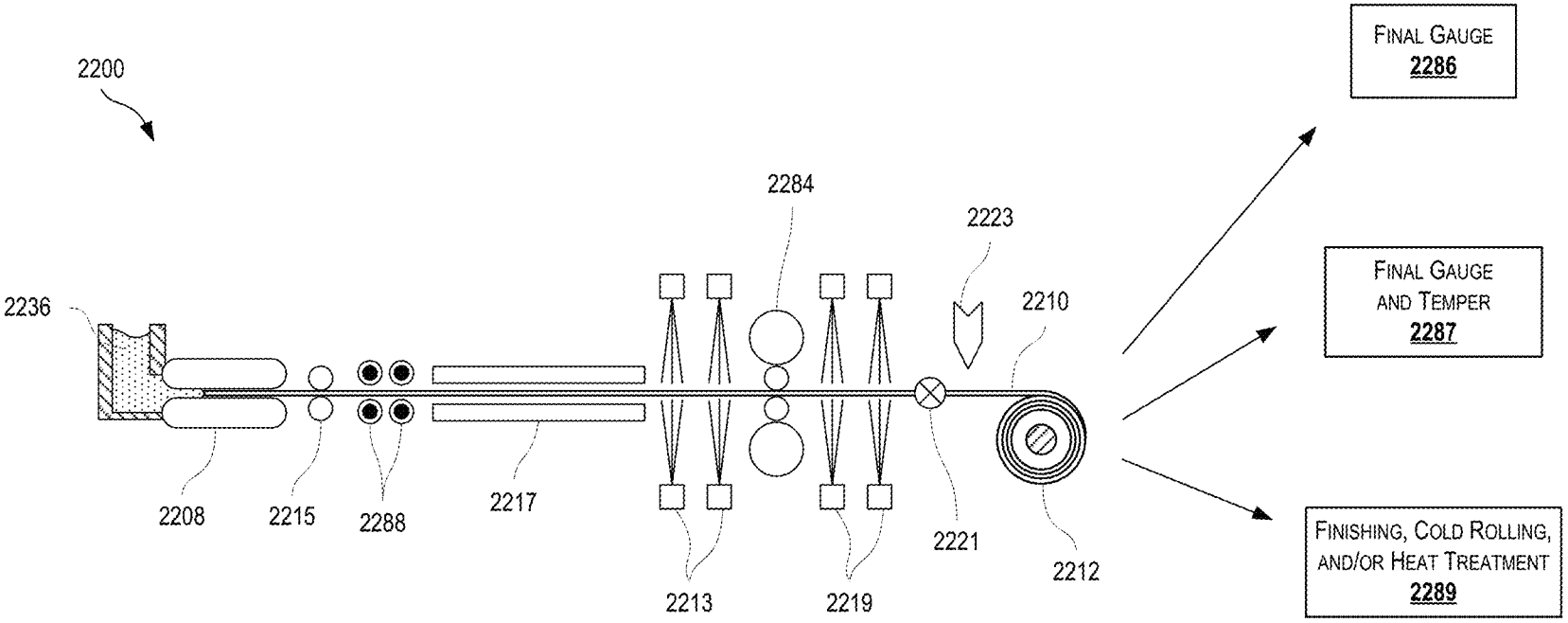
FIG. 22 is a schematic diagram depicting a hot band continuous casting system according to certain aspects of the present disclosure.

FIG. 22 is a schematic diagram depicting a hot band continuous casting system 2200 according to certain aspects of the present disclosure. The hot band continuous casting system 2200 can be a partially decoupled continuous casting system that is similar to the decoupled continuous casting system 300 of FIG. 3, with several inline additions to improve certain metallurgical characteristics. The hot band continuous casting system 2200 can produce a coiled hot band 2212 that is optionally at final gauge and optionally at final temper. In some cases, the hot band 2212 can be used as an intermediate coil and subjected to further processing as described herein. In some cases, however, the hot band 2212 can be a final product itself, at a desired gauge and, optionally, temper.

The hot band continuous casting system 2200 includes a continuous casting device, such as a continuous twin belt caster 2208, although other continuous casting devices can be used, such as twin roll casters. The continuous belt caster 2208 includes opposing belts capable of extracting heat from liquid metal 2236 at a cooling rate sufficient to solidify the liquid metal 2236, which once solid passes out of the continuous belt caster 2208 as a metal strip 2210. The thickness of the metal strip 2210 as it exits the continuous belt caster 2208 can be at or less than 50 mm, although other thicknesses can be used. The continuous belt caster 2208 can operate at a desired casting speed. The opposing belts can be made of any suitable material, however in some cases the belts are made from copper. Cooling systems within the continuous belt caster 2208 can extract sufficient heat from the liquid metal 2236 such that the metal strip 2210 exiting the continuous belt caster 2208 has a temperature between 200° C. to 530° C., although other ranges can be used. In some cases, the temperature (e.g., peak metal temperature) exiting the continuous belt caster 2208 can be at or approximately 350° C.-450° C.

In some cases, an optional soaking furnace 2217 (e.g., a tunnel furnace) can be positioned downstream of the continuous belt caster 2208 near the exit of the continuous belt caster 2208. The use of a soaking furnace 2217 can facilitate achieving a uniform temperature profile across the lateral width of the metal strip 2210. Additionally, the soaking furnace 2217 can flash homogenize the metal strip 2210, which can prepare the metal strip 2210 for improved breakup of iron constituents during hot or warm rolling. In some cases, an optional pinch roll 2215 can be positioned between the continuous belt caster 2208 and the soaking furnace 2217. In some cases, an optional set of magnetic heaters 2288 (e.g., magnetic rotors or magnets rotating about an axis of rotation) can be positioned between the continuous belt caster 2208 or the pinch roll 2215 and the soaking furnace 2217. The magnetic heaters 2288 can increase the temperature of the metal strip 2210 to at or approximately the temperature of the soaking furnace 2217, which can be approximately 570° C. (e.g., 500-570° C., 520-560° C., or at or approximately 560° C. or 570° C.). The soaking furnace 2217 can be of sufficient length to allow the metal strip 2210 to pass through the soaking furnace 2217 in at or approximately 1 minutes to 10 minutes, or more preferably at or between 1 minutes and 3 minutes, or more preferably at or approximately 2 minutes, while moving at the exit speed of the continuous belt caster 2208.

In some cases, a rolling stand 2284 can be positioned downstream of the soaking furnace 2217 and upstream of a coiling apparatus. The rolling stand 2284 can be a hot rolling stand or a warm rolling stand. In some cases, warm rolling occurs at temperatures at or below 400° C. but above a cold rolling temperature, and hot rolling occurs at temperatures above 400° C. but below a melting temperature. The rolling stand 2284 can reduce the thickness of the metal strip 2210 by at least 30%, or more preferably between 50% and 75%. A post-rolling quench 2219 can reduce the temperature of the metal strip 2210 after it exits the rolling stand 2284. The post-rolling quench 2219 can impart beneficial metallurgical characteristics such as those related to dispersoid formation as described with reference to FIG. 3. In some cases, more than one rolling stand 2284 can be used, such as two, three, or more, however that need not be the case.

In some cases, an optional pre-rolling quench 2213 can reduce the temperature of the metal strip 2210 between the soaking furnace 2217 and the rolling stand 2284, which can impart beneficial metallurgical characteristics on the metal strip 2210. The pre-rolling quench 2213 and/or post-rolling quench 2219 can reduce the temperature of the metal strip 2210 at a rate of at or approximately 200° C./sec. The pre-rolling quench 2213 can reduce the peak metal temperature of the metal strip 2210 to at or approximately 350° C.-450° C., although other temperatures can be used.

Before coiling, the metal strip 2210 can undergo edge trimming by an edge trimmer 2221. During coiling, the metal strip 2210 can be wound into a coil of hot band 2212 and a shear 2223 can split the metal strip 2210 when the coil of hot band 2212 has reached a desired length or size. In some cases, the hot band 2212 may not be coiled, but may be directly supplied to another process. In some cases, coiling can occur at temperatures of at or approximately 50° C.-400° C.

The hot band 2212 can be at a final gauge, as indicated by block 2286. In such cases, the rolling stand 2284 can be configured to reduce the thickness of the metal strip 2210 to the final gauge desired for the hot band 2212. In some cases, the hot band 2212 can be at final gauge and temper, as indicated by block 2287. In such cases, the rolling stand 2284 can be configured to reduce the thickness of the metal strip 2210 to the final gauge desired for the hot band 2212, and the temperature can be carefully controlled through the hot band continuous casting system 2200 to achieve a desirable temper, such as an O temper or a T4 temper, although other tempers can be used. In some cases, the hot band 2212 can be stored, optionally reheated as indicated above with reference to intermediate coils, then finished, cold rolled, and/or heat treated, as indicated by block 2289. Hot band 2212 produced using the hot band continuous casting system 2200 can have microstructures more suitable to cold rolling. For example, 6xxx series aluminum alloy hot bands produced using the hot band continuous casting system 2200 can have smaller and more spheroid intermetallics, which respond more favorably to cold rolling than standard intermetallics, which can cause problematic voids and crack initiation sites upon cold rolling.

In some cases, hot band 2212 can include desirable iron particle distributions (e.g., iron constituent breakup and spheroidization) in 6xxx and 5xxx series aluminum alloys when allowing the metal strip 2210 to soak in a soaking furnace 2217, inline after being continuously cast, at peak metal temperatures of at least at or approximately 560° C. or 570° C. for at least at or approximately 1.5 minutes or 2 minutes prior to being hot or warm rolled with a reduction of thickness of at or approximately 50%-70%. Iron particle distribution can play a significant role in crack initiation sites and deformability of a metal product made using the hot band 2212. Using certain aspects of the present disclosure, hot band 2212 can be made with highly broken-up and spheroidized iron constituents, thus resulting in improve deformability and a lower susceptibility to cracking.

In some alternate embodiments, the rolling stand 2284 can be positioned upstream (e.g., left, as depicted in FIG. 22) of the soaking furnace 2217. While such a position may produce desirable results, the increase in speed of the metal strip 2210 as a result of the relatively high reduction in thickness (e.g., 50%-70%) can result in a longer soaking furnace 2217 and thus higher installation costs, operating costs, and physical footprint. In some alternate embodiments, an additional soaking furnace can be positioned downstream of the rolling stand 2284 to further control temperature of the metal strip 2210 after reduction of thickness. Again, however, the speed increase of the metal strip after rolling can result in the additional soaking furnace having a relatively large footprint and higher associated costs.

Figure 23:
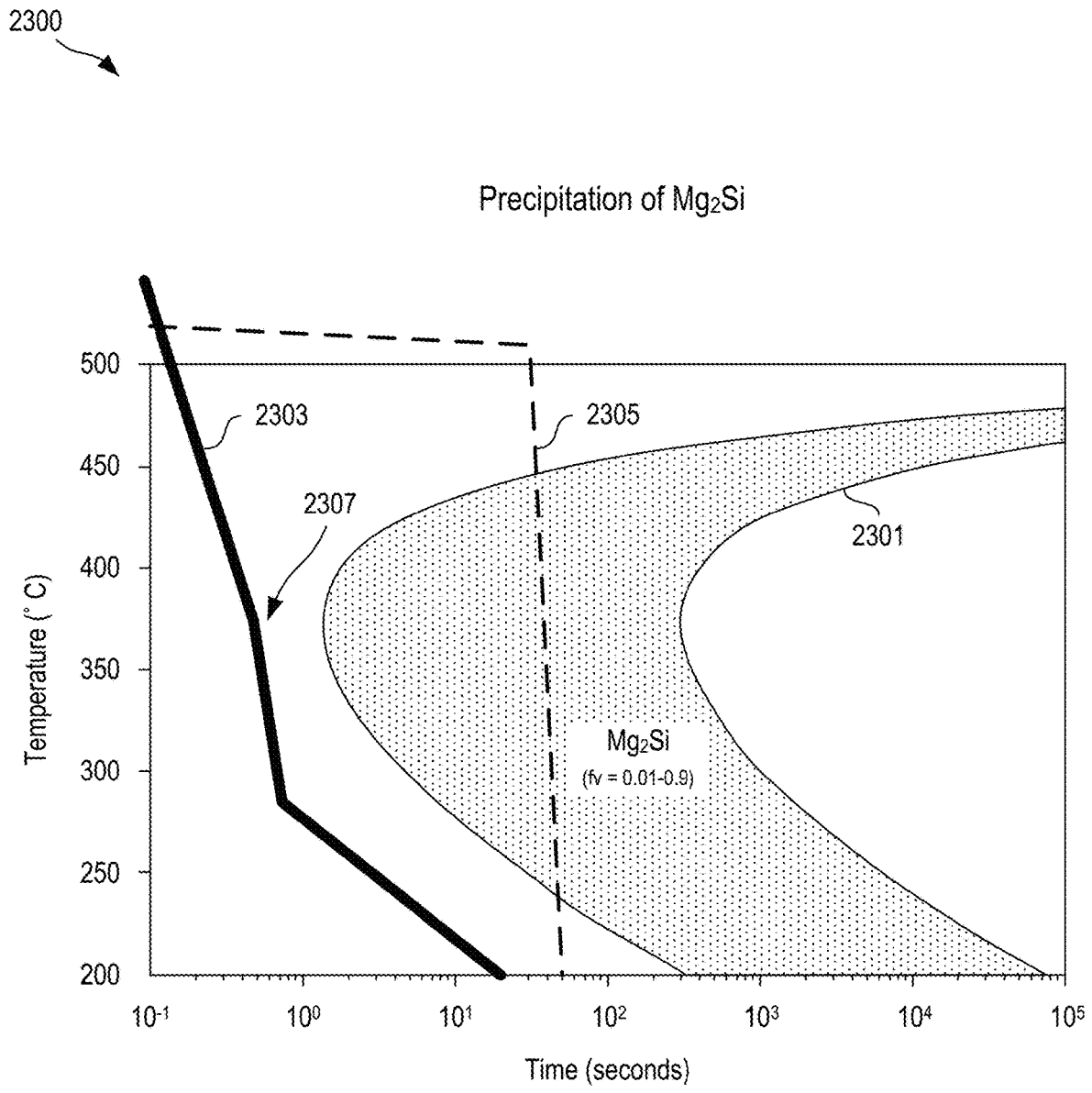
FIG. 23 is a chart depicting the precipitation of $Mg_2Si$ of an aluminum metal strip during hot rolling and quenching according to certain aspects of the present disclosure.

FIG. 23 is a chart 2300 depicting the precipitation of $Mg_2Si$ of an aluminum metal strip during hot rolling and quenching according to certain aspects of the present disclosure. The chart 2300 is similar to chart 2000 of FIG. 20, depicting expected precipitation of $Mg_2Si$ according to the time spent at certain temperatures for an aluminum alloy, such as a 6xxx series aluminum alloy. A zone of high precipitation 2301 is shown, similar to the zone of high precipitation 2001 of FIG. 20.

Line 2303 depicts the temperature of a metal strip processed according to certain aspects of the present disclosure, wherein the metal strip is cooled to a warm rolling temperature, warm rolled while being cooled further, then further cooled thereafter. Warm rolling while being cooled further occurs at section 2307. By controlling the time and temperature of the metal strip such that the temperature line 2303 remains outside of the zone of high precipitation 2301, precipitation of $Mg_2Si$ can be minimized.

In some cases, the metal strip can be passed through two roll stands while being warm rolled. In the first bite (e.g., between the rollers of the first roll stand), the metal strip can be quenched to a sufficiently low temperature to avoid precipitation of undesirable intermetallics (e.g., $Mg_2Si$). In the second bite, the metal strip can be reduced in thickness with sufficient force to recrystallize at the temperature of the metal strip upon entering the second bite.

Line 2305 depicts the temperature of a metal strip processed according to certain aspects of the present disclosure, wherein the metal strip is maintained at a high temperature (e.g., at or above approximately 510° C., 515° C., or 517° C.) from casting through rolling. After rolling, the metal strip can be rapidly quenched, thus minimizing the amount of time the temperature line 2305 of the metal strip remains in the zone of high precipitation 2301. In this case, the metal strip can retain a non-work hardened grain structure due, at least in part, to the high temperature during rolling.

Figure 24:
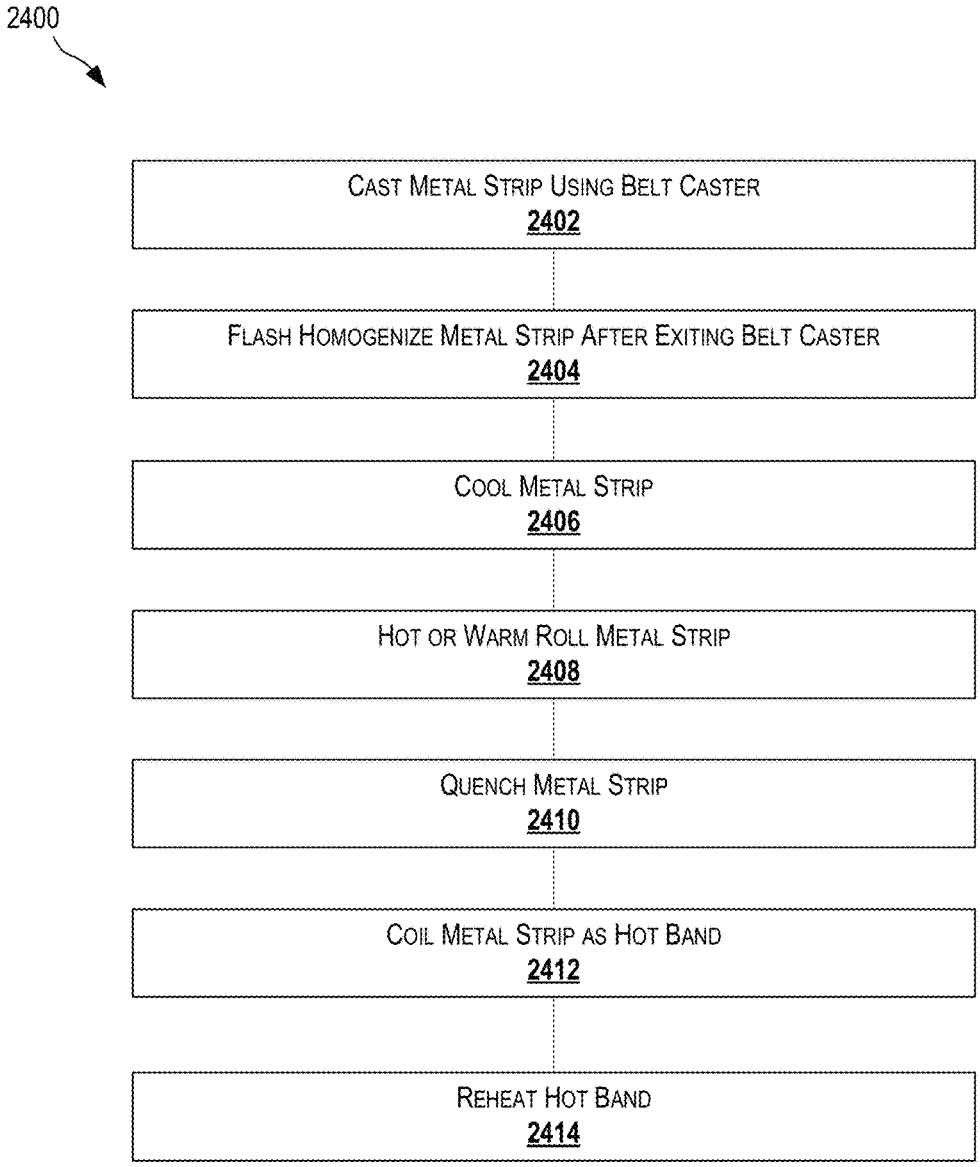
FIG. 24 is a flowchart depicting a process for casting a hot metal band according to certain aspects of the present disclosure.

FIG. 24 is a flowchart depicting a process 2400 for casting a hot metal band according to certain aspects of the present disclosure. Metal strip can be cast using a continuous casting device at block 2402, such as using a belt caster. The use of a continuous casting device, such as a belt caster, can ensure a rapid rate of solidification.

At optional block 2404, the metal strip can be flash homogenized after exiting the belt caster. Flash homogenization can include optionally reheating the metal strip to a soaking temperature (e.g., at or approximately 400° C.-580° C., or more preferably at or approximately 570° C.-580° C.) and maintaining the metal strip at the soaking temperature for a duration of time. The duration of time can be at or approximately 10-300 seconds, 60-180 seconds, or 120 seconds.

Flash homogenization can be especially useful to break up and/or spheroidize large and/or bladelike intermetallics. For example AA6111 and AA6451 alloys can have relatively large intermetallics upon casting that can be significantly improved through flash homogenization as disclosed herein. AA5754 alloys, however, may not produce as needle or blade like intermetallics, so the flash homogenization may be omitted for AA5754 and similar alloys. In some cases, the determination of when to use flash homogenization and when to not use flash homogenization can be made based on the ratio of iron to silicon, where higher silicon content (e.g., at or above a 1:5 ratio of silicon to iron) alloys can be benefited by flash homogenization. In some cases, alloys with lower silicon content (e.g., at or below a 1:5 ratio of silicon to iron) can be desirably cast without flash homogenization or with flash homogenization at lower temperatures (e.g., at or approximately 500° C.-520° C.).

In some cases, flash homogenization can be performed at lower temperatures for specific alloys. For example, a 7xxx series alloy can be successfully flash homogenized at temperatures of at or approximately 350° C.-480° C.

At optional block 2406, the metal strip can be cooled prior to hot or warm rolling. In some cases, especially in cases where precipitation of chromium is desired to be controlled, it can be beneficial to cool the metal strip prior to hot or warm rolling. Cooling at block 2406 can include cooling the metal strip to temperatures at or approximately 350° C.-450° C., although other temperatures can be used.

At block 2408, the metal strip can be hot or warm rolled at a reduction of thickness of at least approximately 30% and less than approximately 80%. In some cases, the reduction of thickness can be at least approximately 50%, 55%, 60%, 65%, 70%, or 75%. In some cases, hot or warm rolling at block 2408 can optionally include quenching the metal strip during rolling (e.g., within the bite between the rolls of a roll stand), although that need not be the case. In some cases, hot or warm rolling at block 2408 is performed while maintaining the metal strip at temperature at or above 500° C., 505° C., 510° C., 515° C., 520° C., or 525° C.

At block 2410, the metal strip can be quenched after hot or warm rolling. Quenching at block 2410 can include cooling the metal strip at a high rate, such as 200° C./sec, although other rates may be used. The quenching at block 2410 can reduce the temperature of the metal strip down to at or approximately 50° C.-400° C., such as 50° C.-300° C., although other temperatures may be used.

At block 2412, the metal strip can be coiled as a hot band. The hot band can be at final gauge and temper, at final gauge, or at an intermediate gauge. If at final gauge and temper or at final gauge, the coiled hot band can be deliverable to a customer for further its intended use. If at an intermediate gauge, the hot band can be reheated, rolled (e.g., cold or hot rolled), heat treated, or otherwise processed into a final product for delivery to a customer.

At optional block 2414, the hot band can be reheated to further improve metallurgical properties, as described herein, including in the below examples.

Figure 25:
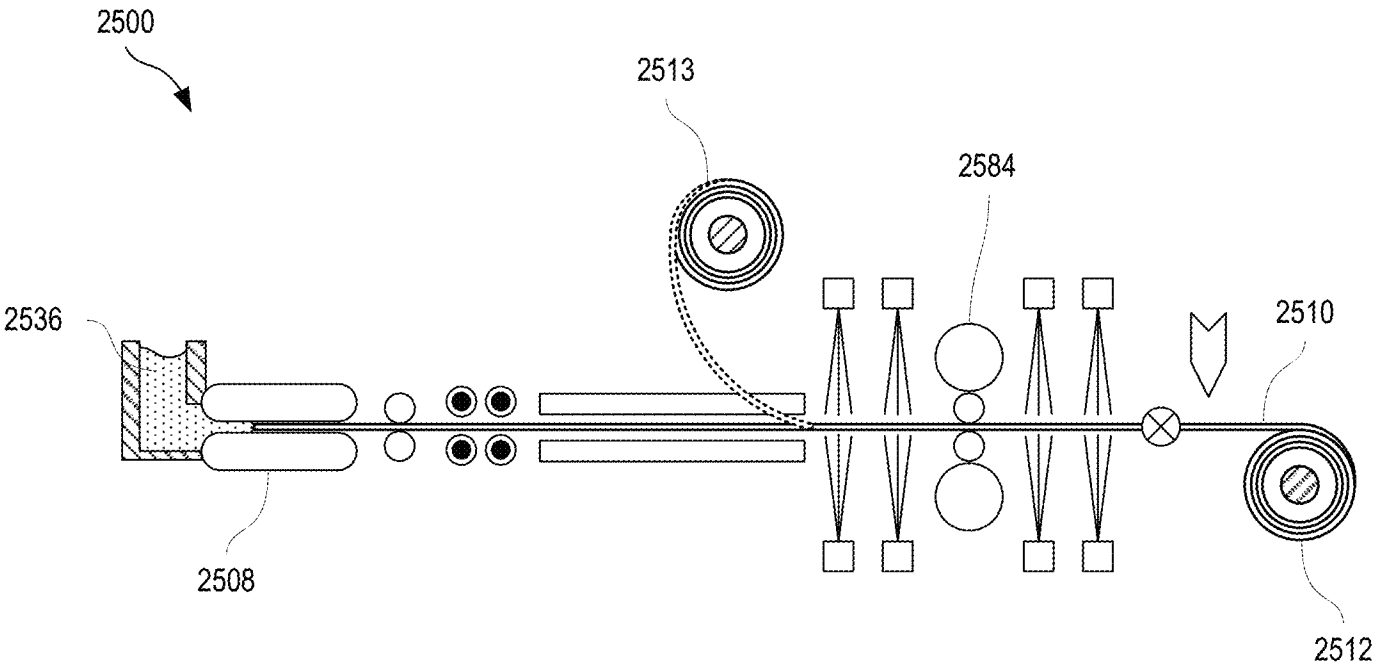
FIG. 25 is a schematic diagram depicting a hot band continuous casting system according to certain aspects of the present disclosure.

FIG. 25 is a schematic diagram depicting a hot band continuous casting system 2500 according to certain aspects of the present disclosure. The hot band continuous casting system 2500 can be the same or similar to the hot band continuous casting system 2200 of FIG. 22, however with an additional feed coil 2513. The hot band continuous casting system 2500 can operate in a casting mode and a processing mode. In a casting mode, the hot band continuous casting system 2500 can make use of the continuous belt caster 2508 to produce a metal strip 2510 that can then be directed through the various components of the hot band continuous casting system 2500, such as described with respect to the hot band continuous casting system 2200 of FIG. 22, including passing the metal strip 2510 through a rolling stand 2584.

However, in a processing mode, the hot band continuous casting system 2500 can provide metal strip 2510 (e.g., hot band not at final gauge) from the additional feed coil 2513 into one or more components of the hot band continuous casting system 2500, including at least the rolling stand 2584. The metal strip 2510 from the additional feed coil 2513, after being rolled (e.g., hot or warm rolled), can be coiled into a coil of hot band 2512.

Thus, the same rolling stand 2584 can be used for both inline rolling of metal strip that has just been continuously cast, as well as rolling of metal strip 2510 that has been previously cast and coiled. Operation of the hot band continuous casting system 2500 in a processing mode can be especially useful when the continuous casting device needs repair or while waiting for liquid metal 2536 to be prepared.

Figure 26:
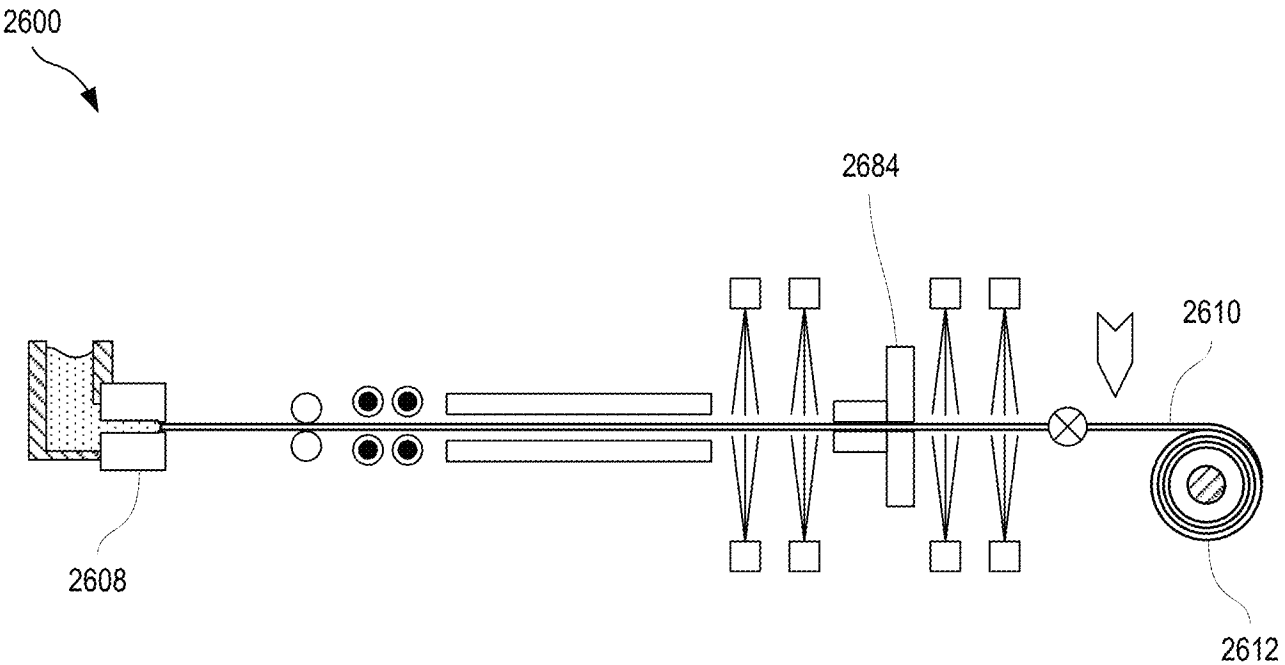
FIG. 26 is a schematic diagram depicting a continuous casting system according to certain aspects of the present disclosure.

FIG. 26 is a schematic diagram depicting a continuous casting system 2600 according to certain aspects of the present disclosure. The continuous casting system 2600 can similar to the hot band continuous casting system 2200 of FIG. 22, however using a continuous casting device 2608 to cast an extrudable metal article 2610 (e.g., a billet) instead of a continuous caster casting a metal strip. The extrudable metal article 2610 can undergo the same or similar processes using the same or similar equipment as described above with reference to the metal strip 2210 of FIG. 22, however the rolling stand can be replaced with a die 2684. The continuous casting system 2600 can produce a coiled product 2612. The coiled product 2612, similar to the hot band 2212 of FIG. 22, can be at final gauge, at final gauge and temper, or can be at an intermediate gauge for further processing.

Figure 27:
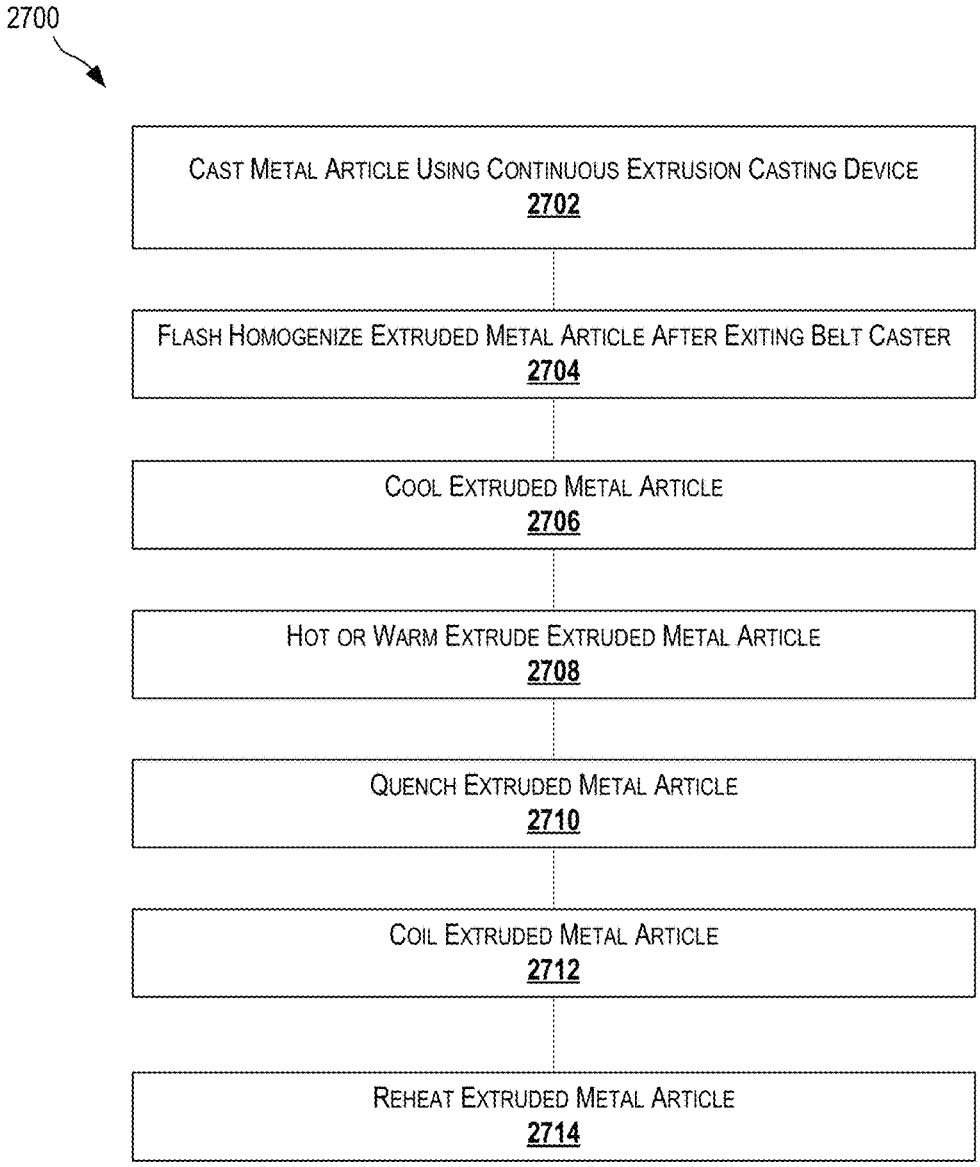
FIG. 27 is a flowchart depicting a process for casting an extrudable metal product according to certain aspects of the present disclosure.

FIG. 27 is a flowchart depicting a process 2700 for casting an extruded metal product according to certain aspects of the present disclosure. An extrudable metal article, such as a billet, can be cast using a continuous casting device at block 2702. The use of a continuous casting device can ensure a rapid rate of solidification.

At optional block 2704, the extrudable metal article can be flash homogenized after exiting the casting device. Flash homogenization can include optionally reheating the extrudable metal article to a soaking temperature (e.g., at or approximately 400° C.-580° C., or more preferably at or approximately 570° C.-580° C.) and maintaining the extrudable metal article at the soaking temperature for a duration of time. The duration of time can be at or approximately 10-300 seconds, 60-180 seconds, or 120 seconds.

Flash homogenization can be especially useful to break up and/or spheroidize large and/or bladelike intermetallics. For example AA6111 and AA6451 alloys can have relatively large intermetallics upon casting that can be significantly improved through flash homogenization as disclosed herein. AA5754 alloys, however, may not produce needle or blade like intermetallics, so the flash homogenization may be omitted for AA5754 and similar alloys. In some cases, the determination of when to use flash homogenization and when to not use flash homogenization can be made based on the ratio of iron to silicon, where higher silicon content (e.g., at or above a 1:5 ratio of silicon to iron) alloys can be benefited by flash homogenization. In some cases, alloys with lower silicon content (e.g., at or below a 1:5 ratio of silicon to iron) can be desirably cast without flash homogenization or with flash homogenization at lower temperatures (e.g., at or approximately 500° C.-520° C.).

In some cases, flash homogenization can be performed at lower temperatures for specific alloys. For example, a 7xxx series alloy can be successfully flash homogenized at temperatures of at or approximately 350° C.-480° C.

At optional block 2706, the extrudable metal article can be cooled prior to extrusion through a die at hot or warm extrusion temperatures. Extrusion at hot or warm extrusion temperature can be a type of hot or warm working. In some cases, especially in cases where precipitation of chromium is desired to be controlled, it can be beneficial to cool the extrudable metal article prior to hot or warm extrusion. Cooling at block 2706 can include cooling the extrudable metal article to temperatures at or approximately 350° C.-450° C., although other temperatures can be used.

At block 2708, the extrudable metal article can be hot or warm extruded at a reduction of diameter (e.g., a reduction of section) of at least approximately 30% and less than approximately 80%. In some cases, the reduction of diameter can be at least approximately 50%, 55%, 60%, 65%, 70%, or 75%. In some cases, hot or warm extrusion at block 2708 can optionally include quenching the metal article during extrusion (e.g., within the die), although that need not be the case. In some cases, hot or warm extrusion at block 2708 is performed while maintaining the metal article at a temperature at or above 500° C., 505° C., 510° C., 515° C., 520° C., or 525° C.

At block 2710, the extruded metal article (e.g., the extrudable metal article after extrusion) can be quenched after hot or warm extrusion. Quenching at block 2710 can include cooling the extruded metal article at a high rate, such as 200° C./sec, although other rates may be used. The quenching at block 2710 can reduce the temperature of the extruded metal article down to at or approximately 50° C.-400° C., such as 50° C.-300° C., although other temperatures may be used.

At block 2712, the extruded metal article can be coiled or otherwise stored. The extruded metal article can be at final gauge and temper, at final gauge, or at an intermediate gauge. If at final gauge and temper or at final gauge, the extruded metal article can be deliverable to a customer for further its intended use. If at an intermediate gauge, the extruded metal article can be reheated, further extruded (e.g., cold or hot extrusion), heat treated, or otherwise processed into a final product for delivery to a customer.

At optional block 2714, the extruded metal article can be reheated to further improve metallurgical properties, as described herein with respect to hot band, including in the below examples.

Examples

The following examples will serve to further illustrate the present invention without, however, constituting any limitation thereof. On the contrary, it is to be clearly understood that resort may be had to various embodiments, modifications and equivalents thereof which, after reading the description herein, may suggest themselves to those of ordinary skill in the art without departing from the spirit of the invention.

Various alloys were tested using certain aspects and features of the present disclosure. The aluminum alloys are described in terms of their elemental composition in weight percentage (wt. %) based on the total weight of the alloy. In certain examples of each alloy, the remainder is aluminum, with a maximum wt. % of 0.15% for the sum of the impurities. Table 1 depicts several such alloys, including approximate solidus and solvus temperatures:

TABLE 1

Example Common 5xxx, 6xxx, and 7xxx Alloys

| ID | Solidus (° C.) | Solvus (° C.) | Constituents (approx. in wt %) |
|---|---|---|---|
| AA5754 | 600 | 521 | 0.06 Si, 0.2 Fe, 0.02 Cu, 0.3 Mn, 3.2 Mg, 0.01 Cr, 0.02 Ti |
| AA5182 | 579 | 578 | 0.06 Si, 0.2 Fe, 0.02 Cu, 0.3 Mn, 4.3 Mg, 0.01 Cr, 0.02 Ti |
| AA6111 | 600 | 520 | 0.6 Si, 0.22 Fe, 0.55 Cu, 0.2 Mn, 0.7 Mg, 0.07 Cr, 0.04 Ti |
| AA6451 | 595 | 532 | 0.8 Si, 0.22 Fe, 0.1 Cu, 0.08 Mn, 0.6 Mg, 0.04 Cr, 0.04 Ti |
| AA6013 | 581 | 546 | 0.7 Si, 0.22 Fe, 0.85 Cu, 0.3 Mn, 0.9 Mg, 0.03 Cr, 0.04 Ti |
| AA7075 | 518 | 533 | 0.1 Si, 0.2 Fe, 1.7 Cu, 0.07 Mn, 2.6 Mg, 0.04 Cr, 0.02 Ti, 5.9 Zn |

While Table 1 depicts several examples of common 5xxx, 6xxx, and 7xxx series alloys, other 5xxx, 6xxx, and 7xxx series alloys can exist with constituents (e.g., alloying elements) being present at different percentages by weight, with the remainder including aluminum and optionally trace amounts (e.g., at or less than 0.15%) of impurities. Incidental elements, such as grain refiners and deoxidizers, or other additives may be present.

Alloys AA6111 and AA6451 were produced according to methods described herein. Alloys AA6111 and AA6451 were continuously cast into slabs having a gauge of 11 mm. Alloy AA6111 was further subjected to a flash homogenization procedure performed at various temperatures and for various times as shown in Table 2:

TABLE 2

Flash Homogenization Temperatures and Times

| Sample | Temperature (° C.) | Time (minutes) | Quench |
|---|---|---|---|
| A | N/A | N/A | N/A |
| B | 570 | 5 | N/A |
| C | 570 | 5 | N/A |
| D | 570 | 5 | Water quench to 350° C. |
| E | 400 | 1 | N/A |
| F | 380 | 0 | N/A |

Figure 28:
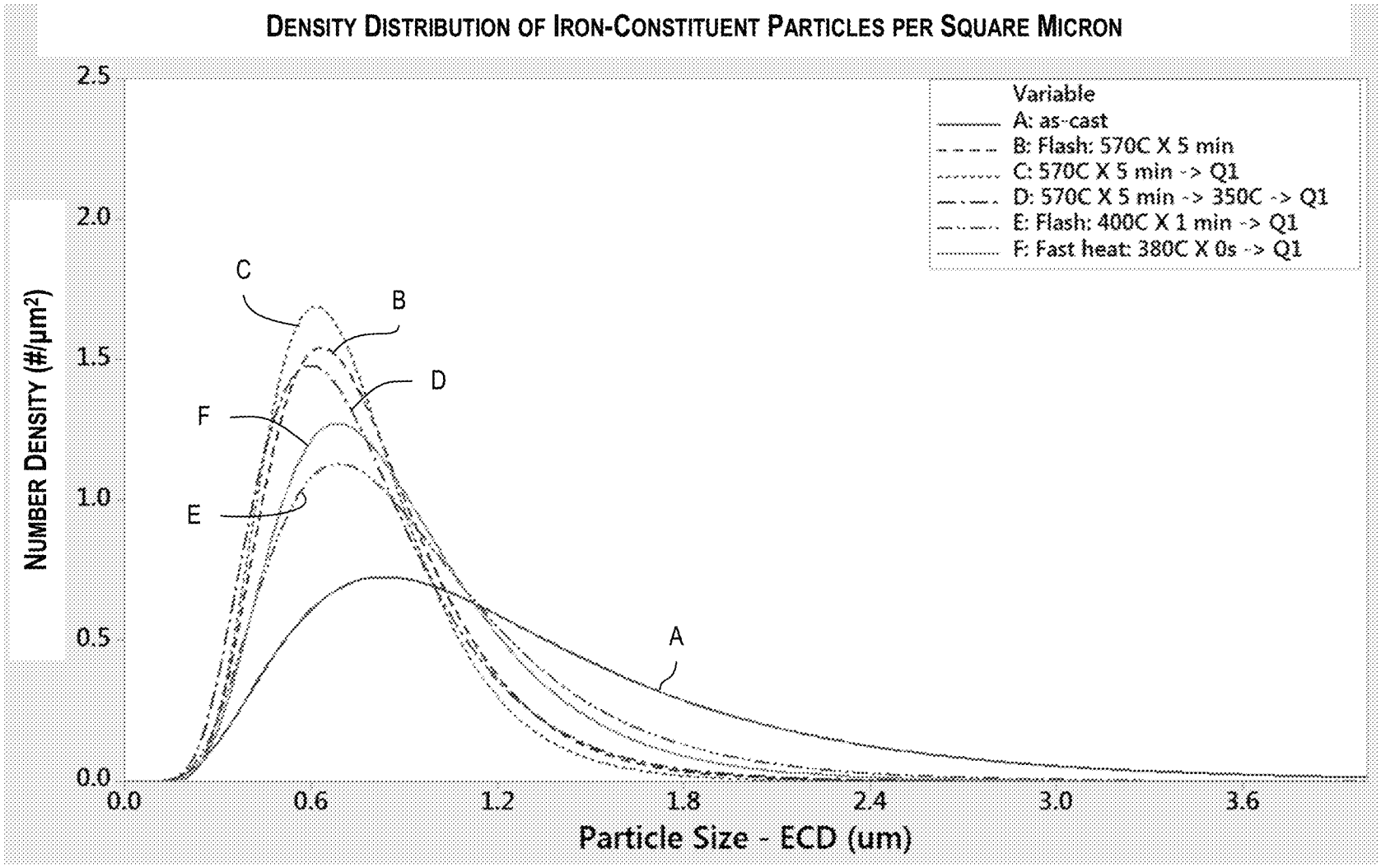
FIG. 28 is a graph showing a log normal number density distribution of iron (Fe)-constituent particles per square micron ($\mu m^2$) versus particle size for alloys produced according to methods described herein.

FIG. 28 is a graph showing a log normal number density distribution of iron (Fe)-constituent particles per square micron ($\mu m^2$) versus particle size for alloys produced according to methods described herein. Sample A was an as-cast AA6111 alloy not subjected to the disclosed flash homogenization procedure or hot rolling. Sample B was a continuously cast AA6111 11 mm slab subjected to the disclosed flash homogenization without any further hot rolling. Sample C was a continuously cast AA6111 11 mm slab subjected to the disclosed flash homogenization and hot rolled to a 50% reduction in thickness (i.e., 6.5 mm gauge). Sample D was a continuously cast AA6111 11 mm slab subjected to the disclosed flash homogenization, thermally quenched with room temperature water to a temperature of 350° C., and hot rolled to a 50% reduction in thickness (i.e., 6.5 mm gauge). Sample E was a continuously cast AA6111 11 mm slab subjected to an optional flash homogenization (see Table 2) and hot rolled to a 50% reduction (i.e., 6.5 mm gauge). Sample F was a continuously cast AA6111 11 mm slab subjected to an optional flash homogenization (see Table 2) and hot rolled to a 50% reduction (i.e., 6.5 mm gauge). Sample A (as-cast AA6111 slab) showed a broad peak indicating a broad distribution of particle sizes and a lack of refinement of Fe-constituents. Sample C (AA6111 cast to an 11 mm slab, subjected to the disclosed flash homogenization and hot rolled to 50% reduction) showed a narrow distribution of particles sizes indicating refinement of the Fe-constituent particles. Samples D and E (subjected to lower temperature optional flash homogenization, 400° C. for Sample D and 380° C. for Sample E) showed broad particle size distributions, indicating less refinement of Fe-constituent particles.

Figure 29:
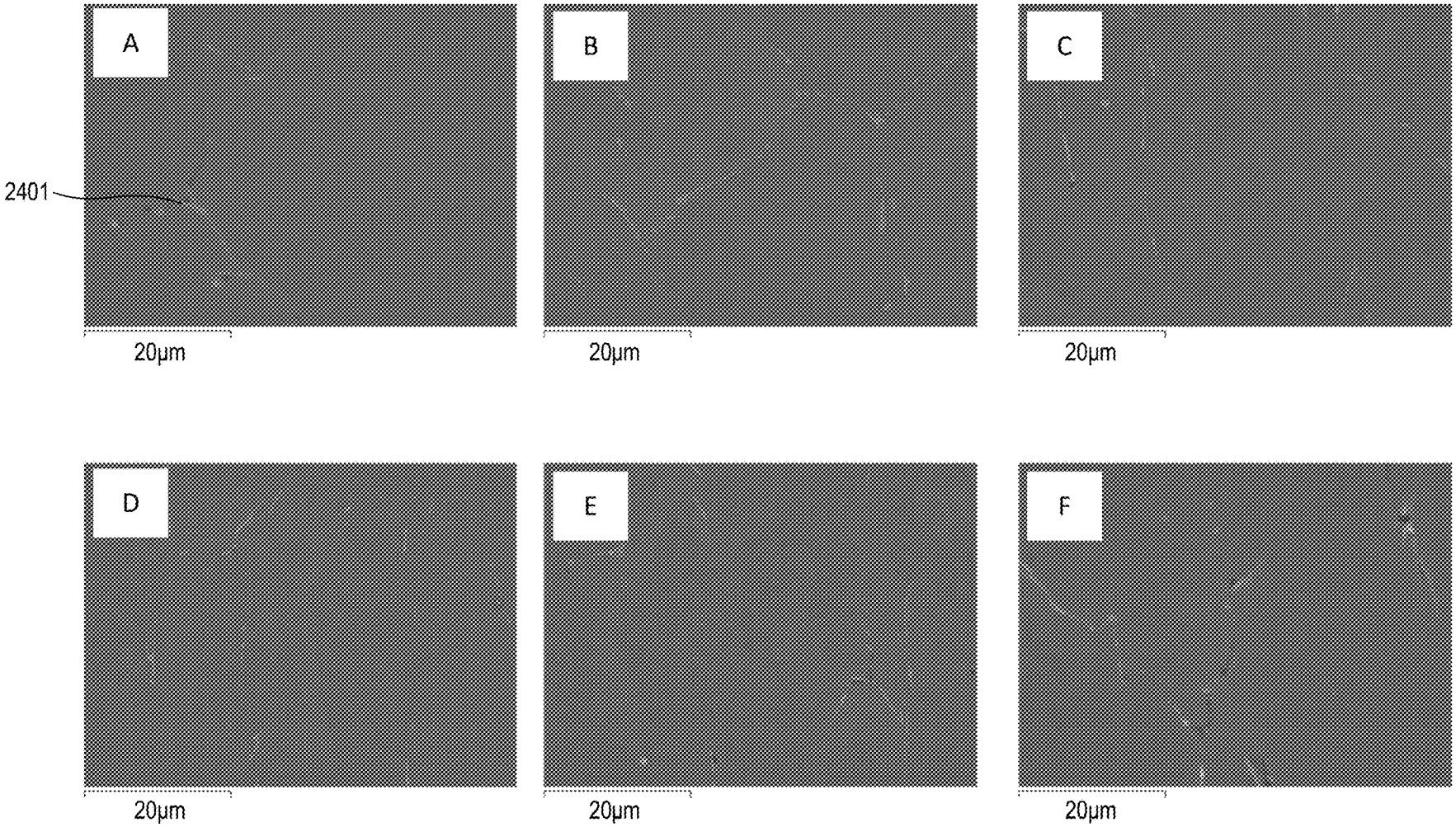
FIG. 29 is a set of scanning electron microscope (SEM) micrographs showing Fe-constituent particles in AA6111 after processing according to methods described herein.

FIG. 29 is a set of scanning electron microscope (SEM) micrographs showing Fe-constituent particles in AA6111 alloys after processing according to methods described herein. The panels A, B, C, D, E, and F of FIG. 29 correlate to Samples A, B, C, D, E, and F of FIG. 28, respectively. Panel A shows large needle-like Fe-constituent particles 2401 in Sample A (see Table 2). Panel B shows a refinement (i.e., a break-up) of Fe-constituent particles after the AA6111 alloy was subjected to the disclosed flash homogenization without being subjected to hot rolling (Sample B, Table 2). Panel C shows a further refinement of the Fe-constituent particles in Sample C, wherein the AA6111 alloy continuously cast 11 mm gauge slab was subjected to the disclosed flash homogenization and further subjected to hot rolling to a 50% reduction in thickness. Panel C shows more refinement, as evidenced by the log-normal distribution fit depicted as Sample C in FIG. 28. Panel D shows a refinement of the Fe-constituent particles in Sample D similar to the refinement seen in Sample C, wherein the AA6111 alloy continuously cast 11 mm gauge slab was subjected to the disclosed flash homogenization and further subjected to water quenching to 350° C. before hot rolling to a 50% reduction in thickness. Panel E illustrates a lack of refinement of the Fe-constituent particles and undissolved magnesium silicide ($Mg_2Si$) particles present in Sample E, wherein the AA6111 alloy continuously cast 11 mm slab was subjected to a flash homogenization at 400° C. for 1 minute and then hot rolled to a 50% reduction in thickness. Panel F illustrates a lack of refinement of the Fe-constituent particles and undissolved magnesium silicide ($Mg_2Si$) particles present in Sample F, wherein the AA6111 alloy continuously cast 11 mm slab was subjected to a flash homogenization at 380° C. without a dwell time and then hot rolled to a 50% reduction in thickness.

Figure 30:
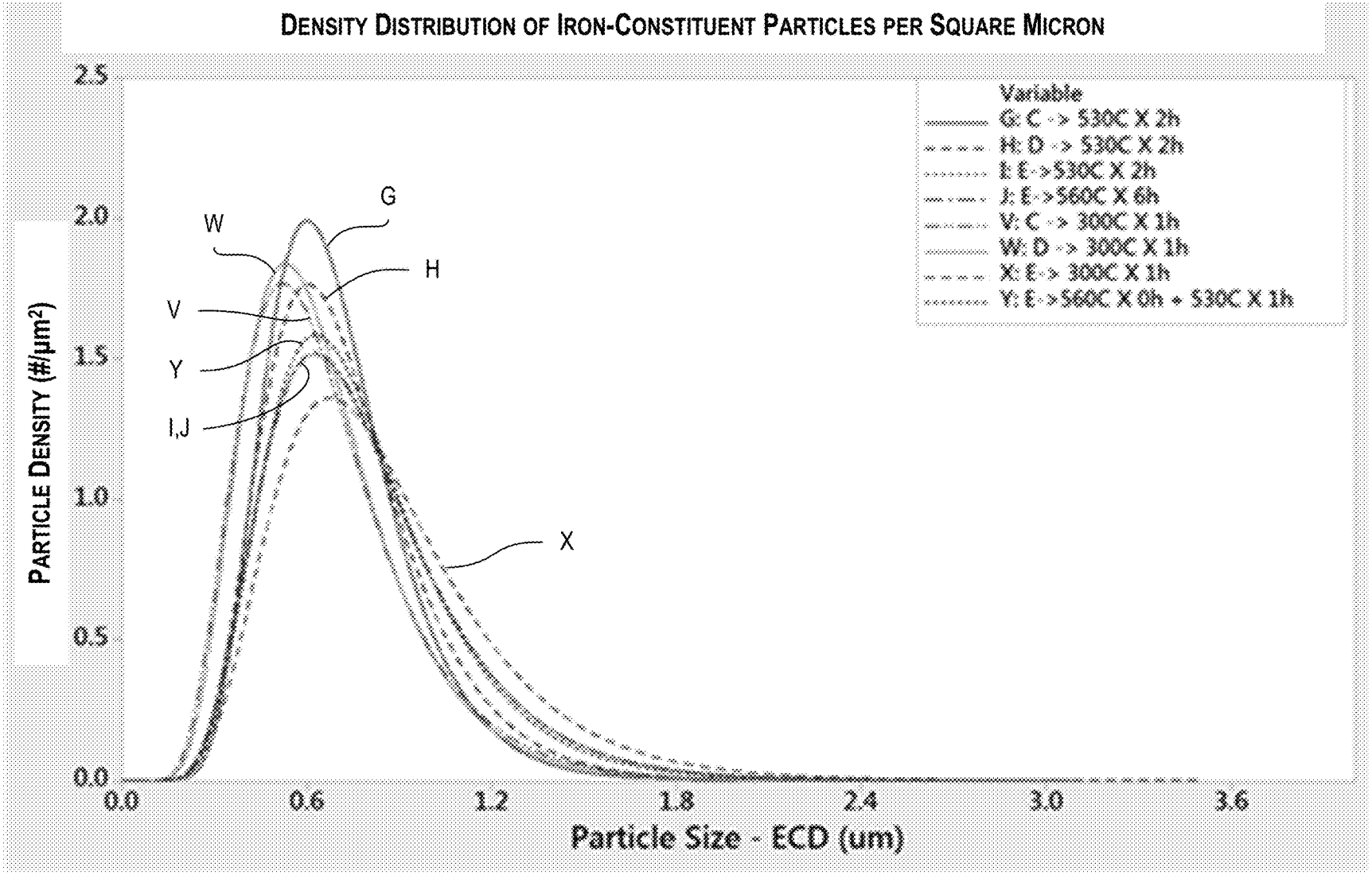
FIG. 30 is a graph showing a log normal number density distribution of iron (Fe)-constituent particles per square micron ($\mu m^2$) versus particle size for alloys produced according to methods described herein.

FIG. 30 is a graph showing a log normal number density distribution of iron (Fe)-constituent particles per square micron ($\mu m^2$) versus particle size for alloys produced according to methods described herein. Sample C, Sample D and Sample E (see Table 2) were further subjected to additional homogenization after hot rolling to a 50% reduction in thickness. Additional homogenization procedures are summarized in Table 3:

TABLE 3

Additional Homogenization Parameters

| Trial Reference | Sample (See Table 2) | Temperature (° C.) | Time (h) |
|---|---|---|---|
| G | C | 530 | 2 |
| H | D | 530 | 2 |
| I | E | 530 | 2 |
| J | E | 560 | 6 |
| V | C | 300 | 1 |
| W | D | 300 | 1 |
| X | E | 300 | 1 |
| Y | E | 560/530 | 0/1 |

All samples subjected to the disclosed flash homogenization and hot rolled to 50% reduction), followed by additional homogenization at various temperatures showed a narrow distribution of particles sizes indicating refinement of the Fe-constituent particles. High temperature flash homogenization (e.g., 570° C., Sample C and Sample D (Trials G, H, V, and W)) continued to exhibit more Fe-constituent particle refinement than low temperature flash homogenization (e.g., 400° C. and below, Sample E (Trials I, J, X, and Y)).

Figure 31:
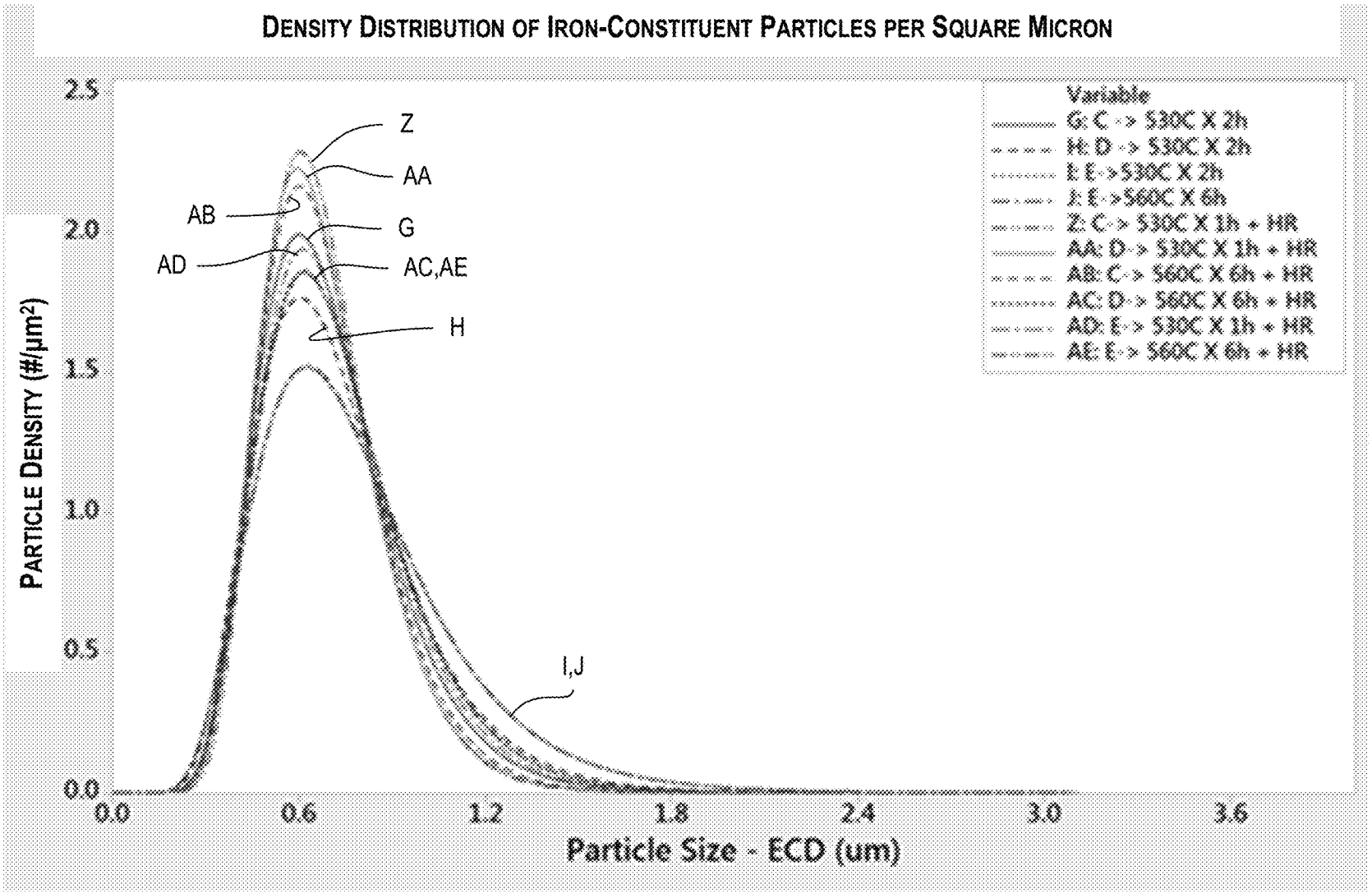
FIG. 31 is a graph showing a log normal number density distribution of iron (Fe)-constituent particles per square micron ($\mu m^2$) versus particle size for alloys produced according to methods described herein.

FIG. 31 is a graph showing a log normal number density distribution of iron (Fe)-constituent particles per square micron ($\mu m^2$) versus particle size for alloys produced according to methods described herein. For each of these flash homogenous trials, 11 mm metal strips were hot rolled to 2 mm. For some cases, an initial hot rolling (e.g., "Q1" reduction) was performed at 50% reduction in thickness, followed by a 68% final reduction in thickness, resulting in a 2 mm strip. In some cases, an initial hot rolling was performed at 70% reduction in thickness, followed by a 40% final reduction in thickness, resulting in a 2 mm strip. Additional homogenization and hot rolling parameters are summarized in Table 4:

TABLE 4

Additional Homogenization and Hot Rolling Parameters

| Trial Reference | Sample (See Table 2) | Temperature (° C.) | Time (h) | Initial Hot Roll |
|---|---|---|---|---|
| G | C | 530 | 2 | 50% |
| H | D | 530 | 2 | 50% |
| I | E | 530 | 2 | 50% |
| J | E | 560 | 6 | 50% |
| Z | C | 530 | 1 | 70% |
| AA | D | 530 | 1 | 70% |
| AB | C | 560 | 6 | 70% |
| AC | D | 560 | 6 | 70% |
| AD | E | 530 | 1 | 70% |
| AE | E | 560 | 6 | 70% |

All samples subjected to the disclosed flash homogenization and initially hot rolled to at least 50% reduction, followed by additional homogenization and hot rolling down to a desired gauge (e.g., 2 mm), showed a narrow distribution of particles sizes indicating refinement of the Fe-constituent particles. Samples subjected to the disclosed flash homogenization (e.g., 570° C. for 5 minutes, Sample C and Sample D, Trials G, H, Z, AA, AB, and AC) exhibited a narrower distribution of fine Fe-constituent particles than samples subjected to a lower temperature flash homogenization (e.g., 400° C., Sample E, Trials I, J, AD, and AE), suggesting further homogenization is not necessary when the disclosed high temperature flash homogenization is used.

Figure 32:
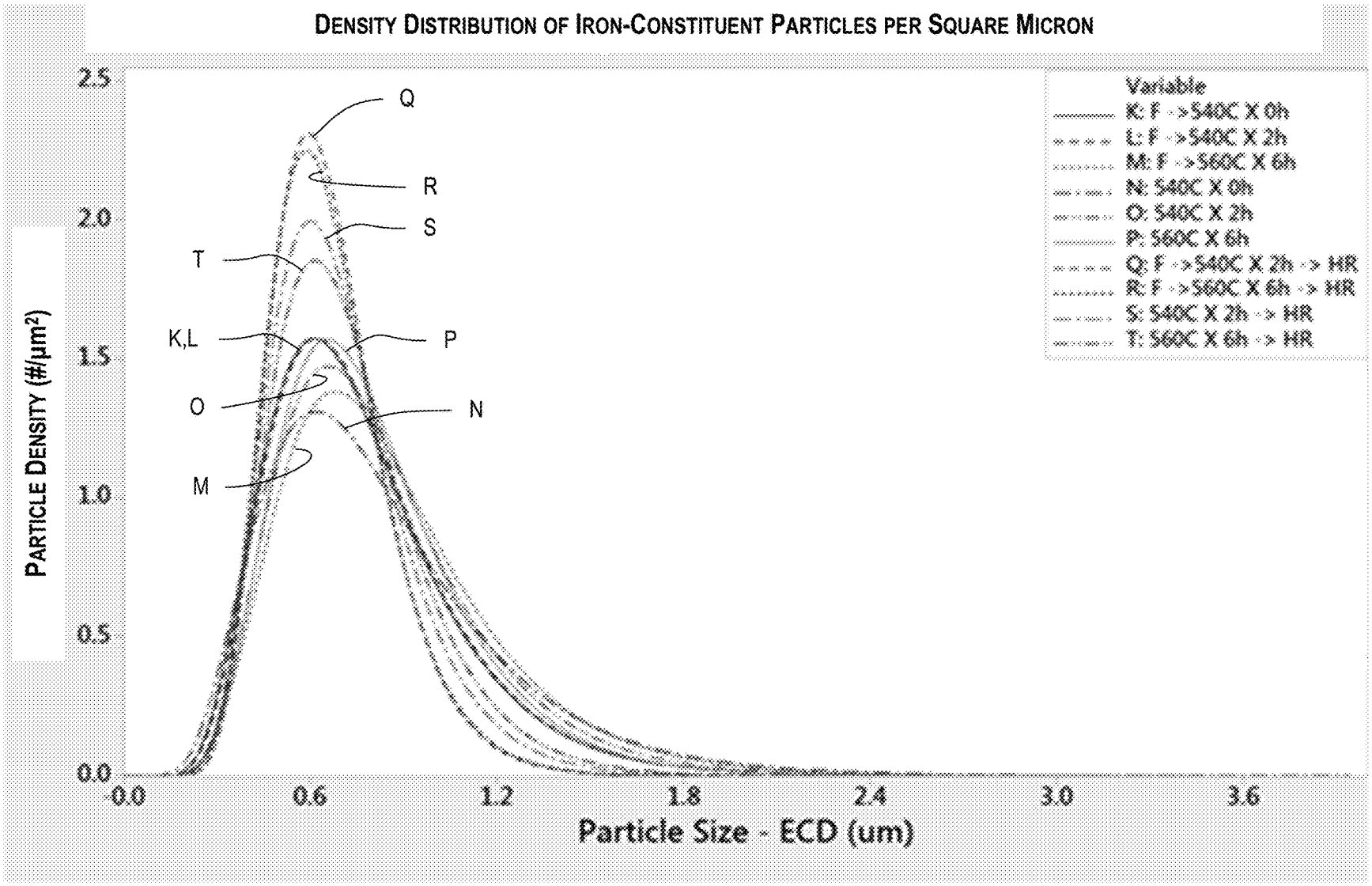
FIG. 32 is a graph showing a log normal number density distribution of iron (Fe)-constituent particles per square micron ($\mu m^2$) versus particle size for alloys produced according to methods described herein.

FIG. 32 is a graph showing a log normal number density distribution of iron (Fe)-constituent particles per square micron ($\mu m^2$) versus particle size for alloys produced according to methods described herein. Sample F (see Table 2) was further subjected to additional homogenization and further hot rolling to a 70% total reduction in thickness (i.e., Sample F, was hot rolled to an additional 20% reduction in thickness as compared to an as-cast AA6111 alloy (Sample A, see Table 2) continuously cast 11 mm slab. The as-cast AA6111 alloy was not subjected to the disclosed flash homogenization. The as-cast AA6111 alloy was subjected to similar additional homogenization and hot rolling as Sample F, parameters are summarized in Table 5:

TABLE 5

Low Temperature Flash Homogenization versus No Flash Homogenization

| Trial Reference | Sample (See Table 2) | Temperature (° C.) | Time (h) | Initial Hot Roll |
|---|---|---|---|---|
| K | F | 540 | 0 | 50% |
| L | F | 540 | 2 | 50% |
| M | F | 560 | 6 | 50% |
| N | A | 540 | 0 | 50% |
| O | A | 540 | 2 | 50% |
| P | A | 560 | 6 | 50% |
| Q | F | 540 | 2 | 70% |
| R | F | 560 | 6 | 70% |
| S | A | 540 | 2 | 70% |
| T | A | 560 | 6 | 70% |

All samples subjected to the disclosed flash homogenization and then hot rolled to at least 50% reduction, followed by additional homogenization and hot rolling to a desired gauge (e.g., 2 mm), showed a narrow distribution of particles sizes indicating refinement of the Fe-constituent particles. Samples not subjected to the disclosed flash homogenization exhibited less refinement of the Fe-constituent particles.

Alloy AA6451 was further subjected to a flash homogenization procedure performed at various temperatures and for various times as shown in Table 6:

TABLE 6

Flash Homogenization Temperatures and Times

| Sample | Temperature (° C.) | Time (minutes) | Quench |
|---|---|---|---|
| AAA | N/A | N/A | N/A |
| CCC | 570 | 5 | N/A |
| DDD | 570 | 5 | Water quench to 350° C. |
| EEE | 400 | 1 | N/A |
| FFF | 380 | 0 | N/A |

Figure 33:
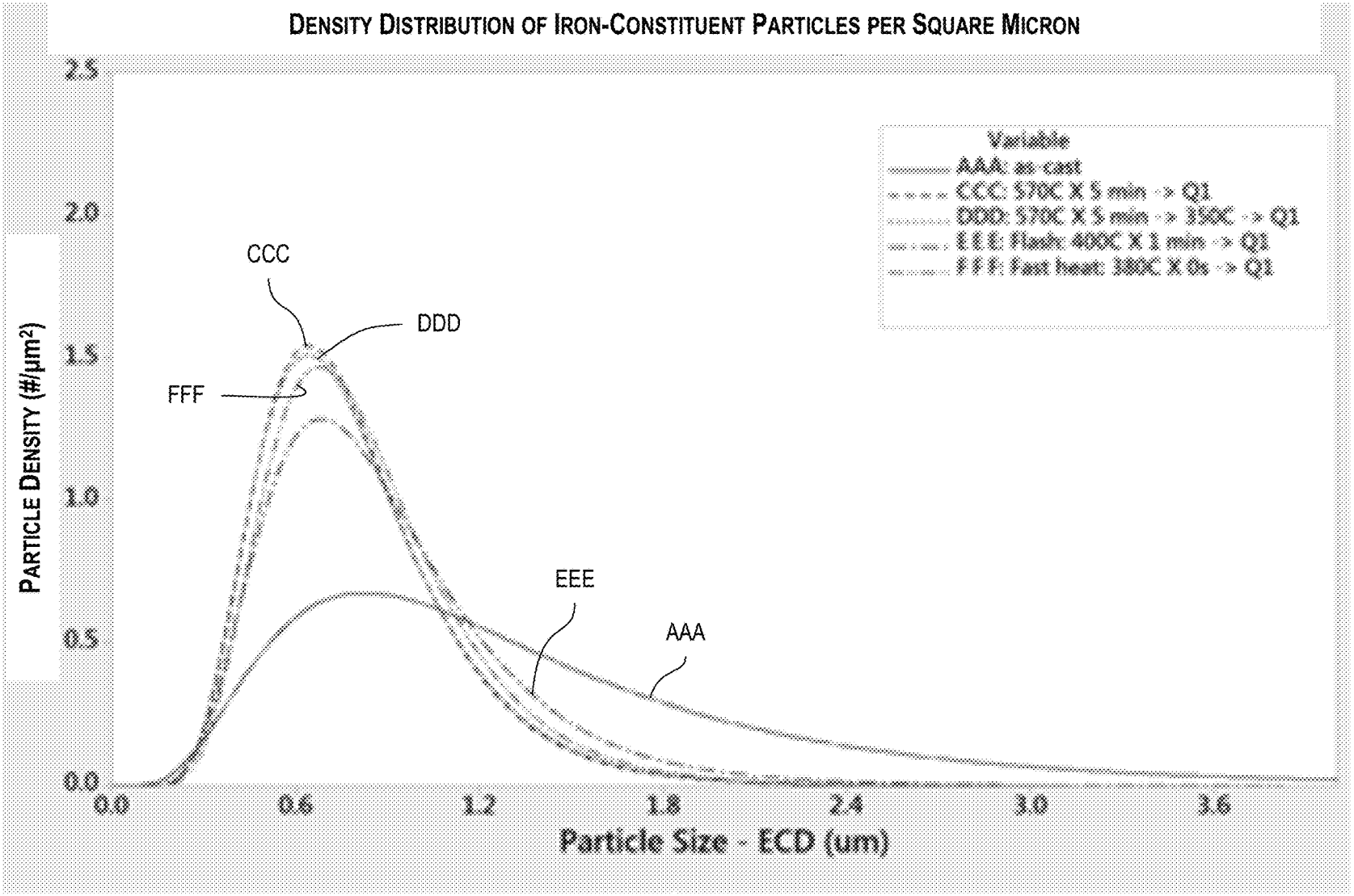
FIG. 33 is a graph showing a log normal number density distribution of iron (Fe)-constituent particles per square micron ($\mu m^2$) versus particle size for alloys produced according to methods described herein.

FIG. 33 is a graph showing a log normal number density distribution of iron (Fe)-constituent particles per square micron ($\mu m^2$) versus particle size for alloys produced according to methods described herein. Sample AAA (indicated by a solid blue line) was an as-cast AA6451 not subjected to the disclosed flash homogenization procedure or hot rolling. Sample CCC (indicated by a small dashed green line) was a continuously cast AA6451 11 mm slab subjected to the disclosed flash homogenization and hot rolled to a 50% reduction in thickness (i.e., 6.5 mm gauge). Sample DDD (indicated by a dashed-single dotted purple line) was a continuously cast AA6451 11 mm slab subjected to the disclosed flash homogenization, thermally quenched with room temperature water to a temperature of 350° C., and hot rolled to a 50% reduction in thickness (i.e., 6.5 mm gauge). Sample EEE (indicated by a dashed-double dotted black line) was a continuously cast AA6451 11 mm slab subjected to an optional flash homogenization (see Table 2) and hot rolled to a 50% reduction (i.e., 6.5 mm gauge). Sample FFF (indicated by a solid orange line) was a continuously cast AA6451 11 mm slab subjected to an optional flash homogenization (see Table 2) and hot rolled to a 50% reduction (i.e., 6.5 mm gauge). Sample AAA (as-cast AA6451 slab) showed a broad peak indicating a broad distribution of particle sizes and a lack of refinement of Fe-constituents. Sample CCC (AA6451 cast to an 11 mm slab, subjected to the disclosed flash homogenization and hot rolled to 50% reduction) showed a narrow distribution of particles sizes indicating refinement of the Fe-constituent particles. Samples DDD and EEE (subjected to lower temperature optional flash homogenization, 400° C. for Sample DDD and 380° C. for Sample EEE) showed broad particle size distributions, indicating less refinement of Fe-constituent particles.

Figure 34:
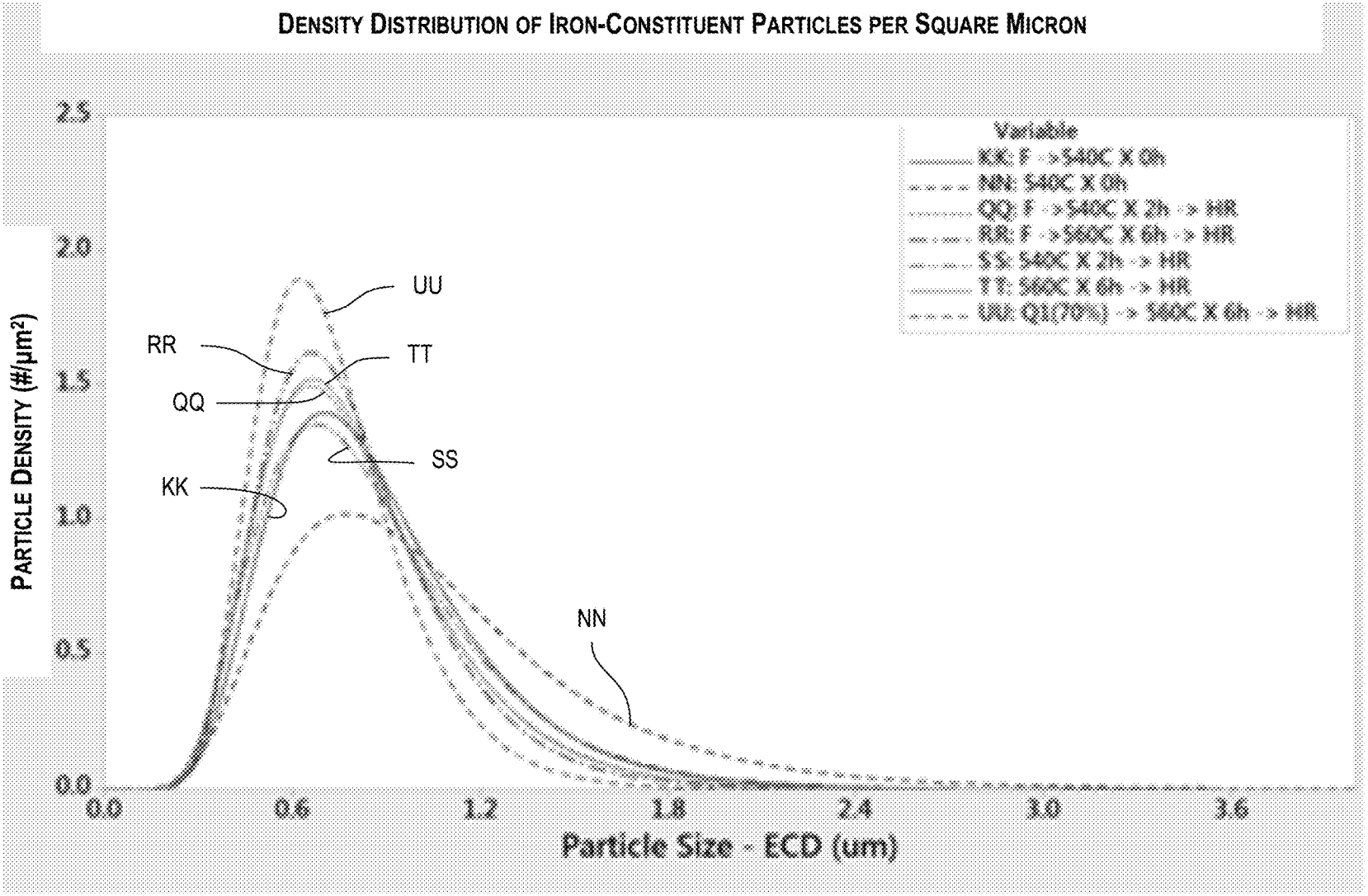
FIG. 34 is a graph showing a log normal number density distribution of iron (Fe)-constituent particles per square micron ($\mu m^2$) versus particle size for alloys produced according to methods described herein.

FIG. 34 is a graph showing a log normal number density distribution of iron (Fe)-constituent particles per square micron ($\mu m^2$) versus particle size for alloys produced according to methods described herein. Sample FFF (see Table 2) was further subjected to additional homogenization and further hot rolling to a 70% total reduction in thickness (i.e., Sample FFF was initially hot rolled by an additional 20% reduction in thickness) and compared to an as-cast AA6451 alloy (Sample AAA, see Table 2) continuously cast 11 mm slab. The as-cast AA6451 alloy was not subjected to the disclosed flash homogenization. The as-cast AA6451 alloy was subjected to similar additional homogenization and hot rolling as Sample FFF, parameters are summarized in Table 7:

TABLE 7

| Low Temperature Flash Homogenization versus No Flash Homogenization | | | | |
|---|---|---|---|---|
| Trial Reference | Sample (See Table 2) | Temperature (° C.) | Time (h) | Initial Hot Roll |
| KK | FFF | 540 | 0 | 50% |
| NN | AAA | 540 | 0 | 50% |
| QQ | FFF | 540 | 2 | 70% |
| RR | FFF | 560 | 6 | 70% |
| SS | AAA | 540 | 2 | 70% |
| TT | AAA | 560 | 6 | 70% |
| UU | FFF | 560 | 6 | 70% |

All samples (except UU) that were subjected to the disclosed flash homogenization and that were hot rolled to at least 50% reduction of thickness, followed by additional homogenization and hot rolling to a desired gauge (e.g., 2 mm), showed a narrow distribution of particles sizes indicating refinement of the Fe-constituent particles. Samples not subjected to the disclosed flash homogenization exhibited less refinement of the Fe-constituent particles. Sample UU was subjected to the disclosed flash homogenization (e.g., 570° C. for 5 minutes) and hot rolled to 70% reduction in thickness immediately, and exhibited excellent refinement of Fe-constituent particles after further homogenization and additional 40% hot rolling.

Figure 35:
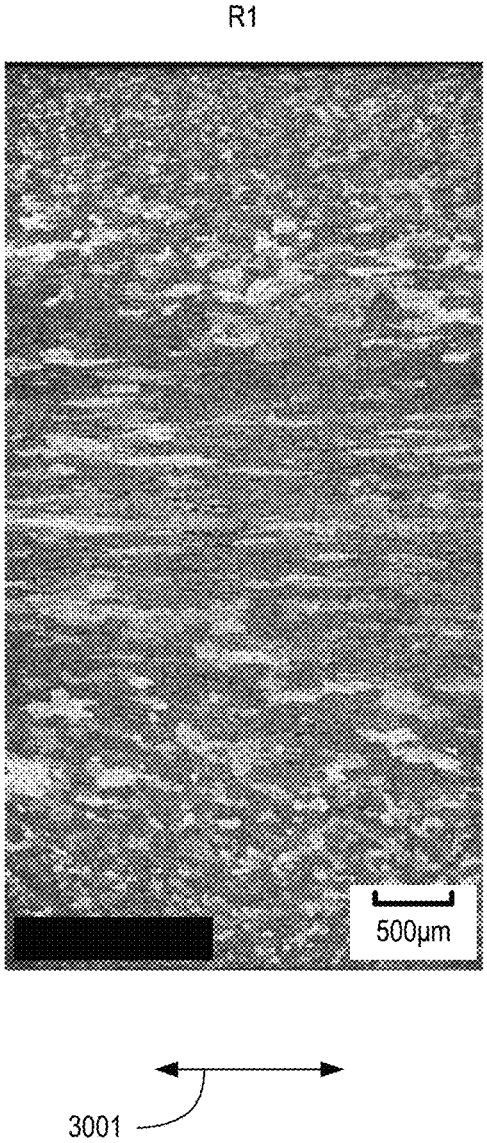
FIG. 35 is a micrograph showing microstructure of an AA6014 aluminum alloy that was continuously cast into a slab having a 19 mm gauge thickness, cooled and stored, preheated and hot rolled to 11 mm thickness, and further hot rolled to 6 mm thickness, referred to as "R1."
Figure 36:
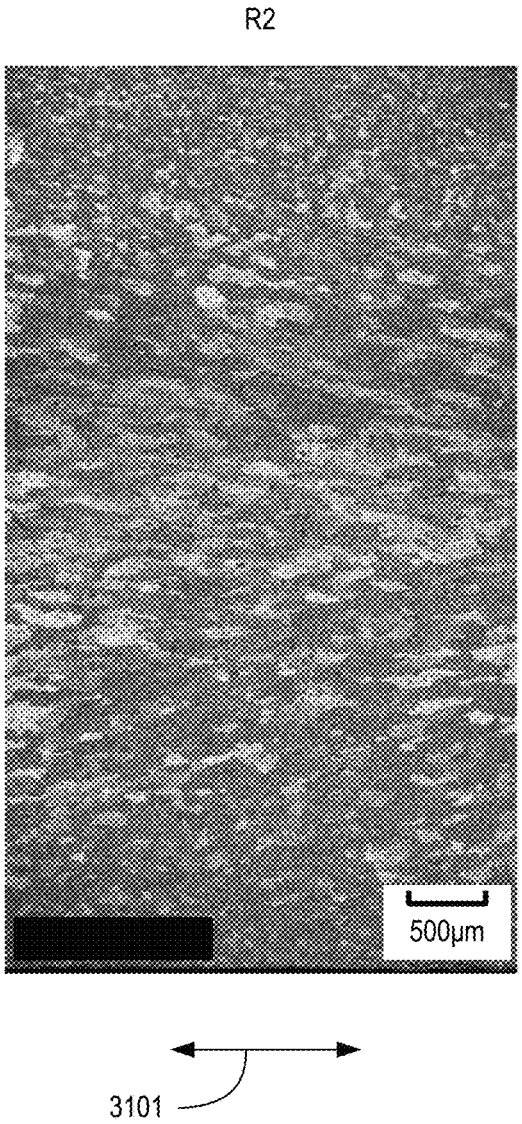
FIG. 36 is a micrograph showing microstructure of an AA6014 aluminum alloy that was continuously cast into a slab having a 10 mm gauge thickness, cooled and stored, preheated and hot rolled to 5.5 mm thickness, referred to as "R2."
Figure 37:
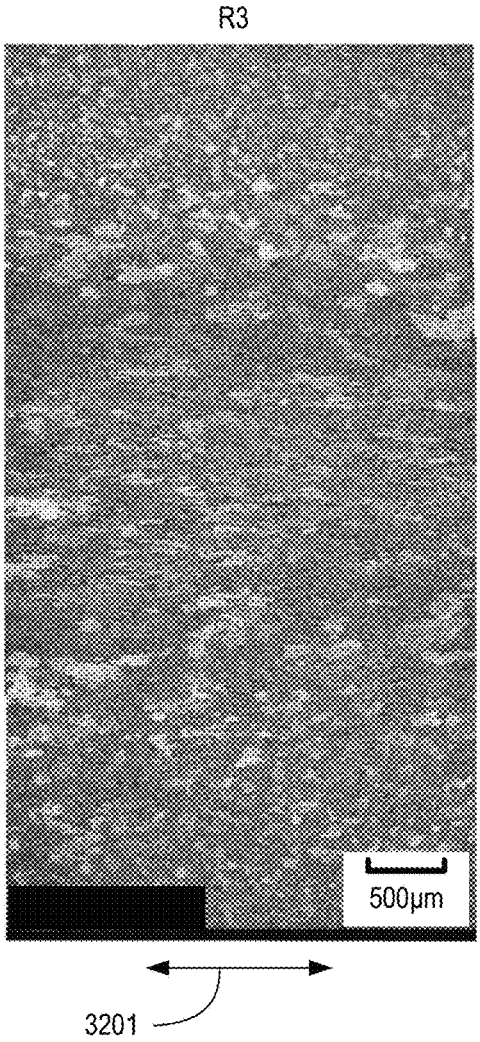
FIG. 37 is a micrograph showing microstructure of an AA6014 aluminum alloy that was continuously cast into a slab having a 19 mm gauge thickness, cooled and stored, cold rolled to 11 mm thickness, preheated, and hot rolled to 6 mm thickness, referred to as "R3."

FIG. 35, FIG. 36, and FIG. 37 are micrographs showing microstructure of an AA6014 aluminum alloy. FIG. 35 shows the AA6014 aluminum alloy that was continuously cast into a slab having a 19 mm gauge thickness, cooled and stored, preheated and hot rolled to 11 mm thickness, and further hot rolled to 6 mm thickness, referred to as "R1." Preheating was performed by heating the cooled slab under two conditions, either (i) heat to 550° C. in 1 minute or (ii) heat to 420° C. in 30 seconds. Rolling direction is indicated by arrow 3001. FIG. 35 illustrates effect on grain size and degree of recrystallization after hot rolling. FIG. 36 shows the AA6014 aluminum alloy that was continuously cast into a slab having a 10 mm gauge thickness, cooled and stored, preheated and hot rolled to 5.5 mm thickness, referred to as "R2." Preheating was performed by heating the cooled slab under two conditions, either (i) heat to 550° C. in 1 minute or (ii) heat to 420° C. in 30 seconds. Rolling direction is indicated by arrow 3101. FIG. 36 illustrates effect on grain size and degree of recrystallization after hot rolling. FIG. 37 shows the AA6014 aluminum alloy that was continuously cast into a slab having a 19 mm gauge thickness, cooled and stored, cold rolled to 11 mm thickness, preheated, and hot rolled to 6 mm thickness, referred to as "R3." Preheating was performed by heating the cooled slab under two conditions, either (i) heat to 550° C. in 1 minute or (ii) heat to 420° C. in 30 seconds. Rolling direction is indicated by arrow 3201. FIG. 37 illustrates effect on grain size and degree of recrystallization after hot rolling.

Figure 38:
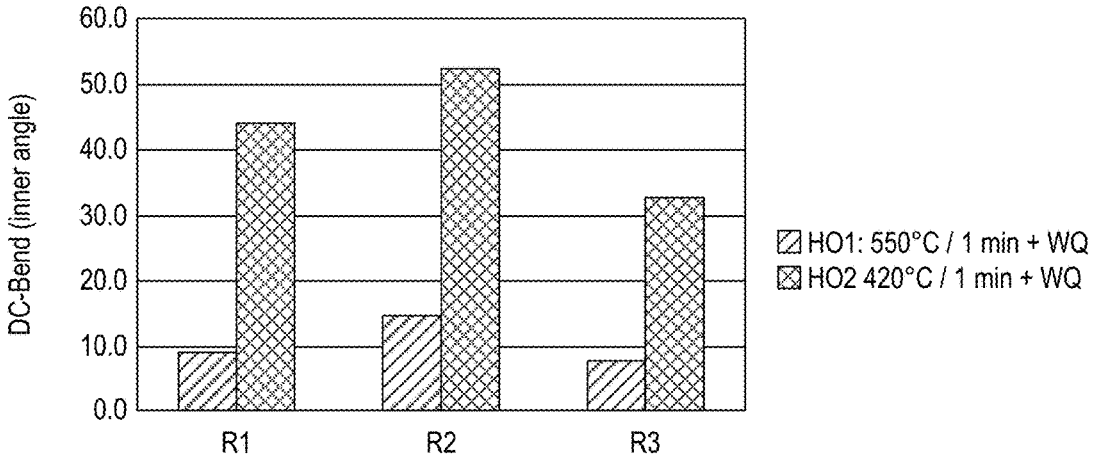
FIG. 38 is a graph showing effects of preheating on formability of the AA6014 aluminum alloy.

FIG. 38 is a graph showing effects of preheating on formability of the AA6014 aluminum alloy. The AA6014 aluminum alloy was subjected to heating and rolling procedures as described above for FIGS. 30-32, referred to as "R1, R2, and R3," respectively. Preheating the AA6014 aluminum alloy at a temperature of 550° C. for 1 minute (referred to as "HO1," left histogram in each group) provided an aluminum alloy with excellent formability properties, indicated by inner bending angles less than 20°. Preheating the AA6014 aluminum alloy at a temperature of 420° C. for 1 minute (referred to as "HO2," right histogram in each group) provided an aluminum alloy with a very low formability, indicated by relatively high inner bending angles (e.g., above 20°). All samples were quenched with water after hot rolling (referred to as "WQ") and pre-strained 10% prior to bend testing.

Figure 39:
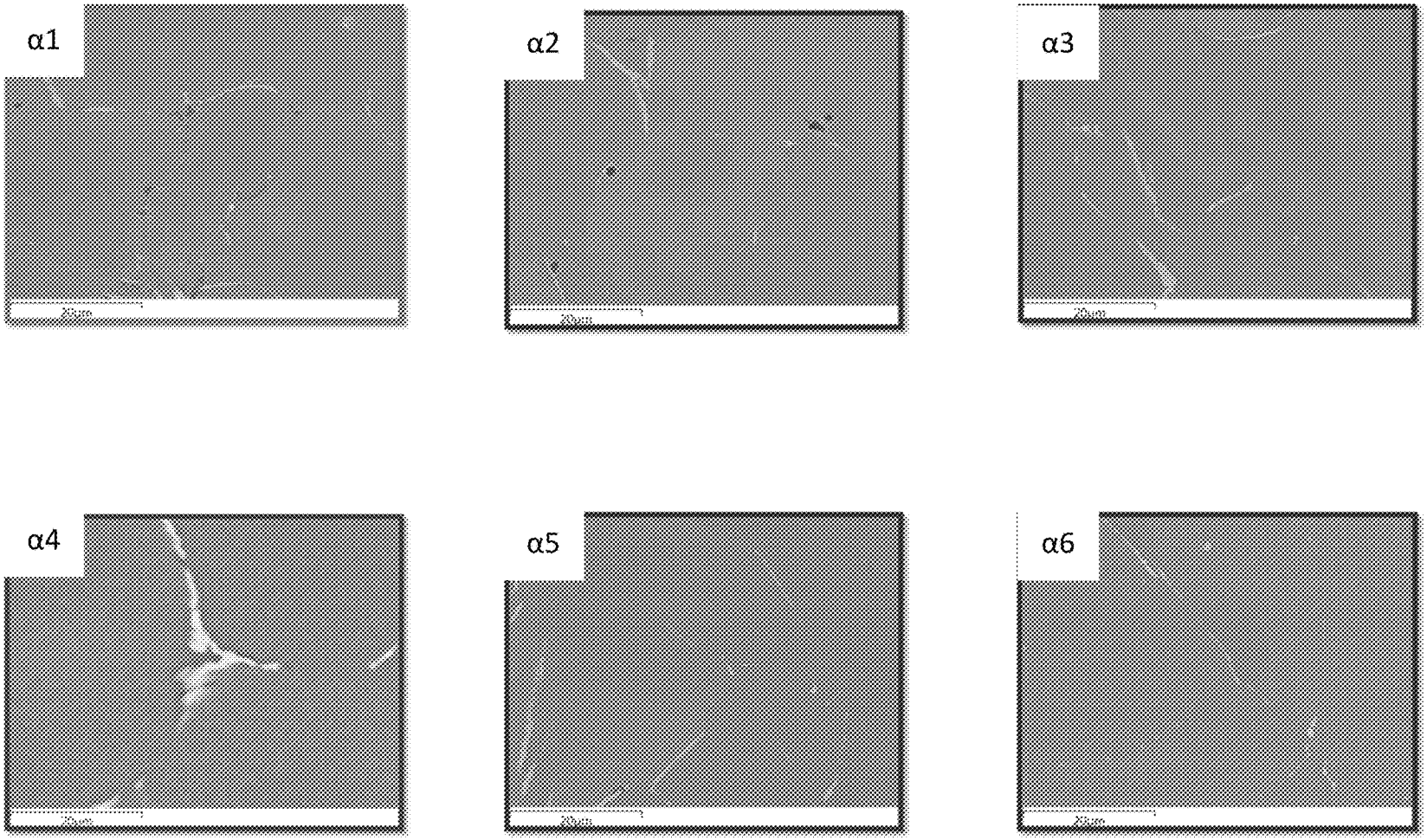
FIG. 39 is a set of scanning electron microscope (SEM) micrographs showing Fe-constituent particles in an 11.3 mm gauge section of AA6111 metal.

FIG. 39 is a set of scanning electron microscope (SEM) micrographs showing Fe-constituent particles in an 11.3 mm gauge section of AA6111 metal. Panels α1, α2, α3, α5, and α6 depict metal that has been cast using a continuous casting device, such as the continuous belt caster 2208 of the hot band continuous casting system 2200 of FIG. 22. Panel α1 shows the as-cast metal, with large needle-like Fe-constituent particles. Panel α4 shows an equivalent piece of metal from a direct chill cast system, with very large Fe-constituent particles. Panels α2, α3, α5, and α6 have all been heated in a soaking furnace after casting (e.g., soaking furnace 2217 of FIG. 22) for 2 minutes at peak metal temperatures of 540° C., 550° C., 560° C., and 570° C., respectively. Smaller Fe-constituents are seen in each of panels α2, α3, α5, and α6, with the smallest in panel α6. Further, almost no spheroidization is seen in any panels except panel α6.

Figure 40:
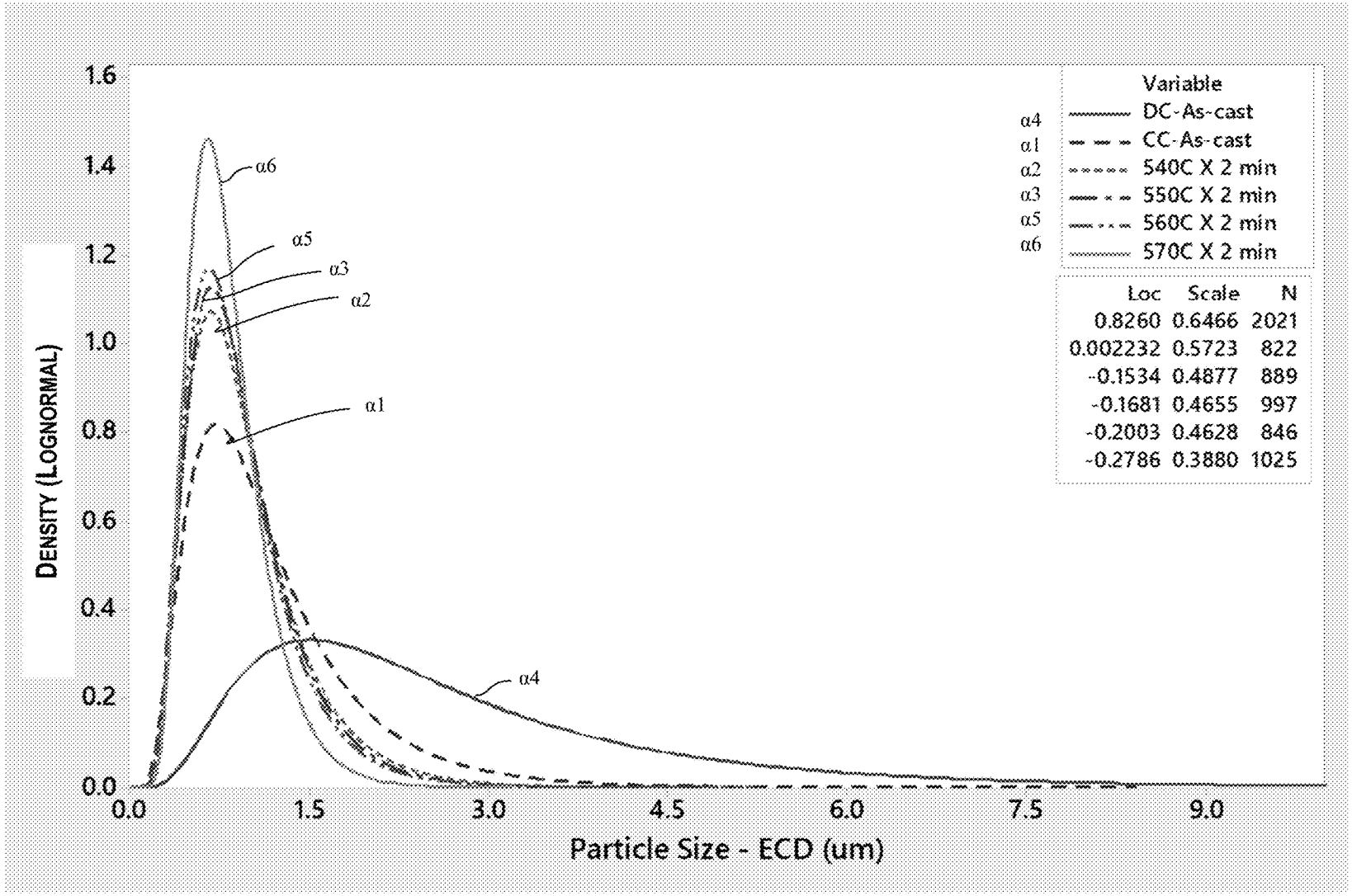
FIG. 40 is a graph depicting equivalent circle diameter (ECD) for Fe-constituent particles in the metal pieces shown and described with reference to FIG. 39.

FIG. 40 is a graph depicting equivalent circle diameter (ECD) for Fe-constituent particles in the metal pieces shown and described with reference to FIG. 39. The graph of FIG. 40 is based on a log normal probability density function. Equivalent circle diameter, as used herein, can be calculated by measuring the area of a particle (e.g., a Fe-constituent particle) and determining the diameter of a circle that would have the same total area. In other words, $$ECD = 2\sqrt{\left(\frac{\text{Area}}{\pi}\right)}.$$

Figure 41:
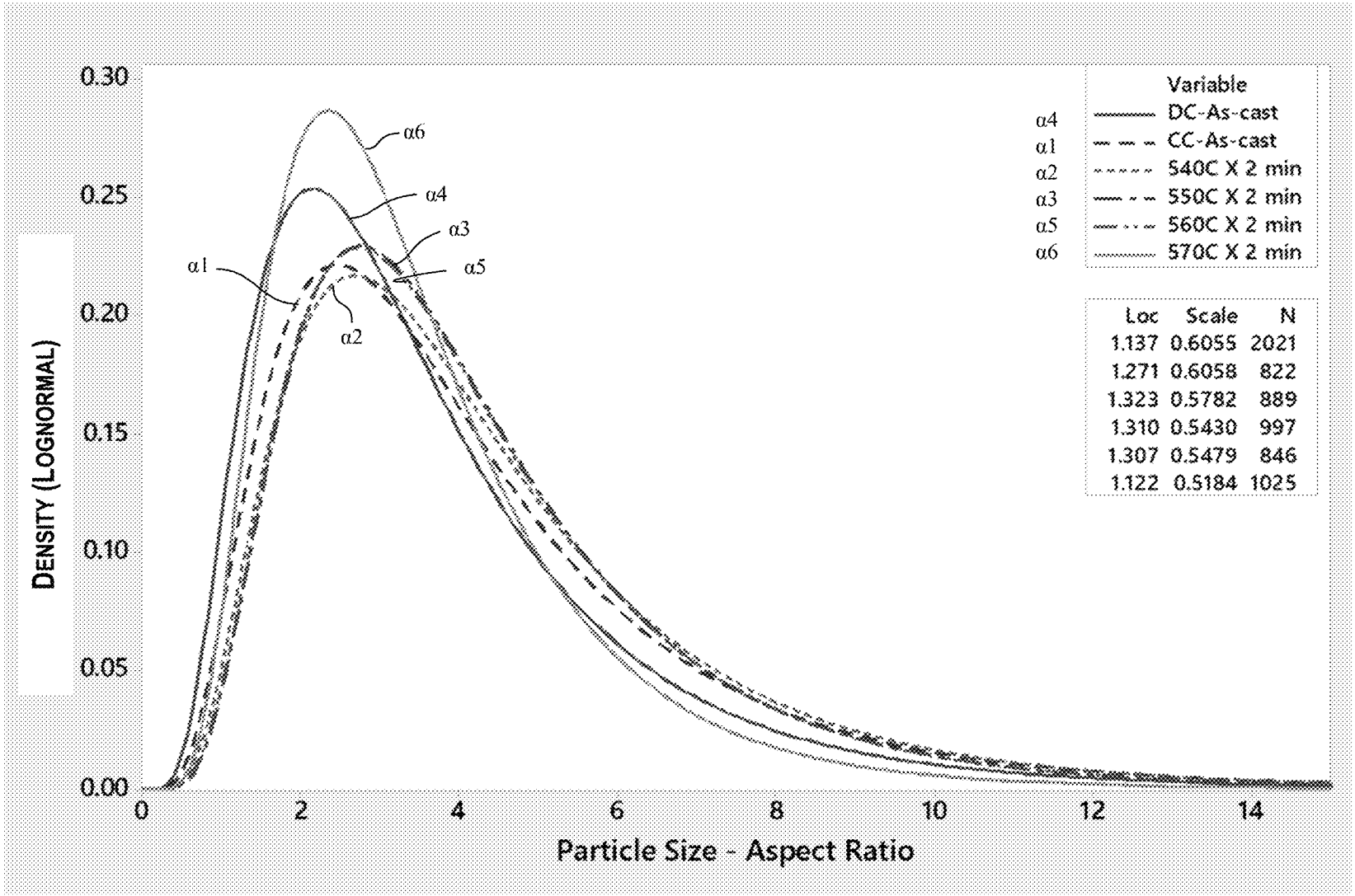
FIG. 41 is a graph depicting aspect ratios for Fe-constituent particles in the metal pieces shown and described with reference to FIG. 39.

FIG. 41 is a graph depicting aspect ratios for Fe-constituent particles in the metal pieces shown and described with reference to FIG. 39. The graph of FIG. 41 is based on a lognormal probability density function. Aspect ratio can be determined by dividing the length of a particle in a first direction by the width of the particle in a perpendicular direction. Aspect ratio can be indicative of the amount of spheroidization undergone by the particle.

Figure 42:
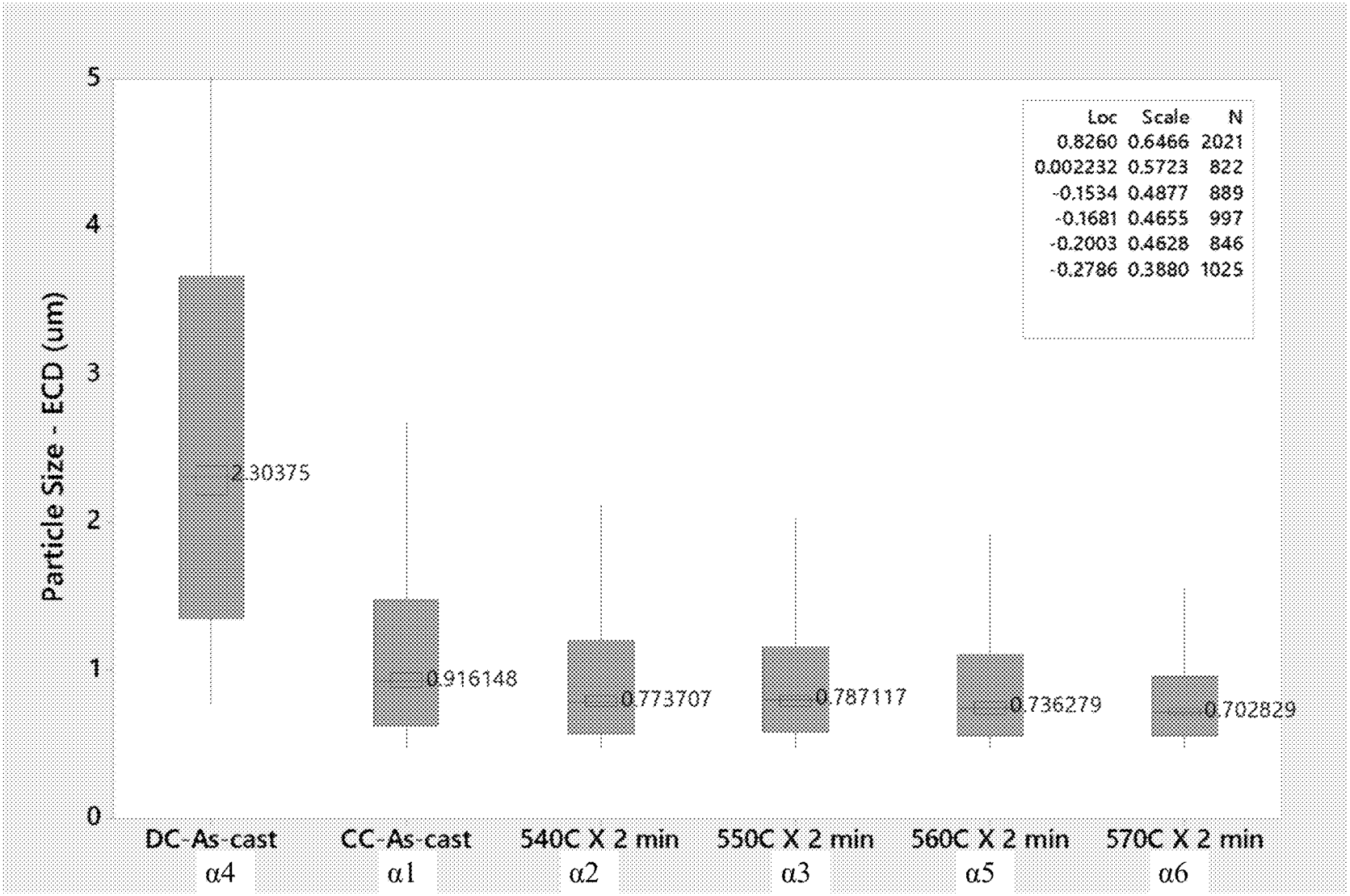
FIG. 42 is a graph depicting median and distribution data for the equivalent circle diameter for Fe-constituent particles in the metal pieces shown and described with reference to FIG. 39.

FIG. 42 is a graph depicting median and distribution data for the equivalent circle diameter for Fe-constituent particles in the metal pieces shown and described with reference to FIG. 39.

Figure 43:
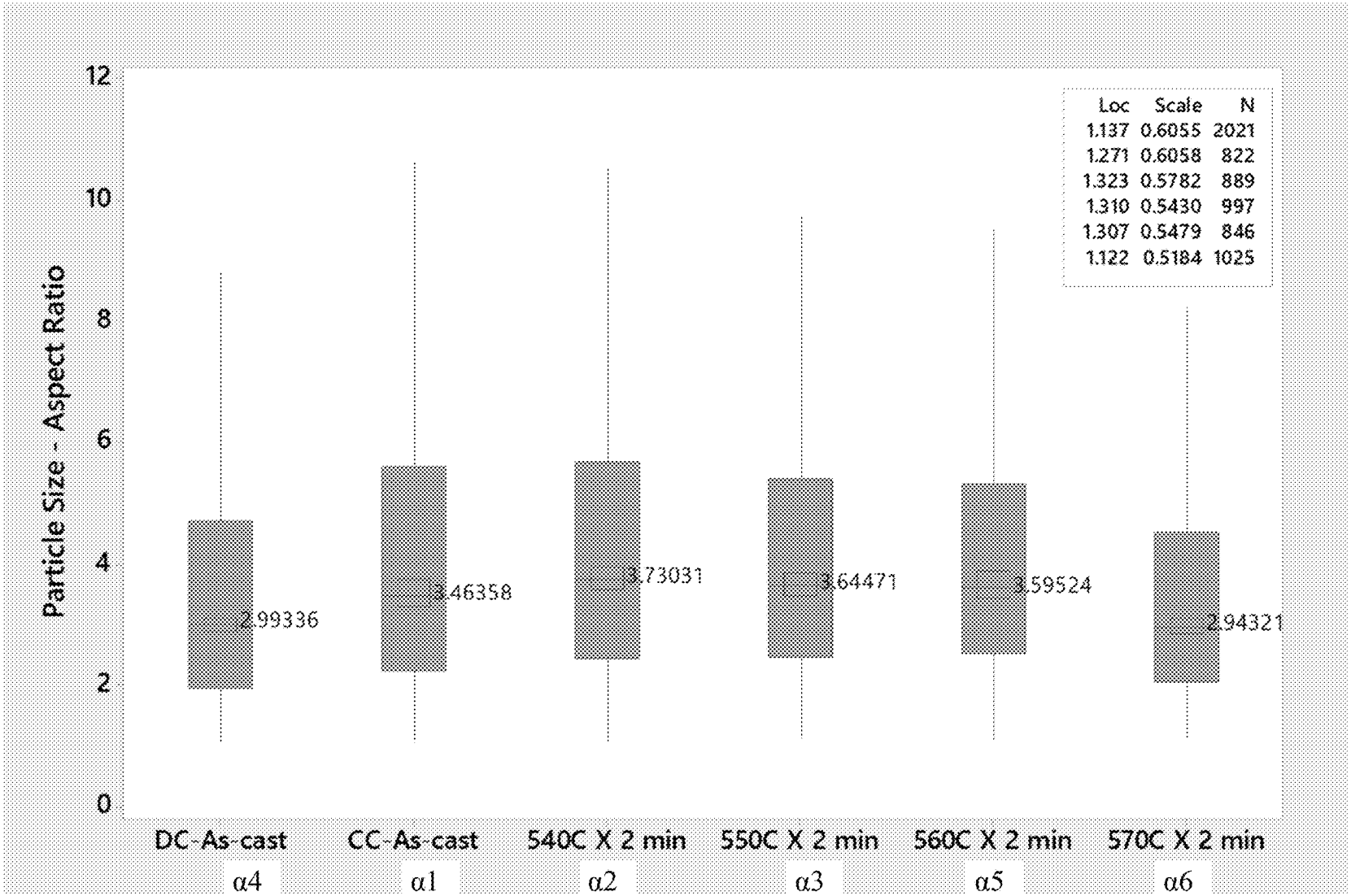
FIG. 43 is a graph depicting median and distribution data for the aspect ratio for Fe-constituent particles in the metal pieces shown and described with reference to FIG. 39.

FIG. 43 is a graph depicting median and distribution data for the aspect ratio for Fe-constituent particles in the metal pieces shown and described with reference to FIG. 39.

FIGS. 39-43 show that smaller Fe-constituents can be achieved through flash homogenization of a continuously cast metal article, especially at temperatures at or approximately 570° C. Further, higher peak metal temperatures during flash homogenization appear to show finer particles. Finally, substantial spheroidization (e.g., smaller aspect ratio) is evident when peak metal temperatures of at or approximately 570° C. are reached, with almost no spheroidization at lower temperatures.

Figure 44:
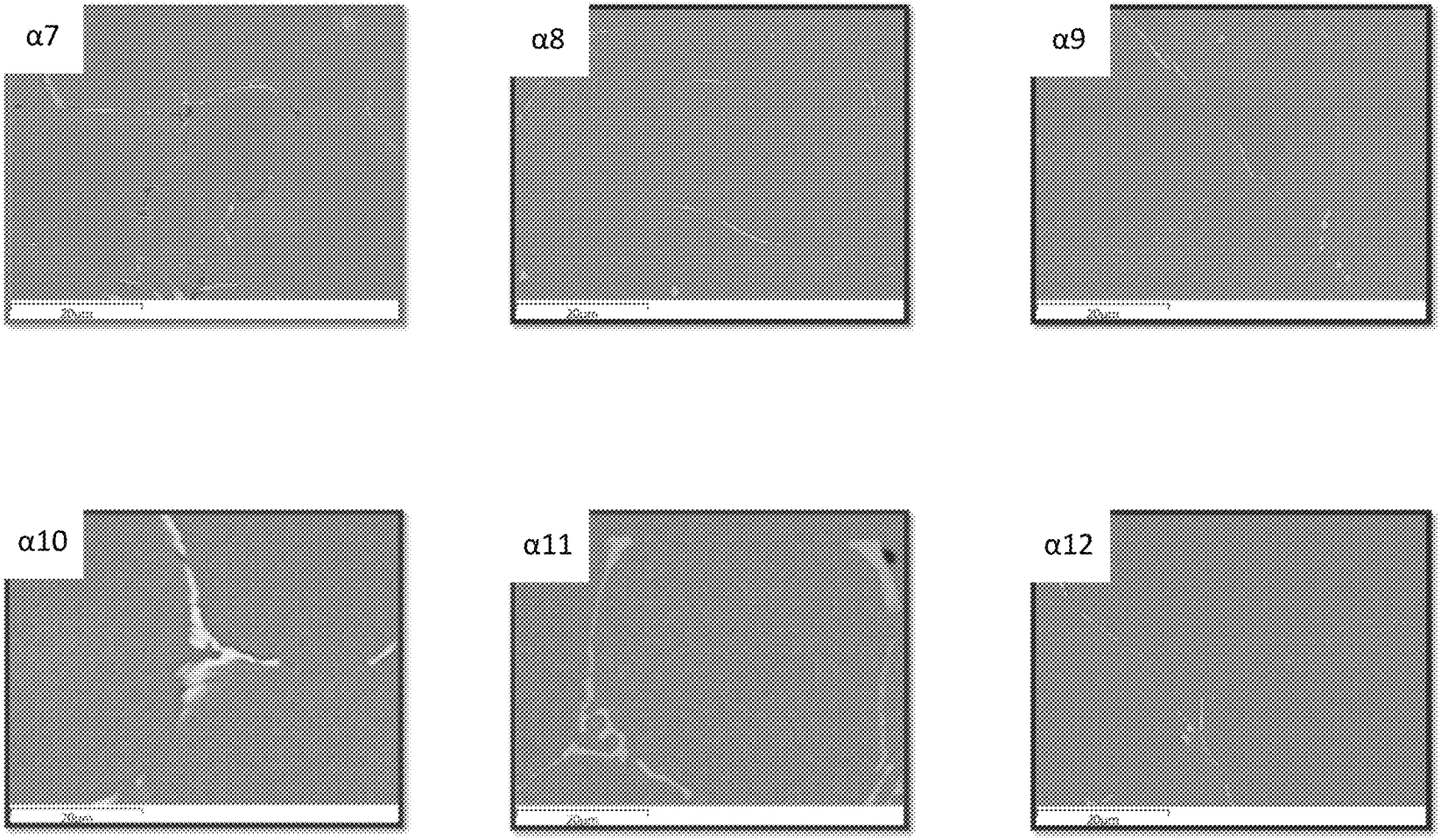
FIG. 44 is a set of scanning electron microscope (SEM) micrographs showing Fe-constituent particles in an 11.3 mm gauge section of AA6111 metal.

FIG. 44 is a set of scanning electron microscope (SEM) micrographs showing Fe-constituent particles in an 11.3 mm gauge section of AA6111 metal. Panels α7, α8, α9, and all depict metal that has been cast using a continuous casting device, such as the continuous belt caster 2208 of the hot band continuous casting system 2200 of FIG. 22. Panel α7 shows the as-cast metal, with large needle-like Fe-constituent particles. Panel α10 shows an equivalent piece of metal from a direct chill cast system, with very large Fe-constituent particles. Panel α11 shows an equivalent piece of metal from a direct chill cast system after having been submitted to a 2 minute homogenization at a peak metal temperature of 570° C. Panels α8, α9, and α12 have all been heated in a soaking furnace after casting (e.g., soaking furnace 2217 of FIG. 22) to a peak metal temperature of 570° C. for periods of 1 minute, 2 minutes, and 3 minutes, respectively. Smaller Fe-constituents are seen in each of panels α8, α9, and all, with the smallest in panel α11. Longer soak times showed more spheroidization, with desirable spheroidization achieved at 2 and 3 minutes. A 2 minute soak for a direct chill cast ingot did not show any noticeable change in microstructure.

Figure 45:
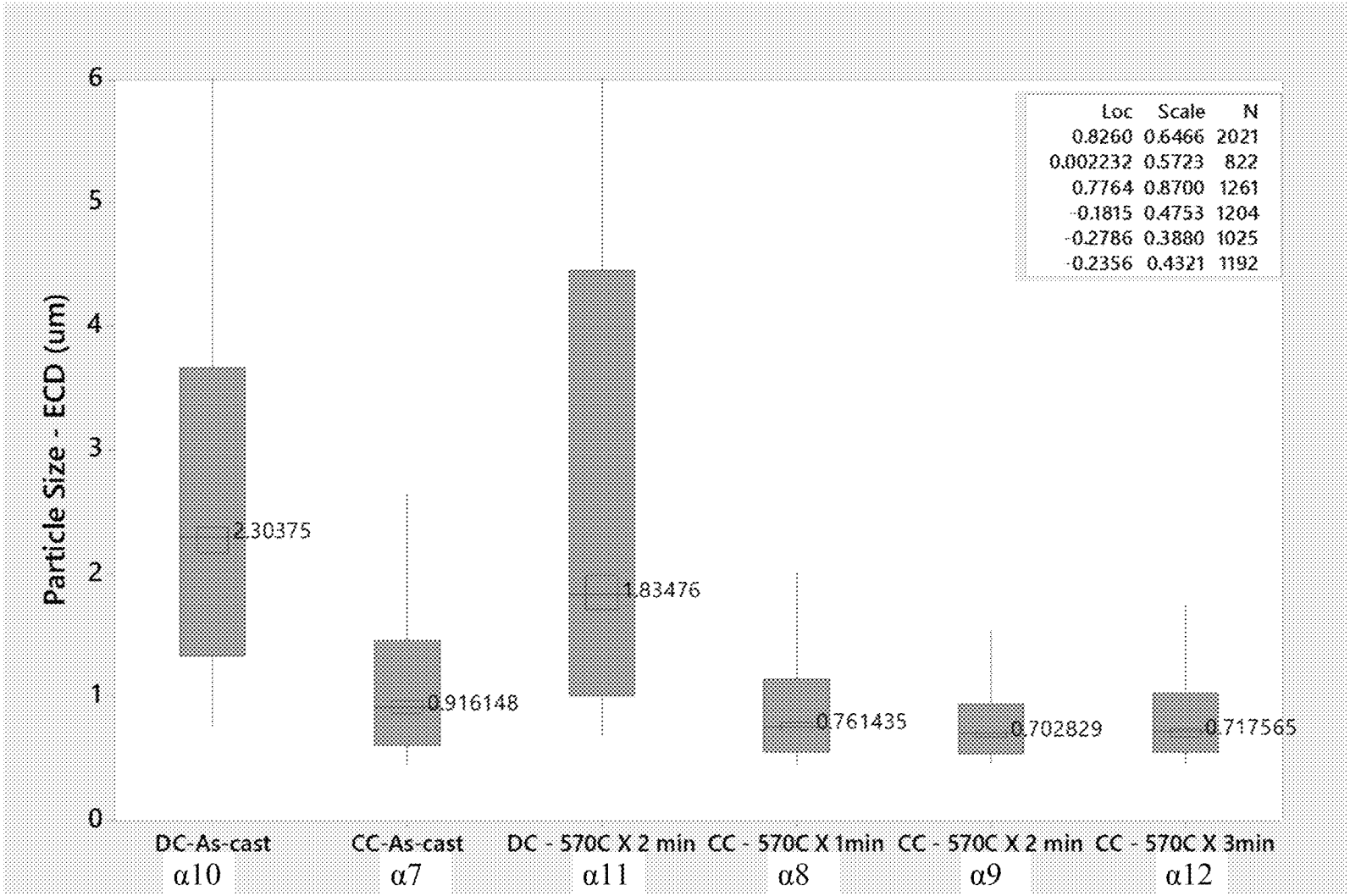
FIG. 45 is a graph depicting median and distribution data for the equivalent circle diameter for Fe-constituent particles in the metal pieces shown and described with reference to FIG. 44.

FIG. 45 is a graph depicting median and distribution data for the equivalent circle diameter for Fe-constituent particles in the metal pieces shown and described with reference to FIG. 44.

Figure 46:
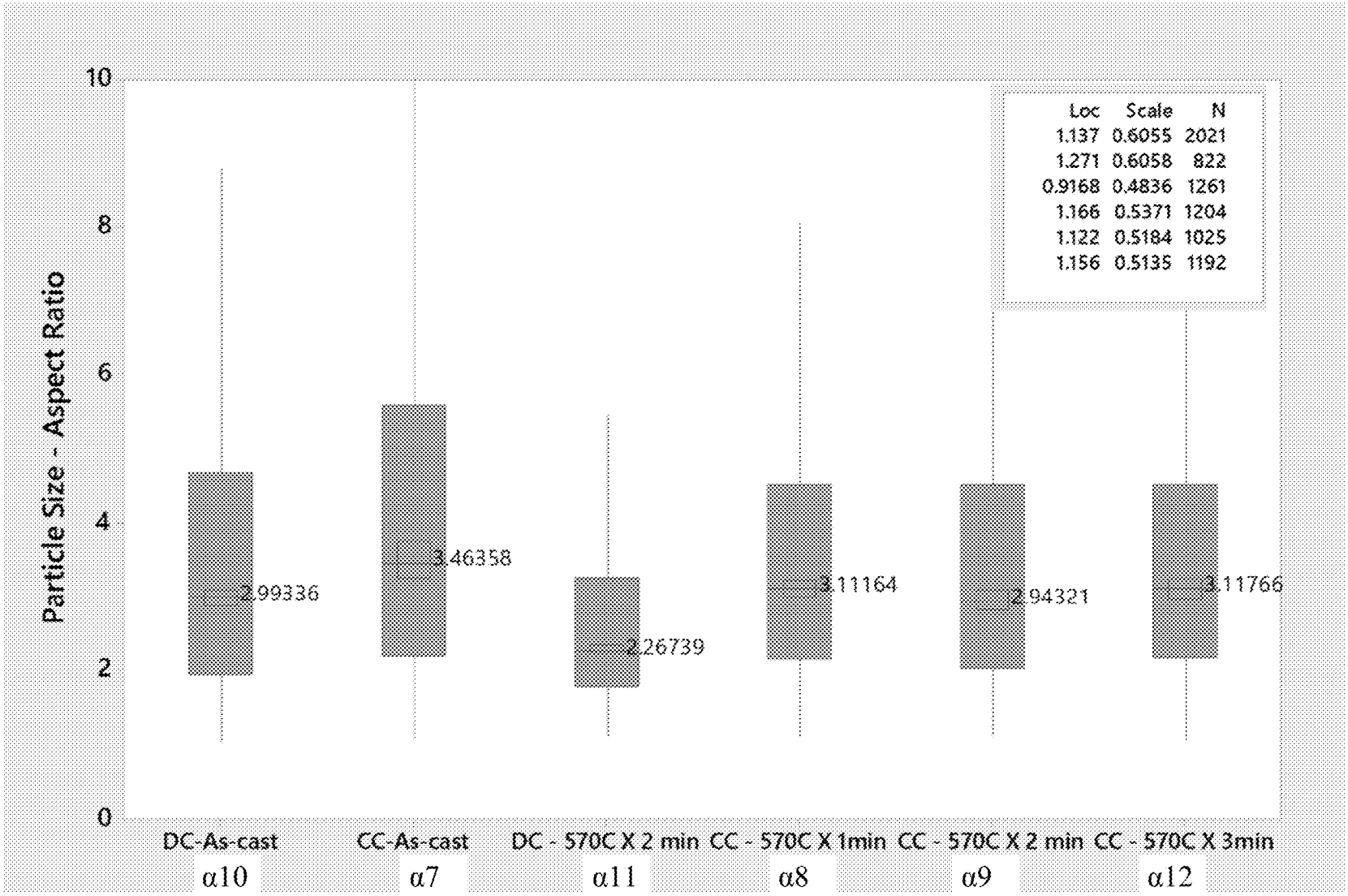
FIG. 46 is a graph depicting median and distribution data for the aspect ratio for Fe-constituent particles in the metal pieces shown and described with reference to FIG. 44.

FIG. 46 is a graph depicting median and distribution data for the aspect ratio for Fe-constituent particles in the metal pieces shown and described with reference to FIG. 44.

FIGS. 45 and 46 show that smaller Fe-constituents can be achieved through flash homogenization of a continuously cast metal article, especially at temperatures at or approximately 570° C., with soak times of at least at or approximately 1 or 2 minutes.

Figure 47:
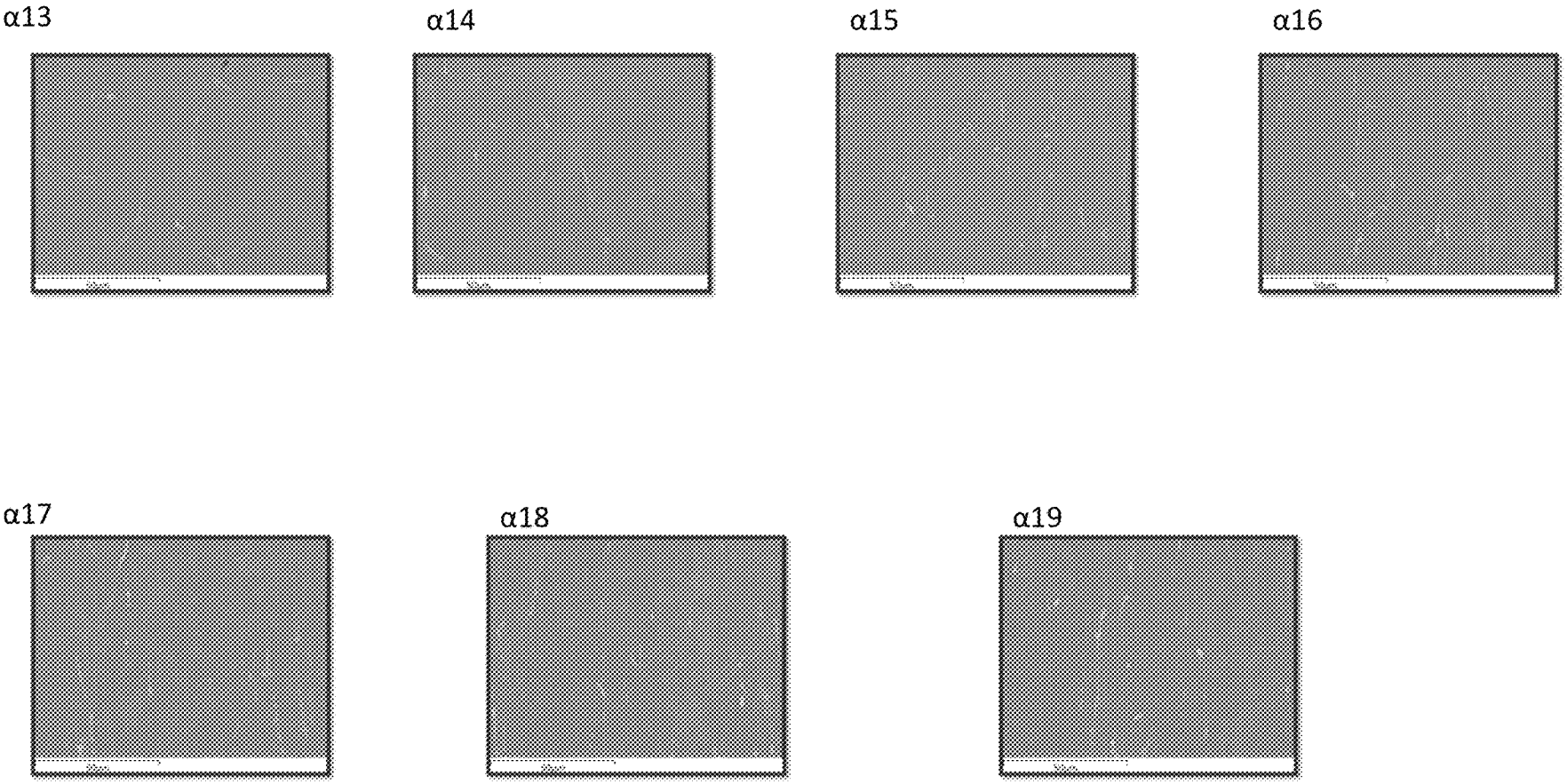
FIG. 47 is a set of scanning electron microscope (SEM) micrographs showing Fe-constituent particles in an 11.3 mm gauge section of AA6111 metal.

FIG. 47 is a set of scanning electron microscope (SEM) micrographs showing Fe-constituent particles in an 11.3 mm gauge section of AA6111 metal. Panel α13 depicts metal that has been cast using a continuous casting device, such as the continuous belt caster 2208 of the hot band continuous casting system 2200 of FIG. 22, subjected to flash homogenization at 565° C. for 5 minutes (e.g., using soaking furnace 2217 of FIG. 22), then subject to no hot rolling. Panels α14, α15, α16, α17, α18, and α19 depict metal that has been cast using a continuous casting device, such as the continuous belt caster 2208 of the hot band continuous casting system 2200 of FIG. 22, subjected to flash homogenization at 565° C. for 5 minutes (e.g., using soaking furnace 2217 of FIG. 22), then subject to hot rolling (e.g., using rolling stand 2284 of FIG. 22) at reductions of thickness of 10%, 20%, 30%, 40%, 50%, 60%, and 70%, respectively. Smaller Fe-constituents are shown after flash homogenization followed by higher hot reduction, although a plateau appears to exist after which a higher reduction of thickness attributes a smaller benefit.

Figure 48:
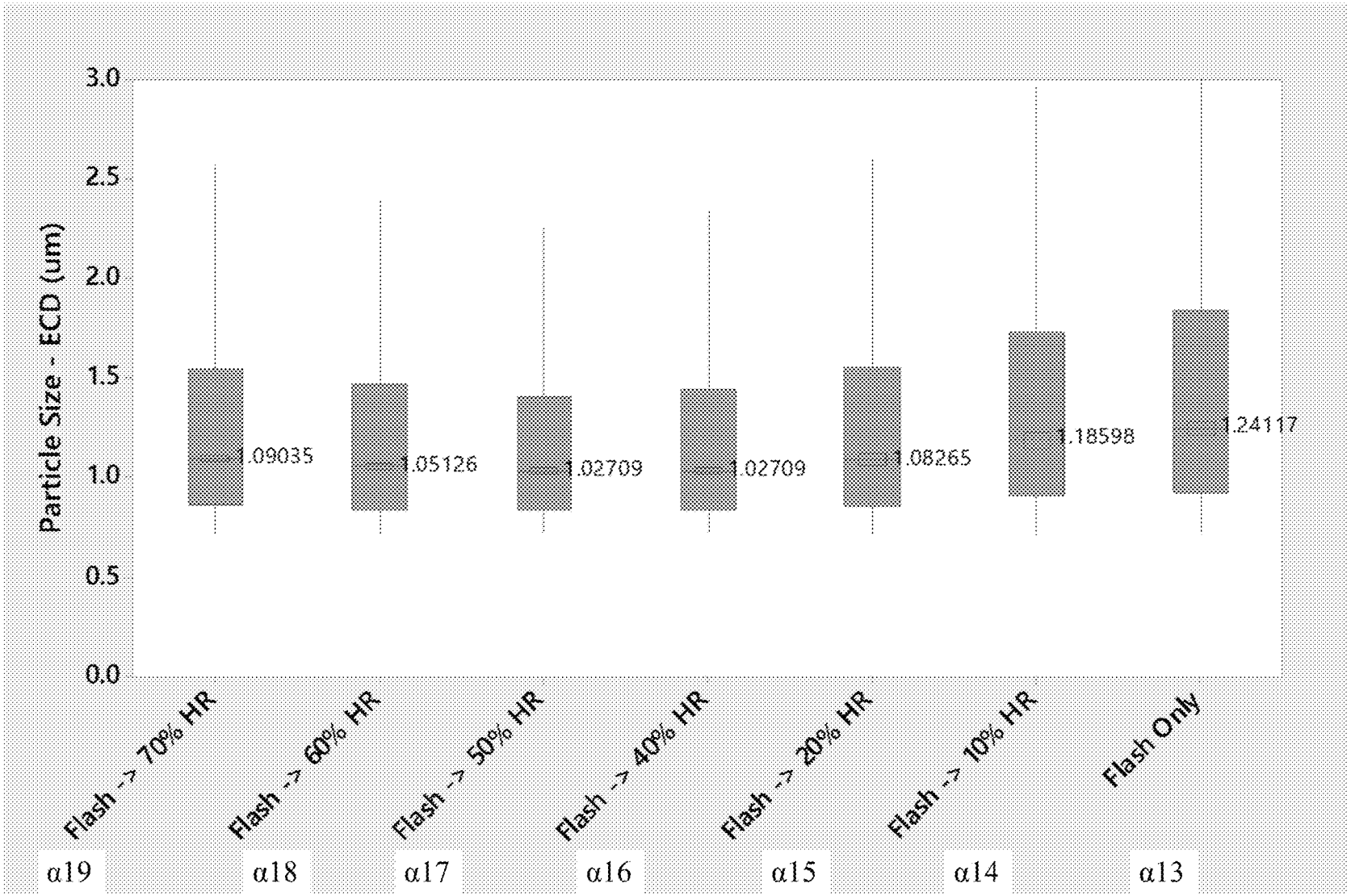
FIG. 48 is a graph depicting median and distribution data for the equivalent circle diameter for Fe-constituent particles in the metal pieces shown and described with reference to FIG. 47.

FIG. 48 is a graph depicting median and distribution data for the equivalent circle diameter for Fe-constituent particles in the metal pieces shown and described with reference to FIG. 47.

Figure 49:
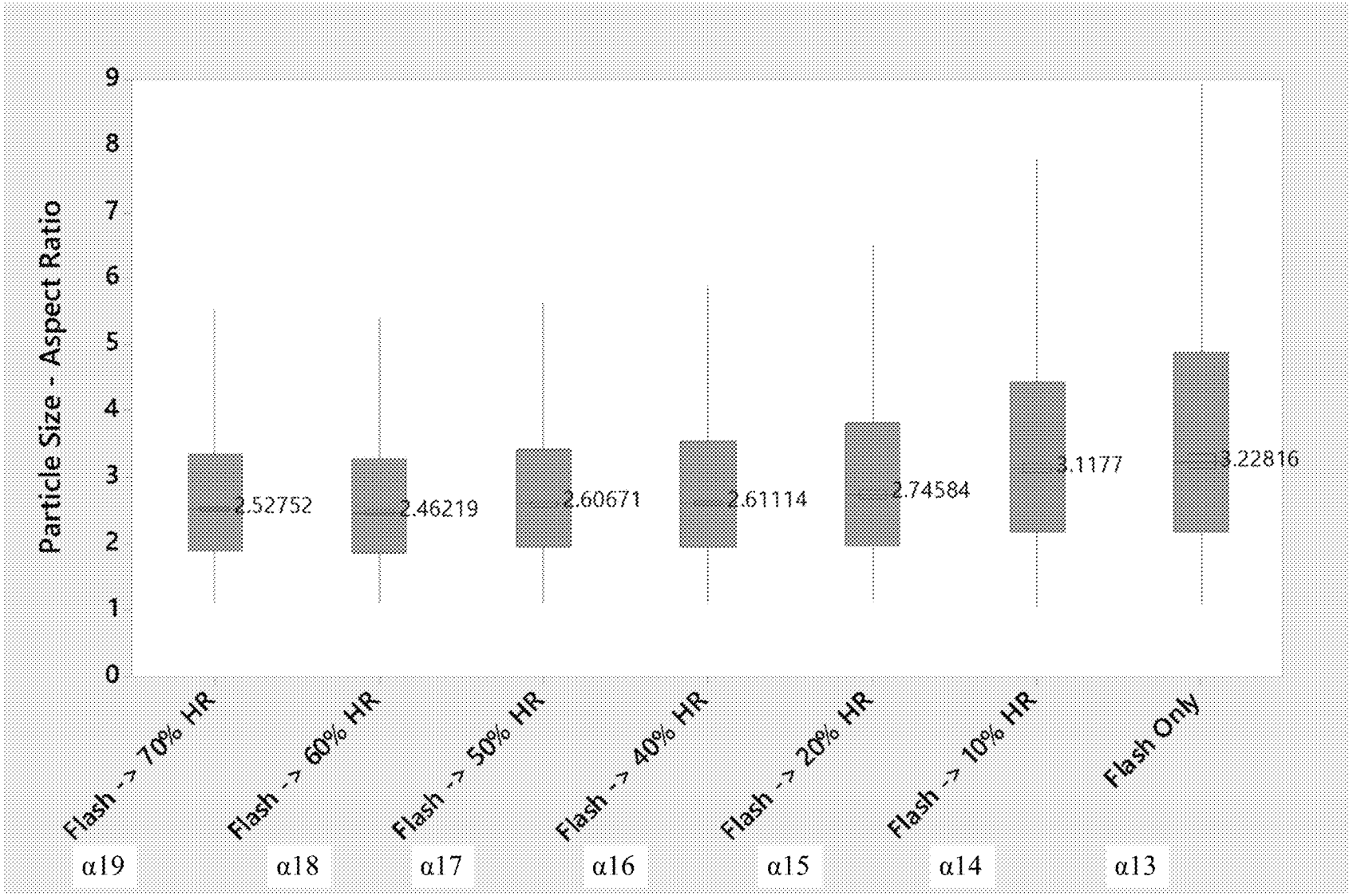
FIG. 49 is a graph depicting median and distribution data for the aspect ratio for Fe-constituent particles in the metal pieces shown and described with reference to FIG. 47.

FIG. 49 is a graph depicting median and distribution data for the aspect ratio for Fe-constituent particles in the metal pieces shown and described with reference to FIG. 47.

FIGS. 48 and 49 show that smaller Fe-constituents can be achieved through flash homogenization of a continuously cast metal article followed by hot rolling, especially at reductions of thickness of at or approximately 40%-70%. Higher hot reduction shows more breakup of Fe-constituent particles, although hot reduction from 50%-70% appears to provide a relatively similar amount of breakup.

Figure 50:
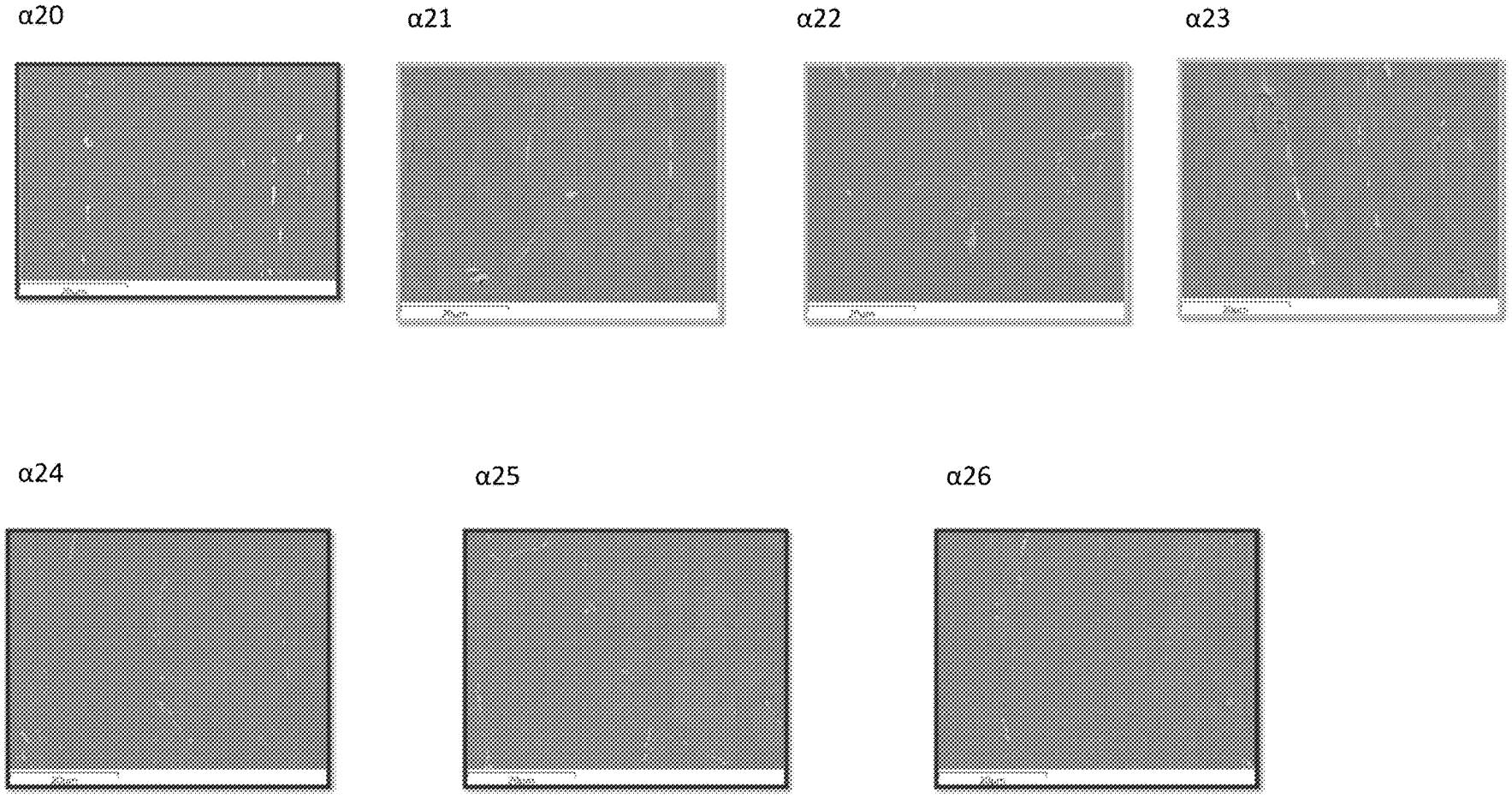
FIG. 50 is a set of scanning electron microscope (SEM) micrographs showing Fe-constituent particles in sections of AA6111 metal after undergoing various processing routes to achieve a 3.7-6 mm gauge band.

FIG. 50 is a set of scanning electron microscope (SEM) micrographs showing Fe-constituent particles in sections of AA6111 metal after undergoing various processing routes to achieve a 3.7-6 mm gauge band. Panel α20 depicts a direct chill cast metal that has been rerolled down to approximately 3.7-6 mm gauge. Panels α21, α22, α23, α24, α25, and α26 depict metal that has been cast using a continuous casting device, such as the continuous belt caster 2208 of the hot band continuous casting system 2200 of FIG. 22 and subjected to some amount of hot rolling (e.g., using rolling stand 2284 of FIG. 22). Panels α21, α22, and α23 were subjected to no flash homogenization, while panels α24, α25, and α26 were subjected to flash homogenization. Panels α21 and α24 underwent 45% reduction of thickness, panels α22 and α25 underwent 45% reduction of thickness and reheating to 530° C. for 2 hours, and panels α23 and α26 underwent 60% reduction of thickness. Smaller Fe-constituent particles were seen after flash homogenization followed by higher hot reduction. Additionally, reheating after hot rolling appeared to promote spheroidization.

Figure 51:
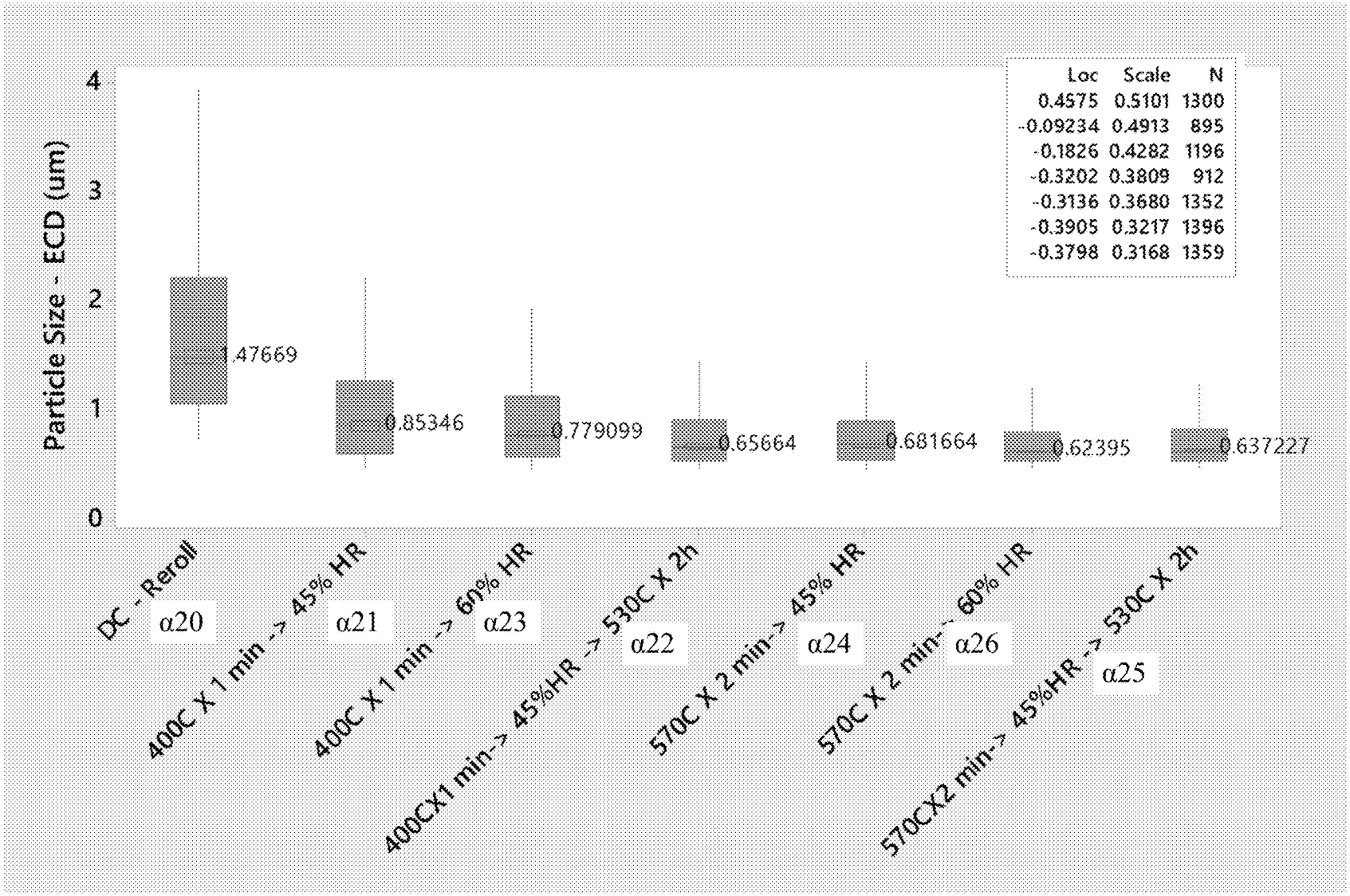
FIG. 51 is a graph depicting median and distribution data for the equivalent circle diameter for Fe-constituent particles in the metal pieces shown and described with reference to FIG. 50.

FIG. 51 is a graph depicting median and distribution data for the equivalent circle diameter for Fe-constituent particles in the metal pieces shown and described with reference to FIG. 50.

Figure 52:
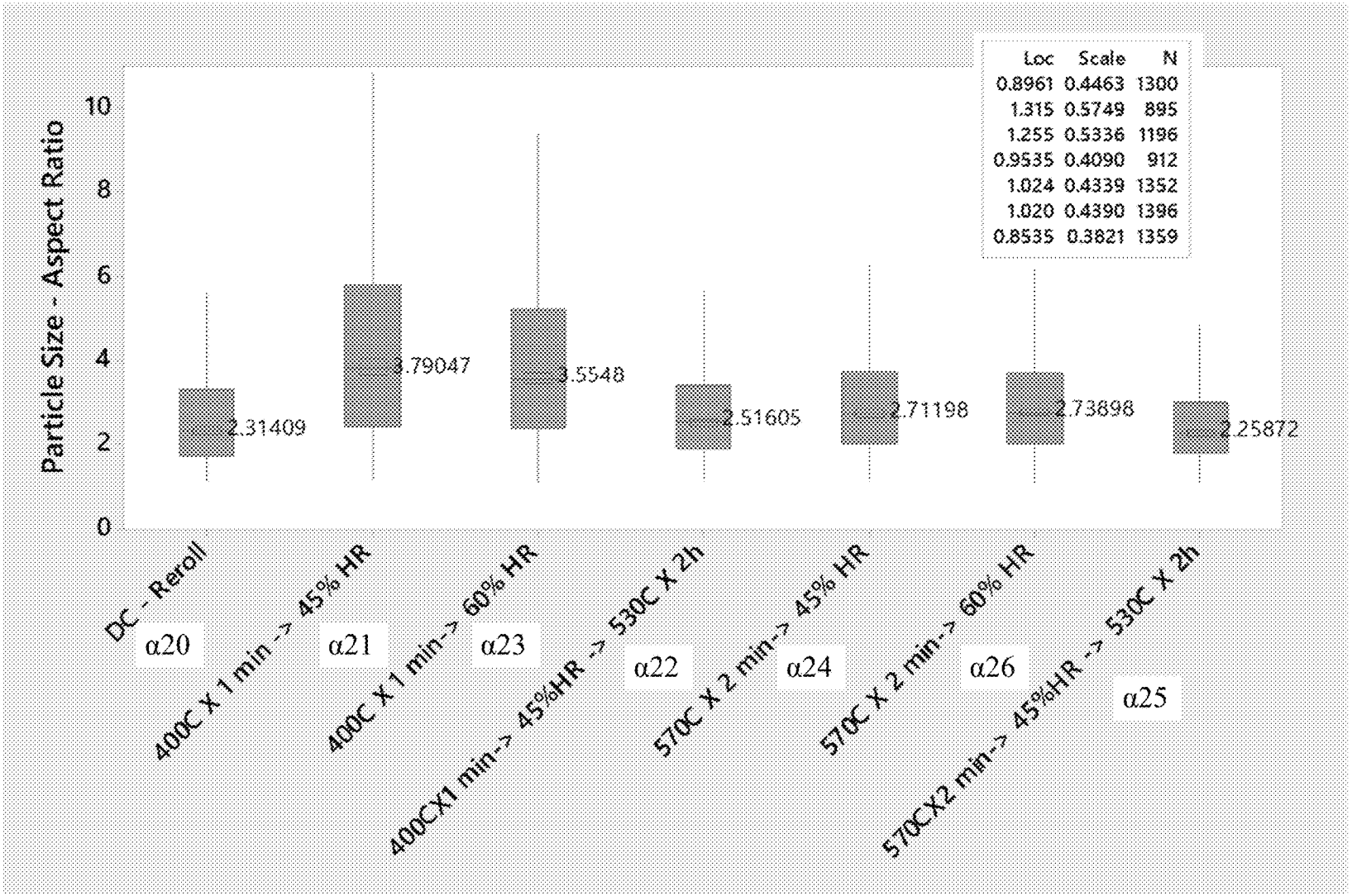
FIG. 52 is a graph depicting median and distribution data for the aspect ratio for Fe-constituent particles in the metal pieces shown and described with reference to FIG. 50.

FIG. 52 is a graph depicting median and distribution data for the aspect ratio for Fe-constituent particles in the metal pieces shown and described with reference to FIG. 50.

FIGS. 51 and 52 show that smaller Fe-constituents can be achieved through flash homogenization of a continuously cast metal article followed by hot rolling, especially over hot rolling without flash homogenization. Additionally, reheating after hot rolling appeared to improve spheroidization.

Figure 53:
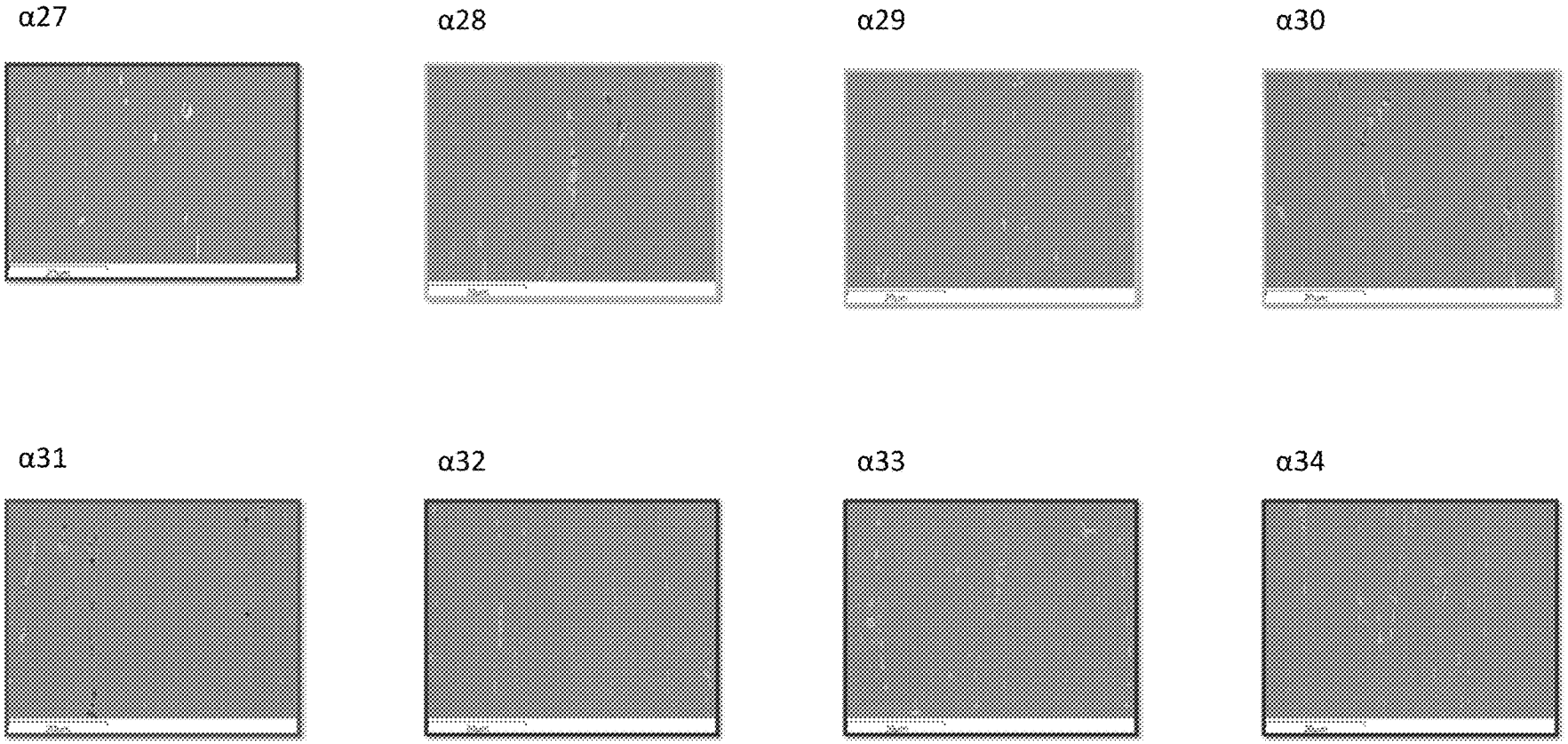
FIG. 53 is a set of scanning electron microscope (SEM) micrographs showing Fe-constituent particles in sections of AA6111 metal after undergoing various processing routes to achieve a 2.0 mm gauge strip.

FIG. 53 is a set of scanning electron microscope (SEM) micrographs showing Fe-constituent particles in sections of AA6111 metal after undergoing various processing routes to achieve a 2.0 mm gauge strip. Panel α27 depicts a direct chill cast metal that has been rolled down to a final gauge of 2.0 mm. Panels α28, α29, α30, α31, α32, α33, and α34 depict metal that has been cast using a continuous casting device, such as the continuous belt caster 2208 of the hot band continuous casting system 2200 of FIG. 22. Panel α31 has been continuously cast and then cold rolled to a final gauge of 2.0 mm. Panels α28, α29, α30, α32, α33, and α34 have been subjected to some amount of hot rolling (e.g., using rolling stand 2284 of FIG. 22). Panels α28, α29, and α30 were subjected to no flash homogenization, while panels α32, α33, and α34 were subjected to flash homogenization. Panels α28 and α32 underwent 45% reduction of thickness under hot rolling, followed by cold rolling to a final gauge of 2.0 mm. Panels α29 and α33 underwent 45% reduction of thickness under hot rolling, reheating to 530° C. for 2 hours, then warm rolling to a final gauge of 2.0 mm. Panels α30 and α34 underwent 60% reduction of thickness under hot rolling, followed by cold rolling to a final gauge of 2.0 mm.

Figure 54:
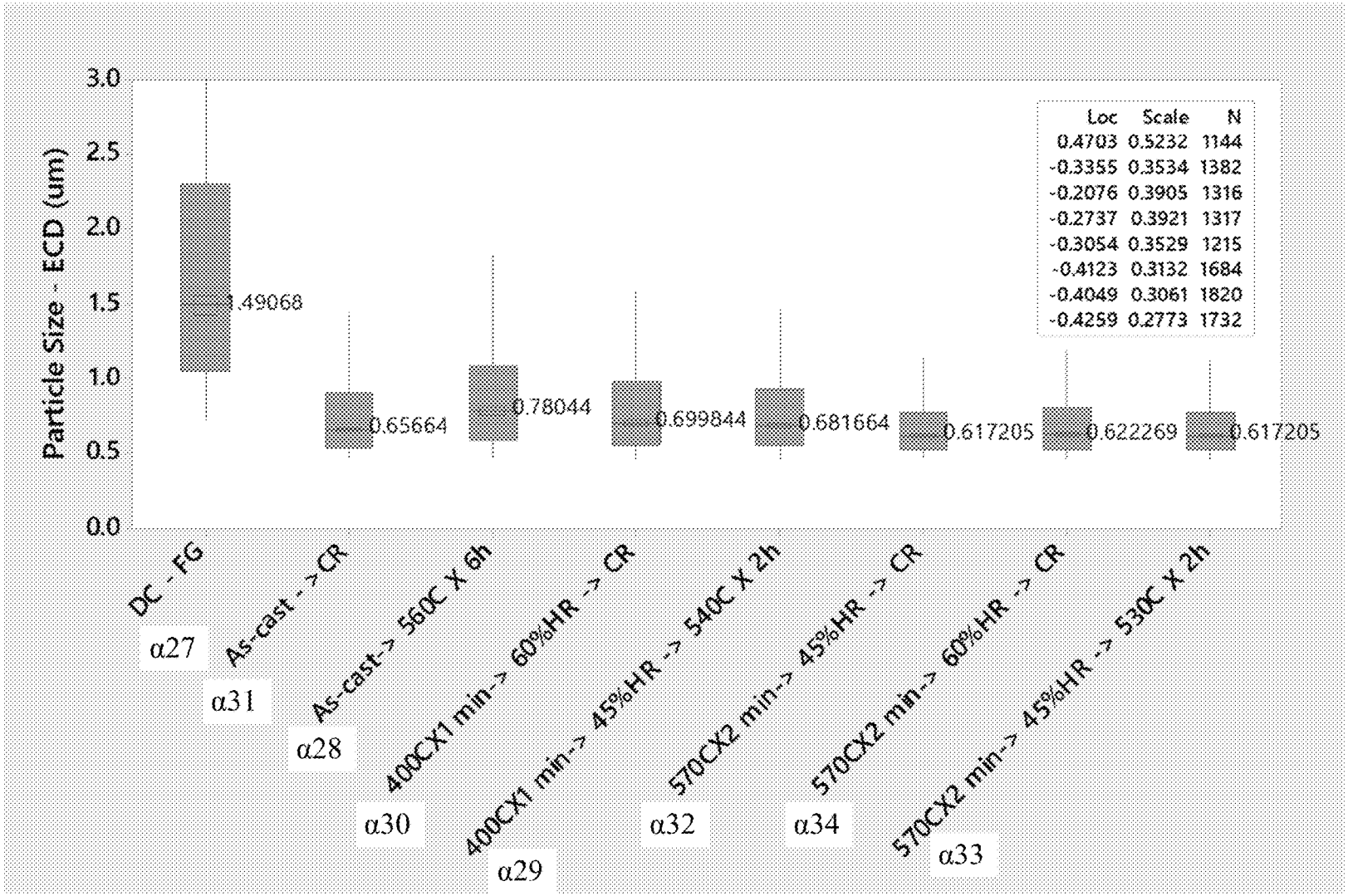
FIG. 54 is a graph depicting median and distribution data for the equivalent circle diameter for Fe-constituent particles in the metal pieces shown and described with reference to FIG. 53.

FIG. 54 is a graph depicting median and distribution data for the equivalent circle diameter for Fe-constituent particles in the metal pieces shown and described with reference to FIG. 53.

Figure 55:
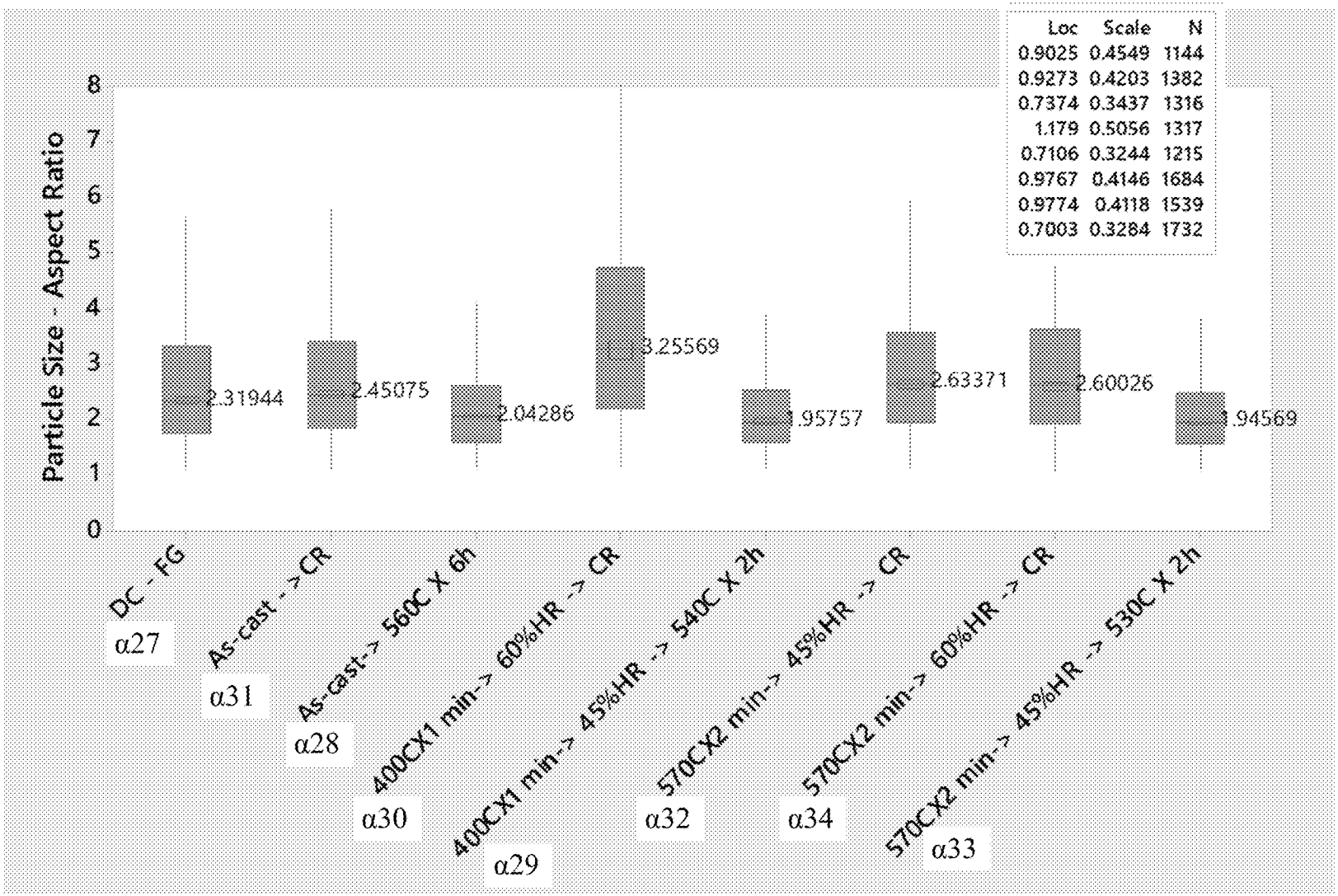
FIG. 55 is a graph depicting median and distribution data for the aspect ratio for Fe-constituent particles in the metal pieces shown and described with reference to FIG. 53.

FIG. 55 is a graph depicting median and distribution data for the aspect ratio for Fe-constituent particles in the metal pieces shown and described with reference to FIG. 53.

FIGS. 54 and 55 show that smaller Fe-constituents can be achieved through flash homogenization of a continuously cast metal article followed by hot rolling and reheating, especially when compared to only hot rolling and cold rolling. Reheating after hot rolling showed improved Fe-constituent particle spheroidization. While cold rolling after continuous casting did show some degree of Fe-constituent particle breakup, it did not achieve desirable spheroidization.

Additionally, bending tests were conducted on the samples from FIG. 53 according to the 238-100 specification of the German Association of the Automotive Industry (VDA) for performing bending tests and the 232-200 specification for normalizing the tests to 2.0 mm. The samples from panels α27, α28, α29, α30, α31, α32, α33, and α34 achieved alpha (exterior) bending angles of 80°, 79°, 75°, 67°, 66°, 96°, 102°, and 95°, respectively.

Figure 56:
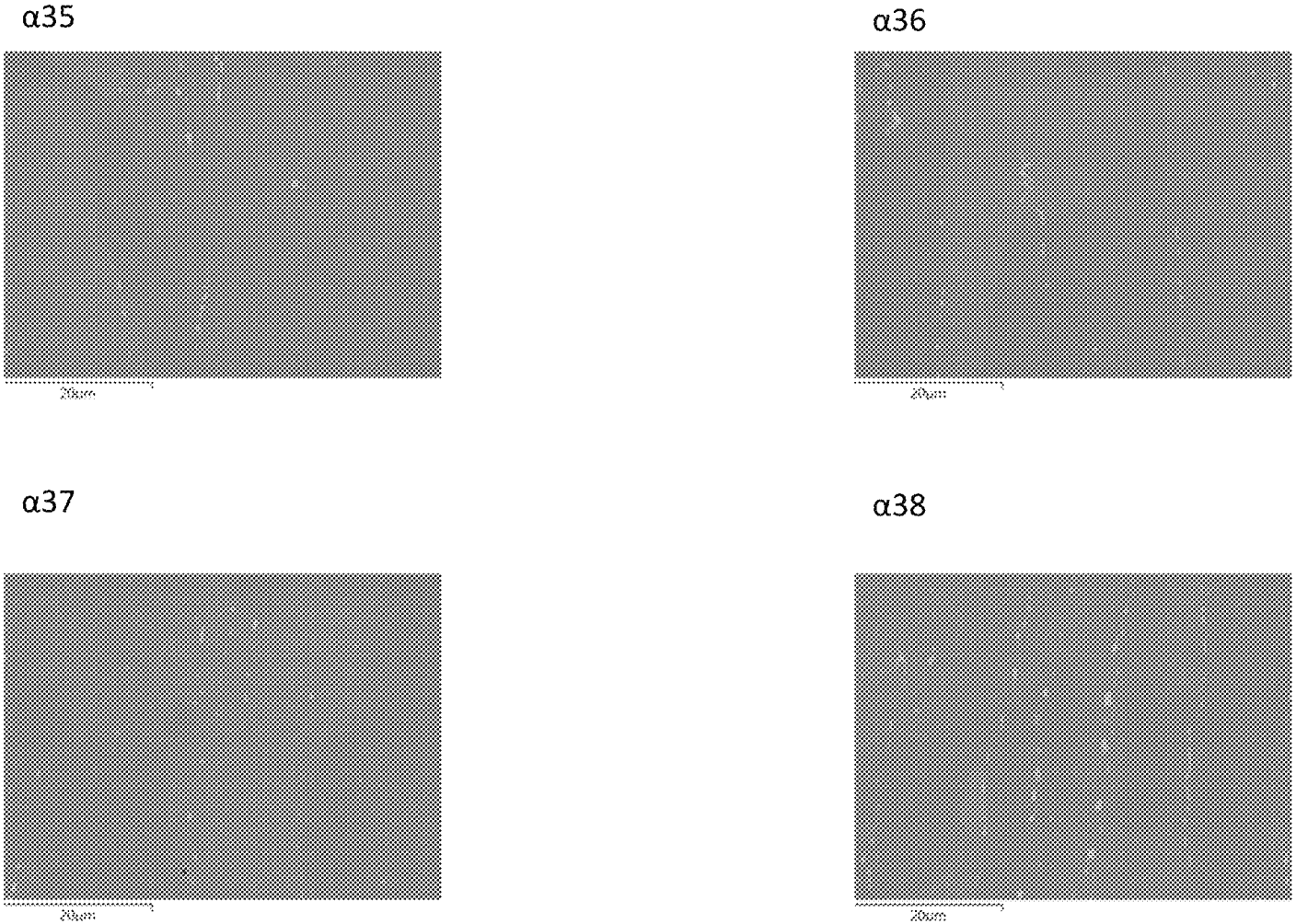
FIG. 56 is a set of scanning electron microscope (SEM) micrographs showing Fe-constituent particles in sections of AA6111 metal after undergoing various processing routes to achieve a 2.0 mm gauge strip.

FIG. 56 is a set of scanning electron microscope (SEM) micrographs showing Fe-constituent particles in sections of AA6111 metal after undergoing various processing routes to achieve a 2.0 mm gauge strip. Panels α35, α36, α37, and α38 depict metal that has been cast using a continuous casting device, such as the continuous belt caster 2208 of the hot band continuous casting system 2200 of FIG. 22, flash homogenized (e.g., using the soaking furnace 2217 of FIG. 22), and hot rolled (e.g., using rolling stand 2284 of FIG. 22) at 45% reduction of thickness. Panels α35, α36, and α37 were thereafter subjected to reheating at a temperature of 530° C. for 2 hours, whereas panel α38 was immediately cold rolled to a final gauge of 2.0 mm. After reheating, panel α35 was warm rolled to a final gauge of 2.0 mm. After reheating, panel α36 was hot rolled again at a 50% reduction of thickness, then quenched and cold rolled to a final gauge of 2.0 mm. After reheating, panel α37 was quenched and cold rolled to a final gauge of 2.0 mm.

Figure 57:
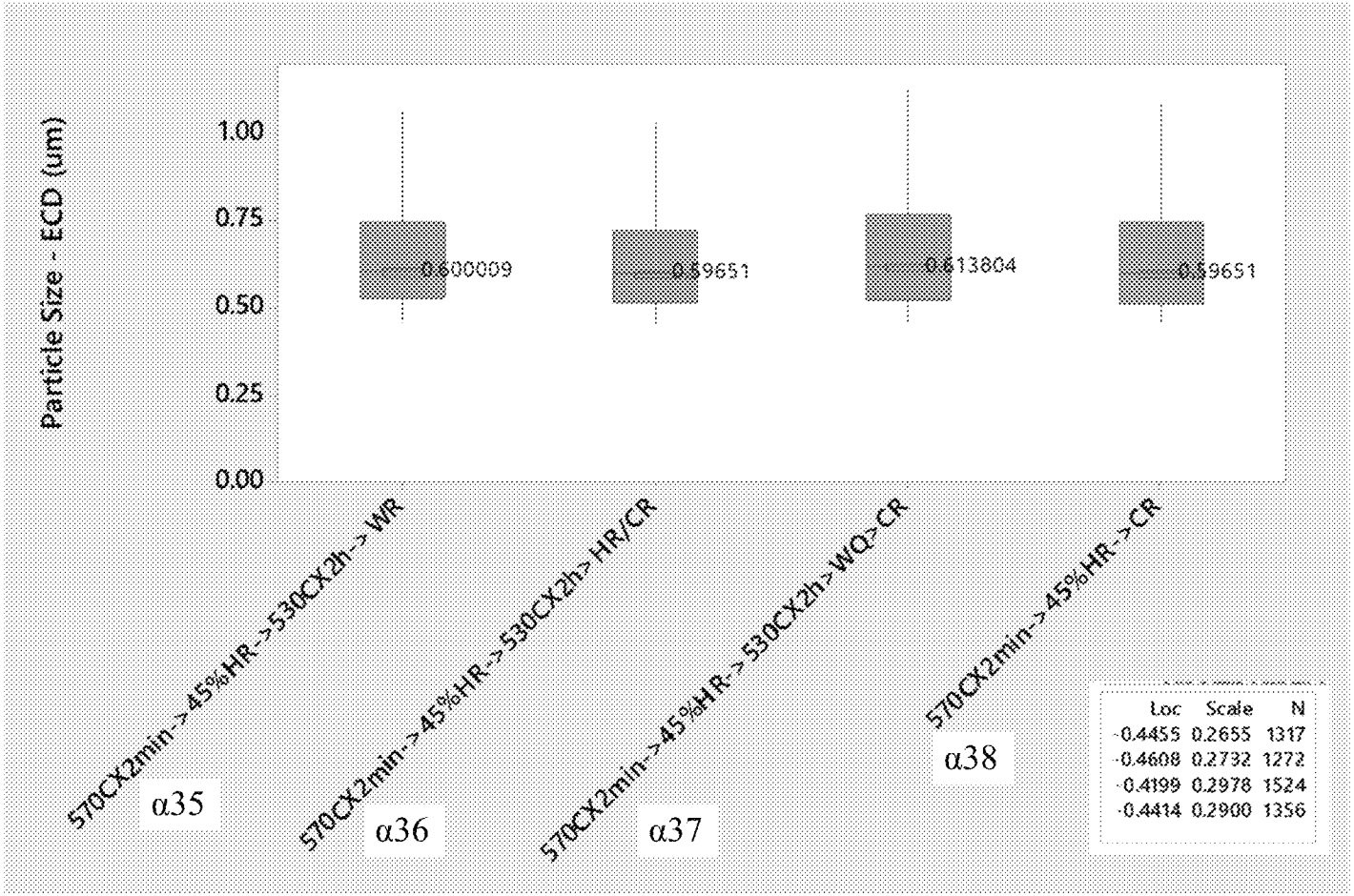
FIG. 57 is a graph depicting median and distribution data for the equivalent circle diameter for Fe-constituent particles in the metal pieces shown and described with reference to FIG. 56.

FIG. 57 is a graph depicting median and distribution data for the equivalent circle diameter for Fe-constituent particles in the metal pieces shown and described with reference to FIG. 56.

Figure 58:
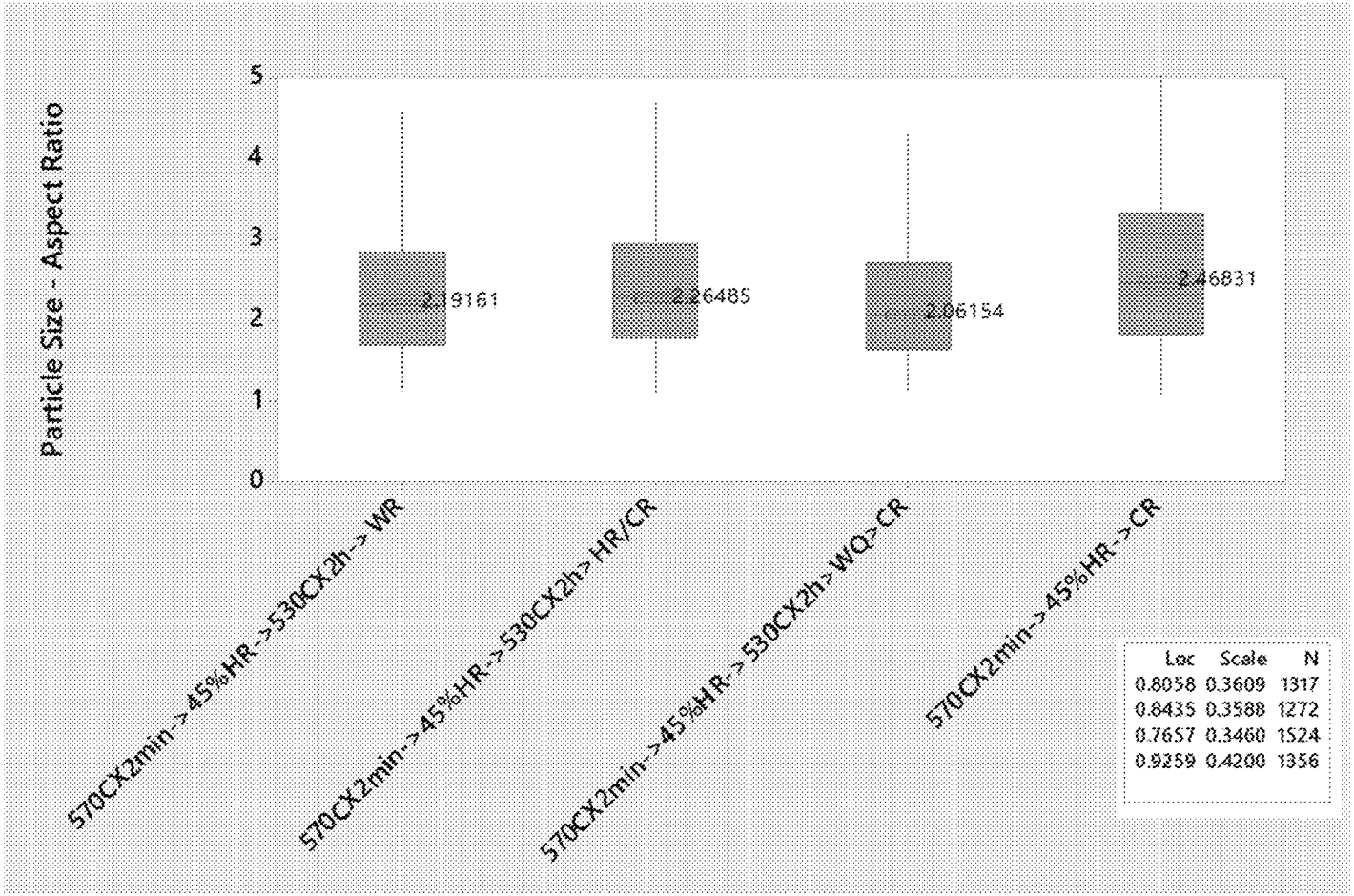
FIG. 58 is a graph depicting median and distribution data for the aspect ratio for Fe-constituent particles in the metal pieces shown and described with reference to FIG. 56.

FIG. 58 is a graph depicting median and distribution data for the aspect ratio for Fe-constituent particles in the metal pieces shown and described with reference to FIG. 56.

FIGS. 57 and 58 show that smaller Fe-constituents can be achieved through flash homogenization of a continuously cast metal article followed by hot rolling and reheating, especially when compared to only hot rolling and cold rolling. Reheating after hot rolling showed improved Fe-constituent particle spheroidization. While cold rolling after continuous casting did show some degree of Fe-constituent particle breakup, it did not achieve desirable spheroidization.

Additionally, bending tests were conducted on the samples from FIG. 56 according to the 238-100 specification of the German Association of the Automotive Industry (VDA) for performing bending tests and the 232-200 specification for normalizing the tests to 2.0 mm. The samples from panels α35, α36, α37, and α38 achieved alpha (exterior) bending angles of 96°, 95°, 104°, and 93°, respectively.

Figure 59:
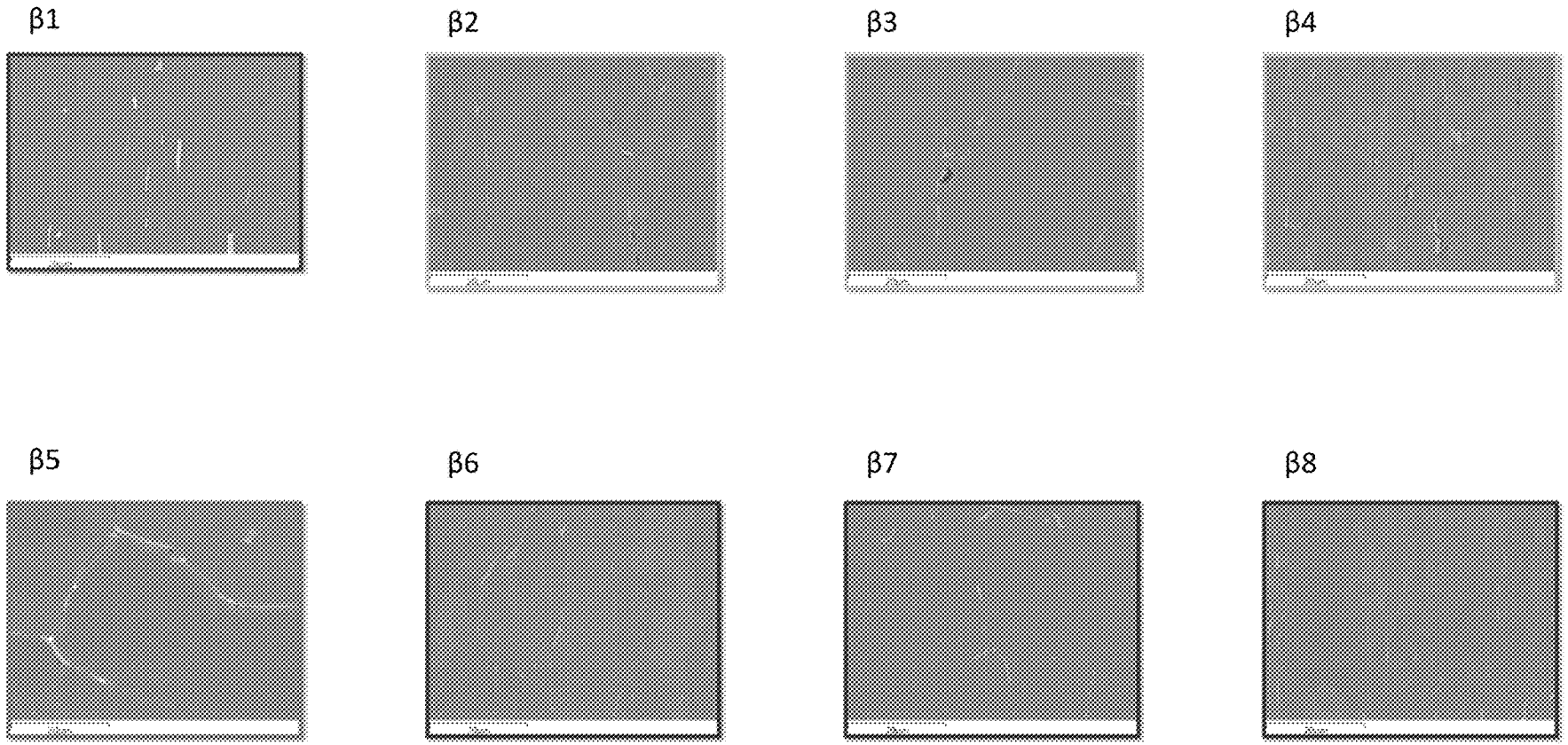
FIG. 59 is a set of scanning electron microscope (SEM) micrographs showing Fe-constituent particles in sections of AA6451 metal after undergoing various processing routes to achieve a 3.7-6 mm gauge band.

FIG. 59 is a set of scanning electron microscope (SEM) micrographs showing Fe-constituent particles in sections of AA6451 metal after undergoing various processing routes to achieve a 3.7-6 mm gauge band. Panel β1 depicts a direct chill cast metal that has been rerolled down to approximately 3.7-6 mm gauge. Panels β2, β3, β4, β5, β6, β7, and β8 depict metal that has been cast using a continuous casting device, such as the continuous belt caster 2208 of the hot band continuous casting system 2200 of FIG. 22. Panel β2 shows a 6 mm strip as cast. Panels β2, β3, β4, β6, β7, and β8 were subjected to some amount of hot rolling (e.g., using rolling stand 2284 of FIG. 22). Panels β2, β3, and β4 were subjected to no flash homogenization, while panels β6, β7, and β8 were subjected to flash homogenization. Panels β2 and β6 underwent 45% reduction of thickness with no reheat. Panels β3 and β6 underwent 45% reduction of thickness and reheating to 530° C. for 2 hours. Panels β4 and β8 underwent 60% reduction of thickness with no reheat. Smaller Fe-constituent particles were seen after flash homogenization followed by higher hot reduction. Additionally, reheating after hot rolling appeared to promote spheroidization. Of note, the dark spot seen in panel β3 was determined to be an anomaly based on further testing.

Figure 60:
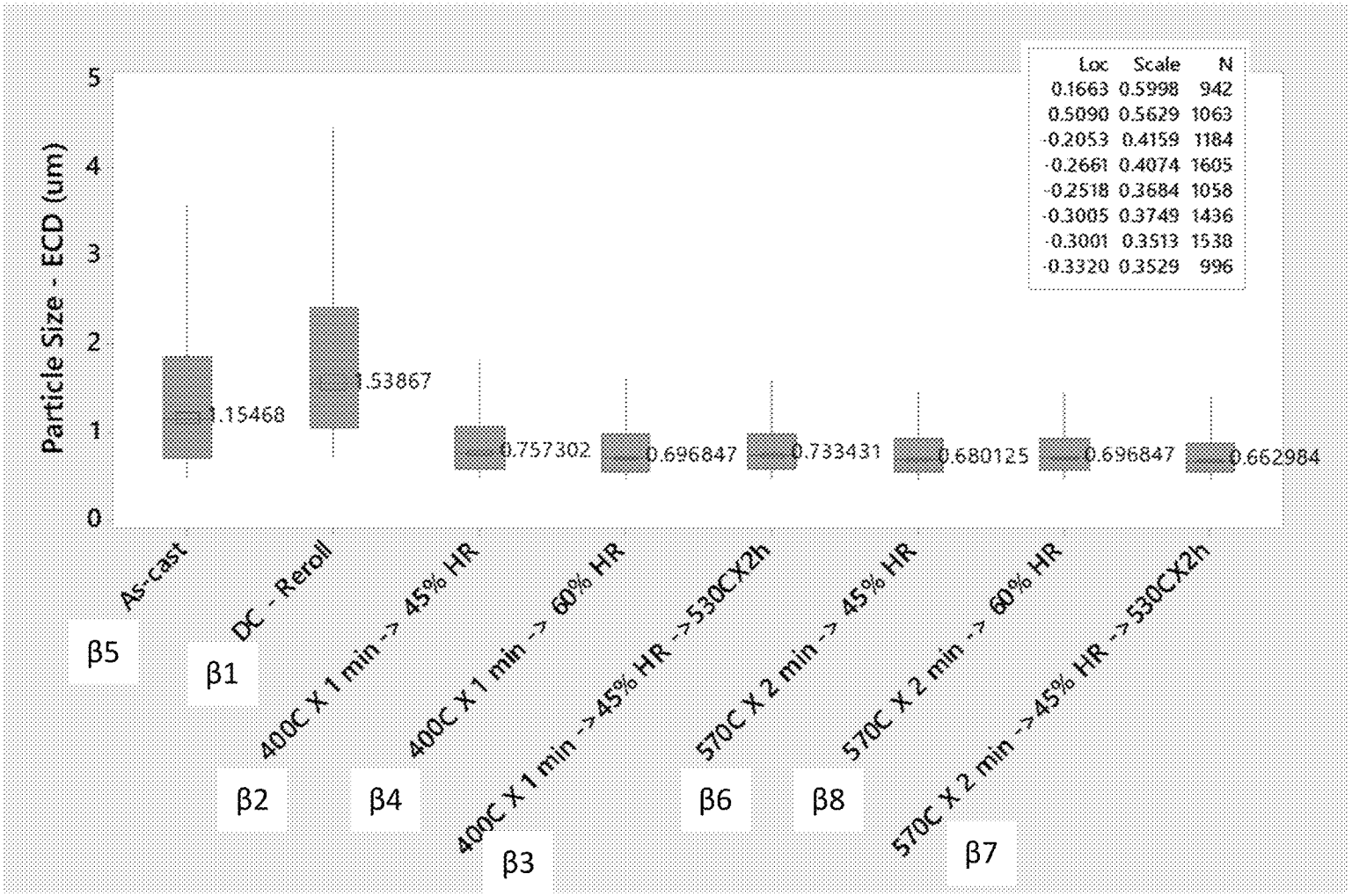
FIG. 60 is a graph depicting median and distribution data for the equivalent circle diameter for Fe-constituent particles in the metal pieces shown and described with reference to FIG. 59.

FIG. 60 is a graph depicting median and distribution data for the equivalent circle diameter for Fe-constituent particles in the metal pieces shown and described with reference to FIG. 59.

Figure 61:
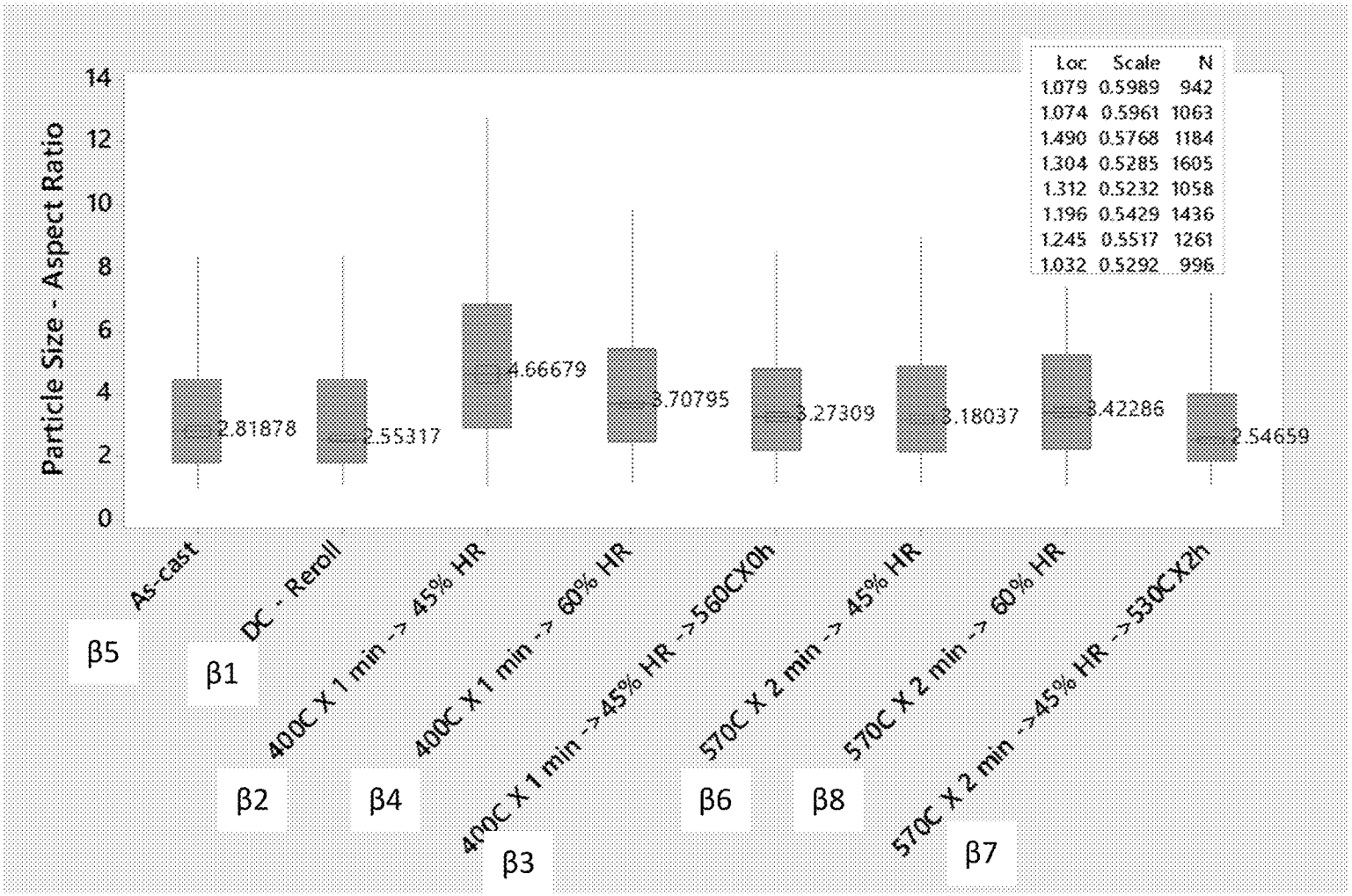
FIG. 61 is a graph depicting median and distribution data for the aspect ratio for Fe-constituent particles in the metal pieces shown and described with reference to FIG. 59.

FIG. 61 is a graph depicting median and distribution data for the aspect ratio for Fe-constituent particles in the metal pieces shown and described with reference to FIG. 59.

FIGS. 60 and 61 show that smaller Fe-constituents can be achieved through flash homogenization of a continuously cast metal article followed by hot rolling, especially over hot rolling without flash homogenization. Additionally, reheating after hot rolling appeared to improve spheroidization.

Figure 62:
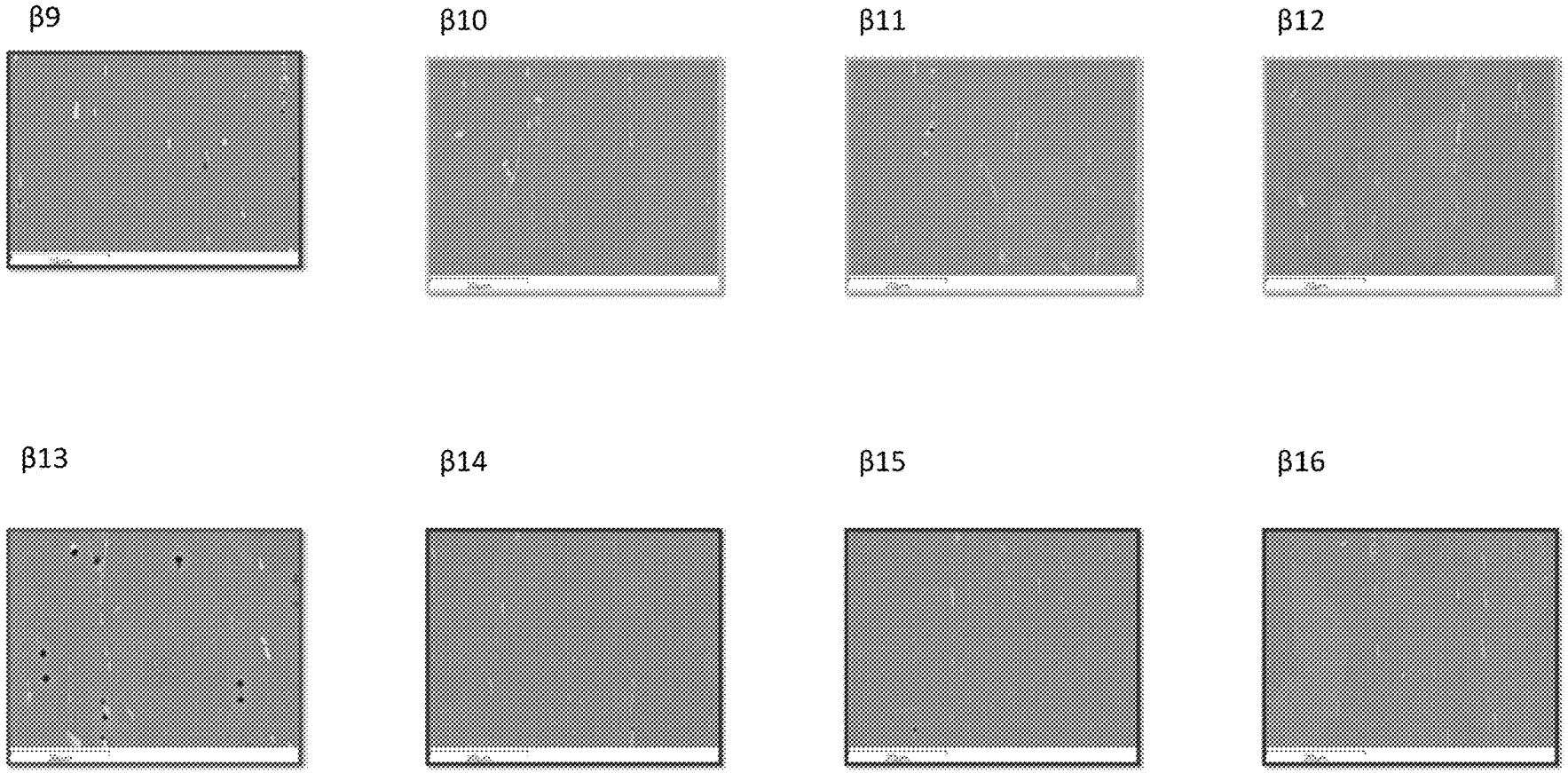
FIG. 62 is a set of scanning electron microscope (SEM) micrographs showing Fe-constituent particles in sections of AA6451 metal after undergoing various processing routes to achieve a 2.0 mm gauge strip.

FIG. 62 is a set of scanning electron microscope (SEM) micrographs showing Fe-constituent particles in sections of AA6451 metal after undergoing various processing routes to achieve a 2.0 mm gauge strip. Panel β9 depicts a direct chill cast metal that has been rolled down to a final gauge of 2.0 mm. Panels β10, β11, β12, β13, β14, β15, and β16 depict metal that has been cast using a continuous casting device, such as the continuous belt caster 2208 of the hot band continuous casting system 2200 of FIG. 22. Panel β13 has been continuously cast and then cold rolled to a final gauge of 2.0 mm. Panels β10, β11, β12, β14, β15, and β16 have been subjected to some amount of hot rolling (e.g., using rolling stand 2284 of FIG. 22). Panels β10, β11, and β12 were subjected to no flash homogenization, while panels β14, β15, and β16 were subjected to flash homogenization. Panels β10 and β14 underwent 45% reduction of thickness under hot rolling, followed by cold rolling to a final gauge of 2.0 mm. Panels β11 and β15 underwent 45% reduction of thickness under hot rolling, reheating to at or approximately 530° C. for 2 hours, then warm rolling to a final gauge of 2.0 mm. Panels β12 and β16 underwent 60% reduction of thickness under hot rolling, followed by cold rolling to a final gauge of 2.0 mm.

Figure 63:
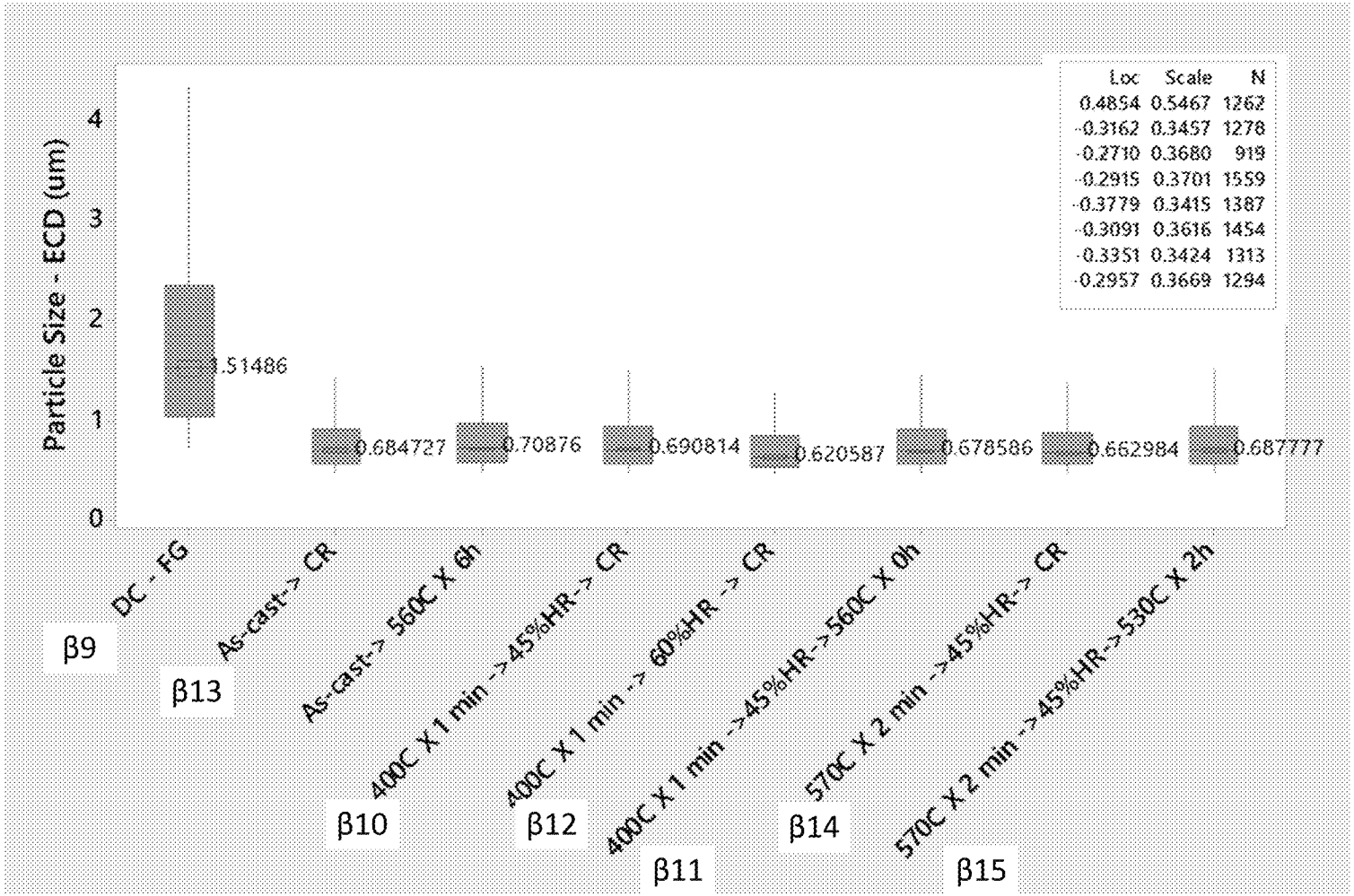
FIG. 63 is a graph depicting median and distribution data for the equivalent circle diameter for Fe-constituent particles in the metal pieces shown and described with reference to FIG. 62.

FIG. 63 is a graph depicting median and distribution data for the equivalent circle diameter for Fe-constituent particles in the metal pieces shown and described with reference to FIG. 62.

Figure 64:
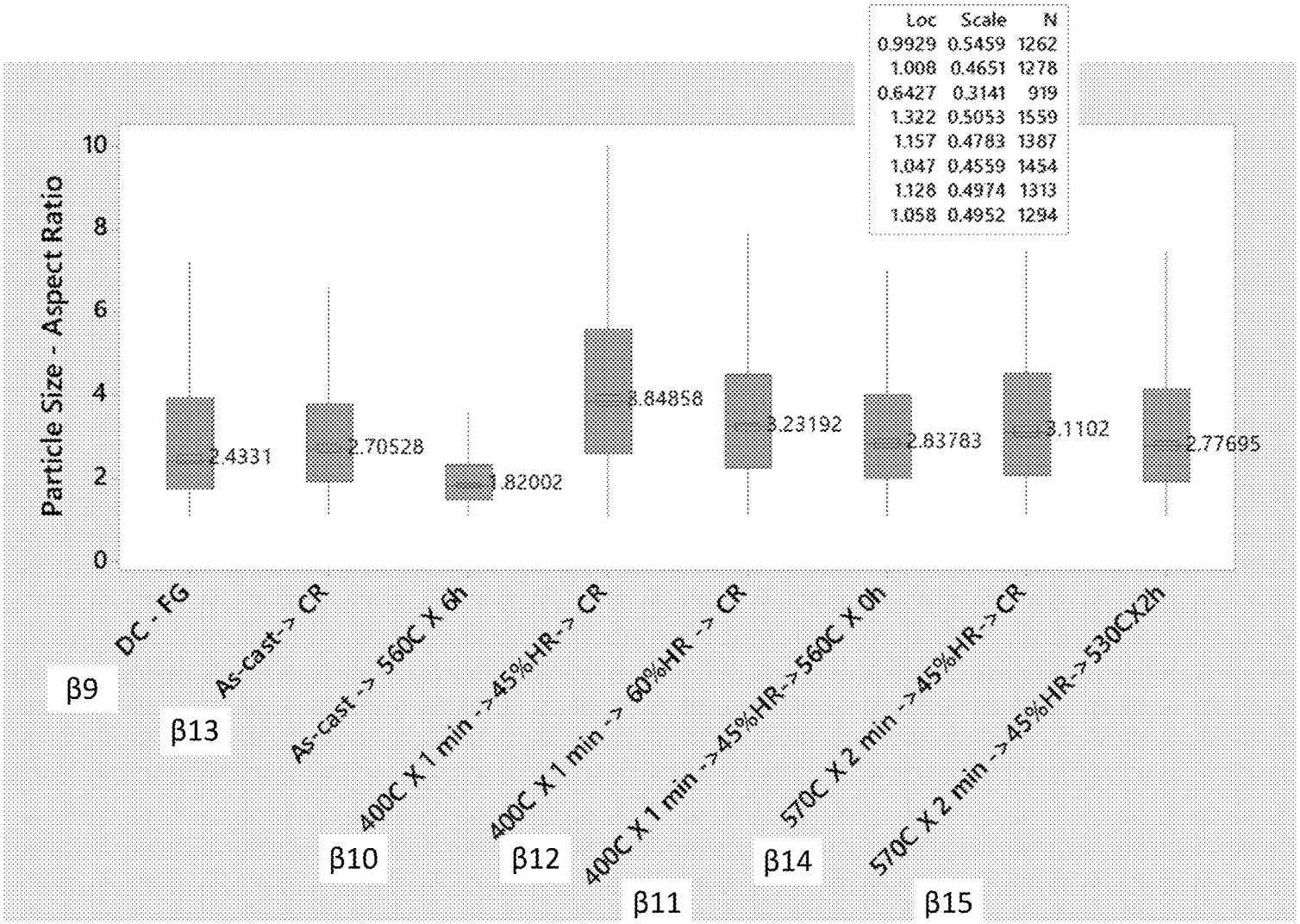
FIG. 64 is a graph depicting median and distribution data for the aspect ratio for Fe-constituent particles in the metal pieces shown and described with reference to FIG. 62.

FIG. 64 is a graph depicting median and distribution data for the aspect ratio for Fe-constituent particles in the metal pieces shown and described with reference to FIG. 62.

FIGS. 63 and 64 show that smaller Fe-constituents can be achieved through flash homogenization of a continuously cast metal article followed by hot rolling and reheating, especially when compared to only hot rolling and cold rolling. Reheating after hot rolling showed improved Fe-constituent particle spheroidization. While cold rolling after continuous casting did show some degree of Fe-constituent particle breakup, it did not achieve desirable spheroidization.

Additionally, bending tests were conducted on the samples from FIG. 62 according to the 238-100 specification of the German Association of the Automotive Industry (VDA) for performing bending tests and the 232-200 specification for normalizing the tests to 2.0 mm. The samples from panels β9, β10, β11, β12, β13, β14, β15, and β16 achieved alpha (exterior) bending angles of 70°, 67°, 88°, 75°, 65°, 75°, 80° and 81°, respectively.

Figure 65:
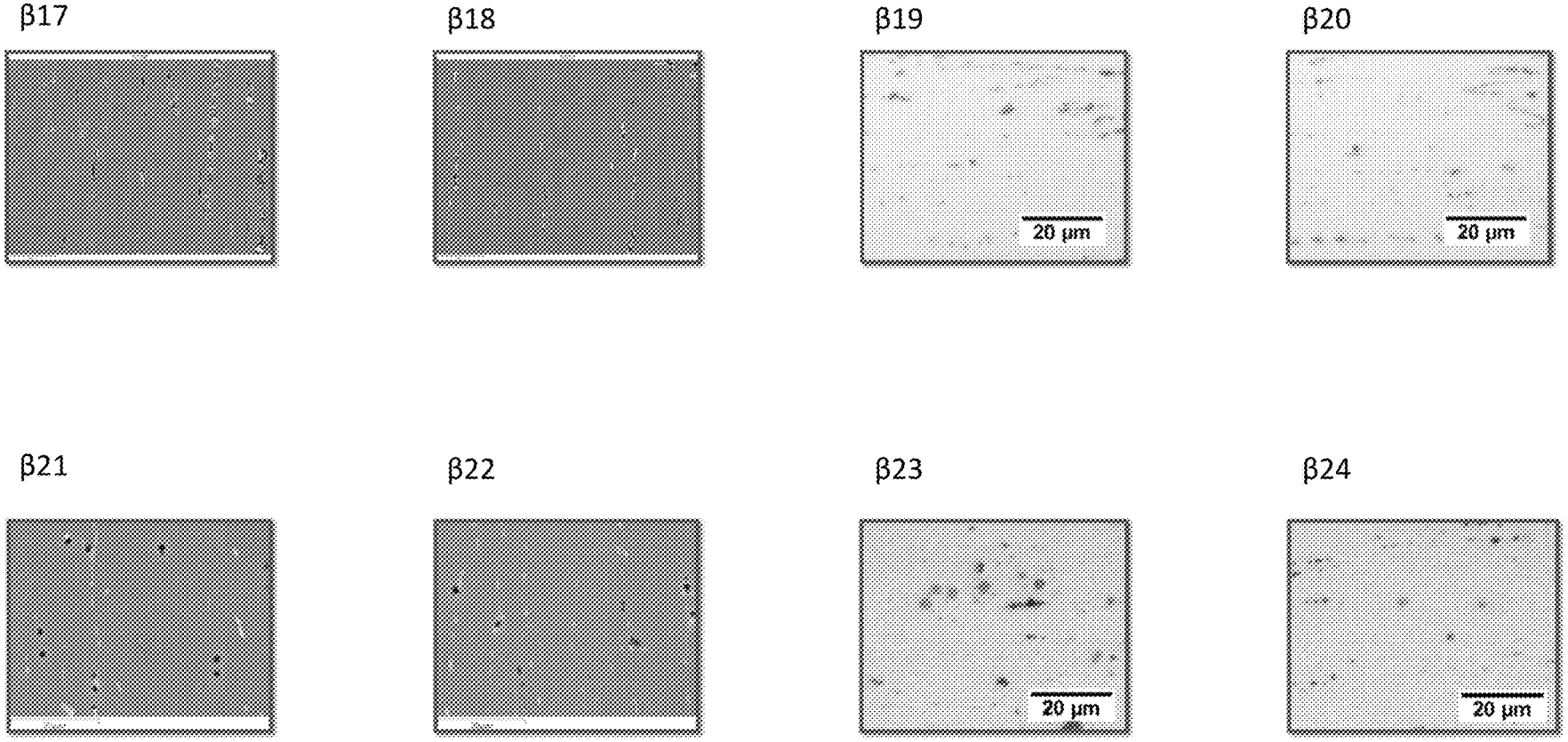
FIG. 65 is a set of scanning electron microscope (SEM) micrographs and optical micrographs depicting Mg2Si melting and voiding in sections of AA6451 metal that has been cast and cold rolled to achieve a 2.0 mm gauge strip.

FIG. 65 is a set of scanning electron microscope (SEM) micrographs and optical micrographs depicting $Mg_2Si$ melting and voiding in sections of AA6451 metal that has been cast and cold rolled to achieve a 2.0 mm gauge strip. Panels β17, β18, β21, and β22 are SEM micrographs, while panels β19, β20, β23, and β24 are optical micrographs. Each of the samples has been continuously cast and then cold rolled, without undergoing the processes of the present disclosure. Panels β17, β18, β19, and β20 are based on metal under F temper (e.g., without solution heat treatment), while panels β21, β22, β23, and β24 are based on metal under T4 temper (e.g., with additional solution heat treatment). The results show that solution heat treatment of cold rolled samples show numerous voiding, which may be due, at least in part, to the presence of coarse as-cast $Mg_2Si$ in F temper. Thus, it is apparent that improvements in intermetallic microstructure can be beneficial to achieve a desirable T4 temper product.

Figure 66:
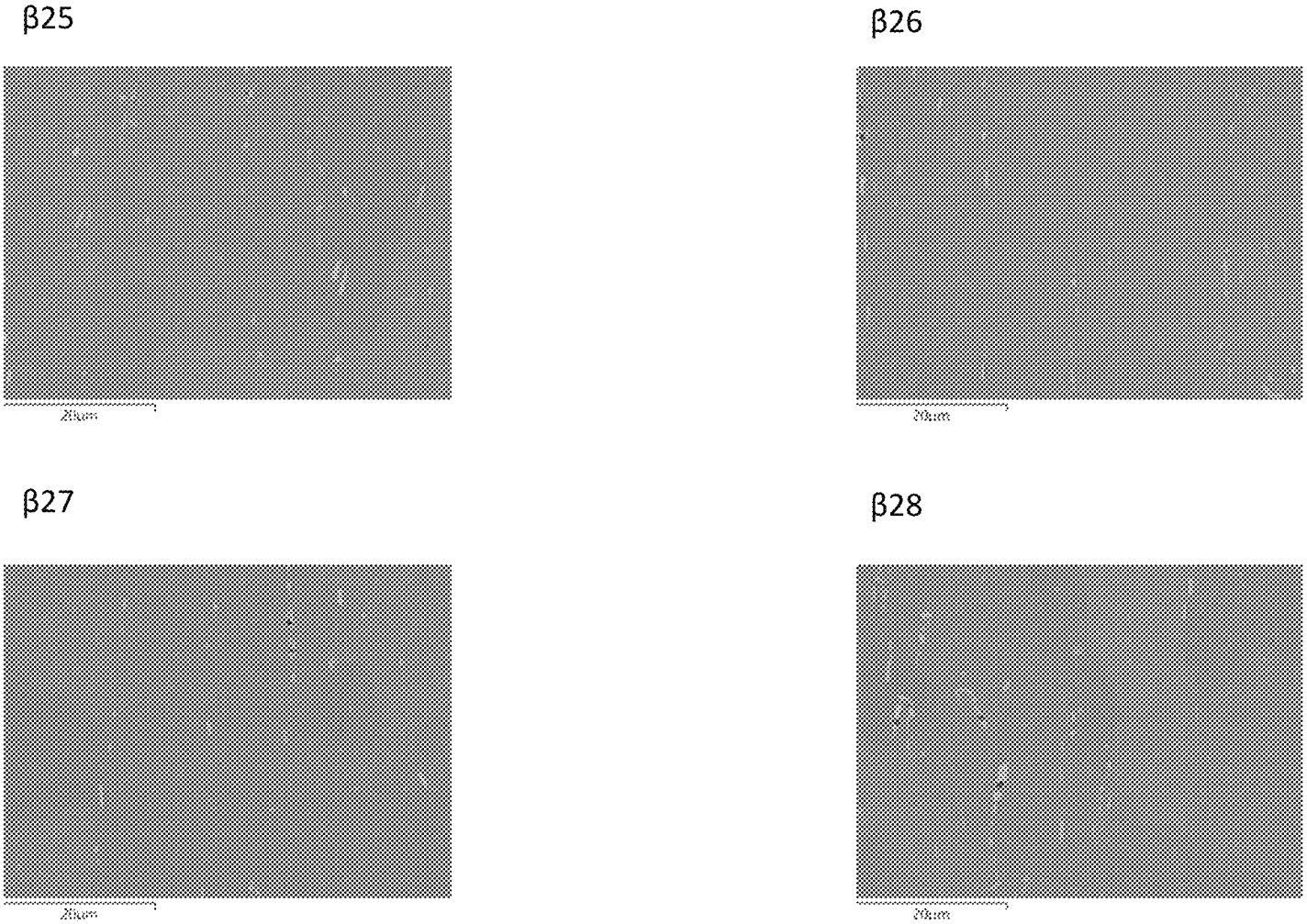
FIG. 66 is a set of scanning electron microscope (SEM) micrographs showing Fe-constituent particles in sections of AA6451 metal after undergoing various processing routes to achieve a 2.0 mm gauge strip.

FIG. 66 is a set of scanning electron microscope (SEM) micrographs showing Fe-constituent particles in sections of AA6451 metal after undergoing various processing routes to achieve a 2.0 mm gauge strip. Panel β25, β26, β27, and β28 depict metal that has been cast using a continuous casting device, such as the continuous belt caster 2208 of the hot band continuous casting system 2200 of FIG. 22 and thereafter subjected to 45% reduction of thickness hot rolling (e.g., using rolling stand 2284 of FIG. 22). Panel β25 was then subjected to reheating at 530° C. for 2 hours followed by warm rolling to final gauge. Panel β26 was then subjected to reheating at 530° C. for 2 hours followed by an additional 50% reduction of thickness hot rolling, followed by a water quench, then cold rolling to final gauge. Panel β27 was then subjected to reheating at 530° C. for 2 hours followed by a water quench then cold rolling to final gauge. Panel β28 was then subjected to cold rolling. The most improved Fe-constituent spheroidization in the final gauge was found when the metal strip was flash homogenized, hot or warm rolled, then preheated, then water quenched before cold rolling to final gauge.

Figure 67:
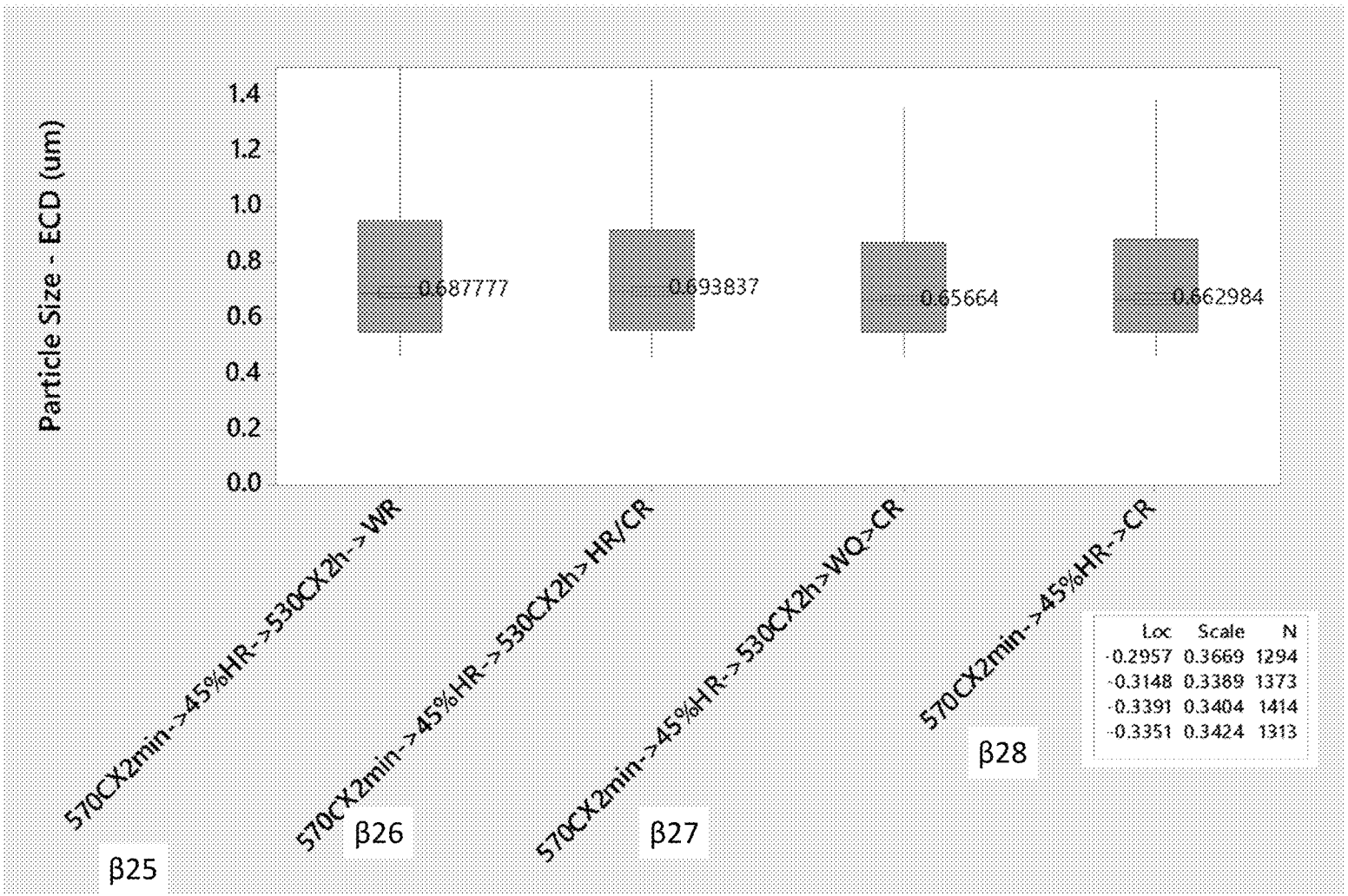
FIG. 67 is a graph depicting median and distribution data for the equivalent circle diameter for Fe-constituent particles in the metal pieces shown and described with reference to FIG. 66.

FIG. 67 is a graph depicting median and distribution data for the equivalent circle diameter for Fe-constituent particles in the metal pieces shown and described with reference to FIG. 66.

Figure 68:
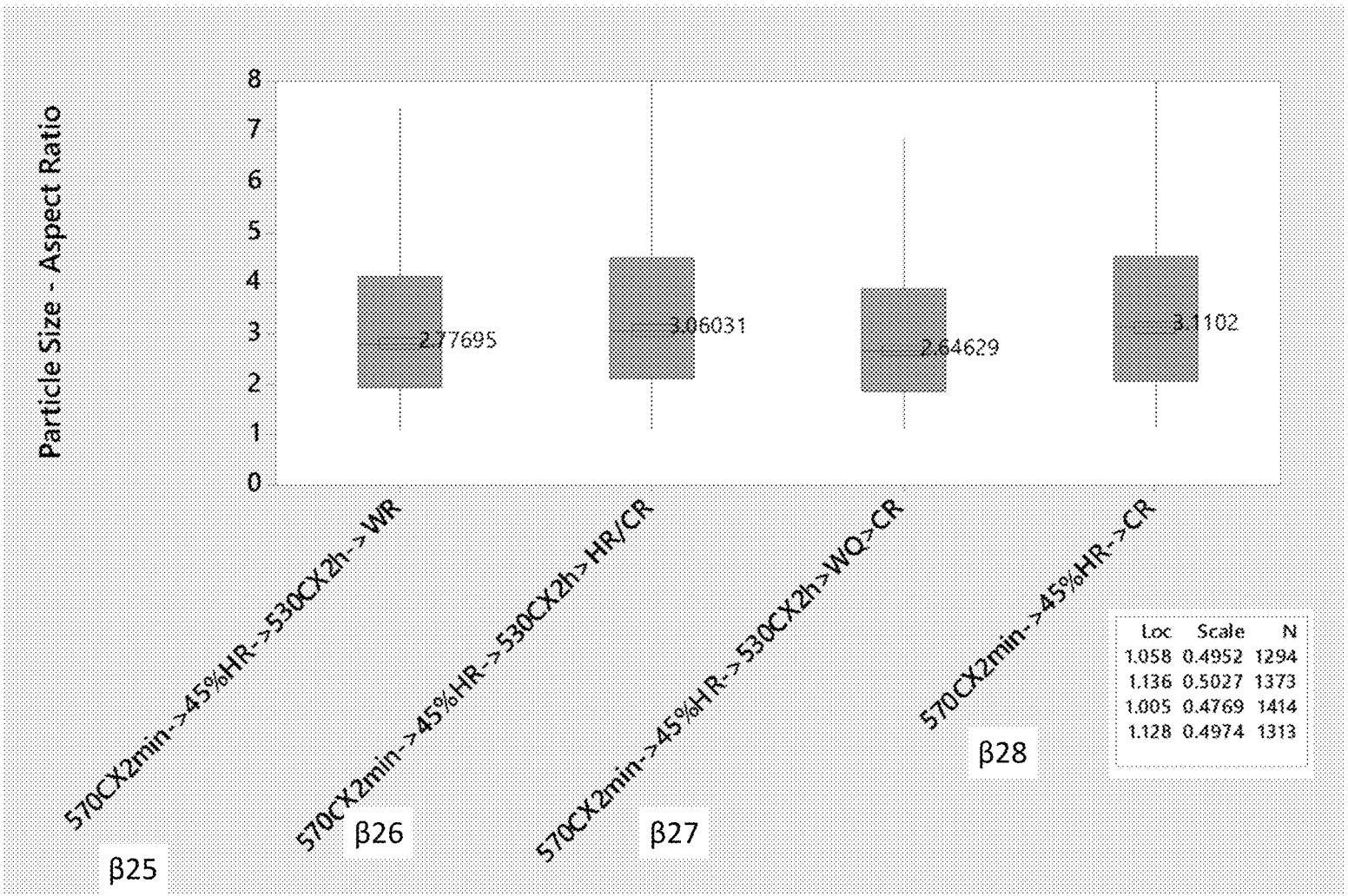
FIG. 68 is a graph depicting median and distribution data for the aspect ratio for Fe-constituent particles in the metal pieces shown and described with reference to FIG. 66.

FIG. 68 is a graph depicting median and distribution data for the aspect ratio for Fe-constituent particles in the metal pieces shown and described with reference to FIG. 66.

FIGS. 67 and 68 show that smaller Fe-constituents can be achieved through flash homogenization of a continuously cast metal article followed by hot rolling and reheating, especially when combined with subsequent water quenching and cold rolling to final gauge. It was determined that homogenization (e.g., reheating) can benefit spheroidization and that quenching after homogenization can benefit particle distribution.

Additionally, bending tests were conducted on the samples from FIG. 66 according to the 238-100 specification of the German Association of the Automotive Industry (VDA) for performing bending tests and the 232-200 specification for normalizing the tests to 2.0 mm. The samples from panels β25, β26, β27, and β28 achieved alpha (exterior) bending angles of 75°, 67°, 78°, and 71°, respectively.

Figure 69:
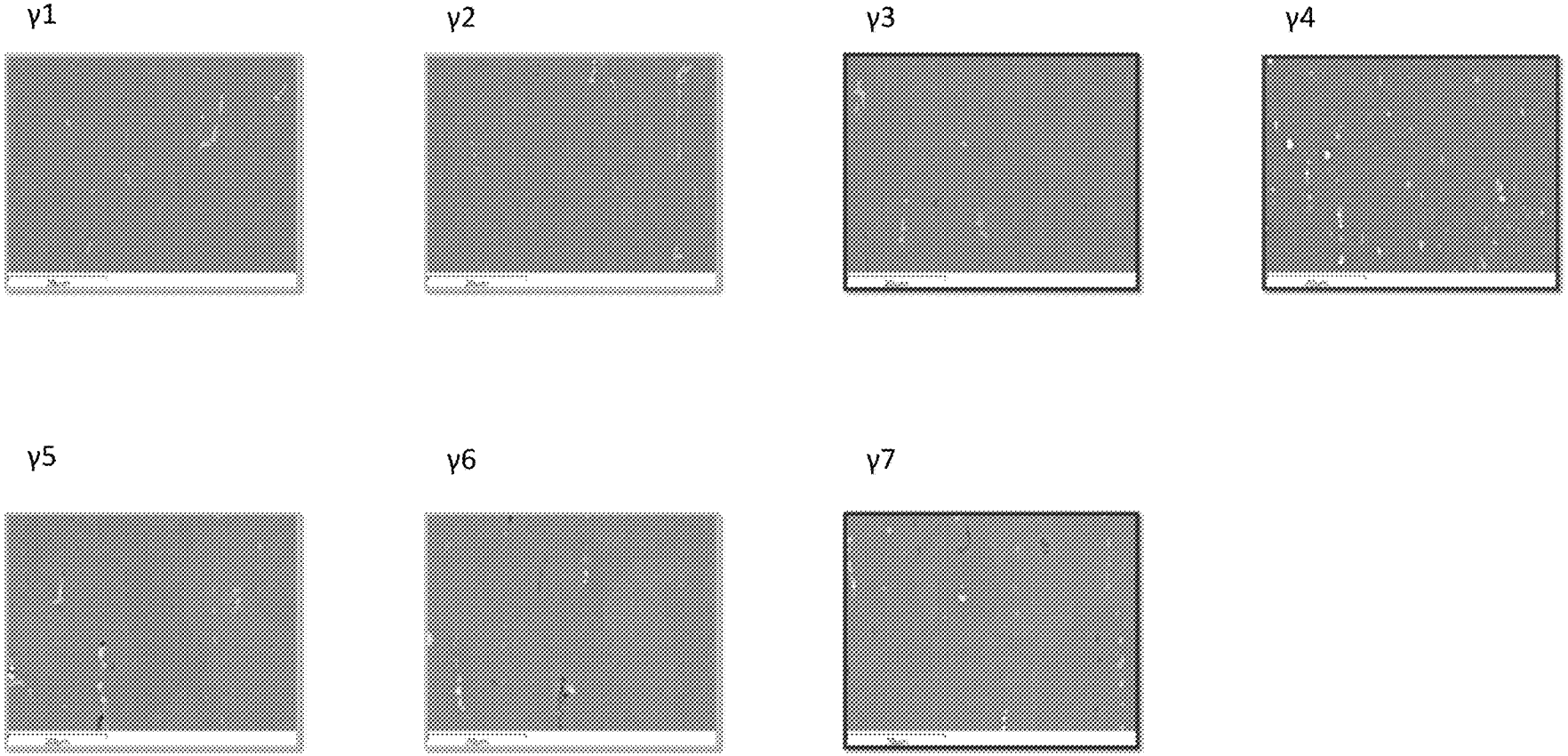
FIG. 69 is a set of scanning electron microscope (SEM) micrographs showing Fe-constituent particles in sections of AA5754 metal.

FIG. 69 is a set of scanning electron microscope (SEM) micrographs showing Fe-constituent particles in sections of AA5754 metal. Panel γ4 depicts metal that has been direct chill cast and reduced to final gauge. Panels γ1, γ2, γ3, γ5, and γ6 depict metal that has been cast using a continuous casting device, such as the continuous belt caster 2208 of the hot band continuous casting system 2200 of FIG. 22 and subject to hot rolling (e.g., using rolling stand 2284 of FIG. 22) at various reductions of thickness. Panels γ1, γ2, γ5, and γ6 were not subject to flash homogenization before hot rolling, whereas panels γ3 and γ7 were subjected to flash homogenization prior to hot rolling. Panel γ1 was subject to 50% hot rolling to final gauge. Panel γ2 was subject to 70% hot rolling to final gauge. Panel γ3 was subject to 70% hot rolling to final gauge. Panel γ5 was subject to 50% hot rolling, then additional cold rolling to final gauge. Panel γ6 was subject to 70% hot rolling, then additional cold rolling to final gauge. Panel γ7 was subject to 70% hot rolling, then additional cold rolling to final gauge. It was seen that the most improved Fe-constituent particle breakup and/or spheroidization was found when the metal strip was continuously cast, flash homogenized, then hot rolled.

Figure 70:
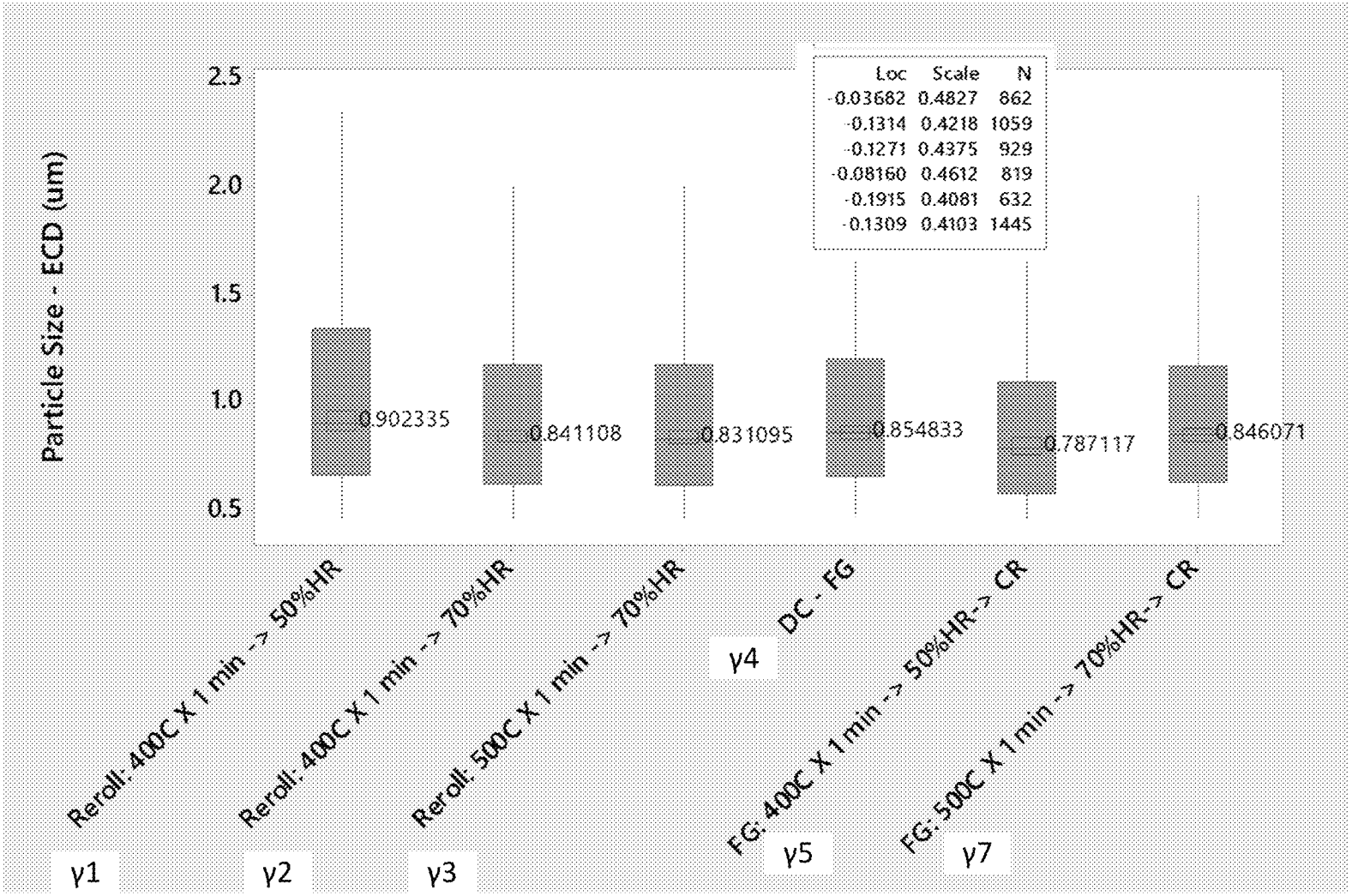
FIG. 70 is a graph depicting median and distribution data for the equivalent circle diameter for Fe-constituent particles in the metal pieces shown and described with reference to FIG. 69.

FIG. 70 is a graph depicting median and distribution data for the equivalent circle diameter for Fe-constituent particles in the metal pieces shown and described with reference to FIG. 69.

Figure 71:
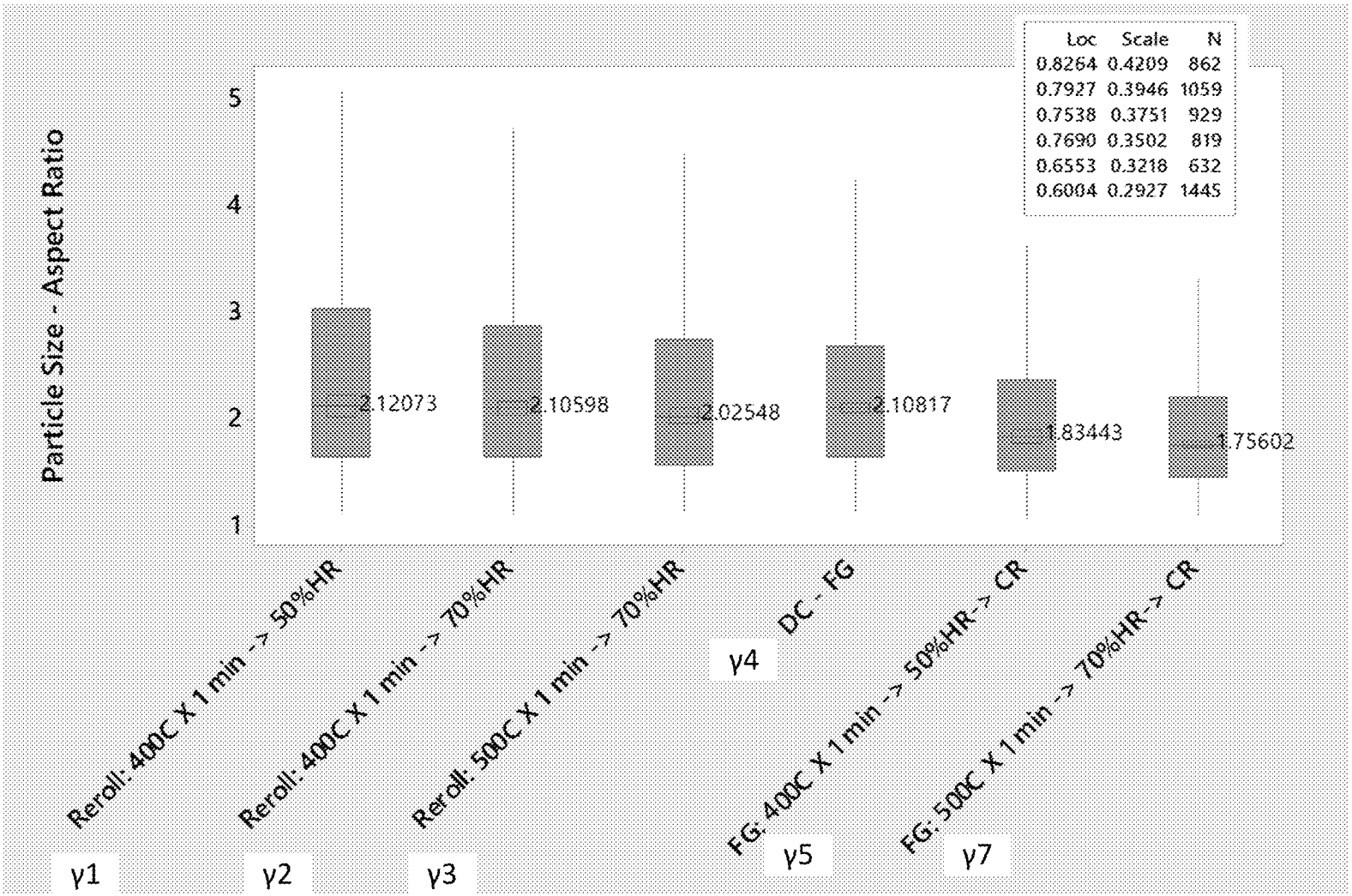
FIG. 71 is a graph depicting median and distribution data for the aspect ratio for Fe-constituent particles in the metal pieces shown and described with reference to FIG. 69.

FIG. 71 is a graph depicting median and distribution data for the aspect ratio for Fe-constituent particles in the metal pieces shown and described with reference to FIG. 69.

FIGS. 70 and 71 show that smaller Fe-constituents can be achieved through flash homogenization of a continuously cast metal article followed by hot rolling, especially when compared to hot rolling without flash homogenization.

Additionally, bending tests were conducted on select samples from FIG. 69 according to the 238-100 specification of the German Association of the Automotive Industry (VDA) for performing bending tests and the 232-200 specification for normalizing the tests to 2.0 mm. The samples from panels γ5 and γ7 achieved alpha (exterior) bending angles of 160° and 171°, respectively.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

As used below, any reference to a series of examples is to be understood as a reference to each of those examples disjunctively (e.g., "Examples 1-4" is to be understood as "Examples 1, 2, 3, or 4").

Example 1 is a metal casting and processing system, comprising: a continuous casting device for casting a metal strip at a first speed; and a hot rolling stand operating at a second speed that is decoupled from the first speed.

Example 2 is the system of example 1, further comprising: a coiling device operatively coupled to the continuous casting device for coiling the metal strip into an intermediate coil; and an uncoiling device for receiving the intermediate coil and operatively coupled to the hot rolling stand for providing the metal strip to a bite of the hot rolling stand.

Example 3 is the system of example 2, further comprising a preheating device for accepting the intermediate coil.

Example 4 is the system of examples 2 or 3, further comprising a storage system for storing the intermediate coil in a vertical orientation.

Example 5 is the system of examples 2-4, further comprising a storage system for storing the intermediate coil, wherein the storage system includes a motor for rotating the intermediate coil.

Example 6 is the system of examples 1-5, further comprising: a heat source positioned downstream of the hot rolling stand; and a quenching system positioned immediately downstream of the heat source.

Example 7 is the system of examples 1-6, further comprising: a preheating heat source positioned upstream of the hot rolling stand; and a quenching system positioned between the preheating heat source and the hot rolling stand.

Example 8 is the system of examples 1 or 6-7, further comprising an accumulator operatively positioned between the continuous casting device and the hot rolling stand for accommodating a difference between the first speed and the second speed.

Example 9 is the system of examples 1-8, further comprising a post-cast quenching device positioned immediately downstream of the continuous casting device.

Example 10 is the system of examples 1-9, wherein the continuous casting device is a belt casting device.

Example 11 is a metal casting and processing system, comprising: a continuous belt casting device for casting a metal strip; a coiling device associated with the continuous casting device for coiling the metal strip into an intermediate coil; and an uncoiling device for receiving the intermediate coil, the uncoiling device operatively coupled to at least one hot rolling stand for reducing a thickness of the metal strip to a desired thickness.

Example 12 is the system of example 11, further comprising a preheating device for accepting the intermediate coil.

Example 13 is the system of examples 11 or 12, further comprising a storage system for storing the intermediate coil in a vertical orientation.

Example 14 is the system of examples 11-13, further comprising a storage system for storing the intermediate coil, wherein the storage system includes a motor for rotating the intermediate coil.

Example 15 is the system of examples 11-14, further comprising: a heat source positioned downstream of the hot rolling stand; and a quenching system positioned immediately downstream of the heat source.

Example 16 is the system of examples 11-15, further comprising: a preheating heat source positioned upstream of the hot rolling stand; and a quenching system positioned between the preheating heat source and the hot rolling stand.

Example 17 is the system of examples 11-16, further comprising a post-cast quenching device positioned immediately downstream of the continuous casting device.

Example 17.5 is the system of examples 11-17, wherein the at least one hot rolling stand is located between the continuous belt casting device and the coiling device for reducing the thickness of the metal strip when the continuous belt casting device is not casting the metal strip.

Example 18 is a casting and rolling method, comprising: continuously casting a metal strip at a first speed; and hot rolling the metal strip at a second speed, wherein the first speed is decoupled from the second speed.

Example 19 is the method of example 18, further comprising coiling the cast metal strip into an intermediate coil, wherein hot rolling the metal strip comprises uncoiling the intermediate coil.

Example 20 is the method of example 19, further comprising preheating the intermediate coil.

Example 21 is the method of examples 19 or 20, further comprising storing the intermediate coil in a vertical position.

Example 22 is the method of examples 19-21, further comprising storing the intermediate coil, wherein storing the intermediate coil comprises periodically or continuously rotating the intermediate coil.

Example 23 is the method of examples 18-22, further comprising heat treating the metal strip after hot rolling the metal strip, wherein heat treating the metal strip comprises applying heat to the metal strip and immediately quenching the metal strip.

Example 24 is the method of examples 18-23, further comprising reheating the metal strip prior to hot rolling the metal strip, wherein reheating the metal strip comprises heating the metal strip to a temperature above a hot rolling temperature and quenching the metal strip down to the hot rolling temperature.

Example 25 is the method of examples 18 or 23-24, further comprising routing the metal strip through an accumulator, wherein the accumulator compensates for a difference between the first speed and the second speed.

Example 26 is the method of examples 18-25, wherein continuously casting the metal strip comprises passing liquid metal through a pair of rollers to extract heat from the liquid metal and solidify the liquid metal.

Example 27 is an intermediate metal product, comprising: a primary phase of solid aluminum formed by cooling liquid metal in a continuous casting device at a strip thickness between 7 mm and 50 mm; and a secondary phase including an alloying element, wherein the alloying element is supersaturated in the primary phase by fast cooling freshly-solidified metal to a temperature below a solutionizing temperature.

Example 28 is the metal product of example 27, wherein the metal product is formed in the shape of a metal strip coiled into an intermediate coil.

Example 30 is a metal strip derived from heating the intermediate metal product of examples 27-28, wherein the metal strip includes dispersoids evenly distributed throughout the primary phase, and wherein the dispersoids have an average size between 10 nm and 500 nm.

Example 30 is a metal casting system, comprising: a continuous casting device for casting a metal strip; and at least one nozzle positioned adjacent the continuous casting device for delivering coolant to the metal strip sufficient to fast cool the metal strip as the metal strip exits the continuous casting device.

Example 31 is the system of example 30, wherein the continuous casting device is arranged to cast the metal strip at a thickness between 7 mm and 50 mm.

Example 32 is the system of examples 30 or 31, wherein the at least one nozzle is arranged to fast cool the metal strip to a temperature at or below 100° C. within ten seconds as the metal strip exits the continuous casting device.

Example 33 is the system of examples 30-32, further comprising a reheater positioned downstream of the at least one nozzle for heating the metal strip to a temperature at or above a solutionizing temperature.

Example 34 is the system of example 33 wherein the solutionizing temperature is approximately 30° C. lower than a solidus temperature of metal in the metal strip. In some cases, the solutionizing temperature is approximately 25° C.-35° C. lower than a solidus temperature of metal in the metal strip.

Example 34.5 is the system of examples 33 or 34, wherein the solutionizing temperature is at or above 450° C.

Example 35 is the system of examples 33 or 34, further comprising a quenching device positioned downstream of the reheater for fast cooling the metal strip to a temperature below the solutionizing temperature, wherein the quenching device is positioned a distance from the reheater suitable to allow the metal strip to remain at or above the solutionizing temperature for a duration at or less than two hours.

Example 36 is the system of example 35, wherein the distance between the quenching device and the reheater is suitable to allow the metal strip to remain at or above the solutionizing temperature for a duration at or less than one hour.

Example 37 is the system of example 35, wherein the distance between the quenching device and the reheater is suitable to allow the metal strip to remain at or above the solutionizing temperature for a duration at or less than five minutes.

Example 38 is the system of examples 30-37, wherein the continuous casting device is a belt caster.

Example 39 is the system of examples 30-38, further comprising a coiling device positioned downstream of the at least one nozzle for coiling the metal strip into an intermediate coil.

Example 40 is a method, comprising: continuously casting a metal strip using a continuous casting device; and fast quenching the metal strip as the metal strip exits the continuous casting device.

Example 41 is the method of example 40, wherein continuously casting the metal strip comprises continuously casting the metal strip at a thickness between 7 mm and 50 mm.

Example 42 is the method of examples 40 or 41, wherein fast quenching the metal strip comprises applying coolant to the metal strip sufficient to cool the metal strip to a temperature at or below 100° C. within ten seconds as the metal strip exits the continuous casting device.

Example 43 is the method of examples 40-42, further comprising reheating the metal strip after fast quenching the metal strip, wherein reheating the metal strip comprises heating the metal strip to a solutionizing temperature.

Example 44 is the method of example 43, wherein the solutionizing temperature is at or above 480° C.

Example 45 is the method of examples 43 or 44, further comprising quenching the metal strip after reheating the metal strip to cool the metal strip below the solutionizing temperature, wherein quenching occurs after allowing the metal strip to remain at or above the solutionizing temperature for a duration at or less than two hours.

Example 46 is the method of example 45, wherein the duration is at or less than one hour.

Example 47 is the method of example 45, wherein the duration is at or less than one minute.

Example 48 is the method of examples 40-47, wherein continuously casting the metal strip comprises passing liquid metal through a pair of rollers to extract heat from the liquid metal and solidify the liquid metal.

Example 49 is the method of examples 40-48, further comprising coiling the metal strip into an intermediate coil after fast quenching the metal strip.

Example 50 is the system of any of examples 1-5 or examples 8-10, further comprising a quenching system positioned immediately downstream of the hot rolling stand, wherein the hot rolling stand is positioned to accept the metal strip at a temperature above a recrystallization temperature for dynamically recrystallizing the metal strip during hot rolling.

Example 50.5 is the system of any of examples 1-5 or examples 8-10, further comprising a quenching system positioned immediately downstream of the hot rolling stand, wherein the hot rolling stand is positioned to accept the metal strip at a rolling temperature and configured to apply force to the metal strip sufficient to reduce a thickness of the metal strip and recrystallize the metal strip at the rolling temperature.

Example 51 is the system of example 50, further comprising a heat source positioned upstream of the hot rolling stand to heat the metal strip to a temperature above the recrystallization temperature of the metal strip at the hot rolling stand.

Example 51.5 is the system of example 50.5, further comprising a heat source positioned upstream of the hot rolling stand to heat the metal strip to the rolling temperature.

Example 52 is the system of examples 50-51.5, wherein hot rolling stand and the quenching system are arranged to monotonically decrease a temperature of the metal strip from immediately before the hot rolling stand to immediately after the quenching system.

Example 53 is the system of examples 11-14 or example 17, further comprising a quenching system positioned immediately downstream of the at least one hot rolling stand, wherein the at least one hot rolling stand is positioned to accept the metal strip at a temperature above a recrystallization temperature for dynamically recrystallizing the metal strip as it passes through a furthest downstream hot rolling stand of the at least one hot rolling stand.

Example 53.5 is the system of examples 11-14 or example 17, further comprising a quenching system positioned immediately downstream of the at least one hot rolling stand, wherein the furthest downstream hot rolling stand of the at least one hot rolling stand is positioned to accept the metal strip at a rolling temperature and configured to apply force to the metal strip sufficient to reduce a thickness of the metal strip and recrystallize the metal strip at the rolling temperature.

Example 54 is the system of example 53, further comprising a heat source positioned upstream of all of the at least one hot rolling stands to heat the metal strip to a temperature above the recrystallization temperature of the metal strip at the furthest downstream hot rolling stand.

Example 54.5 is the system of example 53.5, further comprising a heat source positioned upstream of all of the at least one hot rolling stands to heat the metal strip to a temperature at or above the rolling temperature.

Example 55 is the system of any of examples 53 or 54, wherein the at least one hot rolling stands and the quenching system are arranged to monotonically decrease a temperature of the metal strip from immediately before all of the at least one hot rolling stands to immediately after the quenching system.

Example 56 is the method of examples 18-22 or examples 25-26, further comprising quenching the metal strip immediately after hot rolling the metal strip, wherein hot rolling the metal strip comprises passing the metal strip through a final hot rolling stand at a temperature above a recrystallization temperature.

Example 57 is the method of example 56, further comprising preheating the metal strip immediately before hot rolling the metal strip.

Example 58 is the method of examples 56 or 57, wherein a temperature of the metal strip is monotonically decreased from a temperature above a recrystallization temperature throughout hot rolling the metal strip and quenching the metal strip.

Example 59 is a method comprising preheating a metal strip to a temperature above a recrystallization temperature; hot rolling the metal strip, wherein hot rolling the metal strip comprises passing the metal strip through a final hot rolling stand at a temperature above the recrystallization temperature; and quenching the metal strip, wherein quenching the metal strip occurs immediately after hot rolling the metal strip.

Example 59.5 is a method, comprising: preheating a metal strip to a temperature at or above a rolling temperature; hot rolling the metal strip, wherein hot rolling the metal strip comprises passing the metal strip through a final hot rolling stand at the rolling temperature while applying force to the metal strip sufficient to reduce a thickness of the metal strip and recrystallize the metal strip at the rolling temperature; and quenching the metal strip, wherein quenching the metal strip occurs immediately after hot rolling the metal strip.

Example 60 is the method of examples 59 or 59.5, wherein hot rolling the metal strip comprises monotonically decreasing a temperature of the metal strip from when the metal strip enters a first hot rolling stand to when the metal strip exits the final hot rolling stand.

Example 61 is the method of examples 59 or 59.5, wherein hot rolling the metal strip comprises monotonically decreasing a temperature of the metal strip from when the metal strip enters a first hot rolling stand during hot rolling the metal strip to immediately after quenching the metal strip.

Example 62 is the method of examples 59-61, wherein hot rolling the metal strip comprises providing more percentage reduction of thickness at the final hot rolling stand than one or more preceding hot rolling stands.

Example 63 is the method of examples 59-62, wherein hot rolling the metal strip comprises extracting heat from the metal strip using a plurality of work rolls.

Example 64 is the method of example 63, wherein extracting heat from the metal strip comprises extracting heat sufficient to bring a temperature of the metal strip to a desired temperature when passing the metal strip through the final hot rolling stand, and wherein the desired temperature is determined based on a strain rate associated with reducing a thickness of the metal strip using the final hot rolling stand.

Example 64.5 is the method of example 63, wherein extracting heat from the metal strip comprises extracting heat sufficient to bring a temperature of the metal strip to the rolling temperature, and wherein the rolling temperature is determined based on a strain rate associated with reducing the thickness of the metal strip using the final hot rolling stand.

Example 65 is the method of example 63, wherein the final hot rolling stand is arranged to reduce the thickness of the metal strip by a preset percentage reduction of thickness, wherein the preset percentage reduction of thickness and the desired temperature are determined to minimize a duration of time in which precipitates form in the metal strip.

Example 66 is the method of example 63, wherein the final hot rolling stand is arranged to reduce the thickness of the metal strip by a preset percentage reduction of thickness, wherein the preset percentage reduction of thickness and the rolling temperature are determined to subject the metal strip to a desired amount of precipitate formation.

Example 67 is the method of examples 65 or 66, wherein the precipitates are $Mg_2Si$.

Example 68 is a metallurgical product prepared using the method of examples 59-67, wherein the metallurgical product is tempered to a T4 specification and includes a volume fraction of Mg2Si precipitates at or below 4.0%.

Example 69 is a metallurgical product prepared using the method of examples 59-67, wherein the metallurgical product is tempered to a T4 specification and includes a volume fraction of Mg2Si precipitates at or below 3.0%.

Example 70 is a metallurgical product prepared using the method of examples 59-67, wherein the metallurgical product is tempered to a T4 specification and includes a volume fraction of Mg2Si precipitates at or below 2.0%.

Example 71 is a metallurgical product prepared using the method of examples 59-67, wherein the metallurgical product is tempered to a T4 specification and includes a volume fraction of Mg2Si precipitates at or below 1.0%.

Example 72 is the system of examples 11-17, wherein the at least one hot rolling stand is located between the continuous belt casting device and the coiling device for reducing the thickness of the metal strip when the continuous belt casting device is not casting the metal strip.

Example 73 is an intermediate metal product, comprising: a primary phase of solid aluminum formed by cooling liquid metal in a continuous casting device at a strip thickness between 7 mm and 50 mm; and a secondary phase including an alloying element, wherein the secondary phase is spheroidized by hot or warm working the primary phase and secondary phase at a reduction of section of approximately 30% to 80%. In some cases the reduction of section is approximately 50% to 70%.

Example 73.5 is the intermediate metal product of example 73, wherein hot or warm working includes hot or warm rolling, and the reduction of section is a reduction of thickness.

Example 74 is the metal product of examples 73 or 73.5, wherein the metal product is formed in the shape of a metal strip coiled into a coil.

Example 75 is the metal product of examples 73-74, wherein the secondary phase is further spheroidized by sustaining a peak metal temperature of approximately 450° C.-580° C. in the primary phase and secondary phase for a duration of approximately 1-3 minutes prior to the hot or warm working.

Example 75.5 is the metal product of examples 73-74, wherein the secondary phase is further spheroidized by sustaining a peak metal temperature in the primary phase and secondary phase that is approximately 15° C.-45° C. below a solidus temperature of the metal product, wherein the peak metal temperature is sustained for a duration of approximately 1-3 minutes prior to the hot or warm working.

Example 76 is a metal casting system, comprising: a continuous casting device for casting a metal strip; and one or more rolling stands positioned downstream of the continuous casting device for receiving the metal strip and reducing a thickness of the metal strip by approximately 50% to 70% under hot or warm rolling temperatures.

Example 77 is the system of example 76, wherein the continuous casting device is arranged to cast the metal strip at a thickness between 7 mm and 90 mm.

Example 78 is the system of examples 76 or 77, wherein the hot or warm rolling temperatures are at least approximately 400° C.

Example 79 is the system of examples 76-78, further comprising a soaking furnace positioned inline between the continuous casting device and the rolling stand for maintaining the metal strip at a peak metal temperature that is approximately 15° C.-45° C. below a solidus temperature of the metal strip for a duration of approximately 1-3 minutes. In some cases, the peak metal temperature is maintained at approximately 450° C.-580° C.

Example 80 is the system of examples 76-79, wherein the one or more rolling stands include a single rolling stand capable of achieving a 50%-70% reduction of thickness of the metal strip.

Example 81 is the system of examples 76-80, wherein the continuous casting device is a belt caster.

Example 82 is the system of examples 76-81, further comprising a coiling device positioned downstream of the one or more rolling stands for coiling the metal strip into a coil.

Example 83 is a method, comprising: continuously casting a metal strip using a continuous casting device; and hot or warm rolling the metal strip at a reduction of thickness of approximately 50%-70% after the metal strip exits the continuous casting device.

Example 84 is the method of example 83, wherein continuously casting the metal strip comprises continuously casting the metal strip at a thickness between 7 mm and 50 mm.

Example 85 is the method of examples 83 or 84, wherein hot or warm rolling comprises hot rolling at temperatures of at least approximately 400° C.

Example 86 is the method of examples 83-85, further comprising maintaining a peak metal temperature that is approximately 15° C.-45° C. below a solidus temperature of the metal strip for a duration of approximately 1-3 minutes between casting the metal strip and rolling the metal strip. In some cases, the peak metal temperature is maintained at approximately 450° C.-580° C.

Example 87 is the method of example 86, wherein hot or warm rolling the metal strip comprises reducing a thickness of the metal strip by approximately 50%-70% using a single rolling stand.

Example 88 is the method of examples 83-87, wherein continuously casting the metal strip comprises passing liquid metal through a pair of rollers to extract heat from the liquid metal and solidify the liquid metal.

Example 89 is the method of examples 83-88, further comprising coiling the metal strip into a coil after warm or hot rolling the metal strip.

Example 90 is the method of examples 83-89, wherein hot or warm rolling the metal strip comprises: extracting heat from the metal strip within a bite of a rolling stand; and applying force to the metal strip to reduce a thickness of the metal strip, wherein the force applied is sufficient to recrystallize the metal strip at a temperature of the metal strip when the force is applied.

Example 91 is the method of example 90, wherein extracting heat and applying the force occur in a single rolling stand.

Example 92 is the method of example 90, wherein extracting heat occurs in a first rolling stand and applying the force occurs in a subsequent rolling stand.

Example 93 is an aluminum metal product, comprising: a continuously cast aluminum alloy reduced in thickness to a thickness of at or less than approximately 35 mm, wherein the continuously cast aluminum alloy contains iron present in amounts of at least 0.2% by weight, wherein a median equivalent circle diameter for iron-based intermetallic particles is less than approximately 0.8 μm.

Example 94 is the aluminum metal product of example 93, wherein the median equivalent circle diameter for the iron-based intermetallic particles is less than approximately 0.75 μm.

Example 95 is the aluminum metal product of example 93, wherein the median equivalent circle diameter for the iron-based intermetallic particles is less than approximately 0.65 μm.

Example 96 is the aluminum metal product of examples 93-95, wherein a median aspect ratio for the iron-based intermetallic particles is less than approximately 4.

Example 97 is the aluminum metal product of examples 93-96, wherein the continuously cast aluminum alloy is at final gauge.

Example 98 is the aluminum metal product of examples 93-97, wherein the aluminum alloy is at a gauge of approximately 2.0 mm.

Example 99 is the aluminum metal product of examples 93-98, wherein the aluminum alloy is a 6xxx series aluminum alloy.

What is claimed is:

1. A metal casting system, comprising:

a continuous casting device for casting a metal strip, wherein the metal strip is an aluminum or aluminum alloy; and one or more rolling stands positioned downstream of the continuous casting device for receiving the metal strip and reducing a thickness of the metal strip by approximately 50% to 70% under hot or warm rolling temperatures;

a quenching system upstream from the one or more rolling stands for quenching the metal strip before the one or more rolling stands; and a soaking furnace positioned inline between the continuous casting device and the one or more rolling stands for heating the metal strip while uncoiled and moving downstream in a processing direction.

2. The metal casting system of claim 1, wherein the continuous casting device is arranged to cast the metal strip at a thickness of 7 mm-50 mm.

3. The metal casting system of claim 1, wherein the hot or warm rolling temperatures are at least approximately 400° C.

4. The metal casting system of claim 1, wherein the soaking furnace is configured to maintain the metal strip at a peak metal temperature that is approximately 15° C.-45° C. below a solidus temperature of the metal strip for a duration of approximately 1-3 minutes.

5. The metal casting system of claim 1, wherein the one or more rolling stands include a single rolling stand capable of achieving a 50%-70% reduction of thickness of the metal strip.

6. The metal casting system of claim 1, wherein the continuous casting device is a belt caster.

7. The metal casting system of claim 1, further comprising a coiling device positioned downstream of the one or more rolling stands for coiling the metal strip into a coil.

8. A metal casting and processing system, comprising:

a continuous casting device for casting a metal strip at a first speed, wherein the metal strip is an aluminum or aluminum alloy;

a hot rolling stand for rolling the metal strip at a second speed that is decoupled from the first speed, wherein the hot rolling stand is a first rolling stand of the metal casting and processing system downstream from the continuous casting device;

an accumulator between the continuous casting device and the hot rolling stand; and a quenching system upstream from the hot rolling stand for quenching the metal strip before the hot rolling stand.

9. A casting and rolling method, comprising:

continuously casting a metal strip at a first speed with a continuous casting device;

hot rolling the metal strip at a second speed and with a first rolling stand downstream from the continuous casting device, wherein the first speed is decoupled from the second speed;

an accumulator between the continuous casting device and the first rolling stand; and quenching the metal strip with a quenching system upstream from the first rolling stand before hot rolling the metal strip.

* * * * *